US010188890B2

(12) United States Patent
Olson et al.

(10) Patent No.: US 10,188,890 B2
(45) Date of Patent: Jan. 29, 2019

(54) MAGNETIC RESISTANCE MECHANISM IN A CABLE MACHINE

(71) Applicant: ICON Health & Fitness, Inc., Logan, UT (US)

(72) Inventors: Michael L. Olson, Providence, UT (US); William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 15/976,496

(22) Filed: May 10, 2018

(65) Prior Publication Data

US 2018/0256933 A1 Sep. 13, 2018

Related U.S. Application Data

(63) Continuation of application No. 15/696,841, filed on Sep. 6, 2017, now Pat. No. 9,968,816, which is a (Continued)

(51) Int. Cl.
*A63B 24/00* (2006.01)
*A63B 21/00* (2006.01)
(Continued)

(52) U.S. Cl.
CPC .... *A63B 21/00192* (2013.01); *A63B 21/0051* (2013.01); *A63B 21/153* (2013.01); *A63B 21/154* (2013.01); *A63B 21/225* (2013.01); *A63B 21/4035* (2015.10); *A63B 21/4043* (2015.10); *A63B 23/03541* (2013.01);
(Continued)

(58) Field of Classification Search
CPC ..... A63B 21/00192; A63B 21/0051; A63B 21/153; A63B 21/154; A63B 21/225; A63B 21/4035; A63B 21/4043; A63B 2230/75; A63B 23/03541; A63B 23/03566; A63B 23/1245; A63B 24/0062; A63B 24/0087;
(Continued)

(56) References Cited

U.S. PATENT DOCUMENTS 9,595 A 2/1853 Moreland
9,695 A 5/1853 Hinsdale
(Continued)

FOREIGN PATENT DOCUMENTS

CN 2172137 Y 7/1994
CN 101784308 11/2001
(Continued)

OTHER PUBLICATIONS

U.S. Appl. No. 61/920,834, filed Dec. 26, 2013, titled "Magnetic Resistance Mechanism in a Cable Machine", 31 pages.
(Continued)

*Primary Examiner* — Sundhara M Ganesan
(74) *Attorney, Agent, or Firm* — Maschoff Brennan

(57) ABSTRACT

A cable exercise machine includes a first pull cable and a second pull cable incorporated into a frame. Each of the first pull cable and the second pull cable are linked to at least one resistance mechanism. The at least one resistance mechanism includes a flywheel and a magnetic unit arranged to resist movement of the flywheel.

20 Claims, 7 Drawing Sheets

Related U.S. Application Data continuation of application No. 15/226,703, filed on Aug. 2, 2016, now Pat. No. 9,757,605, which is a continuation of application No. 14/582,493, filed on Dec. 24, 2014, now Pat. No. 9,403,047.

(60) Provisional application No. 61/920,834, filed on Dec. 26, 2013.

(51) Int. Cl.

| | |
|---|---|
| ***A63B 23/12*** | (2006.01) |
| ***A63B 21/005*** | (2006.01) |
| ***A63B 21/22*** | (2006.01) |
| ***A63B 23/035*** | (2006.01) |
| *A63B 71/06* | (2006.01) |

(52) U.S. Cl.

CPC .... *A63B 23/03566* (2013.01); *A63B 23/1245* (2013.01); *A63B 24/0062* (2013.01); *A63B 24/0087* (2013.01); *A63B 71/0622* (2013.01); *A63B 2220/17* (2013.01); *A63B 2220/40* (2013.01); *A63B 2220/805* (2013.01); *A63B 2230/75* (2013.01)

(58) Field of Classification Search

CPC ..... A63B 71/0622; A63B 2220/17; A63B 2220/40; A63B 2220/805

See application file for complete search history.

(56) References Cited

U.S. PATENT DOCUMENTS

| | | | |
|---|---|---|---|
| 34,577 | A | 3/1862 | Jabden |
| 104,973 | A | 7/1870 | Man |
| 115,826 | A | 6/1871 | Creed |
| 192,338 | A | 6/1877 | Marshall |
| 232,022 | A | 9/1880 | Gifford |
| 232,579 | A | 9/1880 | Weeks |
| 248,121 | A | 10/1881 | Tuttle |
| 284,294 | A | 9/1883 | Graves |
| 321,388 | A | 6/1885 | Ruebsam |
| 325,435 | A | 9/1885 | North |
| 337,942 | A | 3/1886 | Parley |
| 339,638 | A | 4/1886 | Goldie |
| 348,493 | A | 8/1886 | Greene |
| 353,089 | A | 11/1886 | Smith |
| 356,219 | A | 1/1887 | Yeoman |
| 359,778 | A | 3/1887 | Pauber |
| 372,272 | A | 10/1887 | Murphy |
| 374,496 | A | 12/1887 | Reach |
| 421,779 | A | 2/1890 | Steven |
| 428,912 | A | 5/1890 | Holmes |
| 447,780 | A | 3/1891 | Luge |
| 450,792 | A | 4/1891 | Dodd |
| 457,400 | A | 8/1891 | Dowd |
| 470,837 | A | 3/1892 | Hart |
| 480,271 | A | 8/1892 | Newton |
| 484,352 | A | 10/1892 | Ayton |
| 549,084 | A | 10/1895 | Whitaker |
| 588,350 | A | 8/1897 | Perkins |
| 601,307 | A | 3/1898 | Salisbury |
| 603,350 | A | 5/1898 | Towers |
| 610,716 | A | 9/1898 | Marshal |
| 624,995 | A | 5/1899 | Tellefsen |
| 659,216 | A | 10/1900 | Dowling |
| 663,486 | A | 12/1900 | Boren |
| 674,391 | A | 5/1901 | Baker |
| 679,784 | A | 8/1901 | Ryan |
| 680,556 | A | 8/1901 | Wray |
| 682,988 | A | 9/1901 | Carroll |
| 683,284 | A | 9/1901 | Honey |
| 685,788 | A | 11/1901 | Mcfadden |
| 689,418 | A | 12/1901 | Ryan |
| 722,462 | A | 3/1903 | Smith |
| 723,625 | A | 3/1903 | Thornley |
| 754,992 | A | 3/1904 | Grabner |
| 760,374 | A | 5/1904 | Belvoir |
| 761,504 | A | 5/1904 | Kleinbach |
| 766,930 | A | 8/1904 | Clemons |
| 772,906 | A | 10/1904 | Reach |
| 776,824 | A | 12/1904 | Bryon, Jr. |
| 807,670 | A | 12/1905 | Grabner |
| 846,389 | A | 3/1907 | Blackburn |
| 852,193 | A | 4/1907 | Mcmillan |
| 881,521 | A | 3/1908 | Wilson |
| 897,722 | A | 9/1908 | Day |
| 931,394 | A | 8/1909 | Day |
| 937,795 | A | 10/1909 | Hackney |
| 943,127 | A | 12/1909 | Van Boven |
| 964,745 | A | 7/1910 | Blakoe |
| 979,609 | A | 12/1910 | Vaughn |
| 1,016,729 | A | 2/1912 | Barrett |
| 1,019,861 | A | 3/1912 | Titus |
| 1,020,777 | A | 3/1912 | Peterson |
| 1,064,968 | A | 6/1913 | Hagen |
| 1,082,940 | A | 12/1913 | Flora |
| 1,115,826 | A | 11/1914 | Johnson |
| 1,123,272 | A | 1/1915 | Goodman |
| 1,144,085 | A | 6/1915 | Abplanalp |
| 1,211,765 | A | 1/1917 | Schmidt |
| 1,316,683 | A | 9/1919 | Calvert |
| 1,422,888 | A | 7/1922 | Reeves |
| 1,495,278 | A | 5/1924 | Titus |
| 1,539,214 | A | 5/1925 | Shockey |
| 1,570,482 | A | 1/1926 | Hale |
| 1,576,474 | A | 3/1926 | Walker |
| 1,580,530 | A | 4/1926 | Rambo |
| 1,585,748 | A | 5/1926 | Wendelken |
| 1,672,944 | A | 6/1928 | Jowett |
| 1,698,831 | A | 1/1929 | Harry |
| 1,715,870 | A | 6/1929 | Augustine |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,851,843 | A | 3/1932 | Inman |
| 1,893,728 | A | 1/1933 | Bullis |
| 1,902,694 | A | 3/1933 | Edwards |
| 1,917,566 | A | 7/1933 | Wood |
| 1,919,627 | A | 7/1933 | Gerald |
| 1,928,089 | A | 9/1933 | Blickman |
| 1,930,416 | A | 10/1933 | Alfred |
| 1,973,945 | A | 9/1934 | Chavin |
| 1,978,579 | A | 10/1934 | Hooks |
| 1,982,843 | A | 12/1934 | Traver |
| 1,982,872 | A | 12/1934 | Newton |
| 1,991,520 | A | 2/1935 | Postl |
| 2,067,136 | A | 1/1937 | Bridenbaugh |
| 2,117,957 | A | 5/1938 | Ritter |
| 2,129,262 | A | 9/1938 | Rex |
| 2,145,940 | A | 2/1939 | Marlowe |
| 2,153,077 | A | 4/1939 | Arthur |
| 2,165,700 | A | 7/1939 | Henry |
| 2,177,957 | A | 10/1939 | Stewart |
| 2,183,345 | A | 12/1939 | Brandon |
| 2,209,034 | A | 7/1940 | Rene |
| 2,219,219 | A | 10/1940 | Boger |
| 2,247,946 | A | 7/1941 | Hein et al. |
| 2,255,864 | A | 9/1941 | Stephens |
| 2,274,574 | A | 2/1942 | Zerne |
| 2,315,485 | A | 4/1943 | Le Roy |
| 2,346,105 | A | 4/1944 | Haehnel |
| 2,379,984 | A | 7/1945 | Nereaux |
| 2,399,915 | A | 5/1946 | Drake |
| 2,413,841 | A | 1/1947 | Minuto |
| 2,436,987 | A | 3/1948 | Bailleaux |
| 2,438,548 | A | 3/1948 | Ehmann |
| 2,440,644 | A | 4/1948 | Powell |
| 2,456,017 | A | 12/1948 | Park |
| 2,470,544 | A | 5/1949 | Bell |
| 2,472,391 | A | 6/1949 | Albizu |
| 2,500,299 | A | 3/1950 | Spitzkeit |
| 2,512,417 | A | 6/1950 | Cook |

(56) References Cited

U.S. PATENT DOCUMENTS

| | | | |
|---|---|---|---|
| 2,569,007 | A | 9/1951 | Klyce |
| 2,573,351 | A | 10/1951 | Hopkins |
| 2,632,645 | A | 3/1953 | Barkschat |
| 2,637,319 | A | 5/1953 | Bruene |
| 2,640,696 | A | 6/1953 | Adalbert |
| 2,641,250 | A | 6/1953 | Brockman |
| 2,642,288 | A | 6/1953 | Bell |
| 2,645,539 | A | 7/1953 | Thompson |
| 2,646,282 | A | 7/1953 | Bernice |
| 2,648,540 | A | 8/1953 | William |
| 2,654,135 | A | 10/1953 | Grizzard et al. |
| 2,674,453 | A | 4/1954 | Hummert |
| 2,695,797 | A | 11/1954 | Mccarthy et al. |
| 2,714,507 | A | 8/1955 | Goodrich |
| 2,740,178 | A | 4/1956 | Kellems |
| 2,743,623 | A | 5/1956 | Wells |
| 2,746,822 | A | 5/1956 | Copenhaver |
| 2,763,156 | A | 9/1956 | Garigal |
| 2,779,139 | A | 1/1957 | Boettcher |
| 2,842,365 | A | 7/1958 | Kelley |
| 2,843,858 | A | 7/1958 | Berma |
| 2,855,200 | A | 10/1958 | Blickman |
| 2,874,971 | A | 2/1959 | Devery |
| 2,906,532 | A | 9/1959 | Echols |
| 2,924,456 | A | 2/1960 | Miller |
| 2,927,006 | A | 3/1960 | Brooks |
| 2,938,695 | A | 5/1960 | Ciampa |
| 2,968,337 | A | 1/1961 | Bartlett |
| 2,969,060 | A | 1/1961 | Swanda |
| 2,977,120 | A | 3/1961 | Morris |
| 2,978,830 | A | 4/1961 | Killian |
| 2,984,594 | A | 5/1961 | Runton |
| 2,985,933 | A | 5/1961 | Peterson et al. |
| 3,000,628 | A | 9/1961 | Kellogg |
| 3,035,671 | A | 5/1962 | Sicherman |
| 3,057,201 | A | 10/1962 | Erich |
| 3,059,312 | A | 10/1962 | Jamieson |
| 3,068,002 | A | 12/1962 | Balne |
| 3,068,950 | A | 12/1962 | Davidson |
| 3,072,426 | A | 1/1963 | Gilbert |
| 3,090,092 | A | 5/1963 | Szemplak |
| 3,099,509 | A | 7/1963 | Duenke |
| 3,112,108 | A | 11/1963 | Hanke |
| 3,115,332 | A | 12/1963 | Singleton |
| 3,118,441 | A | 1/1964 | Prosser |
| 3,127,171 | A | 3/1964 | Noland et al. |
| 3,161,395 | A | 12/1964 | Carter |
| 3,179,071 | A | 4/1965 | Johnston |
| 3,193,287 | A | 7/1965 | Robinson |
| 3,194,598 | A | 7/1965 | Goldfuss |
| 3,205,888 | A | 9/1965 | Stroop |
| 3,246,894 | A | 4/1966 | Salisbury |
| 3,256,630 | A | 6/1966 | Spector |
| 3,270,494 | A | 9/1966 | Holmes |
| 3,312,466 | A | 4/1967 | Melchiona |
| 3,316,898 | A | 5/1967 | Brown |
| 3,319,273 | A | 5/1967 | Lawrence |
| 3,323,367 | A | 6/1967 | Searle |
| 3,342,485 | A | 9/1967 | Martin |
| 3,345,067 | A | 10/1967 | Smith |
| 3,349,621 | A | 10/1967 | Mullen |
| 3,358,813 | A | 12/1967 | Kohlhagen |
| 3,370,584 | A | 2/1968 | William |
| 3,373,993 | A | 3/1968 | Oja et al. |
| 3,378,259 | A | 4/1968 | Kupchinski |
| 3,380,737 | A | 4/1968 | Petros |
| 3,381,958 | A | 5/1968 | Gulland |
| 3,384,370 | A | 5/1968 | Eugene et al. |
| 3,390,460 | A | 7/1968 | Brown |
| 3,394,934 | A | 7/1968 | Petros |
| 3,408,067 | A | 10/1968 | Armstrong |
| 3,408,069 | A | 10/1968 | Lewis |
| 3,411,497 | A | 11/1968 | Rickey et al. |
| 3,411,776 | A | 11/1968 | Holkesvick et al. |
| 3,416,174 | A | 12/1968 | Novitske |
| 3,424,005 | A | 1/1969 | Brown |
| 3,428,311 | A | 2/1969 | Mitchell |
| 3,428,312 | A | 2/1969 | Machen |
| 3,430,507 | A | 3/1969 | Hurst et al. |
| 3,432,164 | A | 3/1969 | Deeks |
| 3,438,627 | A | 4/1969 | La Lanne |
| 3,444,830 | A | 5/1969 | Doetsch |
| 3,446,503 | A | 5/1969 | Lawton |
| 3,456,592 | A | 7/1969 | Nelsen |
| 3,465,592 | A | 9/1969 | Perrine |
| 3,482,835 | A | 12/1969 | Dean |
| 3,488,051 | A | 1/1970 | Papistas Scherer |
| 3,495,824 | A | 2/1970 | Cuinier |
| 3,501,140 | A | 3/1970 | Eichorn |
| 3,511,500 | A | 5/1970 | Dunn |
| 3,514,110 | A | 5/1970 | Thomander |
| 3,518,985 | A | 7/1970 | Quinton |
| 3,540,724 | A | 11/1970 | Hunter |
| 3,547,435 | A | 12/1970 | Scott |
| 3,554,541 | A | 1/1971 | Spoth |
| 3,563,541 | A | 2/1971 | Sanquist |
| 3,566,861 | A | 3/1971 | Weiss |
| 3,567,219 | A | 3/1971 | Foster |
| 3,568,669 | A | 3/1971 | Stites |
| 3,572,700 | A | 3/1971 | Mastropaolo |
| 3,583,465 | A | 6/1971 | Youngs et al. |
| 3,586,322 | A | 6/1971 | Kverneland |
| 3,588,101 | A | 6/1971 | Jungreis |
| 3,589,193 | A | 6/1971 | Thornton |
| 3,589,715 | A | 6/1971 | Mark |
| 3,589,720 | A | 6/1971 | Agamian |
| 3,592,466 | A | 7/1971 | Parsons |
| 3,598,404 | A | 8/1971 | Bowman |
| 3,601,398 | A | 8/1971 | Brochman |
| 3,602,502 | A | 8/1971 | Jaegar |
| 3,606,320 | A | 9/1971 | Erwin, Jr. |
| 3,606,406 | A | 9/1971 | Walters |
| 3,608,898 | A | 9/1971 | Berlin |
| 3,614,097 | A | 10/1971 | Blickman |
| 3,614,108 | A | 10/1971 | Garten |
| 3,617,056 | A | 11/1971 | Herbold |
| 3,628,654 | A | 12/1971 | Haracz |
| 3,628,791 | A | 12/1971 | Garcia |
| 3,634,895 | A | 1/1972 | Childers |
| 3,636,577 | A | 1/1972 | Nissen |
| 3,638,941 | A | 2/1972 | Kulkens |
| 3,640,528 | A | 2/1972 | Proctor |
| 3,640,530 | A | 2/1972 | Henson et al. |
| 3,641,601 | A | 2/1972 | Sieg |
| 3,642,279 | A | 2/1972 | Cutter |
| 3,643,943 | A | 2/1972 | Erwin, Jr. et al. |
| 3,647,209 | A | 3/1972 | La Lanne |
| 3,650,529 | A | 3/1972 | Salm |
| 3,652,085 | A | 3/1972 | Civalier |
| 3,658,327 | A | 4/1972 | Thiede |
| 3,659,845 | A | 5/1972 | Quinton |
| 3,664,666 | A | 5/1972 | Lloyd |
| 3,664,910 | A | 5/1972 | Hollie |
| 3,664,916 | A | 5/1972 | Grellier et al. |
| 3,672,124 | A | 6/1972 | Pirotta |
| 3,679,244 | A | 7/1972 | Reddy |
| 3,686,776 | A | 8/1972 | Dahl |
| 3,689,066 | A | 9/1972 | Hagen |
| 3,690,655 | A | 9/1972 | Chapman |
| 3,703,284 | A | 11/1972 | Hesen |
| 3,708,166 | A | 1/1973 | Annas |
| 3,708,167 | A | 1/1973 | Potgieter |
| 3,709,197 | A | 1/1973 | Moseley |
| 3,728,940 | A | 4/1973 | Peterson |
| 3,731,917 | A | 5/1973 | Townsend |
| 3,738,649 | A | 6/1973 | Miller |
| 3,741,538 | A | 6/1973 | Useldinger |
| 3,744,480 | A | 7/1973 | Gause et al. |
| 3,744,712 | A | 7/1973 | Papadopoulos |
| 3,744,794 | A | 7/1973 | Gause et al. |
| 3,751,033 | A | 8/1973 | Rosenthal |
| 3,756,595 | A | 9/1973 | Hague |
| 3,758,109 | A | 9/1973 | Bender |
| 3,759,511 | A | 9/1973 | Zinkin |

(56) References Cited

U.S. PATENT DOCUMENTS 3,761,083 A 9/1973 Buchner
3,767,195 A 10/1973 Dimick
3,771,785 A 11/1973 Speyer
3,782,718 A 1/1974 Saylor
3,784,193 A 1/1974 Simjian
3,788,412 A 1/1974 Vincent
3,789,467 A 2/1974 Aratani et al.
3,792,860 A 2/1974 Selnes
3,797,624 A 3/1974 Powell et al.
3,802,698 A 4/1974 Burian et al.
3,802,701 A 4/1974 Good
3,807,728 A 4/1974 Chillier
3,809,393 A 5/1974 Jones
3,814,420 A 6/1974 Encke
3,815,903 A 6/1974 Blomqvist
3,818,194 A 6/1974 Biro
3,822,488 A 7/1974 Johnson
3,822,599 A 7/1974 Brentham
3,825,253 A 7/1974 Speyer
3,826,491 A 7/1974 Elder
3,831,942 A 8/1974 Del
3,833,216 A 9/1974 Philbin
3,834,696 A 9/1974 Spector
3,840,227 A 10/1974 Chesemore
3,845,756 A 11/1974 Olsson
3,848,467 A 11/1974 Flavell
3,851,874 A 12/1974 Wilkin
3,858,873 A 1/1975 Jones
3,858,874 A 1/1975 Weider
3,858,938 A 1/1975 Kristensson et al.
3,859,840 A 1/1975 Gause
3,861,215 A 1/1975 Bradley
3,870,297 A 3/1975 Elder
3,874,375 A 4/1975 Penner
3,874,657 A 4/1975 Niebojewski
3,880,274 A 4/1975 Bechtloff
3,883,922 A 5/1975 Fleischhauer
3,884,464 A 5/1975 Evangelos
3,891,207 A 6/1975 Helliwell
3,892,404 A 7/1975 Martucci
3,901,379 A 8/1975 Bruhm
3,902,480 A 9/1975 Wilson
3,902,717 A 9/1975 Kulkens
3,903,613 A 9/1975 Bisberg
3,904,196 A 9/1975 Berlin
3,909,857 A 10/1975 Herrera
3,912,263 A 10/1975 Yatso
3,913,908 A 10/1975 Speyer
3,918,710 A 11/1975 Niebojewski
3,920,240 A 11/1975 Ross
3,926,430 A 12/1975 Good, Jr.
3,929,026 A 12/1975 Hofmann
3,938,400 A 2/1976 Konyha
3,938,803 A 2/1976 Wilmoth
3,941,377 A 3/1976 Lie
3,948,513 A 4/1976 Pfotenhauer
3,953,025 A 4/1976 Mazman
3,957,266 A 5/1976 Rice
3,958,803 A 5/1976 Geisselbrecht
3,963,101 A 6/1976 Stadelmann et al.
3,971,555 A 7/1976 Mahnke
3,974,491 A 8/1976 Sipe
3,976,058 A 8/1976 Tidwell
3,977,451 A 8/1976 Duba
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,012,015 A 3/1977 Nelson et al.
4,020,795 A 5/1977 Marks
4,024,949 A 5/1977 Kleysteuber et al.
4,026,545 A 5/1977 Schonenberger
4,026,548 A 5/1977 Birdwell
4,027,531 A 6/1977 Dawson
4,029,312 A 6/1977 Wright
4,033,567 A 7/1977 Lipfert
4,042,305 A 8/1977 Vincent
4,043,552 A 8/1977 Kerkonian
4,056,265 A 11/1977 Ide
4,059,265 A 11/1977 Wieder et al.
4,060,240 A 11/1977 Dunston
4,061,257 A 12/1977 St Clair
4,063,726 A 12/1977 Wilson
4,063,727 A 12/1977 Hall
4,066,257 A 1/1978 Moller
4,066,259 A 1/1978 Brentham
4,066,868 A 1/1978 Witkin et al.
4,067,372 A 1/1978 Masson
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,076,236 A 2/1978 Ionel
4,076,237 A 2/1978 Dussia
4,077,626 A 3/1978 Newman
4,082,267 A 4/1978 Flavell
4,093,196 A 6/1978 Bauer
4,093,211 A 6/1978 Hughes et al.
4,094,330 A 6/1978 Jong
4,098,100 A 7/1978 Wah
4,101,124 A 7/1978 Mahnke
4,111,417 A 9/1978 Gardner
4,112,928 A 9/1978 Putsch
4,113,071 A 9/1978 Muller et al.
4,120,294 A 10/1978 Wolfe
4,120,924 A 10/1978 Rainville
4,122,585 A 10/1978 Sharp et al.
4,131,701 A 12/1978 VanAuken
4,140,312 A 2/1979 Buchmann
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,154,441 A 5/1979 Gajda
4,157,181 A 6/1979 Cecka
4,157,594 A 6/1979 Raabe
4,161,998 A 7/1979 Trimble
4,167,938 A 9/1979 Remih
4,168,061 A 9/1979 Gordon
4,170,351 A 10/1979 Ozbey
4,171,805 A 10/1979 Abbott
4,176,836 A 12/1979 Coyle
4,179,134 A 12/1979 Atkinson
4,183,156 A 1/1980 Rudy
4,183,494 A 1/1980 Cleveland
4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,215,516 A 8/1980 Huschle et al.
4,216,856 A 8/1980 Moring et al.
4,220,996 A 9/1980 Searcy
4,227,689 A 10/1980 Keiser
4,231,568 A 11/1980 Riley
4,231,569 A 11/1980 Rae
4,235,437 A 11/1980 Ruis et al.
4,236,239 A 11/1980 Imgruth et al.
4,239,092 A 12/1980 Janson
4,240,627 A 12/1980 Brentham
4,241,915 A 12/1980 Noble
4,248,476 A 2/1981 Phelps
4,249,725 A 2/1981 Mattox
4,249,773 A 2/1981 Giambalvo
4,251,932 A 2/1981 Love
4,252,314 A 2/1981 Ceppo
4,253,661 A 3/1981 Russell

(56) References Cited

U.S. PATENT DOCUMENTS 4,253,662 A 3/1981 Podolak
4,256,302 A 3/1981 Keiser et al.
4,257,590 A 3/1981 Sullivan et al.
4,258,821 A 3/1981 Wendt
4,258,913 A 3/1981 Brentham
4,263,897 A 4/1981 Terayama
4,274,625 A 6/1981 Gaetano
4,275,882 A 6/1981 Grosser et al.
4,278,095 A 7/1981 Lapeyre
4,278,249 A 7/1981 Forrest
4,286,782 A 9/1981 Fuhrhop
4,290,601 A 9/1981 Mittelstadt
4,296,924 A 10/1981 Anzaldua et al.
4,298,893 A 11/1981 Holmes
4,300,760 A 11/1981 Bobroff
4,300,761 A 11/1981 Howard
4,301,808 A 11/1981 Taus
4,307,880 A 12/1981 Abram
4,313,602 A 2/1982 Sullivan
4,313,603 A 2/1982 Simjian
4,316,609 A 2/1982 Silberman
4,316,610 A 2/1982 Hinds
4,322,609 A 3/1982 Kato
4,323,237 A 4/1982 Jungerwirth
4,324,501 A 4/1982 Herbenar
4,325,548 A 4/1982 Piccini
4,327,713 A 5/1982 Okazaki et al.
4,328,964 A 5/1982 Walls
4,328,965 A 5/1982 Hatfield
4,328,968 A 5/1982 Hacker
4,333,978 A 6/1982 Kocher
4,334,676 A 6/1982 Schonenberger
4,334,678 A 6/1982 Doyel
4,334,695 A 6/1982 Ashby
4,337,283 A 6/1982 Haas, Jr.
4,337,529 A 6/1982 Morokawa
4,342,452 A 8/1982 Summa
4,344,616 A 8/1982 Ogden
4,345,756 A 8/1982 Hoagland
4,346,888 A 8/1982 Szabo
4,349,192 A 9/1982 Lambert, Jr. et al.
4,349,597 A 9/1982 Fine et al.
4,350,336 A 9/1982 Hanford
4,354,675 A 10/1982 Barclay et al.
4,354,676 A 10/1982 Ariel
4,355,061 A 10/1982 Zeigler
4,355,645 A 10/1982 Mitani et al.
4,357,010 A 11/1982 Telle
4,357,011 A 11/1982 Voris
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,368,735 A 1/1983 Filmer
4,369,081 A 1/1983 Curry et al.
4,369,966 A 1/1983 Silberman et al.
4,370,766 A 2/1983 Teague, Jr.
4,371,162 A 2/1983 Hartzell
4,372,553 A 2/1983 Hatfield
4,373,716 A 2/1983 Pagani
4,374,587 A 2/1983 Ogden
4,374,588 A 2/1983 Ruggles
4,376,533 A 3/1983 Kolbel
4,377,045 A 3/1983 Moulinex
4,378,111 A 3/1983 Tsuchida et al.
4,382,596 A 5/1983 Silberman
4,383,684 A 5/1983 Schliep
4,383,714 A 5/1983 Ishida
4,384,715 A 5/1983 Barrett, Jr.
4,387,893 A 6/1983 Baldwin
4,389,047 A 6/1983 Hall
4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,406,451 A 9/1983 Gaetano
4,408,613 A 10/1983 Relyea
4,422,635 A 12/1983 Herod
4,422,636 A 12/1983 de Angeli
4,423,630 A 1/1984 Morrison
4,423,864 A 1/1984 Wiik
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell
4,431,184 A 2/1984 Lew et al.
4,434,981 A 3/1984 Norton
4,441,708 A 4/1984 Brentham
4,445,684 A 5/1984 Ruff
4,448,434 A 5/1984 Anderson
4,452,448 A 6/1984 Ausherman
4,453,766 A 6/1984 DiVito
4,456,245 A 6/1984 Baldwin
4,456,246 A 6/1984 Szabo
4,461,472 A 7/1984 Martinez
4,461,473 A 7/1984 Cole
4,463,948 A 8/1984 Mohr
4,465,274 A 8/1984 Davenport
4,465,276 A 8/1984 Cox
4,465,277 A 8/1984 Dittrich
4,474,370 A 10/1984 Oman
4,476,582 A 10/1984 Strauss et al.
4,477,071 A 10/1984 Brown et al.
4,478,413 A 10/1984 Siwula
4,480,831 A 11/1984 Muller-Deinhardt
4,482,152 A 11/1984 Wolff
4,489,933 A 12/1984 Fisher
4,489,936 A 12/1984 Dal Monte
4,491,318 A 1/1985 Francke
4,492,375 A 1/1985 Connelly
4,493,561 A 1/1985 Bouchet
4,494,662 A 1/1985 Clymer
4,495,560 A 1/1985 Sugimoto et al.
4,496,147 A 1/1985 DeCloux et al.
4,499,784 A 2/1985 Shum
4,502,679 A 3/1985 De Lorenzo
4,502,682 A 3/1985 Miller
4,504,055 A 3/1985 Wells
4,504,968 A 3/1985 Kaneko et al.
4,505,474 A 3/1985 Mattox
4,505,475 A 3/1985 Olschansky et al.
4,505,495 A 3/1985 Foss et al.
4,509,510 A 4/1985 Hook
4,511,137 A 4/1985 Jones
4,512,566 A 4/1985 Bicocchi
4,512,567 A 4/1985 Phillips
4,512,571 A 4/1985 Hermelin
4,515,363 A 5/1985 Schleffendorf
4,515,988 A 5/1985 Bayer et al.
4,519,603 A 5/1985 Decloux
4,521,013 A 6/1985 Dofel
4,522,394 A 6/1985 Broussard
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,536,244 A 8/1985 Greci et al.
4,537,396 A 8/1985 Hooper
4,538,805 A 9/1985 Parviainen
4,540,171 A 9/1985 Clark
4,540,173 A 9/1985 Hopkins, Jr.
4,542,897 A 9/1985 Melton
4,542,899 A 9/1985 Hendricks
4,544,152 A 10/1985 Taitel
4,544,153 A 10/1985 Babcock
4,546,967 A 10/1985 Kecala
4,546,970 A 10/1985 Mahnke
4,546,971 A 10/1985 Raasoch
4,548,405 A 10/1985 Lee

(56) References Cited

U.S. PATENT DOCUMENTS 4,549,044 A 10/1985 Durham
4,549,433 A 10/1985 Gneiss et al.
4,549,733 A 10/1985 Salyer
4,549,734 A 10/1985 Hibler, Jr.
4,555,108 A 11/1985 Monteiro
4,555,109 A 11/1985 Hartmann
4,563,001 A 1/1986 Terauds
4,563,003 A 1/1986 Bugallo et al.
4,564,193 A 1/1986 Stewart
4,565,369 A 1/1986 Bedgood
4,566,461 A 1/1986 Lubell et al.
4,566,689 A 1/1986 Ogden
4,566,690 A 1/1986 Schook
4,566,732 A 1/1986 Ostergaard, Sr.
4,569,518 A 2/1986 Fulks
4,569,519 A 2/1986 Mattox et al.
4,571,682 A 2/1986 Silverman et al.
4,572,500 A 2/1986 Weiss
4,572,504 A 2/1986 DiBartolo
4,573,449 A 3/1986 Warnke
4,575,074 A 3/1986 Damratoski
4,576,352 A 3/1986 Ogden
4,576,376 A 3/1986 Miller
4,576,377 A 3/1986 Wolff
4,577,860 A 3/1986 Matias et al.
4,577,861 A 3/1986 Bangerter et al.
4,577,865 A 3/1986 Shishido
4,579,360 A 4/1986 Nishimura et al.
4,580,983 A 4/1986 Cassini et al.
4,581,269 A 4/1986 Tilman
4,582,320 A 4/1986 Shaw
4,586,495 A 5/1986 Petrofsky
4,587,695 A 5/1986 Jensen
4,589,656 A 5/1986 Baldwin
4,591,147 A 5/1986 Smith et al.
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Jones
4,601,142 A 7/1986 Frommelt
4,602,779 A 7/1986 Ogden
4,603,855 A 8/1986 Sebelle
4,603,856 A 8/1986 Fiore
4,606,540 A 8/1986 Chiu
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,620,701 A 11/1986 Mojden
4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,627,614 A 12/1986 De Angeli
4,627,615 A 12/1986 Nurkowski
4,627,616 A 12/1986 Kauffman
4,627,618 A 12/1986 Schwartz
4,630,817 A 12/1986 Buckley
4,632,385 A 12/1986 Geraci
4,632,386 A 12/1986 Beech
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,638,994 A 1/1987 Gogarty
4,641,833 A 2/1987 Trethewey
4,642,080 A 2/1987 Takano et al.
4,642,769 A 2/1987 Petrofsky
4,643,418 A 2/1987 Bart
4,643,420 A 2/1987 Riley
4,645,197 A 2/1987 Mcfee
4,645,198 A 2/1987 Levenston
4,645,200 A 2/1987 Hix
4,645,201 A 2/1987 Evans
4,645,917 A 2/1987 Penney et al.
4,647,037 A 3/1987 Donohue
4,647,040 A 3/1987 Ehrenfried
4,647,041 A 3/1987 Whiteley
4,648,481 A 3/1987 Lee
4,648,594 A 3/1987 Schleffendorf
4,650,067 A 3/1987 Brule
4,650,183 A 3/1987 McIntyre
4,650,184 A 3/1987 Brebner
4,650,185 A 3/1987 Cartwright
4,651,446 A 3/1987 Yukawa et al.
4,651,581 A 3/1987 Svensson
4,651,988 A 3/1987 Sobel
4,655,448 A 4/1987 Harder
4,657,246 A 4/1987 Salyer
4,659,074 A 4/1987 Taitel et al.
4,659,077 A 4/1987 Stropkay
4,659,078 A 4/1987 Blome
4,660,550 A 4/1987 Bodine
4,662,629 A 5/1987 Plovie
4,662,630 A 5/1987 Dignard et al.
4,664,371 A 5/1987 Viander
4,664,373 A 5/1987 Hait
4,664,646 A 5/1987 Rorabaugh
4,665,388 A 5/1987 Bernardie et al.
4,666,149 A 5/1987 Olschansky et al.
4,666,151 A 5/1987 Chillier
4,671,257 A 6/1987 Kaiser et al.
4,673,177 A 6/1987 Szymski
4,673,180 A 6/1987 Rice
4,674,740 A 6/1987 Iams et al.
4,674,743 A 6/1987 Hirano
4,678,182 A 7/1987 Nakao et al.
4,678,185 A 7/1987 Mahnke
4,679,786 A 7/1987 Rodgers
4,679,787 A 7/1987 Guilbault
4,684,121 A 8/1987 Nestegard
4,684,126 A 8/1987 Dalebout et al.
4,685,670 A 8/1987 Zinkin
4,685,671 A 8/1987 Hagerman et al.
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,706,953 A 11/1987 Graham
4,708,337 A 11/1987 Shyu
4,708,338 A 11/1987 Potts
4,708,837 A 11/1987 Baxter et al.
4,709,917 A 12/1987 Yang
4,709,918 A 12/1987 Grinblat
4,709,920 A 12/1987 Schnell
4,711,447 A 12/1987 Mansfield
4,714,244 A 12/1987 Kolomayets et al.
4,714,248 A 12/1987 Koss
4,717,146 A 1/1988 Nohara
4,718,207 A 1/1988 Frommelt

(56) References Cited

U.S. PATENT DOCUMENTS

| | | | |
|---|---|---|---|
| 4,720,093 | A | 1/1988 | Del Mar |
| 4,720,099 | A | 1/1988 | Carlson |
| 4,720,789 | A | 1/1988 | Hector et al. |
| 4,721,301 | A | 1/1988 | Drake |
| 4,721,303 | A | 1/1988 | Fitzpatrick |
| 4,722,522 | A | 2/1988 | Lundgren |
| 4,725,057 | A | 2/1988 | Shifferaw |
| 4,726,581 | A | 2/1988 | Chang |
| 4,726,582 | A | 2/1988 | Fulks |
| 4,728,099 | A | 3/1988 | Pitre |
| 4,729,558 | A | 3/1988 | Kuo |
| 4,729,562 | A | 3/1988 | Pipasik |
| 4,730,828 | A | 3/1988 | Lane |
| 4,730,829 | A | 3/1988 | Carlson |
| 4,733,858 | A | 3/1988 | Lan |
| 4,733,860 | A | 3/1988 | Steffee |
| 4,733,905 | A | 3/1988 | Buickerood |
| 4,741,530 | A | 5/1988 | Wolf |
| 4,743,009 | A | 5/1988 | Beale |
| 4,743,010 | A | 5/1988 | Geraci |
| 4,743,015 | A | 5/1988 | Marshall |
| 4,743,017 | A | 5/1988 | Jaeger |
| 4,744,559 | A | 5/1988 | Mahnke et al. |
| 4,746,115 | A | 5/1988 | Lahman |
| 4,749,184 | A | 6/1988 | Tobin |
| 4,750,736 | A | 6/1988 | Watterson |
| 4,750,738 | A | 6/1988 | Dang |
| 4,751,755 | A | 6/1988 | Carey, Jr. et al. |
| 4,753,437 | A | 6/1988 | Lapcevic |
| 4,756,098 | A | 7/1988 | Boggia |
| 4,756,527 | A | 7/1988 | Ledbetter |
| 4,757,495 | A | 7/1988 | Decker et al. |
| 4,757,987 | A | 7/1988 | Allemand |
| 4,759,540 | A | 7/1988 | Yu et al. |
| 4,763,284 | A | 8/1988 | Carlin |
| 4,763,897 | A | 8/1988 | Yakata |
| 4,765,610 | A | 8/1988 | Sidwell |
| 4,765,613 | A | 8/1988 | Voris |
| 4,765,616 | A | 8/1988 | Wolff |
| 4,768,780 | A | 9/1988 | Hayes |
| 4,770,411 | A | 9/1988 | Armstrong et al. |
| 4,771,148 | A | 9/1988 | Bersonnet |
| 4,771,577 | A | 9/1988 | Abe |
| 4,772,015 | A | 9/1988 | Carlson et al. |
| 4,773,170 | A | 9/1988 | Moore et al. |
| 4,773,640 | A | 9/1988 | Kolbel et al. |
| 4,774,679 | A | 9/1988 | Carlin |
| 4,775,149 | A | 10/1988 | Wilson |
| 4,776,581 | A | 10/1988 | Shepherdson |
| 4,776,582 | A | 10/1988 | Ramhorst |
| 4,776,587 | A | 10/1988 | Carlson et al. |
| 4,778,173 | A | 10/1988 | Joutras |
| 4,779,867 | A | 10/1988 | Hinds |
| 4,779,884 | A | 10/1988 | Minati |
| 4,784,384 | A | 11/1988 | Deola |
| 4,786,049 | A | 11/1988 | Lautenschlager |
| 4,786,050 | A | 11/1988 | Geschwender |
| 4,789,153 | A | 12/1988 | Brown |
| 4,790,522 | A | 12/1988 | Drutchas |
| 4,790,528 | A | 12/1988 | Nakao et al. |
| 4,790,596 | A | 12/1988 | Shifferaw |
| 4,792,134 | A | 12/1988 | Chen |
| 4,793,608 | A | 12/1988 | Mahnke et al. |
| 4,797,968 | A | 1/1989 | Wenzlick |
| 4,798,377 | A | 1/1989 | White |
| 4,798,760 | A | 1/1989 | Diaz-Kotti |
| 4,799,475 | A | 1/1989 | Iams et al. |
| 4,799,671 | A | 1/1989 | Hoggan et al. |
| 4,801,079 | A | 1/1989 | Gonella |
| 4,801,139 | A | 1/1989 | Vanhoutte |
| 4,801,140 | A | 1/1989 | Bergeron |
| 4,804,178 | A | 2/1989 | Friedebach |
| 4,805,901 | A | 2/1989 | Kulick |
| 4,807,874 | A | 2/1989 | Little |
| 4,807,893 | A | 2/1989 | Huang |
| 4,809,804 | A | 3/1989 | Houston et al. |
| 4,809,972 | A | 3/1989 | Rasmussen et al. |
| 4,809,973 | A | 3/1989 | Johns |
| 4,809,976 | A | 3/1989 | Berger |
| 4,813,665 | A | 3/1989 | Carr |
| 4,813,667 | A | 3/1989 | Watterson |
| 4,813,668 | A | 3/1989 | Solloway |
| 4,813,743 | A | 3/1989 | Mizelle |
| 4,814,661 | A | 3/1989 | Ratzlaff et al. |
| 4,817,938 | A | 4/1989 | Nakao et al. |
| 4,817,939 | A | 4/1989 | Augspurger et al. |
| 4,817,940 | A | 4/1989 | Shaw et al. |
| 4,818,175 | A | 4/1989 | Kimura |
| 4,818,234 | A | 4/1989 | Redington |
| 4,819,583 | A | 4/1989 | Guerra |
| 4,819,818 | A | 4/1989 | Simkus |
| 4,822,029 | A | 4/1989 | Sarno |
| 4,822,034 | A | 4/1989 | Shields |
| 4,822,035 | A | 4/1989 | Jennings et al. |
| 4,822,038 | A | 4/1989 | Maag |
| 4,824,104 | A | 4/1989 | Bloch |
| 4,826,153 | A | 5/1989 | Schalip |
| 4,826,157 | A | 5/1989 | Fitzpatrick |
| 4,826,158 | A | 5/1989 | Fields, Jr. |
| 4,826,159 | A | 5/1989 | Hersey |
| 4,828,255 | A | 5/1989 | Lahman |
| 4,828,257 | A | 5/1989 | Dyer et al. |
| 4,828,522 | A | 5/1989 | Santos |
| 4,828,713 | A | 5/1989 | McDonald et al. |
| 4,830,362 | A | 5/1989 | Bull |
| 4,830,363 | A | 5/1989 | Kennedy |
| 4,830,365 | A | 5/1989 | March |
| 4,832,332 | A | 5/1989 | Dumbser |
| 4,834,365 | A | 5/1989 | Jones |
| 4,834,396 | A | 5/1989 | Schnell |
| 4,836,530 | A | 6/1989 | Stanley, Jr. |
| 4,836,535 | A | 6/1989 | Pearson |
| 4,837,157 | A | 6/1989 | Turnell et al. |
| 4,838,180 | A | 6/1989 | Gutgsell |
| 4,838,543 | A | 6/1989 | Armstrong et al. |
| 4,838,544 | A | 6/1989 | Sasakawa et al. |
| 4,840,372 | A | 6/1989 | Oglesby et al. |
| 4,840,373 | A | 6/1989 | Maag |
| 4,842,266 | A | 6/1989 | Sweeney, Sr. |
| 4,842,268 | A | 6/1989 | Jenkins |
| 4,844,448 | A | 7/1989 | Niznik |
| 4,844,449 | A | 7/1989 | Truslaske |
| 4,844,450 | A | 7/1989 | Rodgers, Jr. |
| 4,844,453 | A | 7/1989 | Hestilow |
| 4,844,456 | A | 7/1989 | Habing et al. |
| 4,846,458 | A | 7/1989 | Potts |
| 4,846,693 | A | 7/1989 | Baer |
| 4,848,737 | A | 7/1989 | Ehrenfield |
| 4,850,585 | A | 7/1989 | Dalebout |
| 4,852,874 | A | 8/1989 | Sleichter, III et al. |
| 4,854,578 | A | 8/1989 | Fulks |
| 4,855,942 | A | 8/1989 | Bianco |
| 4,856,773 | A | 8/1989 | Deola |
| 4,856,775 | A | 8/1989 | Colledge |
| 4,858,912 | A | 8/1989 | Boyd |
| 4,858,915 | A | 8/1989 | Szabo |
| 4,858,918 | A | 8/1989 | Iams et al. |
| 4,860,763 | A | 8/1989 | Schminke |
| 4,861,020 | A | 8/1989 | Soligny, Sr. |
| 4,861,023 | A | 8/1989 | Wedman |
| 4,861,025 | A | 8/1989 | Rockwell |
| 4,863,157 | A | 9/1989 | Mendel et al. |
| 4,863,161 | A | 9/1989 | Telle |
| 4,863,163 | A | 9/1989 | Wehrell |
| 4,865,344 | A | 9/1989 | Romero, Sr. et al. |
| 4,866,704 | A | 9/1989 | Bergman |
| 4,867,442 | A | 9/1989 | Matthews |
| 4,867,443 | A | 9/1989 | Jensen |
| 4,869,493 | A | 9/1989 | Johnston |
| 4,869,494 | A | 9/1989 | Lambert, Sr. |
| 4,869,497 | A | 9/1989 | Stewart et al. |
| 4,872,670 | A | 10/1989 | Nichols |
| 4,875,676 | A | 10/1989 | Zimmer |
| 4,877,239 | A | 10/1989 | Dela Rosa |

(56) References Cited

U.S. PATENT DOCUMENTS

| | | | |
|---|---|---|---|
| 4,878,662 | A | 11/1989 | Chern |
| 4,878,663 | A | 11/1989 | Luquette |
| 4,880,227 | A | 11/1989 | Sowell |
| 4,880,229 | A | 11/1989 | Broussard |
| 4,880,230 | A | 11/1989 | Cook |
| 4,883,272 | A | 11/1989 | Lay |
| 4,886,266 | A | 12/1989 | Trulaske |
| 4,887,929 | A | 12/1989 | Hale |
| 4,889,108 | A | 12/1989 | Bond et al. |
| 4,889,131 | A | 12/1989 | Salem et al. |
| 4,889,458 | A | 12/1989 | Taylor |
| 4,891,764 | A | 1/1990 | McIntosh |
| 4,891,785 | A | 1/1990 | Donohoo |
| 4,893,409 | A | 1/1990 | Poehlmann |
| 4,893,810 | A | 1/1990 | Lee |
| 4,894,933 | A | 1/1990 | Tonkel et al. |
| 4,898,379 | A | 2/1990 | Shiba |
| 4,898,381 | A | 2/1990 | Gordon |
| 4,900,012 | A | 2/1990 | Fu |
| 4,900,013 | A | 2/1990 | Rodgers, Jr. |
| 4,900,016 | A | 2/1990 | Caruthers |
| 4,900,017 | A | 2/1990 | Bold, Jr. |
| 4,900,018 | A | 2/1990 | Ish, III |
| 4,902,006 | A | 2/1990 | Stallings, Jr. |
| 4,902,007 | A | 2/1990 | Ferrari |
| 4,904,829 | A | 2/1990 | Berthaud et al. |
| 4,905,330 | A | 3/1990 | Jacobs |
| 4,907,795 | A | 3/1990 | Shaw et al. |
| 4,907,797 | A | 3/1990 | Gezari et al. |
| 4,907,798 | A | 3/1990 | Burchatz |
| 4,907,973 | A | 3/1990 | Hon |
| 4,909,504 | A | 3/1990 | Yang |
| 4,909,505 | A | 3/1990 | Tee |
| 4,911,427 | A | 3/1990 | Matsumoto et al. |
| 4,911,436 | A | 3/1990 | Lighter |
| 4,911,438 | A | 3/1990 | Van Straaten |
| 4,912,638 | A | 3/1990 | Pratt, Jr. |
| 4,913,396 | A | 4/1990 | Dalebout et al. |
| 4,913,419 | A | 4/1990 | McAuliffe |
| 4,913,422 | A | 4/1990 | Elmore |
| 4,913,423 | A | 4/1990 | Farran |
| 4,915,377 | A | 4/1990 | Malnke et al. |
| 4,915,379 | A | 4/1990 | Sapp |
| 4,917,376 | A | 4/1990 | Lo |
| 4,919,418 | A | 4/1990 | Miller |
| 4,919,419 | A | 4/1990 | Houston |
| 4,921,242 | A | 5/1990 | Watterson |
| 4,921,245 | A | 5/1990 | Roberts |
| 4,921,247 | A | 5/1990 | Sterling |
| 4,923,193 | A | 5/1990 | Pitzen et al. |
| 4,925,183 | A | 5/1990 | Kim |
| 4,925,189 | A | 5/1990 | Braeunig |
| 4,925,200 | A | 5/1990 | Jones |
| 4,925,724 | A | 5/1990 | Ogden |
| 4,927,136 | A | 5/1990 | Leask |
| 4,927,138 | A | 5/1990 | Ferrari |
| 4,928,546 | A | 5/1990 | Walters |
| 4,928,957 | A | 5/1990 | Lanier et al. |
| 4,928,961 | A | 5/1990 | Madden |
| 4,930,768 | A | 6/1990 | Lapcevic |
| 4,930,769 | A | 6/1990 | Nenoff |
| 4,930,770 | A | 6/1990 | Baker |
| 4,934,690 | A | 6/1990 | Bull |
| 4,934,692 | A | 6/1990 | Owens |
| 4,934,694 | A | 6/1990 | Mcintosh |
| 4,938,469 | A | 7/1990 | Crandell |
| 4,938,473 | A | 7/1990 | Lee |
| 4,938,474 | A | 7/1990 | Sweeney et al. |
| 4,940,233 | A | 7/1990 | Bull |
| 4,941,652 | A | 7/1990 | Nagano et al. |
| 4,941,673 | A | 7/1990 | Bennett |
| 4,944,511 | A | 7/1990 | Francis |
| 4,944,518 | A | 7/1990 | Flynn |
| 4,948,121 | A | 8/1990 | Haaheim et al. |
| 4,948,123 | A | 8/1990 | Schook |
| 4,949,951 | A | 8/1990 | Deola |
| 4,949,954 | A | 8/1990 | Hix |
| 4,949,958 | A | 8/1990 | Richey |
| 4,949,959 | A | 8/1990 | Stevens |
| 4,949,993 | A | 8/1990 | Stark et al. |
| 4,952,265 | A | 8/1990 | Yamanaka et al. |
| 4,953,415 | A | 9/1990 | Lehtonen |
| 4,953,858 | A | 9/1990 | Zelli |
| 4,955,466 | A | 9/1990 | Almes et al. |
| 4,958,832 | A | 9/1990 | Kim |
| 4,959,713 | A | 9/1990 | Morotomi et al. |
| 4,960,276 | A | 10/1990 | Feuer et al. |
| 4,964,632 | A | 10/1990 | Rockwell |
| 4,968,028 | A | 11/1990 | Wehrell |
| 4,971,305 | A | 11/1990 | Rennex |
| 4,971,316 | A | 11/1990 | Dalebout et al. |
| 4,973,050 | A | 11/1990 | Santoro |
| 4,974,831 | A | 12/1990 | Dunham |
| 4,974,832 | A | 12/1990 | Dalebout |
| 4,974,836 | A | 12/1990 | Hirsch |
| 4,974,838 | A | 12/1990 | Sollenberger |
| 4,976,424 | A | 12/1990 | Sargeant et al. |
| 4,976,428 | A | 12/1990 | Ghazi |
| 4,976,435 | A | 12/1990 | Shatford |
| 4,978,122 | A | 12/1990 | Dibowski |
| 4,982,955 | A | 1/1991 | Heasley |
| 4,983,847 | A | 1/1991 | Bryan |
| 4,984,810 | A | 1/1991 | Stearns et al. |
| 4,986,261 | A | 1/1991 | Iams et al. |
| 4,986,534 | A | 1/1991 | Meier et al. |
| 4,986,689 | A | 1/1991 | Drutchas |
| 4,989,860 | A | 2/1991 | Iams et al. |
| 4,990,838 | A | 2/1991 | Kawato et al. |
| 4,992,190 | A | 2/1991 | Shtarkman |
| 4,995,777 | A | 2/1991 | Warmington |
| 4,998,723 | A | 3/1991 | Santoro |
| 4,998,725 | A | 3/1991 | Watterson et al. |
| 5,000,440 | A | 3/1991 | Lynch |
| 5,000,442 | A | 3/1991 | Dalebout et al. |
| 5,000,446 | A | 3/1991 | Sarno |
| 5,001,632 | A | 3/1991 | Hall Tipping |
| 5,002,271 | A | 3/1991 | Gonzales |
| 5,004,224 | A | 4/1991 | Wang |
| 5,005,832 | A | 4/1991 | V D Hoeven |
| 5,007,630 | A | 4/1991 | Real et al. |
| 5,007,631 | A | 4/1991 | Wang |
| 5,011,139 | A | 4/1991 | Towley, III |
| 5,011,142 | A | 4/1991 | Eckler |
| 5,013,031 | A | 5/1991 | Bull |
| 5,015,926 | A | 5/1991 | Casler |
| 5,016,870 | A | 5/1991 | Bulloch et al. |
| 5,018,725 | A | 5/1991 | Cook |
| 5,020,793 | A | 6/1991 | Loane |
| 5,020,794 | A | 6/1991 | Englehardt et al. |
| 5,020,795 | A | 6/1991 | Airy et al. |
| 5,022,377 | A | 6/1991 | Stevens |
| 5,024,441 | A | 6/1991 | Rousseau |
| 5,026,049 | A | 6/1991 | Goodman |
| 5,027,303 | A | 6/1991 | Witte |
| 5,029,801 | A | 7/1991 | Dalebout et al. |
| 5,029,848 | A | 7/1991 | Sleamaker |
| 5,029,849 | A | 7/1991 | Nurkowski |
| 5,029,850 | A | 7/1991 | Van Straaten |
| 5,031,455 | A | 7/1991 | Cline |
| 5,031,901 | A | 7/1991 | Saarinen |
| 5,031,905 | A | 7/1991 | Walsh |
| 5,032,048 | A | 7/1991 | Walton et al. |
| 5,033,740 | A | 7/1991 | Schwartz |
| 5,034,576 | A | 7/1991 | Dalebout et al. |
| 5,035,418 | A | 7/1991 | Harabayashi |
| RE33,662 | E | 8/1991 | Blair et al. |
| 5,037,084 | A | 8/1991 | Flor |
| 5,037,089 | A | 8/1991 | Spagnuolo |
| 5,037,090 | A | 8/1991 | Fitzpatrick |
| 5,039,088 | A | 8/1991 | Shifferaw |
| 5,039,091 | A | 8/1991 | Johnson |
| 5,040,785 | A | 8/1991 | Charnitski |
| 5,040,787 | A | 8/1991 | Brotman |
| 5,040,788 | A | 8/1991 | Randall |

(56) References Cited

U.S. PATENT DOCUMENTS

| | | | |
|---|---|---|---|
| 5,042,704 | A | 8/1991 | Izzo |
| 5,042,799 | A | 8/1991 | Stanley |
| 5,044,629 | A | 9/1991 | Ryan |
| 5,044,631 | A | 9/1991 | Jones |
| 5,044,632 | A | 9/1991 | Jones |
| 5,046,382 | A | 9/1991 | Steinberg |
| 5,046,722 | A | 9/1991 | Antoon |
| 5,048,823 | A | 9/1991 | Bean |
| 5,048,825 | A | 9/1991 | Kelly |
| 5,048,826 | A | 9/1991 | Ryan |
| 5,050,872 | A | 9/1991 | Farenholtz |
| 5,050,873 | A | 9/1991 | Jones |
| 5,052,375 | A | 10/1991 | Stark |
| 5,052,684 | A | 10/1991 | Kosuge et al. |
| 5,054,770 | A | 10/1991 | Bull |
| 5,054,774 | A | 10/1991 | Belsito |
| 5,056,777 | A | 10/1991 | Capjon et al. |
| 5,058,881 | A | 10/1991 | Measom |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,626 | A | 11/1991 | Dalebout et al. |
| 5,062,627 | A | 11/1991 | Bingham |
| 5,062,629 | A | 11/1991 | Vaughan |
| 5,062,630 | A | 11/1991 | Nelson |
| 5,062,631 | A | 11/1991 | Dau et al. |
| 5,062,632 | A | 11/1991 | Dalebout et al. |
| 5,062,633 | A | 11/1991 | Engel et al. |
| 5,064,191 | A | 11/1991 | Johnson |
| 5,066,000 | A | 11/1991 | Dolan |
| 5,067,710 | A | 11/1991 | Watterson et al. |
| 5,071,115 | A | 12/1991 | Welch |
| 5,071,119 | A | 12/1991 | Johnson |
| 5,072,928 | A | 12/1991 | Watterson et al. |
| 5,072,929 | A | 12/1991 | Peterson et al. |
| 5,074,550 | A | 12/1991 | Sloan |
| 5,077,916 | A | 1/1992 | Beneteau |
| 5,078,152 | A | 1/1992 | Bond et al. |
| 5,080,353 | A | 1/1992 | Tench |
| 5,081,991 | A | 1/1992 | Chance |
| 5,085,426 | A | 2/1992 | Wanzer et al. |
| 5,085,427 | A | 2/1992 | Finn |
| 5,085,430 | A | 2/1992 | Habing |
| 5,086,385 | A | 2/1992 | Launey et al. |
| 5,087,047 | A | 2/1992 | McConnell |
| 5,088,729 | A | 2/1992 | Dalebout |
| 5,089,960 | A | 2/1992 | Sweeney, Jr. |
| 5,090,694 | A | 2/1992 | Pauls et al. |
| 5,094,249 | A | 3/1992 | Marras et al. |
| 5,094,447 | A | 3/1992 | Wang |
| 5,094,449 | A | 3/1992 | Stearns |
| 5,096,225 | A | 3/1992 | Osawa |
| 5,100,129 | A | 3/1992 | Porter |
| 5,102,121 | A | 4/1992 | Solow et al. |
| 5,102,122 | A | 4/1992 | Piane, Jr. |
| 5,102,124 | A | 4/1992 | Diodati |
| 5,102,380 | A | 4/1992 | Jacobson et al. |
| 5,104,119 | A | 4/1992 | Lynch |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,109,778 | A | 5/1992 | Berkowitz et al. |
| 5,110,117 | A | 5/1992 | Fisher et al. |
| 5,110,118 | A | 5/1992 | Winey |
| 5,110,121 | A | 5/1992 | Foster |
| 5,112,045 | A | 5/1992 | Mason et al. |
| 5,112,287 | A | 5/1992 | Brewer |
| 5,113,427 | A | 5/1992 | Ryoichi et al. |
| 5,114,388 | A | 5/1992 | Trulaske |
| 5,114,391 | A | 5/1992 | Pitzen et al. |
| 5,116,297 | A | 5/1992 | Stonecipher |
| 5,117,674 | A | 6/1992 | Howard |
| 5,118,112 | A | 6/1992 | Bregman et al. |
| 5,120,289 | A | 6/1992 | Yu |
| 5,123,629 | A | 6/1992 | Takeuchi |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,895 | A | 7/1992 | Rogers, Jr. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,137,501 | A | 8/1992 | Mertesdorf |
| 5,138,730 | A | 8/1992 | Masuda |
| 5,141,478 | A | 8/1992 | Upper |
| 5,141,480 | A | 8/1992 | Lennox et al. |
| 5,141,483 | A | 8/1992 | Smith |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,151,071 | A | 9/1992 | Jain et al. |
| 5,152,210 | A | 10/1992 | Chen |
| 5,156,650 | A | 10/1992 | Bals |
| 5,158,093 | A | 10/1992 | Shvartz |
| 5,158,518 | A | 10/1992 | Pizzuto |
| 5,158,520 | A | 10/1992 | Lemke et al. |
| 5,160,305 | A | 11/1992 | Lin |
| 5,162,029 | A | 11/1992 | Schine |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |
| 5,176,601 | A | 1/1993 | Reynolds |
| 5,176,602 | A | 1/1993 | Roberts |
| 5,178,590 | A | 1/1993 | Stephens |
| 5,178,593 | A | 1/1993 | Roberts |
| 5,178,599 | A | 1/1993 | Scott |
| 5,180,347 | A | 1/1993 | Chen |
| 5,180,351 | A | 1/1993 | Ehrenfried |
| 5,180,352 | A | 1/1993 | Sreter |
| 5,180,647 | A | 1/1993 | Rowland et al. |
| 5,181,894 | A | 1/1993 | Shieng |
| 5,184,295 | A | 2/1993 | Mann |
| 5,184,988 | A | 2/1993 | Dunham |
| 5,184,991 | A | 2/1993 | Brangi |
| 5,184,994 | A | 2/1993 | Morris |
| 5,186,471 | A | 2/1993 | Vancraeynest |
| 5,186,697 | A | 2/1993 | Rennex |
| 5,190,509 | A | 3/1993 | Davison, Jr. |
| 5,190,513 | A | 3/1993 | Habing et al. |
| 5,192,255 | A | 3/1993 | Dalebout et al. |
| 5,192,257 | A | 3/1993 | Panasewicz |
| 5,192,258 | A | 3/1993 | Keller |
| 5,194,059 | A | 3/1993 | Wu |
| 5,195,781 | A | 3/1993 | Osawa |
| 5,195,935 | A | 3/1993 | Fencel |
| 5,199,931 | A | 4/1993 | Easley et al. |
| 5,199,934 | A | 4/1993 | Lin |
| 5,199,935 | A | 4/1993 | Gibon et al. |
| 5,201,694 | A | 4/1993 | Zappel |
| 5,201,772 | A | 4/1993 | Maxwell |
| 5,202,424 | A | 4/1993 | Vlassara et al. |
| 5,203,126 | A | 4/1993 | Sorenson et al. |
| 5,203,229 | A | 4/1993 | Chen |
| 5,203,800 | A | 4/1993 | Meredith |
| 5,203,826 | A | 4/1993 | Dalebout |
| 5,204,670 | A | 4/1993 | Stinton |
| 5,205,798 | A | 4/1993 | Lekhtman |
| 5,205,800 | A | 4/1993 | Grant |
| 5,205,802 | A | 4/1993 | Swisher |

(56) References Cited

U.S. PATENT DOCUMENTS 5,206,671 A 4/1993 Eydelman et al.
5,207,489 A 5/1993 Miller
5,207,621 A 5/1993 Koch et al.
5,207,622 A 5/1993 Wilkinson et al.
5,207,625 A 5/1993 White
5,207,628 A 5/1993 Graham
5,209,223 A 5/1993 McGorry et al.
5,209,482 A 5/1993 Hopfer
5,209,715 A 5/1993 Walker et al.
5,211,614 A 5/1993 Henes
5,211,617 A 5/1993 Millen
5,213,555 A 5/1993 Hood
5,215,510 A 6/1993 Baran
5,217,422 A 6/1993 Domzalski
5,221,240 A 6/1993 Mann
5,221,245 A 6/1993 Yeh
5,222,928 A 6/1993 Yacullo
5,224,909 A 7/1993 Hamilton
5,226,866 A 7/1993 Engel et al.
5,226,868 A 7/1993 Montgomery
5,230,672 A 7/1993 Brown et al.
5,230,673 A 7/1993 Maeyama et al.
5,230,680 A 7/1993 Wu
5,231,752 A 8/1993 Hereford
5,232,422 A 8/1993 Bishop, Jr.
5,233,520 A 8/1993 Kretsch et al.
5,234,392 A 8/1993 Clark
5,234,395 A 8/1993 Miller et al.
5,236,406 A 8/1993 Webber
5,240,417 A 8/1993 Smithson et al.
5,242,339 A 9/1993 Thornton
5,242,340 A 9/1993 Jerome
5,242,342 A 9/1993 Silverman
5,242,343 A 9/1993 Miller
5,242,344 A 9/1993 Hundley
5,242,345 A 9/1993 Mitchell
5,242,347 A 9/1993 Keeton
5,242,348 A 9/1993 Bates
5,242,353 A 9/1993 Cole et al.
5,243,998 A 9/1993 Silverman et al.
5,244,444 A 9/1993 Wostry
5,246,411 A 9/1993 Rackman
5,247,853 A 9/1993 Dalebout
5,250,012 A 10/1993 Whitcomb, Jr.
5,250,013 A 10/1993 Brangi
5,254,065 A 10/1993 Pollock
5,254,066 A 10/1993 Brown et al.
5,254,067 A 10/1993 Habing et al.
5,256,115 A 10/1993 Scholder
5,256,117 A 10/1993 Potts et al.
5,256,118 A 10/1993 Chen
5,256,121 A 10/1993 Brotman
5,256,126 A 10/1993 Grotstein
5,257,084 A 10/1993 Brotman
5,257,701 A 11/1993 Edelson
5,257,964 A 11/1993 Petters
5,260,870 A 11/1993 Tsuchiya et al.
5,261,864 A 11/1993 Fitzpatrick
5,261,865 A 11/1993 Trainor
5,263,913 A 11/1993 Boren
5,263,915 A 11/1993 Habing
5,263,916 A 11/1993 Bobich
5,267,925 A 12/1993 Boyd
5,267,929 A 12/1993 Chen
5,267,930 A 12/1993 Henes
5,269,081 A 12/1993 Gray
5,269,519 A 12/1993 Malone
5,269,736 A 12/1993 Roberts
5,269,737 A 12/1993 Sobotka
5,269,738 A 12/1993 Boren
5,271,416 A 12/1993 Lepley
5,273,285 A 12/1993 Long
5,273,505 A 12/1993 Jones
5,277,678 A 1/1994 Friedebach et al.
5,277,683 A 1/1994 Wilkins
5,277,684 A 1/1994 Harris
5,279,528 A 1/1994 Dalebout et al.
5,279,529 A 1/1994 Eschenbach
5,279,531 A 1/1994 Jen Huey
5,280,936 A 1/1994 Schmidlin
5,281,193 A 1/1994 Colbo, Jr.
5,282,776 A 2/1994 Dalebout
5,284,461 A 2/1994 Wilkinson et al.
5,284,463 A 2/1994 Shields
5,284,464 A 2/1994 Lee, III et al.
5,286,243 A 2/1994 Lapcevic
5,290,205 A 3/1994 Densmore et al.
5,290,211 A 3/1994 Stearns
5,290,214 A 3/1994 Chen
5,292,293 A 3/1994 Schumacher
5,292,297 A 3/1994 Hsu
5,295,928 A 3/1994 Rennex
5,295,935 A 3/1994 Wang
5,298,002 A 3/1994 Lin
5,299,810 A 4/1994 Pierce et al.
5,299,992 A 4/1994 Wilkinson
5,299,993 A 4/1994 Habing
5,299,997 A 4/1994 Chen
5,301,154 A 4/1994 Suga
5,302,161 A 4/1994 Loubert et al.
5,302,162 A 4/1994 Pasero
5,303,885 A 4/1994 Wade
5,306,218 A 4/1994 Huang Chen
5,306,220 A 4/1994 Kearney
5,306,221 A 4/1994 Itaru
5,308,075 A 5/1994 Theriault
5,308,234 A 5/1994 Nicke et al.
5,308,296 A 5/1994 Eckstein
5,308,300 A 5/1994 Chino et al.
5,309,355 A 5/1994 Lockwood
5,310,392 A 5/1994 Lo
5,310,394 A 5/1994 Kallios
5,313,852 A 5/1994 Arena
5,313,942 A 5/1994 Platzker
5,314,389 A 5/1994 Dotan
5,314,390 A 5/1994 Westing et al.
5,314,391 A 5/1994 Potash et al.
5,314,392 A 5/1994 Hawkins et al.
5,314,394 A 5/1994 Ronan
5,316,534 A 5/1994 Dalebout et al.
5,318,487 A 6/1994 Golen et al.
5,318,490 A 6/1994 Henderson et al.
5,318,491 A 6/1994 Houston
5,318,495 A 6/1994 Malynowsky
5,320,343 A 6/1994 McKinney
5,320,588 A 6/1994 Wanzer et al.
5,320,591 A 6/1994 Harmon et al.
5,322,489 A 6/1994 Webb et al.
5,323,650 A 6/1994 Fullen et al.
5,323,784 A 6/1994 Shu
5,324,242 A 6/1994 Lo
5,328,410 A 7/1994 Amburgey et al.
5,328,420 A 7/1994 Allen
5,328,422 A 7/1994 Nichols
5,328,428 A 7/1994 Huang
5,328,429 A 7/1994 Potash et al.
5,328,430 A 7/1994 Vittone
5,330,401 A 7/1994 Walstead
5,330,402 A 7/1994 Johnson
5,330,404 A 7/1994 Lopeteguy et al.
5,330,405 A 7/1994 Habing et al.
5,330,408 A 7/1994 Westmoreland, Jr.
5,334,120 A 8/1994 Rasmussen
5,335,188 A 8/1994 Brisson
5,336,142 A 8/1994 Dalebout et al.
5,336,143 A 8/1994 Wu
5,336,144 A 8/1994 Rodden
5,336,145 A 8/1994 Keiser
5,336,146 A 8/1994 Piaget et al.
5,336,148 A 8/1994 Ish, III
5,336,151 A 8/1994 Van Ballegooie
5,338,274 A 8/1994 Jones
5,338,277 A 8/1994 Yang
5,342,261 A 8/1994 Johnston

(56) References Cited

U.S. PATENT DOCUMENTS

| | | | |
|---|---|---|---|
| 5,342,264 | A | 8/1994 | Gordon |
| 5,342,269 | A | 8/1994 | Huang |
| 5,342,271 | A | 8/1994 | Long |
| RE34,728 | E | 9/1994 | Hall-Tipping |
| 5,344,372 | A | 9/1994 | Hung |
| 5,344,374 | A | 9/1994 | Telle |
| 5,346,447 | A | 9/1994 | Kelly et al. |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,357,696 | A | 10/1994 | Gray |
| 5,358,461 | A | 10/1994 | Bailey, Jr. |
| 5,358,462 | A | 10/1994 | Calderone |
| D352,536 | S | 11/1994 | Byrd et al. |
| 5,359,986 | A | 11/1994 | Magrath, III et al. |
| 5,361,091 | A | 11/1994 | Hoarty et al. |
| 5,361,778 | A | 11/1994 | Seitz |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,362,298 | A | 11/1994 | Brown et al. |
| 5,364,060 | A | 11/1994 | Donovan et al. |
| 5,364,271 | A | 11/1994 | Aknin et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,374,230 | A | 12/1994 | Bonnaime |
| 5,375,068 | A | 12/1994 | Palmer et al. |
| 5,376,053 | A | 12/1994 | Ponder |
| 5,377,171 | A | 12/1994 | Schlup |
| 5,377,258 | A | 12/1994 | Bro |
| 5,378,212 | A | 1/1995 | Pin-Kuo |
| 5,378,216 | A | 1/1995 | Ish, III et al. |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,385,520 | A | 1/1995 | Lepine et al. |
| 5,387,164 | A | 2/1995 | Brown, Jr. |
| 5,387,169 | A | 2/1995 | Wang |
| 5,387,170 | A | 2/1995 | Rawls et al. |
| 5,387,171 | A | 2/1995 | Casey et al. |
| 5,391,080 | A | 2/1995 | Bernacki |
| 5,391,132 | A | 2/1995 | Greenwald |
| 5,392,476 | A | 2/1995 | Williams |
| 5,394,922 | A | 3/1995 | Colson et al. |
| 5,396,340 | A | 3/1995 | Ishii et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,403 | A | 4/1995 | Coleman |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,410,471 | A | 4/1995 | Alyfuku et al. |
| 5,410,472 | A | 4/1995 | Anderson |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,222 | A | 5/1995 | Dempsey et al. |
| 5,417,634 | A | 5/1995 | Habing |
| 5,417,643 | A | 5/1995 | Taylor |
| 5,419,562 | A | 5/1995 | Cromarty |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,798 | A | 6/1995 | Bond et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,289 | A | 8/1995 | Liverance |
| 5,437,589 | A | 8/1995 | Habing |
| 5,439,225 | A | 8/1995 | Gvoich et al. |
| 5,441,467 | A | 8/1995 | Stevens |
| 5,441,468 | A | 8/1995 | Deckers et al. |
| 5,443,435 | A | 8/1995 | Wilkinson |
| 5,445,583 | A | 8/1995 | Habing |
| 5,447,480 | A | 9/1995 | Fulks |
| 5,449,332 | A | 9/1995 | Hervig |
| 5,449,334 | A | 9/1995 | Kingsbury |
| 5,451,191 | A | 9/1995 | Beenken |
| 5,451,922 | A | 9/1995 | Hamilton |
| 5,452,269 | A | 9/1995 | Cherdak |
| 5,453,066 | A | 9/1995 | Richter, Jr. |
| 5,454,772 | A | 10/1995 | Rodden |
| 5,454,773 | A | 10/1995 | Blanchard et al. |
| 5,456,262 | A | 10/1995 | Birnbaum |
| 5,456,644 | A | 10/1995 | Hecox et al. |
| 5,456,648 | A | 10/1995 | Edinburg |
| 5,458,553 | A | 10/1995 | Wu |
| 5,460,586 | A | 10/1995 | Wilkinson |
| 5,462,051 | A | 10/1995 | Oka et al. |
| 5,462,503 | A | 10/1995 | Benjamin et al. |
| 5,462,504 | A | 10/1995 | Trulaske et al. |

(56) References Cited

U.S. PATENT DOCUMENTS 5,464,378 A 11/1995 Lee
5,466,200 A 11/1995 Ulrich et al.
5,466,203 A 11/1995 Chen
5,467,874 A 11/1995 Whitaker
5,468,205 A 11/1995 McFall et al.
5,469,740 A 11/1995 French et al.
5,470,298 A 11/1995 Curtis
5,471,405 A 11/1995 Marsh
5,472,205 A 12/1995 Bouton
5,472,397 A 12/1995 Ammoscato et al.
5,472,399 A 12/1995 Szekely
5,474,077 A 12/1995 Suga
5,474,087 A 12/1995 Nashner
5,474,090 A 12/1995 Begun et al.
5,474,510 A 12/1995 Chen
5,476,428 A 12/1995 Potash et al.
5,476,430 A 12/1995 Lee et al.
5,478,295 A 12/1995 Fracchia
5,478,298 A 12/1995 Chen
5,480,212 A 1/1996 Marconet
5,482,472 A 1/1996 Garoni et al.
5,484,358 A 1/1996 Wang et al.
5,484,362 A 1/1996 Skowronski et al.
5,484,365 A 1/1996 Jones et al.
5,484,389 A 1/1996 Stark
5,486,001 A 1/1996 Baker
5,487,707 A 1/1996 Sharf et al.
5,489,249 A 2/1996 Brewer et al.
5,489,250 A 2/1996 Densmore et al.
5,490,818 A 2/1996 Haber et al.
5,492,514 A 2/1996 Daum
5,492,518 A 2/1996 Measom
5,492,520 A 2/1996 Brown
5,493,127 A 2/1996 Lloyd et al.
5,496,235 A 3/1996 Stevens
5,496,236 A 3/1996 Buonauito
5,496,238 A 3/1996 Taylor
5,496,239 A 3/1996 Kallman
5,496,244 A 3/1996 Caruthers
5,498,222 A 3/1996 Hur
5,498,223 A 3/1996 Iams et al.
5,499,956 A 3/1996 Habing et al.
5,499,959 A 3/1996 Holmes et al.
5,499,961 A 3/1996 Mattox
5,501,647 A 3/1996 Snyder
5,501,656 A 3/1996 Homma et al.
5,503,608 A 4/1996 Chang
5,505,011 A 4/1996 Bleimhofer
5,505,677 A 4/1996 Hinds
5,507,271 A 4/1996 Actor
5,507,710 A 4/1996 Chen
5,509,870 A 4/1996 Lloyd
5,510,828 A 4/1996 Lutterbach
5,512,025 A 4/1996 Dalebout et al.
5,512,029 A 4/1996 Barnard
5,514,053 A 5/1996 Hawkins et al.
5,514,059 A 5/1996 Romney
5,516,334 A 5/1996 Easton
5,518,471 A 5/1996 Hettinger et al.
5,518,473 A 5/1996 Miller
5,518,476 A 5/1996 Mcleon
5,518,477 A 5/1996 Simonson
5,518,483 A 5/1996 Oswald
5,518,486 A 5/1996 Sheeler
5,519,189 A 5/1996 Gibisch
5,520,599 A 5/1996 Chen
5,522,783 A 6/1996 Gordon
5,524,110 A 6/1996 Danneels et al.
5,524,637 A 6/1996 Erickson
5,527,239 A 6/1996 Abbondanza
5,527,245 A 6/1996 Dalebout et al.
5,527,249 A 6/1996 Harris
5,527,250 A 6/1996 Chen
5,527,253 A 6/1996 Wilkinson
5,529,554 A 6/1996 Eschenbach
5,529,560 A 6/1996 Dise
5,531,658 A 7/1996 L. S. C.
5,533,899 A 7/1996 Young
5,533,948 A 7/1996 Wilkinson
5,533,951 A 7/1996 Chang
5,533,952 A 7/1996 Schaber
5,535,664 A 7/1996 Rokowski
5,538,486 A 7/1996 France et al.
5,538,489 A 7/1996 Magid
5,540,642 A 7/1996 Sprague
5,542,420 A 8/1996 Goldman
5,542,672 A 8/1996 Meredith
5,542,892 A 8/1996 Buhler
5,545,112 A 8/1996 Densmore et al.
5,545,114 A 8/1996 Gvoich
5,547,439 A 8/1996 Rawls et al.
5,549,052 A 8/1996 Hoffman
5,549,530 A 8/1996 Fulks
5,549,532 A 8/1996 Kropp
5,549,533 A 8/1996 Olson et al.
5,549,536 A 8/1996 Clark
5,551,934 A 9/1996 Binette
5,551,937 A 9/1996 Kwo
5,554,033 A 9/1996 Bizzi et al.
5,554,083 A 9/1996 Chen
5,554,085 A 9/1996 Dalebout
5,554,086 A 9/1996 Habing et al.
5,556,362 A 9/1996 Whipps
5,556,369 A 9/1996 Roberts
5,558,608 A 9/1996 Hall
5,562,572 A 10/1996 Carmein
5,562,574 A 10/1996 Miller
5,562,577 A 10/1996 Nichols, Sr. et al.
5,563,487 A 10/1996 Davis
5,568,993 A 10/1996 Potzick
5,569,120 A 10/1996 Anjanappa et al.
5,569,128 A 10/1996 Dalebout
5,569,133 A 10/1996 Vittone
5,569,138 A 10/1996 Wang et al.
5,571,064 A 11/1996 Holm
5,572,643 A 11/1996 Judson
5,573,485 A 11/1996 Geschwender
5,575,740 A 11/1996 Piaget
5,576,951 A 11/1996 Lockwood
5,577,186 A 11/1996 Mann, II et al.
5,577,981 A 11/1996 Jarvik
5,577,985 A 11/1996 Miller
5,577,987 A 11/1996 Brown
5,580,249 A 12/1996 Jacobsen et al.
5,580,340 A 12/1996 Yu
5,580,341 A 12/1996 Simonson
5,582,563 A 12/1996 Fan
5,582,565 A 12/1996 Soria
5,584,700 A 12/1996 Feldman et al.
5,584,779 A 12/1996 Knecht
5,584,784 A 12/1996 Wu
5,585,561 A 12/1996 Bahl et al.
5,585,583 A 12/1996 Owen
5,586,736 A 12/1996 Mollet
5,586,811 A 12/1996 Tornero
5,586,962 A 12/1996 Hallmark
5,588,938 A 12/1996 Schneider et al.
5,588,942 A 12/1996 Dillard
5,590,128 A 12/1996 Maloney et al.
5,590,181 A 12/1996 Hogan et al.
5,590,893 A 1/1997 Robinson et al.
5,591,104 A 1/1997 Andrus et al.
5,591,106 A 1/1997 Dalebout et al.
5,591,107 A 1/1997 Rodgers, Jr.
5,591,908 A 1/1997 Reid
5,593,372 A 1/1997 Rodgers, Jr.
5,593,380 A 1/1997 Bittikofer
5,595,545 A 1/1997 O'Brien
5,595,556 A 1/1997 Dalebout et al.
5,595,559 A 1/1997 Viel
5,597,362 A 1/1997 Lee
5,597,375 A 1/1997 Simonson
5,598,849 A 2/1997 Browne
5,599,261 A 2/1997 Easley et al.

(56) References Cited

U.S. PATENT DOCUMENTS

| | | | |
|---|---|---|---|
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,336 | A | 2/1997 | Gaoiran |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |
| 5,618,245 | A | 4/1997 | Trulaske et al. |
| 5,618,250 | A | 4/1997 | Butz |
| 5,619,412 | A | 4/1997 | Hapka |
| 5,619,991 | A | 4/1997 | Sloane |
| 5,620,402 | A | 4/1997 | Simonson |
| 5,620,403 | A | 4/1997 | Lundin |
| 5,622,527 | A | 4/1997 | Watterson et al. |
| 5,624,353 | A | 4/1997 | Naidus |
| 5,624,360 | A | 4/1997 | Wilkins |
| 5,624,361 | A | 4/1997 | Lai |
| 5,625,577 | A | 4/1997 | Kunii et al. |
| 5,626,539 | A | 5/1997 | Piaget |
| 5,626,546 | A | 5/1997 | Little |
| 5,626,548 | A | 5/1997 | Coyle |
| 5,628,715 | A | 5/1997 | Simonson |
| 5,628,716 | A | 5/1997 | Brice |
| 5,630,566 | A | 5/1997 | Case |
| 5,632,209 | A | 5/1997 | Sakakibara |
| 5,632,711 | A | 5/1997 | Hwang |
| 5,634,870 | A | 6/1997 | Wilkinson |
| 5,637,064 | A | 6/1997 | Olson et al. |
| 5,638,343 | A | 6/1997 | Ticknor |
| 5,643,142 | A | 7/1997 | Salerno et al. |
| 5,643,144 | A | 7/1997 | Trulaske |
| 5,643,146 | A | 7/1997 | Stark et al. |
| 5,643,147 | A | 7/1997 | Huang |
| 5,643,152 | A | 7/1997 | Simonson |
| 5,643,153 | A | 7/1997 | Nylen et al. |
| 5,643,157 | A | 7/1997 | Seliber |
| 5,643,162 | A | 7/1997 | Landers et al. |
| 5,645,509 | A | 7/1997 | Brewer et al. |
| 5,645,510 | A | 7/1997 | Wilkinson |
| 5,645,513 | A | 7/1997 | Haydocy et al. |
| 5,645,914 | A | 7/1997 | Horowitz |
| 5,649,882 | A | 7/1997 | Parikh et al. |
| 5,650,709 | A | 7/1997 | Rotunda et al. |
| 5,652,304 | A | 7/1997 | Calderon et al. |
| 5,652,824 | A | 7/1997 | Hirayama et al. |
| 5,653,662 | A | 8/1997 | Rodgers, Jr. |
| 5,653,669 | A | 8/1997 | Cheng |
| 5,655,945 | A | 8/1997 | Jani |
| 5,655,997 | A | 8/1997 | Greenberg et al. |
| 5,656,001 | A | 8/1997 | Baatz |
| 5,656,003 | A | 8/1997 | Robinson et al. |
| 5,658,227 | A | 8/1997 | Stearns |
| 5,659,691 | A | 8/1997 | Durward et al. |
| 5,662,557 | A | 9/1997 | Watterson et al. |
| 5,665,031 | A | 9/1997 | Hsieh |
| 5,665,033 | A | 9/1997 | Palmer |
| 5,665,041 | A | 9/1997 | Hsieh |
| 5,667,459 | A | 9/1997 | Su |
| 5,667,465 | A | 9/1997 | McCollum et al. |
| 5,669,455 | A | 9/1997 | Dietrich |
| 5,669,833 | A | 9/1997 | Stone |
| 5,669,857 | A | 9/1997 | Watterson et al. |
| 5,669,862 | A | 9/1997 | Sayman |
| 5,669,865 | A | 9/1997 | Gordon |
| 5,672,140 | A | 9/1997 | Watterson et al. |
| 5,674,156 | A | 10/1997 | Watterson et al. |
| 5,674,167 | A | 10/1997 | Piaget et al. |
| 5,674,453 | A | 10/1997 | Watterson et al. |
| 5,676,138 | A | 10/1997 | Zawilinski |
| 5,676,624 | A | 10/1997 | Watterson et al. |
| 5,679,047 | A | 10/1997 | Engel |
| 5,679,100 | A | 10/1997 | Charnitski |
| 5,679,101 | A | 10/1997 | Magid |
| 5,681,247 | A | 10/1997 | Webber |
| 5,681,249 | A | 10/1997 | Endelman |
| 5,683,332 | A | 11/1997 | Watterson et al. |
| 5,683,334 | A | 11/1997 | Webber |
| 5,685,804 | A | 11/1997 | Whan-Tong et al. |
| 5,685,810 | A | 11/1997 | Chung |
| 5,688,196 | A | 11/1997 | O'neil |
| 5,688,209 | A | 11/1997 | Trulaske et al. |
| 5,688,210 | A | 11/1997 | Chou |
| 5,688,212 | A | 11/1997 | Walker |
| 5,688,216 | A | 11/1997 | Mauriello |
| 5,690,582 | A | 11/1997 | Ulrich et al. |
| 5,690,587 | A | 11/1997 | Gruenangerl |
| 5,690,589 | A | 11/1997 | Rodgers, Jr. |
| 5,690,852 | A | 11/1997 | Saito et al. |
| 5,692,994 | A | 12/1997 | Eschenbach |
| 5,692,996 | A | 12/1997 | Widerman |
| 5,692,997 | A | 12/1997 | Stearns |
| 5,693,004 | A | 12/1997 | Carlson et al. |
| 5,695,400 | A | 12/1997 | Fennell, Jr. et al. |
| 5,695,434 | A | 12/1997 | Dalebout et al. |
| 5,695,436 | A | 12/1997 | Huang |
| 5,697,834 | A | 12/1997 | Heumann et al. |
| 5,702,323 | A | 12/1997 | Poulton |
| 5,702,325 | A | 12/1997 | Watterson et al. |
| 5,704,875 | A | 1/1998 | Tanabe |
| 5,704,879 | A | 1/1998 | Watterson et al. |
| 5,707,168 | A | 1/1998 | Sharon |
| 5,707,319 | A | 1/1998 | Riley |
| 5,708,355 | A | 1/1998 | Schrey |
| 5,709,428 | A | 1/1998 | Hugghins |
| 5,709,632 | A | 1/1998 | Socwell |
| 5,709,633 | A | 1/1998 | Sokol |
| 5,709,634 | A | 1/1998 | Pointer |
| 5,709,636 | A | 1/1998 | Vallone |
| 5,709,638 | A | 1/1998 | Mackert et al. |
| 5,710,884 | A | 1/1998 | Dedrick |
| 5,711,745 | A | 1/1998 | Yang |
| 5,711,746 | A | 1/1998 | Carlson |
| 5,711,749 | A | 1/1998 | Miller |
| 5,713,549 | A | 2/1998 | Shieh |
| 5,713,794 | A | 2/1998 | Shimojima et al. |
| 5,713,821 | A | 2/1998 | Nissen |
| 5,716,308 | A | 2/1998 | Lee |
| 5,718,657 | A | 2/1998 | Dalebout et al. |
| 5,718,660 | A | 2/1998 | Chen |
| 5,719,825 | A | 2/1998 | Dotter |
| 5,720,200 | A | 2/1998 | Anderson et al. |
| 5,720,474 | A | 2/1998 | Sugiyama |
| 5,720,702 | A | 2/1998 | Lee |
| 5,720,771 | A | 2/1998 | Snell |
| 5,721,539 | A | 2/1998 | Goetzl |
| 5,722,418 | A | 3/1998 | Bro |
| 5,722,420 | A | 3/1998 | Lee |
| 5,722,917 | A | 3/1998 | Olschansky et al. |
| 5,722,920 | A | 3/1998 | Bauer |
| 5,722,921 | A | 3/1998 | Simonson |
| 5,722,922 | A | 3/1998 | Watterson et al. |
| 5,724,025 | A | 3/1998 | Tavori |
| 5,725,459 | A | 3/1998 | Rexach |
| 5,725,463 | A | 3/1998 | Colonello et al. |
| 5,730,236 | A | 3/1998 | Miller et al. |
| 5,733,227 | A | 3/1998 | Lee |
| 5,733,228 | A | 3/1998 | Stevens |
| 5,733,229 | A | 3/1998 | Dalebout et al. |
| 5,733,232 | A | 3/1998 | Hsu |
| 5,734,625 | A | 3/1998 | Kondo |
| 5,735,586 | A | 4/1998 | Cheng |
| 5,735,773 | A | 4/1998 | Vittone |
| 5,735,776 | A | 4/1998 | Swezey |
| 5,738,612 | A | 4/1998 | Tsuda |

(56) References Cited

U.S. PATENT DOCUMENTS

| | | | |
|---|---|---|---|
| 5,738,616 | A | 4/1998 | Robertson |
| 5,739,457 | A | 4/1998 | Devecka |
| 5,741,205 | A | 4/1998 | Doll et al. |
| 5,743,193 | A | 4/1998 | Kakuta et al. |
| 5,743,832 | A | 4/1998 | Sands et al. |
| 5,743,833 | A | 4/1998 | Watterson et al. |
| 5,743,835 | A | 4/1998 | Trotter |
| 5,746,682 | A | 5/1998 | Hung |
| 5,746,687 | A | 5/1998 | Vial et al. |
| 5,746,688 | A | 5/1998 | Prager |
| 5,749,372 | A | 5/1998 | Allen |
| 5,749,668 | A | 5/1998 | Mcilvain |
| 5,749,787 | A | 5/1998 | Jank |
| 5,749,807 | A | 5/1998 | Webb |
| 5,749,809 | A | 5/1998 | Lin |
| 5,749,813 | A | 5/1998 | Domzalski |
| 5,752,879 | A | 5/1998 | Berdut |
| 5,752,883 | A | 5/1998 | Butcher et al. |
| 5,752,897 | A | 5/1998 | Skowronski et al. |
| 5,752,901 | A | 5/1998 | Lee |
| 5,754,765 | A | 5/1998 | Danneels et al. |
| 5,755,642 | A | 5/1998 | Miller |
| 5,755,645 | A | 5/1998 | Miller et al. |
| 5,755,646 | A | 5/1998 | Chu |
| 5,755,651 | A | 5/1998 | Homyonfer |
| 5,755,823 | A | 5/1998 | Cleary |
| 5,759,136 | A | 6/1998 | Chen |
| 5,759,139 | A | 6/1998 | Wright |
| 5,759,199 | A | 6/1998 | Snell et al. |
| 5,760,353 | A | 6/1998 | Rapp |
| 5,761,831 | A | 6/1998 | Cho |
| 5,762,503 | A | 6/1998 | Hoo et al. |
| 5,762,587 | A | 6/1998 | Dalebout et al. |
| 5,762,588 | A | 6/1998 | Chen |
| 5,766,118 | A | 6/1998 | Conner |
| 5,769,755 | A | 6/1998 | Henry et al. |
| 5,769,759 | A | 6/1998 | Alter |
| 5,769,762 | A | 6/1998 | Towley, III et al. |
| 5,771,152 | A | 6/1998 | Crompton et al. |
| 5,771,354 | A | 6/1998 | Crawford |
| 5,772,508 | A | 6/1998 | Sugita et al. |
| 5,772,522 | A | 6/1998 | Nesbit |
| 5,772,558 | A | 6/1998 | Rodgers, Jr. |
| 5,772,560 | A | 6/1998 | Watterson et al. |
| 5,772,563 | A | 6/1998 | Lin |
| 5,776,040 | A | 7/1998 | Webb et al. |
| 5,776,582 | A | 7/1998 | Needham |
| 5,777,678 | A | 7/1998 | Ogata et al. |
| 5,779,596 | A | 7/1998 | Weber |
| 5,779,599 | A | 7/1998 | Chen |
| 5,779,604 | A | 7/1998 | Towley, III et al. |
| 5,779,607 | A | 7/1998 | Harris |
| 5,782,639 | A | 7/1998 | Beal |
| 5,782,723 | A | 7/1998 | Kuo |
| 5,785,630 | A | 7/1998 | Bobick et al. |
| 5,785,631 | A | 7/1998 | Heidecke |
| 5,785,632 | A | 7/1998 | Greenberg et al. |
| 5,788,609 | A | 8/1998 | Miller |
| 5,788,610 | A | 8/1998 | Eschenbach |
| 5,788,611 | A | 8/1998 | Kuo |
| 5,788,616 | A | 8/1998 | Polidi |
| 5,788,618 | A | 8/1998 | Joutras |
| 5,790,785 | A | 8/1998 | Klug et al. |
| 5,792,027 | A | 8/1998 | Gvoich |
| 5,792,028 | A | 8/1998 | Jarvie |
| 5,792,029 | A | 8/1998 | Gordon |
| 5,792,031 | A | 8/1998 | Alton |
| 5,792,034 | A | 8/1998 | Kozlovsky |
| 5,794,210 | A | 8/1998 | Goldhaber et al. |
| 5,795,270 | A | 8/1998 | Woods et al. |
| 5,795,274 | A | 8/1998 | Kasbohm |
| 5,797,578 | A | 8/1998 | Graffeo |
| 5,797,639 | A | 8/1998 | Zorzenon |
| 5,797,805 | A | 8/1998 | Lubell et al. |
| 5,799,281 | A | 8/1998 | Login et al. |
| 5,800,310 | A | 9/1998 | Jones |
| 5,800,321 | A | 9/1998 | Webber |
| 5,800,323 | A | 9/1998 | Ansel |
| 5,803,870 | A | 9/1998 | Buhler |
| 5,803,874 | A | 9/1998 | Wilkinson |
| 5,803,877 | A | 9/1998 | Franey |
| 5,803,882 | A | 9/1998 | Habing et al. |
| 5,807,210 | A | 9/1998 | Devlin |
| 5,807,214 | A | 9/1998 | Riazi |
| 5,810,696 | A | 9/1998 | Webb |
| 5,810,697 | A | 9/1998 | Joiner |
| 5,810,698 | A | 9/1998 | Hullett et al. |
| 5,810,702 | A | 9/1998 | Wilkinson |
| 5,810,747 | A | 9/1998 | Brudny et al. |
| 5,813,142 | A | 9/1998 | Demon |
| 5,813,864 | A | 9/1998 | Ikuta |
| 5,813,945 | A | 9/1998 | Bernacki |
| 5,813,947 | A | 9/1998 | Densmore |
| 5,813,953 | A | 9/1998 | Whipple |
| 5,816,372 | A | 10/1998 | Carlson et al. |
| 5,816,443 | A | 10/1998 | Bustos |
| 5,816,981 | A | 10/1998 | Hung |
| 5,816,983 | A | 10/1998 | Dawes et al. |
| 5,820,478 | A | 10/1998 | Wood et al. |
| 5,820,525 | A | 10/1998 | Riley |
| 5,820,529 | A | 10/1998 | Weintraub |
| 5,820,532 | A | 10/1998 | Oliver |
| 5,823,618 | A | 10/1998 | Fox et al. |
| 5,823,913 | A | 10/1998 | Aruin |
| 5,825,983 | A | 10/1998 | Park et al. |
| 5,827,154 | A | 10/1998 | Gill |
| 5,827,155 | A | 10/1998 | Jensen et al. |
| 5,827,158 | A | 10/1998 | Drecksel |
| 5,829,771 | A | 11/1998 | Hsu |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,582 | A | 11/1998 | Chen |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,836,854 | A | 11/1998 | Kuo |
| 5,836,858 | A | 11/1998 | Sharff |
| 5,838,906 | A | 11/1998 | Doyle et al. |
| 5,839,990 | A | 11/1998 | Virkkala |
| 5,839,993 | A | 11/1998 | Fox |
| 5,839,997 | A | 11/1998 | Roth et al. |
| 5,842,956 | A | 12/1998 | Strachan |
| 5,842,961 | A | 12/1998 | Davis |
| 5,845,230 | A | 12/1998 | Lamberson |
| 5,846,166 | A | 12/1998 | Kuo |
| 5,848,396 | A | 12/1998 | Gerace |
| 5,848,954 | A | 12/1998 | Stearns et al. |
| 5,852,264 | A | 12/1998 | Muller |
| 5,854,833 | A | 12/1998 | Hogan et al. |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,942 | A | 1/1999 | Moon et al. |
| 5,857,943 | A | 1/1999 | Murray |
| 5,860,190 | A | 1/1999 | Cano |
| 5,860,893 | A | 1/1999 | Watterson et al. |
| 5,860,894 | A | 1/1999 | Dalebout et al. |
| 5,860,899 | A | 1/1999 | Rassman |
| 5,864,018 | A | 1/1999 | Morser et al. |
| 5,865,710 | A | 2/1999 | Wilson-Hyde |
| 5,865,714 | A | 2/1999 | Marlowe |
| 5,865,733 | A | 2/1999 | Malinouskas et al. |
| 5,868,108 | A | 2/1999 | Schmitz et al. |
| 5,868,648 | A | 2/1999 | Coody et al. |
| 5,868,653 | A | 2/1999 | Klasen |
| 5,871,421 | A | 2/1999 | Trulaske et al. |
| 5,871,424 | A | 2/1999 | Conner |
| 5,873,369 | A | 2/1999 | Laniado et al. |
| 5,876,095 | A | 3/1999 | Johnston |

(56) References Cited

U.S. PATENT DOCUMENTS

| | | | |
|---|---|---|---|
| 5,876,310 | A | 3/1999 | Mackey et al. |
| 5,876,313 | A | 3/1999 | Krull |
| 5,879,247 | A | 3/1999 | Winter et al. |
| 5,879,270 | A | 3/1999 | Huish et al. |
| 5,879,271 | A | 3/1999 | Stearns et al. |
| 5,879,273 | A | 3/1999 | Wei |
| 5,879,276 | A | 3/1999 | Miller |
| 5,880,677 | A | 3/1999 | Lestician |
| 5,882,281 | A | 3/1999 | Stearns et al. |
| 5,885,196 | A | 3/1999 | Gvoich |
| 5,885,197 | A | 3/1999 | Barton |
| 5,888,172 | A | 3/1999 | Andrus et al. |
| 5,890,149 | A | 3/1999 | Schmonsees |
| 5,890,562 | A | 4/1999 | Bartels et al. |
| 5,890,906 | A | 4/1999 | Macri |
| 5,890,995 | A | 4/1999 | Bobick et al. |
| 5,890,996 | A | 4/1999 | Frame et al. |
| 5,890,997 | A | 4/1999 | Roth |
| 5,891,001 | A | 4/1999 | Carnes et al. |
| 5,891,003 | A | 4/1999 | Deac et al. |
| 5,891,004 | A | 4/1999 | Berry |
| 5,891,042 | A | 4/1999 | Sham et al. |
| 5,895,339 | A | 4/1999 | Maresh |
| 5,895,340 | A | 4/1999 | Keller |
| 5,895,342 | A | 4/1999 | Solland |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,897,467 | A | 4/1999 | Habing et al. |
| 5,897,469 | A | 4/1999 | Yalch |
| 5,897,472 | A | 4/1999 | Thulasingam |
| 5,897,474 | A | 4/1999 | Romero |
| 5,899,833 | A | 5/1999 | Ryan et al. |
| 5,899,834 | A | 5/1999 | Dalebout et al. |
| 5,899,963 | A | 5/1999 | Hutchings |
| 5,902,214 | A | 5/1999 | Makikawa et al. |
| 5,904,398 | A | 5/1999 | Farricielli |
| 5,904,636 | A | 5/1999 | Chen |
| 5,904,638 | A | 5/1999 | Habing et al. |
| 5,905,442 | A | 5/1999 | Mosebrook et al. |
| 5,906,269 | A | 5/1999 | Zabron et al. |
| 5,906,494 | A | 5/1999 | Ogawa et al. |
| 5,906,564 | A | 5/1999 | Jacobsen |
| 5,906,566 | A | 5/1999 | Whitcomb |
| 5,906,581 | A | 5/1999 | Tsuda |
| 5,908,373 | A | 6/1999 | Pitre |
| 5,909,544 | A | 6/1999 | Anderson, II et al. |
| 5,910,070 | A | 6/1999 | Henry et al. |
| 5,910,072 | A | 6/1999 | Rawls et al. |
| 5,910,073 | A | 6/1999 | Conner |
| 5,911,044 | A | 6/1999 | Lo et al. |
| 5,911,132 | A | 6/1999 | Sloane |
| 5,911,649 | A | 6/1999 | Miller |
| 5,911,687 | A | 6/1999 | Sato et al. |
| 5,913,310 | A | 6/1999 | Brown |
| 5,913,751 | A | 6/1999 | Eschenbach |
| 5,913,830 | A | 6/1999 | Miles |
| 5,916,063 | A | 6/1999 | Alessandri |
| 5,916,064 | A | 6/1999 | Eschenbach |
| 5,916,065 | A | 6/1999 | McBride et al. |
| 5,916,069 | A | 6/1999 | Wang |
| 5,917,405 | A | 6/1999 | Joao |
| 5,917,692 | A | 6/1999 | Schmitz et al. |
| 5,919,117 | A | 7/1999 | Thompson et al. |
| 5,919,118 | A | 7/1999 | Stearns |
| 5,921,891 | A | 7/1999 | Browne |
| 5,921,892 | A | 7/1999 | Easton |
| 5,921,896 | A | 7/1999 | Boland |
| 5,921,901 | A | 7/1999 | Palacios |
| 5,924,966 | A | 7/1999 | Havlovic |
| 5,925,001 | A | 7/1999 | Hoyt et al. |
| 5,927,780 | A | 7/1999 | Chandler |
| 5,928,116 | A | 7/1999 | Chiang |
| 5,929,748 | A | 7/1999 | Odinak |
| 5,929,782 | A | 7/1999 | Stark |
| 5,929,848 | A | 7/1999 | Albukerk et al. |
| 5,931,763 | A | 8/1999 | Alessandri |
| 5,931,767 | A | 8/1999 | Morales |
| 5,935,048 | A | 8/1999 | Krull |
| 5,937,387 | A | 8/1999 | Summerell et al. |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,574 | A | 8/1999 | Webber |
| 5,938,575 | A | 8/1999 | Stearns |
| 5,940,502 | A | 8/1999 | Hirai et al. |
| 5,940,911 | A | 8/1999 | Wang |
| 5,941,797 | A | 8/1999 | Kashiwaguchi |
| 5,941,800 | A | 8/1999 | Laconis |
| 5,941,803 | A | 8/1999 | Chamberlain |
| 5,941,807 | A | 8/1999 | Cassidy |
| 5,943,794 | A | 8/1999 | Gelsomini |
| 5,944,638 | A | 8/1999 | Maresh |
| 5,944,641 | A | 8/1999 | Habing |
| 5,944,642 | A | 8/1999 | Krull |
| 5,947,868 | A | 9/1999 | Dugan |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,954,106 | A | 9/1999 | Huang |
| 5,954,621 | A | 9/1999 | Joutras et al. |
| 5,956,509 | A | 9/1999 | Kevner |
| 5,957,699 | A | 9/1999 | Peterson et al. |
| 5,957,814 | A | 9/1999 | Eschenbach |
| 5,957,819 | A | 9/1999 | Cortesi |
| 5,961,423 | A | 10/1999 | Sellers |
| 5,961,428 | A | 10/1999 | Webber |
| 5,961,430 | A | 10/1999 | Zuckerman et al. |
| 5,961,561 | A | 10/1999 | Wakefield, II |
| 5,961,593 | A | 10/1999 | Gabber et al. |
| 5,964,684 | A | 10/1999 | Sokol |
| 5,964,701 | A | 10/1999 | Asada et al. |
| 5,967,944 | A | 10/1999 | Vittone et al. |
| 5,967,948 | A | 10/1999 | Carr |
| 5,967,950 | A | 10/1999 | Hsu |
| 5,967,954 | A | 10/1999 | Habing |
| 5,967,955 | A | 10/1999 | Westfall et al. |
| 5,967,975 | A | 10/1999 | Ridgeway |
| 5,970,340 | A | 10/1999 | Edgar |
| 5,971,892 | A | 10/1999 | Lee |
| 5,971,895 | A | 10/1999 | Habing |
| 5,971,902 | A | 10/1999 | Robertson et al. |
| 5,973,696 | A | 10/1999 | Agranat et al. |
| 5,976,039 | A | 11/1999 | Epel et al. |
| 5,976,061 | A | 11/1999 | Moon et al. |
| 5,976,083 | A | 11/1999 | Richardson et al. |
| 5,980,429 | A | 11/1999 | Nashner |
| 5,980,430 | A | 11/1999 | Wang |
| 5,980,432 | A | 11/1999 | Ahman |
| 5,981,168 | A | 11/1999 | Reiner et al. |
| 5,984,798 | A | 11/1999 | Gilmour |
| 5,984,836 | A | 11/1999 | Casali |
| 5,984,839 | A | 11/1999 | Corkum |
| 5,989,161 | A | 11/1999 | Wang et al. |
| 5,989,163 | A | 11/1999 | Rodgers, Jr. |
| 5,989,164 | A | 11/1999 | Kullman et al. |
| 5,989,165 | A | 11/1999 | Giannelli et al. |
| 5,989,166 | A | 11/1999 | Capizzo et al. |
| 5,989,168 | A | 11/1999 | See |
| 5,990,405 | A | 11/1999 | Auten et al. |
| 5,991,143 | A | 11/1999 | Wright et al. |
| 5,993,356 | A | 11/1999 | Houston et al. |
| 5,993,358 | A | 11/1999 | Gureghian et al. |
| 5,993,359 | A | 11/1999 | Eschenbach |
| 5,993,362 | A | 11/1999 | Ghobadi |
| 5,995,868 | A | 11/1999 | Dorfmeister et al. |
| 5,997,447 | A | 12/1999 | Giannelli et al. |
| 5,997,450 | A | 12/1999 | Wilkinson |
| 5,997,476 | A | 12/1999 | Brown |

(56) References Cited

U.S. PATENT DOCUMENTS

| | | | |
|---|---|---|---|
| 5,998,897 | A | 12/1999 | Bosten et al. |
| 6,002,982 | A | 12/1999 | Fry |
| 6,003,294 | A | 12/1999 | Fitzgerald et al. |
| 6,003,481 | A | 12/1999 | Pischinger et al. |
| 6,004,243 | A | 12/1999 | Ewert |
| 6,004,244 | A | 12/1999 | Simonson |
| 6,004,246 | A | 12/1999 | Sencil |
| 6,004,247 | A | 12/1999 | Webber |
| 6,006,379 | A | 12/1999 | Hensley |
| 6,007,268 | A | 12/1999 | Whittington et al. |
| 6,010,432 | A | 1/2000 | Vawter |
| 6,010,451 | A | 1/2000 | Clawson |
| 6,011,134 | A | 1/2000 | Marks et al. |
| 6,012,591 | A | 1/2000 | Brandenberg |
| 6,012,772 | A | 1/2000 | Conde et al. |
| 6,013,007 | A | 1/2000 | Root et al. |
| 6,013,009 | A | 1/2000 | Karkanen |
| 6,013,011 | A | 1/2000 | Moore et al. |
| 6,014,432 | A | 1/2000 | Modney |
| 6,014,634 | A | 1/2000 | Scroggie et al. |
| 6,015,367 | A | 1/2000 | Scaramucci |
| 6,015,368 | A | 1/2000 | Clem |
| 6,015,371 | A | 1/2000 | Davitt |
| 6,017,293 | A | 1/2000 | Pfefferle |
| 6,018,705 | A | 1/2000 | Gaudet et al. |
| 6,019,403 | A | 2/2000 | Corbett |
| 6,022,300 | A | 2/2000 | Hightower |
| 6,022,302 | A | 2/2000 | McBride |
| 6,024,677 | A | 2/2000 | Siwertz |
| 6,027,428 | A | 2/2000 | Thomas et al. |
| 6,027,429 | A | 2/2000 | Daniels |
| 6,027,430 | A | 2/2000 | Stearns et al. |
| 6,027,432 | A | 2/2000 | Cheng |
| 6,027,433 | A | 2/2000 | Flynn |
| 6,029,858 | A | 2/2000 | Srokose |
| 6,030,320 | A | 2/2000 | Stearns |
| 6,030,323 | A | 2/2000 | Fontenot |
| 6,033,227 | A | 3/2000 | Ishige |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,036,625 | A | 3/2000 | Woodruff |
| 6,039,677 | A | 3/2000 | Spletzer |
| 6,039,678 | A | 3/2000 | Dawson |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,519 | A | 3/2000 | Shea |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,822 | A | 4/2000 | Faughn |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,050,924 | A | 4/2000 | Shea |
| 6,050,942 | A | 4/2000 | Rust et al. |
| 6,053,737 | A | 4/2000 | Babbitt et al. |
| 6,053,816 | A | 4/2000 | Immel |
| 6,053,844 | A | 4/2000 | Clem |
| 6,053,847 | A | 4/2000 | Stearns et al. |
| 6,053,848 | A | 4/2000 | Eschenbach |
| 6,053,853 | A | 4/2000 | Hinds |
| 6,055,513 | A | 4/2000 | Katz et al. |
| 6,055,573 | A | 4/2000 | Gardenswartz et al. |
| 6,055,747 | A | 5/2000 | Lombardino |
| 6,056,670 | A | 5/2000 | Shu et al. |
| 6,056,678 | A | 5/2000 | Giannelli et al. |
| 6,059,576 | A | 5/2000 | Brann |
| 6,059,692 | A | 5/2000 | Hickman |
| 6,059,695 | A | 5/2000 | Hung |
| 6,059,698 | A | 5/2000 | Mazor |
| 6,059,701 | A | 5/2000 | George et al. |
| 6,063,009 | A | 5/2000 | Stearns |
| 6,065,572 | A | 5/2000 | Schober et al. |
| 6,066,075 | A | 5/2000 | Poulton |
| 6,066,077 | A | 5/2000 | Horst |
| 6,066,705 | A | 5/2000 | Calderon et al. |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,071,217 | A | 6/2000 | Barnett |
| 6,074,328 | A | 6/2000 | Johnson |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,079,915 | A | 6/2000 | Bosten et al. |
| 6,080,091 | A | 6/2000 | Habing et al. |
| 6,082,346 | A | 7/2000 | Andrews et al. |
| 6,083,144 | A | 7/2000 | Towley, III et al. |
| 6,086,379 | A | 7/2000 | Pendergast et al. |
| 6,086,520 | A | 7/2000 | Rodriquez |
| 6,086,521 | A | 7/2000 | Solland |
| 6,090,014 | A | 7/2000 | Eschenbach |
| 6,090,016 | A | 7/2000 | Kuo |
| 6,090,017 | A | 7/2000 | Wang |
| 6,090,020 | A | 7/2000 | Webber |
| 6,095,951 | A | 8/2000 | Skowronski et al. |
| 6,095,954 | A | 8/2000 | Svanberg |
| 6,099,439 | A | 8/2000 | Ryan et al. |
| 6,099,442 | A | 8/2000 | Krull |
| 6,099,444 | A | 8/2000 | Domenge |
| 6,101,684 | A | 8/2000 | Ginocchio |
| 6,102,412 | A | 8/2000 | Staffaroni |
| 6,102,832 | A | 8/2000 | Tani |
| 6,102,836 | A | 8/2000 | Person |
| 6,102,837 | A | 8/2000 | Hubbard |
| 6,102,846 | A | 8/2000 | Patton et al. |
| 6,103,203 | A | 8/2000 | Fischer |
| 6,106,297 | A | 8/2000 | Pollak et al. |
| 6,106,437 | A | 8/2000 | Brooks |
| 6,106,439 | A | 8/2000 | Boland |
| 6,110,075 | A | 8/2000 | Woodruff |
| 6,110,076 | A | 8/2000 | Hurt |
| 6,110,077 | A | 8/2000 | Yu |
| 6,110,081 | A | 8/2000 | Barrett |
| 6,112,624 | A | 9/2000 | Chen |
| 6,113,188 | A | 9/2000 | Stewart et al. |
| 6,113,323 | A | 9/2000 | Bosten et al. |
| 6,113,518 | A | 9/2000 | Maresh |
| 6,113,522 | A | 9/2000 | Montgomery |
| 6,113,537 | A | 9/2000 | Castano |
| 6,113,564 | A | 9/2000 | McGuire |
| 6,117,049 | A | 9/2000 | Lowe |
| 6,120,421 | A | 9/2000 | Kuo |
| 6,120,424 | A | 9/2000 | Arline |
| 6,122,340 | A | 9/2000 | Darley et al. |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,126,577 | A | 10/2000 | Chang |
| 6,128,663 | A | 10/2000 | Thomas |
| 6,128,981 | A | 10/2000 | Bondhus et al. |
| 6,129,651 | A | 10/2000 | Denaro |
| 6,129,962 | A | 10/2000 | Quigley et al. |
| 6,132,337 | A | 10/2000 | Krupka et al. |
| 6,132,340 | A | 10/2000 | Wang |
| 6,132,347 | A | 10/2000 | Alessandri |
| 6,133,610 | A | 10/2000 | Bolam et al. |

(56) References Cited

U.S. PATENT DOCUMENTS

| | | | |
|---|---|---|---|
| 6,135,924 | A | 10/2000 | Gibbs et al. |
| 6,135,925 | A | 10/2000 | Liu |
| 6,135,926 | A | 10/2000 | Lee |
| 6,135,927 | A | 10/2000 | Lo |
| 6,142,870 | A | 11/2000 | Wada et al. |
| 6,142,912 | A | 11/2000 | Profaci |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,148,262 | A | 11/2000 | Fry |
| 6,149,551 | A | 11/2000 | Pyles et al. |
| 6,149,552 | A | 11/2000 | Chen |
| 6,149,556 | A | 11/2000 | Jordan |
| 6,149,558 | A | 11/2000 | Chen |
| 6,149,559 | A | 11/2000 | Mackey |
| 6,151,586 | A | 11/2000 | Brown |
| 6,152,854 | A | 11/2000 | Carmein |
| 6,152,856 | A | 11/2000 | Studor et al. |
| 6,152,859 | A | 11/2000 | Stearns |
| 6,152,864 | A | 11/2000 | Giannelli et al. |
| 6,159,131 | A | 12/2000 | Pfeffer |
| 6,162,151 | A | 12/2000 | Tani et al. |
| 6,162,153 | A | 12/2000 | Perez, Jr. |
| 6,162,183 | A | 12/2000 | Hoover |
| 6,162,189 | A | 12/2000 | Girone et al. |
| 6,163,451 | A | 12/2000 | Chiu |
| 6,165,107 | A | 12/2000 | Birrell |
| 6,165,110 | A | 12/2000 | Gajda |
| 6,168,551 | B1 | 1/2001 | Mcguinness |
| 6,168,557 | B1 | 1/2001 | Liao |
| 6,171,186 | B1 | 1/2001 | Kurosawa et al. |
| 6,171,216 | B1 | 1/2001 | Wang |
| 6,171,218 | B1 | 1/2001 | Shea |
| 6,172,178 | B1 | 1/2001 | Koning et al. |
| 6,174,265 | B1 | 1/2001 | Alessandri |
| 6,174,267 | B1 | 1/2001 | Dalebout |
| 6,174,268 | B1 | 1/2001 | Novak |
| 6,175,608 | B1 | 1/2001 | Pyles et al. |
| 6,175,994 | B1 | 1/2001 | Nicoletti |
| 6,176,241 | B1 | 1/2001 | Blau et al. |
| 6,176,814 | B1 | 1/2001 | Ryan et al. |
| 6,179,746 | B1 | 1/2001 | Delman |
| 6,179,748 | B1 | 1/2001 | Barr |
| 6,179,753 | B1 | 1/2001 | Barker et al. |
| 6,181,647 | B1 | 1/2001 | Tipton et al. |
| 6,183,259 | B1 | 2/2001 | Macri et al. |
| 6,183,397 | B1 | 2/2001 | Stearns et al. |
| 6,183,400 | B1 | 2/2001 | Pope |
| 6,183,401 | B1 | 2/2001 | Krull |
| 6,183,403 | B1 | 2/2001 | Dunn |
| 6,183,425 | B1 | 2/2001 | Whalen |
| 6,186,145 | B1 | 2/2001 | Brown |
| 6,186,290 | B1 | 2/2001 | Carlson |
| 6,186,460 | B1 | 2/2001 | Lin |
| 6,186,926 | B1 | 2/2001 | Ellis |
| 6,186,927 | B1 | 2/2001 | Krull |
| 6,186,928 | B1 | 2/2001 | Chen |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,631 | B1 | 2/2001 | Hickman |
| 6,193,635 | B1 | 2/2001 | Webber et al. |
| 6,196,952 | B1 | 3/2001 | Chen |
| 6,196,954 | B1 | 3/2001 | Chen |
| 6,198,394 | B1 | 3/2001 | Jacobsen et al. |
| 6,199,732 | B1 | 3/2001 | Swetish |
| 6,203,473 | B1 | 3/2001 | Atwood |
| 6,203,474 | B1 | 3/2001 | Jones |
| 6,206,795 | B1 | 3/2001 | Ou |
| 6,206,804 | B1 | 3/2001 | Maresh |
| 6,210,305 | B1 | 4/2001 | Eschenbach |
| 6,211,451 | B1 | 4/2001 | Tohgi et al. |
| 6,213,919 | B1 | 4/2001 | Wang |
| 6,213,923 | B1 | 4/2001 | Cameron et al. |
| 6,215,870 | B1 | 4/2001 | Hirai et al. |
| 6,217,483 | B1 | 4/2001 | Kallassy |
| 6,217,487 | B1 | 4/2001 | Reinert |
| 6,217,493 | B1 | 4/2001 | Spletzer |
| 6,217,495 | B1 | 4/2001 | Yalch |
| 6,220,865 | B1 | 4/2001 | Macri et al. |
| 6,220,990 | B1 | 4/2001 | Crivello |
| 6,220,992 | B1 | 4/2001 | Shafik |
| 6,220,995 | B1 | 4/2001 | Chen |
| 6,221,451 | B1 | 4/2001 | Lauer et al. |
| 6,221,667 | B1 | 4/2001 | Reiner et al. |
| 6,224,387 | B1 | 5/2001 | Jones |
| 6,224,516 | B1 | 5/2001 | Disch |
| 6,224,519 | B1 | 5/2001 | Doolittle |
| 6,225,977 | B1 | 5/2001 | Li |
| 6,227,968 | B1 | 5/2001 | Suzuki et al. |
| 6,228,003 | B1 | 5/2001 | Hald et al. |
| 6,230,047 | B1 | 5/2001 | McHugh |
| 6,230,460 | B1 | 5/2001 | Huyett |
| 6,230,501 | B1 | 5/2001 | Bailey, Sr. et al. |
| 6,231,481 | B1 | 5/2001 | Brock |
| 6,231,482 | B1 | 5/2001 | Thompson |
| 6,231,489 | B1 | 5/2001 | McBride et al. |
| 6,231,946 | B1 | 5/2001 | Brown, Jr. et al. |
| 6,234,935 | B1 | 5/2001 | Chu |
| 6,234,936 | B1 | 5/2001 | Wang |
| 6,234,941 | B1 | 5/2001 | Chu |
| 6,237,583 | B1 | 5/2001 | Ripley et al. |
| 6,238,322 | B1 | 5/2001 | Hsu |
| 6,241,524 | B1 | 6/2001 | Aoshima et al. |
| 6,241,553 | B1 | 6/2001 | Hsia |
| 6,241,638 | B1 | 6/2001 | Hurt |
| 6,244,987 | B1 | 6/2001 | Ohsuga et al. |
| 6,244,988 | B1 | 6/2001 | Delman |
| 6,244,992 | B1 | 6/2001 | James |
| 6,244,995 | B1 | 6/2001 | Prsala |
| 6,245,001 | B1 | 6/2001 | Siaperas |
| 6,251,047 | B1 | 6/2001 | Stearns et al. |
| 6,251,048 | B1 | 6/2001 | Kaufman |
| 6,251,052 | B1 | 6/2001 | Simonson |
| 6,252,153 | B1 | 6/2001 | Toyama |
| 6,254,513 | B1 | 7/2001 | Takenaka et al. |
| 6,254,514 | B1 | 7/2001 | Maresh et al. |
| 6,254,515 | B1 | 7/2001 | Carman et al. |
| 6,254,516 | B1 | 7/2001 | Giannelli et al. |
| 6,259,944 | B1 | 7/2001 | Margulis et al. |
| 6,260,970 | B1 | 7/2001 | Horn |
| 6,261,022 | B1 | 7/2001 | Dalebout et al. |
| 6,261,209 | B1 | 7/2001 | Coody |
| 6,264,272 | B1 | 7/2001 | Jones et al. |
| 6,264,586 | B1 | 7/2001 | Webber |
| 6,264,588 | B1 | 7/2001 | Ellis |
| 6,267,710 | B1 | 7/2001 | Liu |
| 6,267,711 | B1 | 7/2001 | Hinds |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,278,378 | B1 | 8/2001 | Feiner et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,760 | B1 | 9/2001 | Wakamoto |
| 6,283,859 | B1 | 9/2001 | Carlson et al. |
| 6,283,896 | B1 | 9/2001 | Grunfeld |
| 6,287,239 | B1 | 9/2001 | Hernandez |
| 6,287,240 | B1 | 9/2001 | Trabbic |
| 6,287,241 | B1 | 9/2001 | Ellis |
| 6,290,630 | B1 | 9/2001 | Boland |
| 6,292,688 | B1 | 9/2001 | Patton |
| 6,293,375 | B1 | 9/2001 | Chen |
| 6,293,802 | B1 | 9/2001 | Ahlgren |
| 6,293,892 | B1 | 9/2001 | Slawinski et al. |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |

(56) References Cited

U.S. PATENT DOCUMENTS

| | | | |
|---|---|---|---|
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,308,565 | B1 | 10/2001 | French |
| 6,309,331 | B1 | 10/2001 | Raymond |
| 6,312,363 | B1 | 11/2001 | Watterson et al. |
| 6,312,366 | B1 | 11/2001 | Prusick |
| 6,313,363 | B1 | 11/2001 | Joly et al. |
| 6,314,058 | B1 | 11/2001 | Lee |
| 6,314,667 | B1 | 11/2001 | Rife et al. |
| 6,315,486 | B1 | 11/2001 | Lunz |
| 6,315,702 | B1 | 11/2001 | Ikonomopoulos |
| 6,317,151 | B1 | 11/2001 | Ohsuga et al. |
| 6,319,176 | B1 | 11/2001 | Landfair |
| 6,319,178 | B1 | 11/2001 | Webber |
| 6,319,179 | B1 | 11/2001 | Hinds |
| 6,322,059 | B1 | 11/2001 | Kelm et al. |
| 6,322,451 | B1 | 11/2001 | Miura |
| 6,322,481 | B1 | 11/2001 | Krull |
| 6,322,483 | B1 | 11/2001 | Rotella |
| 6,325,745 | B1 | 12/2001 | Yu |
| 6,325,746 | B1 | 12/2001 | Wang |
| 6,328,325 | B1 | 12/2001 | Greenwood |
| 6,328,676 | B1 | 12/2001 | Alessandri |
| 6,328,677 | B1 | 12/2001 | Drapeau |
| 6,334,624 | B1 | 1/2002 | Giglio |
| 6,335,100 | B1 | 1/2002 | Tominaga et al. |
| 6,336,891 | B1 | 1/2002 | Fedrigon et al. |
| 6,338,701 | B1 | 1/2002 | Webber |
| 6,340,340 | B1 | 1/2002 | Stearns |
| 6,342,028 | B1 | 1/2002 | De Sane |
| 6,344,986 | B1 | 2/2002 | Jain et al. |
| 6,345,197 | B1 | 2/2002 | Fabrizio |
| 6,347,603 | B1 | 2/2002 | Felger |
| 6,347,731 | B1 | 2/2002 | Burger |
| 6,348,028 | B1 | 2/2002 | Cragg |
| 6,350,218 | B1 | 2/2002 | Dalebout et al. |
| 6,350,219 | B1 | 2/2002 | Hobson |
| 6,350,221 | B1 | 2/2002 | Krull |
| 6,352,494 | B2 | 3/2002 | McAlonan |
| 6,356,856 | B1 | 3/2002 | Damen et al. |
| 6,357,077 | B1 | 3/2002 | Jones, Jr. et al. |
| 6,358,187 | B1 | 3/2002 | Smith |
| 6,360,408 | B1 | 3/2002 | Dykstra et al. |
| 6,361,476 | B1 | 3/2002 | Eschenbach |
| 6,368,252 | B1 | 4/2002 | Stearns |
| 6,368,254 | B1 | 4/2002 | Wall |
| 6,369,313 | B2 | 4/2002 | Devecka |
| 6,371,123 | B1 | 4/2002 | Stark et al. |
| 6,371,738 | B2 | 4/2002 | Jones |
| 6,371,850 | B1 | 4/2002 | Sonoda |
| 6,371,895 | B1 | 4/2002 | Endelman et al. |
| 6,375,580 | B1 | 4/2002 | Schmidt |
| 6,379,287 | B1 | 4/2002 | Slawinski et al. |
| 6,379,289 | B1 | 4/2002 | Gossie |
| 6,382,627 | B1 | 5/2002 | Lundberg |
| 6,383,120 | B1 | 5/2002 | Lo |
| 6,385,651 | B2 | 5/2002 | Dancs et al. |
| 6,387,015 | B1 | 5/2002 | Watson |
| 6,387,016 | B1 | 5/2002 | Lo |
| 6,387,018 | B1 | 5/2002 | Krull |
| 6,387,019 | B1 | 5/2002 | Krull |
| 6,387,022 | B1 | 5/2002 | Smith |
| 6,387,024 | B1 | 5/2002 | Monti et al. |
| 6,390,923 | B1 | 5/2002 | Yoshitomi et al. |
| 6,390,927 | B1 | 5/2002 | Cleveland, III |
| 6,390,953 | B1 | 5/2002 | Maresh |
| 6,390,955 | B1 | 5/2002 | Wang |
| 6,394,239 | B1 | 5/2002 | Carlson |
| 6,394,935 | B1 | 5/2002 | Lake |
| 6,394,936 | B1 | 5/2002 | Voris |
| 6,394,938 | B1 | 5/2002 | Tornabene |
| 6,397,797 | B1 | 6/2002 | Kolmanovsky et al. |
| 6,398,695 | B2 | 6/2002 | Miller |
| 6,402,520 | B1 | 6/2002 | Freer |
| 6,402,558 | B1 | 6/2002 | Hung-Ju et al. |
| 6,402,666 | B2 | 6/2002 | Krull |
| 6,404,418 | B1 | 6/2002 | Leem |
| 6,405,077 | B1 | 6/2002 | Birnbaum et al. |
| 6,409,513 | B1 | 6/2002 | Kawamura et al. |
| 6,409,632 | B1 | 6/2002 | Eschenbach |
| 6,409,633 | B1 | 6/2002 | Abelbeck |
| 6,413,196 | B1 | 7/2002 | Crowson |
| 6,413,197 | B2 | 7/2002 | McKechnie et al. |
| 6,416,442 | B1 | 7/2002 | Stearns et al. |
| 6,416,444 | B1 | 7/2002 | Lim |
| 6,416,446 | B1 | 7/2002 | Krull |
| 6,416,447 | B1 | 7/2002 | Harmon |
| 6,418,394 | B1 | 7/2002 | Puolakanaho et al. |
| 6,419,611 | B1 | 7/2002 | Levine et al. |
| 6,421,358 | B1 | 7/2002 | Stimmel et al. |
| 6,422,976 | B1 | 7/2002 | Eschenbach |
| 6,422,977 | B1 | 7/2002 | Eschenbach |
| 6,422,979 | B1 | 7/2002 | Krull |
| 6,422,980 | B1 | 7/2002 | Simonson |
| 6,422,981 | B1 | 7/2002 | Riser |
| 6,422,983 | B1 | 7/2002 | Weck |
| 6,427,805 | B1 | 8/2002 | Gibson et al. |
| 6,428,449 | B1 | 8/2002 | Apseloff |
| 6,428,450 | B1 | 8/2002 | Ho |
| 6,430,997 | B1 | 8/2002 | French et al. |
| 6,432,026 | B1 | 8/2002 | Wang |
| 6,435,466 | B1 | 8/2002 | Adams |
| 6,436,007 | B1 | 8/2002 | Eschenbach |
| 6,436,008 | B1 | 8/2002 | Skowronski et al. |
| 6,436,013 | B1 | 8/2002 | Krull |
| 6,440,013 | B1 | 8/2002 | Brown |
| 6,440,042 | B2 | 8/2002 | Eschenbach |
| 6,440,045 | B1 | 8/2002 | Gaston |
| 6,443,521 | B1 | 9/2002 | Nye et al. |
| 6,443,875 | B1 | 9/2002 | Golen, Jr. et al. |
| 6,443,877 | B1 | 9/2002 | Hoecht |
| 6,443,878 | B1 | 9/2002 | Webber |
| 6,446,745 | B1 | 9/2002 | Lee |
| 6,447,424 | B1 | 9/2002 | Ashby et al. |
| 6,447,430 | B1 | 9/2002 | Webb et al. |
| 6,447,432 | B1 | 9/2002 | Krull |
| 6,450,284 | B1 | 9/2002 | Sakyo et al. |
| 6,450,922 | B1 | 9/2002 | Henderson et al. |
| 6,450,923 | B1 | 9/2002 | Vatti |
| 6,450,925 | B1 | 9/2002 | Kuo |
| 6,450,928 | B1 | 9/2002 | Larkins, Jr. |
| 6,454,050 | B2 | 9/2002 | Gibson et al. |
| 6,454,679 | B1 | 9/2002 | Radow |
| 6,454,682 | B1 | 9/2002 | Kuo |
| 6,455,960 | B1 | 9/2002 | Trago et al. |
| 6,458,060 | B1 | 10/2002 | Watterson et al. |
| 6,458,061 | B2 | 10/2002 | Simonson |
| 6,461,275 | B1 | 10/2002 | Wang et al. |
| 6,461,279 | B1 | 10/2002 | Kuo |
| 6,461,284 | B1 | 10/2002 | Francavilla |
| 6,463,385 | B1 | 10/2002 | Fry |
| 6,464,618 | B1 | 10/2002 | Shea |
| 6,466,460 | B1 | 10/2002 | Rein et al. |
| 6,468,189 | B2 | 10/2002 | Alessandri |
| 6,471,622 | B1 | 10/2002 | Hammer et al. |
| 6,471,624 | B1 | 10/2002 | Voris |
| 6,473,483 | B2 | 10/2002 | Pyles |
| 6,474,193 | B1 | 11/2002 | Farney |
| 6,475,115 | B1 | 11/2002 | Candito |
| 6,475,121 | B2 | 11/2002 | Wang |
| 6,475,122 | B2 | 11/2002 | Wu |
| 6,478,721 | B1 | 11/2002 | Hunter |
| 6,478,736 | B1 | 11/2002 | Mault |
| 6,482,128 | B1 | 11/2002 | Michalow |
| 6,482,130 | B1 | 11/2002 | Pasero et al. |
| 6,482,132 | B2 | 11/2002 | Eschenbach |
| 6,482,134 | B1 | 11/2002 | Rasmussen |
| 6,482,139 | B1 | 11/2002 | Haag |
| 6,484,062 | B1 | 11/2002 | Kim |
| 6,485,397 | B1 | 11/2002 | Manderbacka |
| 6,488,020 | B1 | 12/2002 | Rosas-Magallan |

(56) References Cited

U.S. PATENT DOCUMENTS

| | | | |
|---|---|---|---|
| 6,488,599 | B2 | 12/2002 | Nye |
| 6,488,612 | B2 | 12/2002 | Sechrest et al. |
| 6,491,268 | B1 | 12/2002 | Channer et al. |
| 6,491,609 | B2 | 12/2002 | Webber |
| 6,491,610 | B1 | 12/2002 | Henn |
| 6,493,652 | B1 | 12/2002 | Ohlenbusch et al. |
| 6,494,814 | B1 | 12/2002 | Wang |
| 6,497,426 | B2 | 12/2002 | Vanpelt |
| 6,500,097 | B1 | 12/2002 | Hall |
| 6,500,101 | B1 | 12/2002 | Chen |
| 6,500,102 | B1 | 12/2002 | Domenge |
| 6,503,173 | B2 | 1/2003 | Clem |
| 6,505,503 | B1 | 1/2003 | Teresi et al. |
| 6,506,142 | B2 | 1/2003 | Itoh et al. |
| 6,510,760 | B2 | 1/2003 | Matsuo |
| 6,511,402 | B2 | 1/2003 | Shu et al. |
| 6,513,381 | B2 | 2/2003 | Fyfe et al. |
| 6,513,532 | B2 | 2/2003 | Mault et al. |
| 6,513,669 | B2 | 2/2003 | Ozawa et al. |
| 6,514,180 | B1 | 2/2003 | Rawls |
| 6,515,182 | B2 | 2/2003 | Hosokawa et al. |
| 6,515,593 | B1 | 2/2003 | Stark et al. |
| 6,520,531 | B1 | 2/2003 | Gien |
| 6,520,891 | B1 | 2/2003 | Stephens, Jr. |
| 6,524,226 | B2 | 2/2003 | Kushner |
| 6,527,674 | B1 | 3/2003 | Clem |
| 6,527,678 | B1 | 3/2003 | Wang |
| 6,527,683 | B2 | 3/2003 | Tolles |
| 6,527,685 | B2 | 3/2003 | Endelman et al. |
| 6,527,711 | B1 | 3/2003 | Stivoric et al. |
| 6,527,712 | B1 | 3/2003 | Brown et al. |
| 6,527,796 | B1 | 3/2003 | Magovern |
| 6,530,864 | B1 | 3/2003 | Parks |
| 6,533,707 | B2 | 3/2003 | Wang |
| 6,537,184 | B2 | 3/2003 | Kim |
| 6,537,185 | B1 | 3/2003 | Hur |
| 6,539,931 | B2 | 4/2003 | Trajkovic et al. |
| 6,540,650 | B1 | 4/2003 | Krull |
| 6,540,651 | B1 | 4/2003 | Aberton et al. |
| 6,543,247 | B2 | 4/2003 | Strauss |
| 6,544,146 | B1 | 4/2003 | Stearns et al. |
| 6,547,701 | B1 | 4/2003 | Eschenbach |
| 6,551,217 | B2 | 4/2003 | Kaganovsky |
| 6,551,218 | B2 | 4/2003 | Goh |
| 6,551,220 | B1 | 4/2003 | Schroeder |
| 6,551,223 | B2 | 4/2003 | Cheng |
| 6,551,226 | B1 | 4/2003 | Webber et al. |
| 6,554,749 | B2 | 4/2003 | Iund et al. |
| 6,558,300 | B2 | 5/2003 | Deola |
| 6,558,301 | B1 | 5/2003 | Jackson |
| 6,558,302 | B2 | 5/2003 | Cluff |
| 6,560,903 | B1 | 5/2003 | Darley |
| 6,561,951 | B2 | 5/2003 | Cannon et al. |
| 6,561,955 | B1 | 5/2003 | Dreissigacker et al. |
| 6,561,956 | B1 | 5/2003 | Allison |
| 6,561,960 | B2 | 5/2003 | Webber |
| 6,563,489 | B1 | 5/2003 | Latypov et al. |
| 6,569,061 | B2 | 5/2003 | Stearns et al. |
| 6,569,062 | B2 | 5/2003 | Wang |
| 6,572,511 | B1 | 6/2003 | Volpe |
| 6,572,512 | B2 | 6/2003 | Anderson et al. |
| 6,572,513 | B1 | 6/2003 | Whan-Tong et al. |
| 6,575,878 | B1 | 6/2003 | Choy |
| 6,575,885 | B1 | 6/2003 | Weck et al. |
| 6,579,210 | B1 | 6/2003 | Stearns et al. |
| 6,579,213 | B1 | 6/2003 | Webber et al. |
| 6,579,214 | B2 | 6/2003 | Crump |
| 6,582,342 | B2 | 6/2003 | Kaufman |
| 6,582,344 | B2 | 6/2003 | Tang |
| 6,582,345 | B2 | 6/2003 | Roy |
| 6,585,622 | B1 | 7/2003 | Shum et al. |
| 6,585,624 | B1 | 7/2003 | Chen |
| 6,585,626 | B2 | 7/2003 | McBride |
| 6,589,138 | B2 | 7/2003 | Dyer et al. |
| 6,592,498 | B1 | 7/2003 | Trainor |
| 6,592,499 | B2 | 7/2003 | Parker |
| 6,592,502 | B1 | 7/2003 | Phillips |
| 6,595,905 | B2 | 7/2003 | McBride |
| 6,601,016 | B1 | 7/2003 | Brown et al. |
| 6,601,358 | B2 | 8/2003 | Panatta |
| 6,601,825 | B2 | 8/2003 | Bressner et al. |
| 6,602,191 | B2 | 8/2003 | Quy |
| 6,604,008 | B2 | 8/2003 | Chudley et al. |
| 6,604,023 | B1 | 8/2003 | Brown et al. |
| 6,604,419 | B2 | 8/2003 | Guzman |
| 6,605,020 | B1 | 8/2003 | Huang |
| 6,605,024 | B2 | 8/2003 | Stearns |
| 6,605,038 | B1 | 8/2003 | Teller et al. |
| 6,605,044 | B2 | 8/2003 | Bimbaum |
| 6,606,374 | B1 | 8/2003 | Rokoff et al. |
| 6,607,472 | B2 | 8/2003 | Toole |
| 6,609,478 | B2 | 8/2003 | Del Valle |
| 6,610,063 | B2 | 8/2003 | Kumar et al. |
| 6,611,789 | B1 | 8/2003 | Darley |
| 6,612,170 | B2 | 9/2003 | Brown |
| 6,612,492 | B1 | 9/2003 | Yen |
| 6,612,969 | B2 | 9/2003 | Eschenbach |
| 6,612,971 | B1 | 9/2003 | Morris |
| 6,616,578 | B2 | 9/2003 | Alessandri |
| 6,619,681 | B2 | 9/2003 | Gutierrez |
| 6,619,835 | B2 | 9/2003 | Kita |
| 6,620,079 | B2 | 9/2003 | Kuo |
| 6,623,407 | B2 | 9/2003 | Novak |
| 6,623,409 | B1 | 9/2003 | Abelbeck |
| 6,626,799 | B2 | 9/2003 | Watterson et al. |
| 6,626,800 | B1 | 9/2003 | Casler |
| 6,626,802 | B1 | 9/2003 | Rodgers, Jr. |
| 6,626,803 | B1 | 9/2003 | Oglesby et al. |
| 6,629,902 | B2 | 10/2003 | Murphy et al. |
| 6,629,908 | B2 | 10/2003 | Hamady |
| 6,629,909 | B1 | 10/2003 | Stearns et al. |
| 6,629,910 | B1 | 10/2003 | Krull |
| 6,632,160 | B2 | 10/2003 | LaFond et al. |
| 6,632,161 | B1 | 10/2003 | Nir |
| 6,634,992 | B1 | 10/2003 | Ogawa |
| 6,634,996 | B2 | 10/2003 | Jacobsen |
| 6,634,997 | B2 | 10/2003 | Breibart et al. |
| 6,634,998 | B2 | 10/2003 | Siaperas |
| 6,635,015 | B2 | 10/2003 | Sagel |
| 6,637,811 | B2 | 10/2003 | Zheng |
| 6,637,818 | B2 | 10/2003 | Williams |
| 6,638,160 | B2 | 10/2003 | Yoshitomi |
| 6,645,124 | B1 | 11/2003 | Clem |
| 6,645,125 | B1 | 11/2003 | Stearns et al. |
| 6,645,126 | B1 | 11/2003 | Martin et al. |
| 6,645,129 | B2 | 11/2003 | Eschenbach |
| 6,645,130 | B2 | 11/2003 | Webber |
| 6,648,353 | B1 | 11/2003 | Cabal |
| 6,648,798 | B2 | 11/2003 | Yoo |
| 6,648,800 | B2 | 11/2003 | Stearns et al. |
| 6,648,801 | B2 | 11/2003 | Stearns et al. |
| 6,648,802 | B2 | 11/2003 | Ware |
| 6,652,419 | B1 | 11/2003 | Rota |
| 6,652,424 | B2 | 11/2003 | Dalebout |
| 6,652,425 | B1 | 11/2003 | Martin et al. |
| 6,652,426 | B2 | 11/2003 | Carter |
| 6,652,429 | B2 | 11/2003 | Bushnell |
| 6,652,431 | B1 | 11/2003 | Mattox |
| 6,652,432 | B2 | 11/2003 | Smith |
| 6,656,091 | B1 | 12/2003 | Abelbeck |
| 6,656,093 | B2 | 12/2003 | Chen |
| 6,659,916 | B1 | 12/2003 | Shea |
| 6,659,946 | B1 | 12/2003 | Batchelor et al. |
| 6,660,949 | B2 | 12/2003 | Kamino et al. |
| 6,661,136 | B1 | 12/2003 | Lee |
| 6,662,651 | B1 | 12/2003 | Roth |
| 6,663,127 | B2 | 12/2003 | Miller |
| 6,663,498 | B2 | 12/2003 | Stipan |
| 6,663,500 | B2 | 12/2003 | Huang |
| 6,666,796 | B1 | 12/2003 | MacCready, Jr. |
| 6,666,800 | B2 | 12/2003 | Krull |
| 6,666,801 | B1 | 12/2003 | Michalow |
| 6,668,678 | B1 | 12/2003 | Baba et al. |
| 6,669,606 | B2 | 12/2003 | Krull |

(56) References Cited

U.S. PATENT DOCUMENTS

| | | | |
|---|---|---|---|
| 6,669,607 | B2 | 12/2003 | Slawinski et al. |
| 6,669,609 | B2 | 12/2003 | Gerschefske et al. |
| 6,671,975 | B2 | 1/2004 | Hennessey |
| 6,672,991 | B2 | 1/2004 | O'Malley |
| 6,672,992 | B1 | 1/2004 | Lo et al. |
| 6,672,994 | B1 | 1/2004 | Stearns et al. |
| 6,676,530 | B2 | 1/2004 | Lochtefeld |
| 6,676,569 | B1 | 1/2004 | Radow |
| 6,676,572 | B2 | 1/2004 | Wang |
| 6,676,573 | B2 | 1/2004 | Abelbeck et al. |
| 6,676,577 | B2 | 1/2004 | Stearns |
| 6,676,579 | B1 | 1/2004 | Lin |
| 6,677,299 | B2 | 1/2004 | Stern et al. |
| 6,679,816 | B1 | 1/2004 | Krull |
| 6,679,820 | B2 | 1/2004 | Barkus et al. |
| 6,681,014 | B1 | 1/2004 | Ghassabian |
| 6,681,704 | B1 | 1/2004 | Brookhiser |
| 6,681,728 | B2 | 1/2004 | Haghgooie |
| 6,682,460 | B2 | 1/2004 | Lo |
| 6,682,461 | B2 | 1/2004 | Wang |
| 6,685,480 | B2 | 2/2004 | Nishimoto et al. |
| 6,685,600 | B1 | 2/2004 | Ullman |
| 6,685,601 | B1 | 2/2004 | Knapp |
| 6,685,602 | B2 | 2/2004 | Colosky, Jr. et al. |
| 6,685,607 | B1 | 2/2004 | Olson |
| 6,687,535 | B2 | 2/2004 | Hautala et al. |
| 6,689,019 | B2 | 2/2004 | Ohrt et al. |
| 6,689,023 | B2 | 2/2004 | Baumler |
| 6,689,025 | B2 | 2/2004 | Emick |
| 6,689,057 | B1 | 2/2004 | Shinsel et al. |
| 6,691,839 | B1 | 2/2004 | El-Kassouf |
| 6,692,415 | B1 | 2/2004 | Winston |
| 6,692,417 | B2 | 2/2004 | Burrell |
| 6,695,620 | B1 | 2/2004 | Huang |
| 6,695,694 | B2 | 2/2004 | Ishikawa et al. |
| 6,695,799 | B2 | 2/2004 | Kitadou et al. |
| 6,698,110 | B1 | 3/2004 | Robbins |
| 6,699,146 | B1 | 3/2004 | Winter et al. |
| 6,699,159 | B2 | 3/2004 | Rouse |
| 6,699,161 | B1 | 3/2004 | Speas |
| 6,699,162 | B2 | 3/2004 | Chen |
| 6,700,788 | B2 | 3/2004 | Matsushita et al. |
| 6,701,271 | B2 | 3/2004 | Willner et al. |
| 6,702,719 | B1 | 3/2004 | Brown et al. |
| 6,702,723 | B2 | 3/2004 | Landfair |
| 6,702,726 | B2 | 3/2004 | Lin |
| 6,705,974 | B1 | 3/2004 | Tardif |
| 6,705,976 | B1 | 3/2004 | Piane, Jr. |
| 6,705,977 | B1 | 3/2004 | Ziak |
| 6,708,427 | B2 | 3/2004 | Sussmann et al. |
| 6,711,789 | B2 | 3/2004 | Ping |
| 6,712,737 | B1 | 3/2004 | Nusbaum |
| 6,712,740 | B2 | 3/2004 | Simonson |
| 6,716,139 | B1 | 4/2004 | Hosseinzadeh-Dolkhani |
| 6,716,142 | B2 | 4/2004 | Kuo |
| 6,716,144 | B1 | 4/2004 | Shifferaw |
| 6,719,667 | B2 | 4/2004 | Wong et al. |
| 6,719,669 | B1 | 4/2004 | Wang |
| 6,719,672 | B1 | 4/2004 | Ellis et al. |
| 6,719,674 | B2 | 4/2004 | Krull |
| 6,722,888 | B1 | 4/2004 | Macri et al. |
| 6,723,413 | B2 | 4/2004 | Walters |
| 6,726,113 | B2 | 4/2004 | Guo |
| 6,726,600 | B2 | 4/2004 | Miller |
| 6,726,601 | B1 | 4/2004 | Beutel |
| 6,726,602 | B2 | 4/2004 | Chang |
| 6,730,002 | B2 | 5/2004 | Hald et al. |
| 6,733,423 | B1 | 5/2004 | Chang |
| 6,733,424 | B2 | 5/2004 | Krull |
| 6,736,360 | B1 | 5/2004 | Buczek |
| 6,736,759 | B1 | 5/2004 | Stubbs et al. |
| 6,736,765 | B2 | 5/2004 | Wallace et al. |
| 6,736,766 | B1 | 5/2004 | Gallant |
| 6,738,274 | B2 | 5/2004 | Prasad et al. |
| 6,740,007 | B2 | 5/2004 | Gordon et al. |
| 6,740,009 | B1 | 5/2004 | Hall |
| 6,741,052 | B2 | 5/2004 | Fitzgibbon |
| 6,743,153 | B2 | 6/2004 | Watterson et al. |
| 6,746,247 | B2 | 6/2004 | Barton |
| 6,746,370 | B1 | 6/2004 | Fleming et al. |
| 6,746,371 | B1 | 6/2004 | Brown et al. |
| 6,746,380 | B2 | 6/2004 | Lien et al. |
| 6,746,381 | B2 | 6/2004 | Krull |
| 6,747,427 | B1 | 6/2004 | Carson |
| 6,749,432 | B2 | 6/2004 | French et al. |
| 6,749,536 | B1 | 6/2004 | Cuskaden et al. |
| 6,749,537 | B1 | 6/2004 | Hickman |
| 6,749,540 | B1 | 6/2004 | Pasero et al. |
| 6,749,542 | B2 | 6/2004 | Wu |
| 6,749,546 | B2 | 6/2004 | Yang |
| 6,749,547 | B2 | 6/2004 | Krull |
| 6,751,439 | B2 | 6/2004 | Tice et al. |
| 6,752,745 | B1 | 6/2004 | Davis |
| 6,757,572 | B1 | 6/2004 | Forest |
| 6,758,790 | B1 | 7/2004 | Ellis |
| 6,758,791 | B1 | 7/2004 | Kuo |
| 6,758,792 | B1 | 7/2004 | Chang |
| 6,761,387 | B2 | 7/2004 | Sloss |
| 6,761,667 | B1 | 7/2004 | Cutler et al. |
| 6,761,672 | B1 | 7/2004 | Williams |
| 6,764,429 | B1 | 7/2004 | Michalow |
| 6,764,430 | B1 | 7/2004 | Fencel |
| 6,764,431 | B2 | 7/2004 | Yoss |
| 6,765,726 | B2 | 7/2004 | French et al. |
| 6,767,314 | B2 | 7/2004 | Thompson |
| 6,769,689 | B1 | 8/2004 | Shimomura et al. |
| 6,770,014 | B2 | 8/2004 | Amore |
| 6,770,015 | B2 | 8/2004 | Simonson |
| 6,776,740 | B1 | 8/2004 | Anderson et al. |
| 6,778,938 | B1 | 8/2004 | Ng et al. |
| 6,783,482 | B2 | 8/2004 | Oglesby et al. |
| 6,786,415 | B2 | 9/2004 | Yiu |
| 6,786,821 | B2 | 9/2004 | Nobe et al. |
| 6,786,847 | B1 | 9/2004 | Morgan et al. |
| 6,786,848 | B2 | 9/2004 | Yamashita et al. |
| 6,786,850 | B2 | 9/2004 | Nizamuddin |
| 6,786,852 | B2 | 9/2004 | Watterson et al. |
| 6,790,162 | B1 | 9/2004 | Ellis et al. |
| 6,790,163 | B1 | 9/2004 | Van De Laarschot |
| 6,790,178 | B1 | 9/2004 | Mault et al. |
| 6,793,609 | B1 | 9/2004 | Fan |
| 6,796,159 | B2 | 9/2004 | Kelm et al. |
| 6,796,925 | B2 | 9/2004 | Martinez et al. |
| 6,796,927 | B2 | 9/2004 | Toyama |
| 6,798,378 | B1 | 9/2004 | Walters |
| 6,802,800 | B1 | 10/2004 | Hobson |
| 6,807,869 | B2 | 10/2004 | Farringdon et al. |
| 6,808,458 | B1 | 10/2004 | Jung |
| 6,808,472 | B1 | 10/2004 | Hickman |
| 6,808,473 | B2 | 10/2004 | Hisano et al. |
| 6,808,475 | B2 | 10/2004 | Kehrbaum |
| 6,811,516 | B1 | 11/2004 | Dugan |
| 6,811,519 | B2 | 11/2004 | Kuo |
| 6,817,117 | B1 | 11/2004 | Campbell |
| 6,817,968 | B2 | 11/2004 | Galbraith et al. |
| 6,817,979 | B2 | 11/2004 | Nihtilä |
| 6,821,230 | B2 | 11/2004 | Dalebout et al. |
| 6,823,036 | B1 | 11/2004 | Chen |
| 6,823,327 | B1 | 11/2004 | Klug |
| 6,824,210 | B2 | 11/2004 | Zheng |
| 6,824,502 | B1 | 11/2004 | Huang |
| 6,825,164 | B1 | 11/2004 | Stern et al. |
| 6,825,876 | B1 | 11/2004 | Easwar et al. |
| 6,827,669 | B2 | 12/2004 | Cohen et al. |
| 6,827,670 | B1 | 12/2004 | Stark et al. |
| 6,827,822 | B2 | 12/2004 | Tao et al. |
| 6,830,540 | B2 | 12/2004 | Watterson et al. |
| 6,830,541 | B2 | 12/2004 | Wu |
| 6,835,166 | B1 | 12/2004 | Stearns et al. |
| 6,837,827 | B1 | 1/2005 | Lee et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |

(56) References Cited

U.S. PATENT DOCUMENTS

| | | | |
|---|---|---|---|
| 6,840,904 | B2 | 1/2005 | Goldberg |
| 6,842,928 | B2 | 1/2005 | Yang et al. |
| 6,843,732 | B1 | 1/2005 | Huang |
| 6,846,270 | B1 | 1/2005 | Etnyre |
| 6,846,272 | B2 | 1/2005 | Rosenow et al. |
| 6,849,032 | B2 | 2/2005 | Chu |
| 6,852,068 | B2 | 2/2005 | Ogawa |
| 6,852,069 | B2 | 2/2005 | Park |
| 6,855,093 | B2 | 2/2005 | Anderson et al. |
| 6,855,097 | B2 | 2/2005 | Krull |
| 6,857,993 | B2 | 2/2005 | Yeh |
| 6,859,215 | B1 | 2/2005 | Brown et al. |
| 6,860,131 | B2 | 3/2005 | Armstrong et al. |
| 6,860,836 | B1 | 3/2005 | Wu |
| 6,860,839 | B1 | 3/2005 | Dice |
| 6,860,841 | B1 | 3/2005 | Mortorano |
| 6,863,641 | B1 | 3/2005 | Brown et al. |
| 6,866,613 | B1 | 3/2005 | Brown et al. |
| 6,872,077 | B2 | 3/2005 | Yeager |
| 6,872,168 | B2 | 3/2005 | Wang et al. |
| 6,872,173 | B2 | 3/2005 | Krull |
| 6,872,175 | B2 | 3/2005 | Lin |
| 6,872,187 | B1 | 3/2005 | Ramamurthy et al. |
| 6,875,157 | B1 | 4/2005 | Wang |
| 6,875,160 | B2 | 4/2005 | Watterson et al. |
| 6,876,496 | B2 | 4/2005 | French et al. |
| 6,876,947 | B1 | 4/2005 | Darley et al. |
| 6,878,099 | B2 | 4/2005 | Harrison, III et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,882,955 | B1 | 4/2005 | Ohlenbusch et al. |
| 6,885,971 | B2 | 4/2005 | Vock et al. |
| 6,886,613 | B1 | 5/2005 | Zahdeh |
| 6,886,645 | B2 | 5/2005 | Bise et al. |
| 6,887,185 | B1 | 5/2005 | Kuo |
| 6,887,190 | B1 | 5/2005 | Azari |
| 6,893,381 | B2 | 5/2005 | Slawinski |
| 6,893,383 | B1 | 5/2005 | Chang et al. |
| 6,896,342 | B1 | 5/2005 | Cheng |
| 6,896,645 | B1 | 5/2005 | Krull |
| 6,899,657 | B2 | 5/2005 | Chuang |
| 6,899,659 | B2 | 5/2005 | Anderson et al. |
| 6,899,661 | B1 | 5/2005 | Krull |
| 6,902,513 | B1 | 6/2005 | Mcclure |
| 6,902,515 | B2 | 6/2005 | Howell et al. |
| 6,902,516 | B2 | 6/2005 | Krull |
| 6,905,440 | B2 | 6/2005 | Heppert |
| 6,905,446 | B2 | 6/2005 | Greenland |
| 6,908,416 | B2 | 6/2005 | Mercado et al. |
| 6,908,417 | B2 | 6/2005 | Jackson |
| 6,910,992 | B2 | 6/2005 | Arguilez |
| 6,913,562 | B2 | 7/2005 | Chen |
| 6,913,563 | B2 | 7/2005 | Chen |
| 6,915,271 | B1 | 7/2005 | Meyer et al. |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,918,861 | B2 | 7/2005 | Liao et al. |
| 6,921,351 | B1 | 7/2005 | Hickman et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,923,748 | B1 | 8/2005 | Mauz |
| 6,923,749 | B1 | 8/2005 | Smith |
| 6,926,644 | B2 | 8/2005 | Chen |
| 6,926,646 | B1 | 8/2005 | Nguyen |
| 6,926,649 | B2 | 8/2005 | Slawinski |
| 6,929,589 | B1 | 8/2005 | Bruggemann et al. |
| 6,932,745 | B1 | 8/2005 | Ellis |
| 6,934,658 | B2 | 8/2005 | Clabes et al. |
| 6,936,007 | B2 | 8/2005 | Quy |
| 6,937,289 | B1 | 8/2005 | Ranta et al. |
| 6,939,271 | B1 | 9/2005 | Whan-Tong et al. |
| 6,941,620 | B1 | 9/2005 | Hinds |
| 6,942,599 | B1 | 9/2005 | Racine |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,949,054 | B1 | 9/2005 | Stearns |
| 6,952,221 | B1 | 10/2005 | Holtz et al. |
| 6,953,418 | B1 | 10/2005 | Chen |
| 6,955,542 | B2 | 10/2005 | Roncalez et al. |
| 6,960,156 | B2 | 11/2005 | Smith |
| 6,964,632 | B1 | 11/2005 | Ko |
| 6,966,872 | B2 | 11/2005 | Eschenbach |
| 6,971,972 | B1 | 12/2005 | Mcgovern |
| 6,971,973 | B2 | 12/2005 | Cohen et al. |
| 6,971,974 | B2 | 12/2005 | Bowman |
| 6,971,975 | B2 | 12/2005 | Croft |
| 6,971,978 | B2 | 12/2005 | Hyder |
| 6,974,403 | B2 | 12/2005 | Wong et al. |
| 6,974,404 | B1 | 12/2005 | Watterson et al. |
| 6,974,405 | B2 | 12/2005 | Krull |
| 6,975,910 | B1 | 12/2005 | Brown et al. |
| 6,976,624 | B2 | 12/2005 | Hsiao |
| 6,976,698 | B2 | 12/2005 | Kuiken |
| 6,976,941 | B2 | 12/2005 | Britt |
| 6,976,943 | B1 | 12/2005 | Hsiung |
| 6,976,958 | B2 | 12/2005 | Quy |
| 6,979,283 | B2 | 12/2005 | Pan |
| 6,991,586 | B2 | 1/2006 | Lapcevic |
| 6,991,588 | B1 | 1/2006 | Adams |
| 6,994,306 | B1 | 2/2006 | Sweere et al. |
| 6,994,657 | B1 | 2/2006 | Eschenbach |
| 6,994,683 | B1 | 2/2006 | Starr |
| 6,996,852 | B1 | 2/2006 | Cabrera |
| 6,997,852 | B2 | 2/2006 | Watterson et al. |
| 6,997,853 | B1 | 2/2006 | Cuskaden et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,015,950 | B1 | 3/2006 | Pryor |
| 7,016,812 | B2 | 3/2006 | Aritsuka et al. |
| 7,020,508 | B2 | 3/2006 | Stivoric |
| 7,022,047 | B2 | 4/2006 | Cohen et al. |
| 7,022,048 | B1 | 4/2006 | Fernandez |
| 7,022,049 | B2 | 4/2006 | Ryan et al. |
| 7,022,051 | B2 | 4/2006 | Ota |
| 7,029,425 | B2 | 4/2006 | Krull |
| 7,032,870 | B2 | 4/2006 | Sweere et al. |
| 7,033,176 | B2 | 4/2006 | Feldman |
| 7,033,306 | B2 | 4/2006 | Graber |
| 7,035,936 | B2 | 4/2006 | Fouquet |
| 7,037,246 | B2 | 5/2006 | Kim |
| 7,038,855 | B2 | 5/2006 | French et al. |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,041,049 | B1 | 5/2006 | Raniere |
| 7,044,066 | B1 | 5/2006 | Miller |
| 7,044,891 | B1 | 5/2006 | Rivera |
| 7,044,897 | B2 | 5/2006 | Myers et al. |
| 7,048,638 | B2 | 5/2006 | Novotny |
| 7,048,677 | B2 | 5/2006 | Mackert |
| 7,051,049 | B2 | 5/2006 | Samn |
| 7,052,426 | B2 | 5/2006 | Battat et al. |

(56) References Cited

U.S. PATENT DOCUMENTS

| | | | |
|---|---|---|---|
| 7,052,444 | B2 | 5/2006 | Webber |
| 7,052,446 | B2 | 5/2006 | Morris et al. |
| 7,055,899 | B2 | 6/2006 | Zhurong et al. |
| 7,056,265 | B1 | 6/2006 | Shea |
| 7,060,005 | B2 | 6/2006 | Carlsen et al. |
| 7,060,006 | B1 | 6/2006 | Watterson et al. |
| 7,060,008 | B2 | 6/2006 | Watterson et al. |
| 7,060,011 | B1 | 6/2006 | Krull |
| 7,060,012 | B2 | 6/2006 | Howell et al. |
| 7,060,031 | B2 | 6/2006 | Webb et al. |
| 7,063,644 | B2 | 6/2006 | Albert et al. |
| 7,065,768 | B1 | 6/2006 | Janzig et al. |
| 7,066,865 | B2 | 6/2006 | Radow |
| 7,066,867 | B2 | 6/2006 | Krull |
| 7,070,415 | B2 | 7/2006 | Hojo et al. |
| 7,070,539 | B2 | 7/2006 | Brown et al. |
| 7,070,542 | B2 | 7/2006 | Reyes et al. |
| 7,070,545 | B2 | 7/2006 | Lull et al. |
| 7,072,789 | B2 | 7/2006 | Vock et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,083,536 | B2 | 8/2006 | Lu et al. |
| 7,083,549 | B1 | 8/2006 | Fan |
| 7,083,554 | B1 | 8/2006 | Lo Presti |
| 7,086,994 | B2 | 8/2006 | Turak et al. |
| 7,086,999 | B2 | 8/2006 | Jeneve et al. |
| 7,087,000 | B1 | 8/2006 | Walker |
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,091,635 | B1 | 8/2006 | Gilliland et al. |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,163 | B2 | 9/2006 | Krull |
| 7,113,166 | B1 | 9/2006 | Rosenberg et al. |
| 7,115,073 | B2 | 10/2006 | Nizamuddin |
| 7,115,076 | B2 | 10/2006 | Oglesby et al. |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,125,371 | B2 | 10/2006 | Henderson |
| 7,125,373 | B1 | 10/2006 | Garza |
| 7,128,692 | B2 | 10/2006 | Black |
| 7,128,693 | B2 | 10/2006 | Brown et al. |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tyndall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,139,835 | B2 | 11/2006 | Fouquet et al. |
| 7,140,626 | B1 | 11/2006 | Keay |
| 7,141,008 | B2 | 11/2006 | Krull et al. |
| 7,148,879 | B2 | 12/2006 | Amento et al. |
| 7,150,168 | B1 | 12/2006 | Kuo |
| 7,151,214 | B2 | 12/2006 | Barry |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,156,808 | B2 | 1/2007 | Quy |
| 7,156,809 | B2 | 1/2007 | Quy |
| 7,158,938 | B2 | 1/2007 | Labbe et al. |
| 7,163,489 | B1 | 1/2007 | Nelson |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,170,016 | B2 | 1/2007 | Dumornay |
| 7,171,331 | B2 | 1/2007 | Vock et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,182,738 | B2 | 2/2007 | Bonutti et al. |
| 7,186,189 | B2 | 3/2007 | Huang |
| 7,187,961 | B2 | 3/2007 | Yamashita et al. |
| 7,188,439 | B2 | 3/2007 | DiBenedetto et al. |
| 7,192,388 | B2 | 3/2007 | Dalebout et al. |
| 7,192,389 | B2 | 3/2007 | Allison |
| 7,195,568 | B2 | 3/2007 | Huang |
| 7,197,029 | B1 | 3/2007 | Osterhout et al. |
| 7,200,517 | B2 | 4/2007 | Darley et al. |
| 7,201,705 | B2 | 4/2007 | Rodgers, Jr. |
| 7,201,707 | B1 | 4/2007 | Moon |
| 7,204,328 | B2 | 4/2007 | Lopresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,170 | B2 | 5/2007 | Sumners |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,216 | B1 | 5/2007 | McBride |
| 7,224,326 | B2 | 5/2007 | Sefton |
| 7,225,282 | B1 | 5/2007 | Lyle |
| 7,225,565 | B2 | 6/2007 | DiBenedetto et al. |
| 7,225,694 | B2 | 6/2007 | Said |
| 7,226,402 | B1 | 6/2007 | Joya |
| 7,229,391 | B2 | 6/2007 | Francis |
| 7,232,404 | B2 | 6/2007 | Nelson |
| 7,235,942 | B2 | 6/2007 | Nagaoka et al. |
| 7,236,154 | B1 | 6/2007 | Nakada et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,254,516 | B2 | 8/2007 | Case, Jr. et al. |
| 7,255,665 | B2 | 8/2007 | Ish, III |

(56) References Cited

U.S. PATENT DOCUMENTS

| | | | |
|---|---|---|---|
| 7,255,666 | B2 | 8/2007 | Cardenas |
| 7,257,468 | B1 | 8/2007 | Costa et al. |
| 7,258,651 | B2 | 8/2007 | Clarke |
| 7,259,906 | B1 | 8/2007 | Islam |
| 7,261,678 | B2 | 8/2007 | Nakashima et al. |
| 7,264,554 | B2 | 9/2007 | Bentley |
| 7,264,578 | B1 | 9/2007 | Krull |
| 7,269,038 | B2 | 9/2007 | Shekhawat |
| 7,276,017 | B2 | 10/2007 | Lin |
| 7,278,934 | B2 | 10/2007 | McBride et al. |
| 7,278,955 | B2 | 10/2007 | Giannelli et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,285,090 | B2 | 10/2007 | Stivoric et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,292,151 | B2 | 11/2007 | Ferguson |
| 7,293,510 | B1 | 11/2007 | Siao |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,308,818 | B2 | 12/2007 | Considine et al. |
| 7,309,303 | B1 | 12/2007 | Proctor |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,906 | B2 | 1/2008 | Webber |
| 7,322,907 | B2 | 1/2008 | Bowser |
| 7,322,909 | B1 | 1/2008 | Loccarini |
| 7,328,119 | B1 | 2/2008 | Pryor |
| 7,329,684 | B2 | 2/2008 | Mjalli et al. |
| 7,331,911 | B2 | 2/2008 | Webber et al. |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,147 | B2 | 2/2008 | Jones |
| 7,336,178 | B2 | 2/2008 | Le |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |
| 7,347,806 | B2 | 3/2008 | Nakano et al. |
| 7,350,787 | B2 | 4/2008 | Voss |
| 7,352,365 | B2 | 4/2008 | Trachte |
| 7,354,380 | B2 | 4/2008 | Volpe, Jr. |
| 7,357,756 | B2 | 4/2008 | Demas |
| 7,357,758 | B2 | 4/2008 | Polk, III |
| 7,359,121 | B2 | 4/2008 | French et al. |
| 7,361,123 | B1 | 4/2008 | Krull |
| 7,361,125 | B2 | 4/2008 | Webber et al. |
| 7,361,127 | B2 | 4/2008 | Tremayne |
| 7,364,538 | B2 | 4/2008 | Aucamp |
| 7,365,647 | B2 | 4/2008 | Nativ |
| 7,366,921 | B2 | 4/2008 | Ranganathan |
| 7,367,926 | B2 | 5/2008 | Clark |
| 7,367,927 | B2 | 5/2008 | Krull |
| 7,369,121 | B2 | 5/2008 | Lane |
| 7,370,498 | B1 | 5/2008 | Miao |
| 7,372,485 | B1 | 5/2008 | Bodnar et al. |
| 7,373,820 | B1 | 5/2008 | James |
| 7,374,519 | B2 | 5/2008 | Naidus |
| 7,374,522 | B2 | 5/2008 | Arnold |
| 7,377,881 | B2 | 5/2008 | Moon |
| 7,377,886 | B2 | 5/2008 | Wu |
| 7,383,081 | B2 | 6/2008 | Butt et al. |
| 7,384,013 | B2 | 6/2008 | Yen |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,398,151 | B1 | 7/2008 | Burrell et al. |
| 7,401,918 | B2 | 7/2008 | Howell et al. |
| 7,402,125 | B2 | 7/2008 | Wang |
| 7,402,145 | B1 | 7/2008 | Woggon |
| 7,412,206 | B1 | 8/2008 | Hutchings et al. |
| 7,413,056 | B2 | 8/2008 | Gonzi et al. |
| 7,413,065 | B2 | 8/2008 | Gauthier |
| 7,413,532 | B1 | 8/2008 | Monsrud et al. |
| 7,413,533 | B2 | 8/2008 | Lin |
| 7,416,537 | B1 | 8/2008 | Stark et al. |
| 7,418,862 | B2 | 9/2008 | Gruben et al. |
| 7,425,189 | B1 | 9/2008 | Eschenbach |
| 7,428,760 | B2 | 9/2008 | McCrimmon |
| 7,429,235 | B2 | 9/2008 | Lin |
| 7,429,236 | B2 | 9/2008 | Dalebout et al. |
| 7,432,184 | B2 | 10/2008 | Hosokawa et al. |
| 7,432,454 | B1 | 10/2008 | Sze et al. |
| 7,432,677 | B2 | 10/2008 | Heydt et al. |
| 7,435,205 | B2 | 10/2008 | Reyes et al. |
| 7,438,673 | B1 | 10/2008 | Jones |
| 7,448,823 | B2 | 11/2008 | Silva |
| 7,452,336 | B2 | 11/2008 | Thompson |
| 7,454,002 | B1 | 11/2008 | Gardner et al. |
| 7,455,621 | B1 | 11/2008 | Anthony |
| 7,455,622 | B2 | 11/2008 | Watterson et al. |
| 7,455,626 | B2 | 11/2008 | Trevino et al. |
| 7,455,628 | B1 | 11/2008 | Stearns |
| 7,455,633 | B2 | 11/2008 | Brown et al. |
| 7,462,141 | B1 | 12/2008 | Raboin et al. |
| 7,465,257 | B1 | 12/2008 | Morgan, Jr. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,477,890 | B1 | 1/2009 | Narayanaswami |
| 7,478,794 | B1 | 1/2009 | Gohlke et al. |
| 7,480,512 | B2 | 1/2009 | Graham et al. |
| 7,482,050 | B2 | 1/2009 | Olson |
| 7,485,077 | B2 | 2/2009 | Chen |
| 7,488,277 | B1 | 2/2009 | Knapp |
| 7,489,979 | B2 | 2/2009 | Rosenberg |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,497,784 | B2 | 3/2009 | Henry |
| 7,497,814 | B1 | 3/2009 | Krull |
| 7,503,476 | B2 | 3/2009 | Bhavnani |
| 7,503,878 | B1 | 3/2009 | Amsbury et al. |
| 7,503,883 | B2 | 3/2009 | Madden |
| 7,507,183 | B2 | 3/2009 | Anderson |
| 7,507,186 | B2 | 3/2009 | Stearns |
| 7,507,187 | B2 | 3/2009 | Dyer et al. |
| 7,507,189 | B2 | 3/2009 | Krull |
| 7,507,190 | B2 | 3/2009 | Piane, Jr. |
| 7,510,509 | B2 | 3/2009 | Hickman |
| 7,510,511 | B2 | 3/2009 | Von Detten |
| 7,517,303 | B2 | 4/2009 | Crawford et al. |
| 7,517,304 | B1 | 4/2009 | Swanson et al. |
| 7,519,327 | B2 | 4/2009 | White |
| 7,519,537 | B2 | 4/2009 | Rosenberg |
| 7,520,840 | B2 | 4/2009 | Shifferaw |
| 7,520,845 | B2 | 4/2009 | Shifferaw |

(56) References Cited

U.S. PATENT DOCUMENTS

| | | | |
|---|---|---|---|
| 7,521,623 | B2 | 4/2009 | Bowen |
| 7,525,293 | B1 | 4/2009 | Notohamiprodjo et al. |
| 7,532,977 | B2 | 5/2009 | Chen |
| 7,534,200 | B1 | 5/2009 | Martinez |
| 7,534,206 | B1 | 5/2009 | Lovitt et al. |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,539,487 | B2 | 5/2009 | Sinclair et al. |
| 7,540,828 | B2 | 6/2009 | Watterson et al. |
| 7,540,829 | B1 | 6/2009 | Lin |
| 7,542,816 | B2 | 6/2009 | Rosenberg |
| 7,543,934 | B2 | 6/2009 | Howell et al. |
| 7,544,153 | B2 | 6/2009 | Trevino et al. |
| 7,549,947 | B2 | 6/2009 | Hickman et al. |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,267 | B1 | 6/2009 | Hauser |
| 7,556,590 | B2 | 7/2009 | Watterson et al. |
| 7,556,591 | B2 | 7/2009 | Chuang |
| 7,561,989 | B2 | 7/2009 | Banks et al. |
| 7,562,117 | B2 | 7/2009 | Rosenberg |
| 7,563,203 | B2 | 7/2009 | Dalebout et al. |
| 7,563,205 | B2 | 7/2009 | Alling |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,569,000 | B2 | 8/2009 | Wang |
| 7,569,004 | B2 | 8/2009 | Kolomeir |
| 7,569,005 | B2 | 8/2009 | Geeting |
| 7,571,517 | B2 | 8/2009 | Smith et al. |
| 7,575,536 | B1 | 8/2009 | Hickman |
| 7,575,537 | B2 | 8/2009 | Ellis |
| 7,575,538 | B1 | 8/2009 | Clark |
| 7,577,522 | B2 | 8/2009 | Rosenberg |
| 7,578,771 | B1 | 8/2009 | Towley, III et al. |
| 7,578,772 | B2 | 8/2009 | Lippitt |
| 7,579,946 | B2 | 8/2009 | Case, Jr. |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,585,262 | B1 | 9/2009 | Vayntraub |
| 7,586,032 | B2 | 9/2009 | Louis |
| 7,588,520 | B2 | 9/2009 | Nalley |
| 7,591,763 | B1 | 9/2009 | Fucci |
| 7,591,770 | B2 | 9/2009 | Stewart et al. |
| 7,591,773 | B2 | 9/2009 | Weir |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,594,881 | B2 | 9/2009 | Shifferaw |
| 7,598,255 | B2 | 10/2009 | Dvorak |
| 7,601,096 | B2 | 10/2009 | Negrin |
| 7,601,097 | B2 | 10/2009 | Miyamaru et al. |
| 7,601,101 | B2 | 10/2009 | Jackson et al. |
| 7,601,105 | B1 | 10/2009 | Gipson, III et al. |
| 7,602,301 | B1 | 10/2009 | Stirling et al. |
| 7,603,255 | B2 | 10/2009 | Case, Jr. et al. |
| 7,604,571 | B2 | 10/2009 | Wilkins et al. |
| 7,604,573 | B2 | 10/2009 | Dalebout et al. |
| 7,604,576 | B2 | 10/2009 | Drechsler |
| 7,604,578 | B2 | 10/2009 | Liu |
| 7,607,243 | B2 | 10/2009 | Berner, Jr. et al. |
| 7,608,015 | B2 | 10/2009 | Radow |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,611,445 | B2 | 11/2009 | Brown et al. |
| 7,611,450 | B2 | 11/2009 | Mancini |
| 7,614,639 | B2 | 11/2009 | Tholkes et al. |
| 7,614,981 | B2 | 11/2009 | Cao |
| 7,614,984 | B1 | 11/2009 | Krull |
| 7,616,097 | B1 | 11/2009 | Whang |
| 7,618,345 | B2 | 11/2009 | Corbalis et al. |
| 7,618,346 | B2 | 11/2009 | Crawford et al. |
| 7,618,350 | B2 | 11/2009 | Dalebout et al. |
| 7,619,514 | B1 | 11/2009 | Stone |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,315 | B2 | 12/2009 | Hickman |
| 7,625,316 | B1 | 12/2009 | Amsbury et al. |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,628,743 | B1 | 12/2009 | Flentye et al. |
| 7,631,382 | B2 | 12/2009 | Saito et al. |
| 7,632,221 | B1 | 12/2009 | Kolander |
| 7,637,847 | B1 | 12/2009 | Hickman |
| 7,637,850 | B2 | 12/2009 | Lin |
| 7,639,520 | B1 | 12/2009 | Zansky et al. |
| 7,641,592 | B2 | 1/2010 | Roche |
| 7,643,895 | B2 | 1/2010 | Gupta et al. |
| 7,645,212 | B2 | 1/2010 | Ashby et al. |
| 7,645,213 | B2 | 1/2010 | Watterson |
| 7,645,214 | B2 | 1/2010 | Lull |
| 7,645,218 | B2 | 1/2010 | Potok et al. |
| 7,645,221 | B1 | 1/2010 | Curry |
| 7,647,196 | B2 | 1/2010 | Kahn et al. |
| 7,648,443 | B2 | 1/2010 | Schenk |
| 7,648,446 | B2 | 1/2010 | Chiles et al. |
| 7,648,463 | B1 | 1/2010 | Elhag et al. |
| 7,648,858 | B2 | 1/2010 | Tang et al. |
| 7,651,442 | B2 | 1/2010 | Carlson |
| 7,651,450 | B2 | 1/2010 | Wehrell |
| 7,654,229 | B2 | 2/2010 | Smith |
| 7,654,940 | B2 | 2/2010 | Webber et al. |
| 7,654,948 | B2 | 2/2010 | Kaplan et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,662,065 | B1 | 2/2010 | Kahn et al. |
| 7,662,282 | B2 | 2/2010 | Lee et al. |
| 7,670,263 | B2 | 3/2010 | Ellis |
| 7,670,269 | B2 | 3/2010 | Webber et al. |
| 7,670,270 | B2 | 3/2010 | Alessandri et al. |
| 7,674,205 | B2 | 3/2010 | Dalebout et al. |
| 7,674,206 | B2 | 3/2010 | Jones |
| 7,674,216 | B1 | 3/2010 | Bolling |
| 7,676,332 | B2 | 3/2010 | Damen |
| 7,677,518 | B2 | 3/2010 | Chouinard et al. |
| 7,677,723 | B2 | 3/2010 | Howell et al. |
| 7,678,023 | B1 | 3/2010 | Shea |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,683,252 | B2 | 3/2010 | Oliver et al. |
| 7,689,437 | B1 | 3/2010 | Teller et al. |
| 7,690,556 | B1 | 4/2010 | Kahn et al. |
| 7,691,042 | B2 | 4/2010 | Pandozy |
| 7,695,409 | B2 | 4/2010 | Helie et al. |
| 7,698,101 | B2 | 4/2010 | Alten et al. |
| 7,698,359 | B2 | 4/2010 | Wray et al. |
| 7,699,752 | B1 | 4/2010 | Anderson |
| 7,699,753 | B2 | 4/2010 | Daikeler |
| 7,699,754 | B2 | 4/2010 | Schneider |
| 7,699,755 | B2 | 4/2010 | Feldman et al. |
| 7,702,781 | B2 | 4/2010 | Devolites |

(56) References Cited

U.S. PATENT DOCUMENTS

| | | | |
|---|---|---|---|
| 7,703,974 | B2 | 4/2010 | Bouille |
| 7,704,191 | B2 | 4/2010 | Smith et al. |
| 7,704,192 | B2 | 4/2010 | Dyer et al. |
| 7,704,195 | B2 | 4/2010 | Alessandri et al. |
| 7,705,230 | B2 | 4/2010 | Bowen |
| 7,708,668 | B2 | 5/2010 | Rodgers, Jr. |
| 7,708,672 | B2 | 5/2010 | Gibson et al. |
| 7,713,171 | B1 | 5/2010 | Hickman |
| 7,713,172 | B2 | 5/2010 | Watterson et al. |
| 7,713,177 | B2 | 5/2010 | Lo |
| 7,717,825 | B2 | 5/2010 | Van Der Hoeven |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,717,833 | B1 | 5/2010 | Nelson et al. |
| 7,717,866 | B2 | 5/2010 | Damen |
| 7,722,503 | B1 | 5/2010 | Smith et al. |
| 7,722,509 | B2 | 5/2010 | Eder |
| 7,725,362 | B2 | 5/2010 | Weathers, Jr. |
| 7,727,117 | B2 | 6/2010 | Feldman et al. |
| 7,727,125 | B2 | 6/2010 | Day |
| 7,728,214 | B2 | 6/2010 | Oliver et al. |
| 7,730,588 | B1 | 6/2010 | Bernier |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,739,076 | B1 | 6/2010 | Vock et al. |
| 7,740,562 | B2 | 6/2010 | Jones |
| 7,740,563 | B2 | 6/2010 | Dalebout et al. |
| 7,740,568 | B2 | 6/2010 | Webb |
| 7,740,570 | B2 | 6/2010 | Winston |
| 7,740,588 | B1 | 6/2010 | Sciarra |
| 7,745,716 | B1 | 6/2010 | Murphy |
| 7,747,671 | B2 | 6/2010 | Ku |
| 7,749,137 | B2 | 7/2010 | Watt et al. |
| 7,749,140 | B1 | 7/2010 | Lindemeier et al. |
| 7,753,824 | B2 | 7/2010 | Wang |
| 7,753,825 | B2 | 7/2010 | Jaquish et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,758,523 | B2 | 7/2010 | Collings et al. |
| 7,761,300 | B2 | 7/2010 | Klingler |
| 7,762,931 | B2 | 7/2010 | Fisher et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,764,990 | B2 | 7/2010 | Martikka et al. |
| 7,765,348 | B2 | 7/2010 | Dybsetter |
| 7,766,794 | B2 | 8/2010 | Oliver et al. |
| 7,766,797 | B2 | 8/2010 | Dalebout |
| 7,766,798 | B2 | 8/2010 | Hamilton |
| 7,770,181 | B2 | 8/2010 | Snover et al. |
| 7,771,319 | B1 | 8/2010 | Lannon |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,952 | B1 | 8/2010 | Curran et al. |
| 7,775,953 | B2 | 8/2010 | Wang |
| 7,780,578 | B2 | 8/2010 | Packham |
| 7,780,583 | B2 | 8/2010 | Brown |
| 7,780,585 | B1 | 8/2010 | Rivas |
| 7,789,800 | B1 | 9/2010 | Watterson et al. |
| 7,789,806 | B2 | 9/2010 | Yang |
| 7,794,014 | B2 | 9/2010 | Beall et al. |
| 7,794,363 | B2 | 9/2010 | Wang |
| 7,794,371 | B2 | 9/2010 | Webber et al. |
| 7,795,824 | B2 | 9/2010 | Shen et al. |
| 7,798,942 | B2 | 9/2010 | Digiulio |
| 7,798,946 | B2 | 9/2010 | Dalebout et al. |
| 7,803,096 | B2 | 9/2010 | Mehta |
| 7,805,149 | B2 | 9/2010 | Werner et al. |
| 7,806,780 | B1 | 10/2010 | Plunkett |
| 7,806,805 | B2 | 10/2010 | Barufka et al. |
| 7,806,806 | B2 | 10/2010 | Jaquish |
| 7,806,815 | B2 | 10/2010 | Fernandez |
| 7,809,153 | B2 | 10/2010 | Bravomalo et al. |
| 7,811,200 | B2 | 10/2010 | Lai |
| 7,811,201 | B1 | 10/2010 | Mikan et al. |
| 7,811,202 | B2 | 10/2010 | Planke |
| 7,811,209 | B2 | 10/2010 | Crawford et al. |
| 7,811,213 | B2 | 10/2010 | Chen |
| 7,813,715 | B2 | 10/2010 | McKillop et al. |
| 7,815,548 | B2 | 10/2010 | Barre et al. |
| 7,815,549 | B2 | 10/2010 | Crawford et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,784 | B1 | 10/2010 | Caswell et al. |
| 7,819,785 | B2 | 10/2010 | Maiaro et al. |
| 7,822,547 | B2 | 10/2010 | Lindroos |
| 7,825,319 | B2 | 11/2010 | Turner |
| 7,827,000 | B2 | 11/2010 | Stirling et al. |
| 7,828,703 | B1 | 11/2010 | Boesch |
| 7,830,570 | B2 | 11/2010 | Morita et al. |
| 7,833,129 | B2 | 11/2010 | Badarneh |
| 7,833,135 | B2 | 11/2010 | Radow |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,596 | B2 | 11/2010 | Astilean |
| 7,837,598 | B1 | 11/2010 | Boozel, Jr. |
| 7,837,599 | B2 | 11/2010 | Kowalczewski et al. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,840,346 | B2 | 11/2010 | Huhtala et al. |
| 7,841,967 | B1 | 11/2010 | Kahn |
| 7,841,971 | B2 | 11/2010 | Smith |
| 7,846,067 | B2 | 12/2010 | Hanoun |
| 7,846,070 | B2 | 12/2010 | Oglesby et al. |
| 7,846,080 | B2 | 12/2010 | Boren |
| 7,850,584 | B2 | 12/2010 | Uygan |
| 7,854,669 | B2 | 12/2010 | Marty et al. |
| 7,857,731 | B2 | 12/2010 | Hickman et al. |
| 7,857,732 | B2 | 12/2010 | Nielson |
| 7,862,476 | B2 | 1/2011 | Radow |
| 7,862,478 | B2 | 1/2011 | Watterson et al. |
| 7,862,483 | B2 | 1/2011 | Hendrickson et al. |
| 7,862,486 | B1 | 1/2011 | Watson |
| 7,862,489 | B2 | 1/2011 | Savsek et al. |
| 7,867,088 | B2 | 1/2011 | Prum |
| 7,871,355 | B2 | 1/2011 | Yeh |
| 7,871,357 | B2 | 1/2011 | Gibson et al. |
| 7,874,957 | B2 | 1/2011 | Hurwitz et al. |
| 7,874,961 | B2 | 1/2011 | McKee et al. |
| 7,878,950 | B1 | 2/2011 | Bastian |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,894,177 | B2 | 2/2011 | Rothkopf |
| 7,894,849 | B2 | 2/2011 | Kass et al. |
| 7,896,782 | B2 | 3/2011 | Tamari |
| 7,900,324 | B2 | 3/2011 | Ginocchio |
| 7,901,292 | B1 | 3/2011 | Uhlir et al. |
| 7,901,323 | B2 | 3/2011 | Olason et al. |
| 7,901,324 | B2 | 3/2011 | Kodama |

(56) References Cited

U.S. PATENT DOCUMENTS

| | | | |
|---|---|---|---|
| 7,901,325 | B2 | 3/2011 | Henderson |
| 7,901,335 | B2 | 3/2011 | Webber et al. |
| 7,908,981 | B2 | 3/2011 | Agee |
| 7,909,741 | B2 | 3/2011 | Kim et al. |
| 7,909,742 | B2 | 3/2011 | Ish, III et al. |
| 7,909,743 | B1 | 3/2011 | Webber |
| 7,909,745 | B2 | 3/2011 | Mills et al. |
| 7,913,297 | B2 | 3/2011 | Wyld |
| 7,914,420 | B2 | 3/2011 | Daly et al. |
| 7,914,421 | B2 | 3/2011 | Weier et al. |
| 7,914,425 | B2 | 3/2011 | Hanoun |
| 7,914,468 | B2 | 3/2011 | Shalon et al. |
| 7,917,148 | B2 | 3/2011 | Rosenberg |
| 7,918,732 | B2 | 4/2011 | Van Noland |
| 7,919,950 | B2 | 4/2011 | Uno et al. |
| 7,922,635 | B2 | 4/2011 | Lull et al. |
| 7,927,253 | B2 | 4/2011 | Vincent |
| 7,927,258 | B2 | 4/2011 | Irving et al. |
| 7,931,563 | B2 | 4/2011 | Shaw et al. |
| 7,931,570 | B2 | 4/2011 | Hoffman |
| 7,934,983 | B1 | 5/2011 | Eisner |
| 7,935,026 | B2 | 5/2011 | Mcsorley |
| 7,935,032 | B1 | 5/2011 | Jackson |
| 7,938,751 | B2 | 5/2011 | Nicolas et al. |
| 7,938,752 | B1 | 5/2011 | Wang |
| 7,938,755 | B1 | 5/2011 | Dyer et al. |
| 7,938,760 | B1 | 5/2011 | Webber et al. |
| 7,938,761 | B2 | 5/2011 | Simonson |
| 7,942,788 | B2 | 5/2011 | Wu |
| 7,942,793 | B2 | 5/2011 | Mills et al. |
| 7,946,959 | B2 | 5/2011 | Shum et al. |
| 7,946,961 | B2 | 5/2011 | Blum et al. |
| 7,946,968 | B2 | 5/2011 | Kjellberg |
| 7,949,295 | B2 | 5/2011 | Kumar et al. |
| 7,950,297 | B2 | 5/2011 | Moore et al. |
| 7,951,046 | B1 | 5/2011 | Barber, Jr. |
| 7,953,549 | B2 | 5/2011 | Graham et al. |
| 7,955,219 | B2 | 6/2011 | Birrell et al. |
| 7,959,124 | B2 | 6/2011 | Phifer et al. |
| 7,959,567 | B2 | 6/2011 | Stivoric et al. |
| 7,963,889 | B2 | 6/2011 | Badarneh et al. |
| 7,963,892 | B2 | 6/2011 | Poblete Castro et al. |
| 7,967,728 | B2 | 6/2011 | Zavadsky |
| 7,967,734 | B1 | 6/2011 | Damian |
| 7,968,574 | B2 | 6/2011 | Hangauer, Jr. |
| 7,972,245 | B2 | 7/2011 | Temple et al. |
| 7,972,247 | B2 | 7/2011 | Daikeler |
| 7,972,249 | B1 | 7/2011 | Napalan |
| 7,973,231 | B2 | 7/2011 | Bowen |
| 7,974,889 | B2 | 7/2011 | Raimbeault |
| 7,976,437 | B1 | 7/2011 | Von Detten |
| 7,976,443 | B2 | 7/2011 | Krull |
| 7,976,518 | B2 | 7/2011 | Shaughnessy et al. |
| 7,978,081 | B2 | 7/2011 | Shears et al. |
| 7,980,996 | B2 | 7/2011 | Hickman |
| 7,981,000 | B2 | 7/2011 | Watterson et al. |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ashby |
| 7,988,598 | B2 | 8/2011 | Trzecieski |
| 7,988,599 | B2 | 8/2011 | Ainsworth et al. |
| 7,988,600 | B2 | 8/2011 | Rodgers, Jr. |
| 7,988,605 | B1 | 8/2011 | Wyeroski |
| 7,993,251 | B1 | 8/2011 | Webber et al. |
| 7,998,036 | B2 | 8/2011 | Ish, III |
| 7,998,042 | B2 | 8/2011 | Bowser et al. |
| 8,001,472 | B2 | 8/2011 | Gilley et al. |
| 8,002,671 | B1 | 8/2011 | Vigilia |
| 8,002,674 | B2 | 8/2011 | Piaget et al. |
| 8,002,678 | B1 | 8/2011 | Krull |
| 8,002,684 | B2 | 8/2011 | Laurent |
| 8,006,711 | B2 | 8/2011 | Pietrzak et al. |
| 8,007,409 | B2 | 8/2011 | Elllis |
| 8,007,413 | B1 | 8/2011 | Wu |
| 8,007,415 | B1 | 8/2011 | Lundquist |
| RE42,698 | E | 9/2011 | Kuo et al. |
| 8,012,064 | B2 | 9/2011 | Martens |
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,021,270 | B2 | 9/2011 | Eredita |
| 8,021,277 | B2 | 9/2011 | Baudhuin |
| 8,025,607 | B2 | 9/2011 | Ranky et al. |
| 8,025,608 | B2 | 9/2011 | Popescu |
| 8,025,612 | B1 | 9/2011 | Buzzanco |
| 8,025,613 | B1 | 9/2011 | Wang |
| 8,028,443 | B2 | 10/2011 | Case, Jr. |
| 8,029,415 | B2 | 10/2011 | Ashby et al. |
| 8,029,425 | B2 | 10/2011 | Bronston et al. |
| 8,033,959 | B2 | 10/2011 | Oleson et al. |
| 8,033,960 | B1 | 10/2011 | Dalebout et al. |
| 8,033,965 | B1 | 10/2011 | Krull |
| 8,034,294 | B1 | 10/2011 | Goldberg |
| 8,037,017 | B2 | 10/2011 | Samn |
| 8,038,577 | B2 | 10/2011 | Mcintosh |
| 8,040,758 | B1 | 10/2011 | Dickinson |
| 8,043,173 | B2 | 10/2011 | Menalagha et al. |
| 8,046,803 | B1 | 10/2011 | Lee |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,580 | B2 | 11/2011 | Saalasti et al. |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,360 | B2 | 11/2011 | Shea |
| 8,057,367 | B2 | 11/2011 | Giannelli et al. |
| 8,057,368 | B1 | 11/2011 | Lyszczarz |
| 8,062,182 | B2 | 11/2011 | Somers |
| 8,062,192 | B1 | 11/2011 | Arstein |
| 8,062,196 | B1 | 11/2011 | Khubani |
| 8,065,185 | B2 | 11/2011 | Foladare et al. |
| 8,066,514 | B2 | 11/2011 | Clarke |
| 8,070,655 | B1 | 12/2011 | Napolitano |
| 8,070,657 | B2 | 12/2011 | Loach |
| 8,072,902 | B2 | 12/2011 | Moon |
| 8,075,453 | B1 | 12/2011 | Wilkinson |
| 8,078,426 | B2 | 12/2011 | Pipinich et al. |
| 8,079,939 | B1 | 12/2011 | Wang |
| 8,082,029 | B2 | 12/2011 | Honda |
| 8,083,643 | B2 | 12/2011 | Ng et al. |
| 8,083,693 | B1 | 12/2011 | McKeon et al. |
| 8,086,421 | B2 | 12/2011 | Case, Jr. et al. |
| 8,088,043 | B2 | 1/2012 | Andren et al. |
| 8,088,044 | B2 | 1/2012 | Tchao et al. |
| 8,092,351 | B1 | 1/2012 | Rodgers, Jr. |
| 8,092,381 | B2 | 1/2012 | Edwards |
| 8,096,926 | B1 | 1/2012 | Batca |
| 8,101,843 | B2 | 1/2012 | Turner |
| 8,103,379 | B2 | 1/2012 | Biba et al. |
| 8,103,517 | B2 | 1/2012 | Hinnebusch |
| 8,104,411 | B2 | 1/2012 | Fenton |
| 8,105,207 | B1 | 1/2012 | Lannon |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,112,281 | B2 | 2/2012 | Yeung et al. |
| 8,113,990 | B2 | 2/2012 | Kolman et al. |
| 8,113,991 | B2 | 2/2012 | Kutliroff |
| 8,113,994 | B2 | 2/2012 | Piaget et al. |
| 8,116,841 | B2 | 2/2012 | Bly et al. |
| 8,121,785 | B2 | 2/2012 | Swisher et al. |
| 8,123,527 | B2 | 2/2012 | Holljes |
| 8,128,533 | B2 | 3/2012 | Nakagawa et al. |
| 8,141,276 | B2 | 3/2012 | Ellis |
| 8,142,298 | B2 | 3/2012 | King et al. |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |

(56) References Cited

U.S. PATENT DOCUMENTS

| | | | |
|---|---|---|---|
| 8,152,693 | B2 | 4/2012 | Nurmela et al. |
| 8,152,695 | B2 | 4/2012 | Riley et al. |
| 8,152,702 | B2 | 4/2012 | Pacheco |
| 8,157,706 | B2 | 4/2012 | Ainsworth et al. |
| 8,157,731 | B2 | 4/2012 | Teller et al. |
| 8,162,804 | B2 | 4/2012 | Tagliabue |
| 8,162,857 | B2 | 4/2012 | Lanfermann et al. |
| 8,165,893 | B1 | 4/2012 | Goldberg et al. |
| 8,167,776 | B2 | 5/2012 | Lannon |
| 8,172,723 | B1 | 5/2012 | Yanev et al. |
| 8,172,729 | B2 | 5/2012 | Ellis |
| 8,172,882 | B2 | 5/2012 | Klyce et al. |
| 8,176,101 | B2 | 5/2012 | Rosenberg |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,188,868 | B2 | 5/2012 | Case, Jr. |
| 8,192,332 | B2 | 6/2012 | Baker et al. |
| 8,197,392 | B2 | 6/2012 | Silverman et al. |
| 8,200,323 | B2 | 6/2012 | Dibenedetto et al. |
| 8,206,274 | B2 | 6/2012 | Svenberg et al. |
| 8,212,445 | B2 | 7/2012 | Ritchey |
| 8,213,908 | B2 | 7/2012 | Sangster et al. |
| 8,215,886 | B2 | 7/2012 | Campbell |
| 8,221,290 | B2 | 7/2012 | Vincent et al. |
| 8,221,292 | B2 | 7/2012 | Barker et al. |
| 8,224,429 | B2 | 7/2012 | Prstojevich et al. |
| 8,225,024 | B2 | 7/2012 | Dybsetter |
| 8,231,506 | B2 | 7/2012 | Molyneux et al. |
| 8,235,724 | B2 | 8/2012 | Gilley et al. |
| 8,240,430 | B2 | 8/2012 | Downey |
| 8,241,118 | B2 | 8/2012 | Camhi |
| 8,241,186 | B2 | 8/2012 | Brodess et al. |
| 8,241,187 | B2 | 8/2012 | Moon et al. |
| 8,249,686 | B2 | 8/2012 | Libbus et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,253,586 | B1 | 8/2012 | Matak |
| 8,257,228 | B2 | 9/2012 | Quatrochi et al. |
| 8,260,667 | B2 | 9/2012 | Graham et al. |
| 8,260,858 | B2 | 9/2012 | Belz et al. |
| 8,262,546 | B1 | 9/2012 | Lashinske |
| 8,269,093 | B2 | 9/2012 | Naik et al. |
| 8,272,996 | B2 | 9/2012 | Weier |
| 8,275,143 | B2 | 9/2012 | Johnson |
| 8,275,265 | B2 | 9/2012 | Kobyakov et al. |
| 8,276,434 | B2 | 10/2012 | Senoo |
| 8,280,259 | B2 | 10/2012 | George et al. |
| 8,287,434 | B2 | 10/2012 | Zavadsky et al. |
| 8,296,172 | B2 | 10/2012 | Marci et al. |
| 8,298,123 | B2 | 10/2012 | Hickman |
| 8,298,125 | B2 | 10/2012 | Colledge et al. |
| 8,306,635 | B2 | 11/2012 | Pryor |
| 8,308,620 | B2 | 11/2012 | Lyszczarz |
| 8,308,794 | B2 | 11/2012 | Martinson et al. |
| 8,314,840 | B1 | 11/2012 | Funk |
| 8,315,636 | B2 | 11/2012 | Moon et al. |
| 8,315,823 | B2 | 11/2012 | Berme et al. |
| 8,320,578 | B2 | 11/2012 | Kahn et al. |
| 8,321,004 | B2 | 11/2012 | Moon et al. |
| 8,332,544 | B1 | 12/2012 | Ralls et al. |
| 8,333,681 | B2 | 12/2012 | Schmidt |
| 8,337,335 | B2 | 12/2012 | Dugan |
| 8,341,557 | B2 | 12/2012 | Pisula et al. |
| 8,343,016 | B1 | 1/2013 | Astilean |
| 8,348,840 | B2 | 1/2013 | Heit et al. |
| 8,360,785 | B2 | 1/2013 | Park et al. |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,363,913 | B2 | 1/2013 | Boushey et al. |
| 8,364,250 | B2 | 1/2013 | Moon et al. |
| 8,364,389 | B2 | 1/2013 | Dorogusker et al. |
| 8,368,329 | B1 | 2/2013 | Depew et al. |
| 8,369,936 | B2 | 2/2013 | Farringdon et al. |
| 8,371,990 | B2 | 2/2013 | Shea |
| 8,374,688 | B2 | 2/2013 | Libbus et al. |
| 8,376,910 | B2 | 2/2013 | Cheung et al. |
| 8,378,647 | B2 | 2/2013 | Yonezawa et al. |
| 8,384,551 | B2 | 2/2013 | Ross et al. |
| 8,394,005 | B2 | 3/2013 | Solow et al. |
| 8,395,366 | B2 | 3/2013 | Uno |
| 8,398,529 | B2 | 3/2013 | Ellis |
| 8,398,546 | B2 | 3/2013 | Pacione et al. |
| 8,403,845 | B2 | 3/2013 | Stivoric et al. |
| 8,407,623 | B2 | 3/2013 | Kerr et al. |
| 8,412,317 | B2 | 4/2013 | Mazar |
| 8,419,593 | B2 | 4/2013 | Ainsworth et al. |
| 8,429,223 | B2 | 4/2013 | Gilley et al. |
| 8,430,770 | B2 | 4/2013 | Dugan |
| 8,435,160 | B1 | 5/2013 | Clum |
| 8,437,824 | B2 | 5/2013 | Moon et al. |
| 8,444,537 | B1 | 5/2013 | Santoro |
| 8,446,275 | B2 | 5/2013 | Utter, II |
| 8,449,620 | B2 | 5/2013 | Hakansson et al. |
| 8,452,259 | B2 | 5/2013 | Ellis et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,460,001 | B1 | 6/2013 | Chuang |
| 8,460,189 | B2 | 6/2013 | Libbus et al. |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,475,370 | B2 | 7/2013 | McCombie et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,982 | B2 | 7/2013 | Gavish et al. |
| 8,485,996 | B2 | 7/2013 | Bluman |
| 8,487,759 | B2 | 7/2013 | Hill |
| 8,491,446 | B2 | 7/2013 | Hinds et al. |
| 8,491,572 | B2 | 7/2013 | Martinson et al. |
| 8,493,822 | B2 | 7/2013 | Lee et al. |
| 8,500,608 | B1 | 8/2013 | Bonomi |
| 8,503,086 | B2 | 8/2013 | French et al. |
| 8,505,597 | B2 | 8/2013 | Sharperson |
| 8,506,370 | B2 | 8/2013 | Homsi |
| 8,506,457 | B2 | 8/2013 | Baudhuin |
| 8,506,458 | B2 | 8/2013 | Dugan |
| 8,506,459 | B2 | 8/2013 | Cassidy et al. |
| 8,512,210 | B2 | 8/2013 | Shauli |
| 8,512,212 | B2 | 8/2013 | Ish, III |
| 8,515,930 | B2 | 8/2013 | Hong |
| 8,516,723 | B2 | 8/2013 | Ferrigan et al. |
| 8,517,896 | B2 | 8/2013 | Robinette et al. |
| 8,517,899 | B2 | 8/2013 | Zhou |
| 8,523,743 | B1 | 9/2013 | Miles et al. |
| 8,523,789 | B2 | 9/2013 | Keiser |
| 8,527,038 | B2 | 9/2013 | Moon et al. |
| 8,529,409 | B1 | 9/2013 | Lesea-Ames |
| 8,529,415 | B2 | 9/2013 | Svenberg |
| 8,531,386 | B1 | 9/2013 | Kerr et al. |
| 8,533,007 | B2 | 9/2013 | Egami et al. |
| 8,533,620 | B2 | 9/2013 | Hoffman et al. |
| 8,535,204 | B2 | 9/2013 | Stacey |
| 8,535,247 | B2 | 9/2013 | Williams |
| 8,538,333 | B2 | 9/2013 | Jain et al. |
| 8,538,723 | B2 | 9/2013 | Chang |
| 8,540,560 | B2 | 9/2013 | Crowley et al. |
| 8,540,641 | B2 | 9/2013 | Kroll et al. |
| 8,543,185 | B2 | 9/2013 | Yuen et al. |
| 8,545,417 | B2 | 10/2013 | Banet et al. |
| 8,550,962 | B2 | 10/2013 | Piaget et al. |
| 8,550,964 | B2 | 10/2013 | Ish, III et al. |
| 8,554,214 | B2 | 10/2013 | Sweeney et al. |
| 8,554,802 | B1 | 10/2013 | Barden et al. |
| 8,556,778 | B1 | 10/2013 | Dugan |
| 8,560,951 | B1 | 10/2013 | Snyder et al. |

(56) References Cited

U.S. PATENT DOCUMENTS 8,562,489 B2 10/2013 Burton et al.
8,562,496 B2 10/2013 Webber et al.
8,568,278 B2 10/2013 Riley et al.
8,568,279 B2 10/2013 Golesh
8,571,880 B2 10/2013 Goldberg
8,572,576 B2 10/2013 Elvanoglu et al.
8,572,764 B2 11/2013 Thellmann
8,572,820 B2 11/2013 Richards
8,573,572 B2 11/2013 Bowen et al.
8,573,982 B1 11/2013 Chuang
8,579,767 B2 11/2013 Ellis et al.
8,585,561 B2 11/2013 Watt et al.
8,588,476 B1 11/2013 Spicola, Jr.
8,590,120 B2 11/2013 Sakai
8,591,386 B2 11/2013 Meyer
8,591,411 B2 11/2013 Banet et al.
8,594,772 B2 11/2013 Eggenberger et al.
RE44,650 E 12/2013 Anderson
8,597,093 B2 12/2013 Engelberg et al.
8,602,951 B2 12/2013 Morris
8,602,997 B2 12/2013 Banet et al.
8,605,048 B2 12/2013 Ye et al.
8,608,624 B2 12/2013 Shabodyash et al.
8,610,593 B2 12/2013 Van Acht et al.
8,613,689 B2 12/2013 Dyer et al.
8,614,595 B2 12/2013 Acatrinei
8,614,902 B2 12/2013 Pansier et al.
8,617,008 B2 12/2013 Marty et al.
8,622,873 B2 1/2014 McGown
8,628,333 B2 1/2014 Prinzel, III et al.
8,628,453 B2 1/2014 Balakrishnan et al.
8,631,544 B1 1/2014 Shotey et al.
8,639,020 B1 1/2014 Kutliroff et al.
8,647,239 B1 2/2014 Sokolovas
8,647,240 B2 2/2014 Heidecke
8,649,890 B2 2/2014 Martin
8,652,010 B2 2/2014 Ellis et al.
8,654,198 B2 2/2014 Pryor
8,655,004 B2 2/2014 Prest et al.
8,657,724 B2 2/2014 Yang
8,662,901 B2 3/2014 Tzao et al.
8,663,106 B2 3/2014 Stivoric et al.
8,667,194 B2 3/2014 Dybsetter et al.
8,670,222 B2 3/2014 Rothkopf
8,672,852 B2 3/2014 Gavish
8,676,170 B2 3/2014 Porrati et al.
8,676,541 B2 3/2014 Schrock et al.
8,678,979 B2 3/2014 Stark et al.
8,684,925 B2 4/2014 Manicka et al.
8,690,578 B1 4/2014 Nusbaum et al.
8,690,735 B2 4/2014 Watterson et al.
8,690,738 B1 4/2014 Astilian
8,696,527 B2 4/2014 Wu
8,701,567 B1 4/2014 Esfandiari et al.
8,702,430 B2 4/2014 Dibenedetto et al.
8,702,567 B2 4/2014 Hu
8,704,068 B2 4/2014 Bowen
8,706,530 B2 4/2014 Ohnemus et al.
8,708,842 B2 4/2014 Ganuza
8,708,870 B2 4/2014 Nalley
8,712,510 B2 4/2014 Quy
8,715,140 B1 5/2014 Gertz
8,718,752 B2 5/2014 Libbus et al.
8,719,202 B1 5/2014 Maeng
8,727,947 B2 5/2014 Tagliabue
8,734,157 B1 5/2014 Hummel, III
8,734,296 B1 5/2014 Brumback et al.
8,734,301 B2 5/2014 Remelius
8,734,302 B2 5/2014 Hsieh
8,734,304 B2 5/2014 Webber et al.
8,734,308 B1 5/2014 Joslin
8,738,732 B2 5/2014 Karidi
8,740,751 B2 6/2014 Shum
8,740,753 B2 6/2014 Olson et al.
8,740,756 B2 6/2014 Shabodyash et al.
8,740,802 B2 6/2014 Shabodyash et al.
8,740,807 B2 6/2014 Banet et al.
8,744,803 B2 6/2014 Park et al.
8,745,104 B1 6/2014 Rosenberg
8,745,496 B2 6/2014 Gilley et al.
8,747,330 B2 6/2014 Banet et al.
8,749,380 B2 6/2014 Vock et al.
8,758,201 B2 6/2014 Ashby et al.
8,762,101 B2 6/2014 Yuen et al.
8,762,167 B2 6/2014 Blander et al.
8,762,313 B2 6/2014 Lahav et al.
8,764,609 B1 7/2014 Elahmadie
8,764,651 B2 7/2014 Tran
8,768,769 B2 7/2014 Foladare et al.
8,770,742 B2 7/2014 Howell et al.
8,771,153 B2 7/2014 Dalebout et al.
8,771,206 B2 7/2014 Gettelman et al.
8,775,454 B2 7/2014 Geer
8,776,264 B2 7/2014 Kiernan
8,777,815 B2 7/2014 Case, Jr. et al.
8,777,820 B2 7/2014 Lo
8,781,568 B2 7/2014 Dugan
8,783,326 B1 7/2014 Vaninger et al.
8,784,271 B2 7/2014 Brumback et al.
8,784,273 B2 7/2014 Dugan
8,784,274 B1 7/2014 Chuang
8,784,286 B2 7/2014 Reyes
8,790,220 B2 7/2014 Karvonen
8,790,222 B2 7/2014 Burger
8,790,259 B2 7/2014 Katra et al.
8,795,138 B1 8/2014 Yeh et al.
8,799,200 B2 8/2014 Lahav
8,801,581 B2 8/2014 Lai et al.
8,805,844 B2 8/2014 Schorzman et al.
8,805,941 B2 8/2014 Barak et al.
8,808,152 B1 * 8/2014 Midgett ..... A63B 21/015
482/146
8,814,754 B2 8/2014 Weast et al.
8,815,189 B2 8/2014 Arnold et al.
8,821,350 B2 9/2014 Maertz
8,821,351 B2 9/2014 Abuelsaad et al.
8,821,354 B1 9/2014 Kassel
8,821,359 B1 9/2014 Kassel
8,821,870 B2 9/2014 Robinson et al.
8,824,697 B2 9/2014 Christoph
8,825,445 B2 9/2014 Hoffman et al.
8,827,870 B2 9/2014 Dyer et al.
8,827,879 B2 9/2014 Nicholas
8,831,407 B2 9/2014 Meschter et al.
8,831,538 B2 9/2014 Yuen
8,838,471 B1 9/2014 Shum et al.
8,845,497 B2 9/2014 Turner
8,845,498 B2 9/2014 Webb
8,845,499 B1 9/2014 Boatwright
8,847,988 B2 9/2014 Geisner et al.
8,851,565 B2 10/2014 Hontz et al.
8,861,860 B2 10/2014 Gupta
8,864,587 B2 10/2014 Framel et al.
8,864,627 B2 10/2014 Bayerlein et al.
8,868,448 B2 10/2014 Freishtat et al.
8,870,720 B1 10/2014 Webber et al.
8,870,791 B2 10/2014 Sabatino
8,876,131 B1 11/2014 Gomes
8,876,661 B2 11/2014 Lu
8,876,674 B2 11/2014 Webb et al.
8,882,637 B2 11/2014 Ainsworth et al.
8,882,666 B1 11/2014 Goldberg et al.
8,888,583 B2 11/2014 Dugan et al.
8,888,660 B1 11/2014 Oteman
8,888,700 B2 11/2014 Banet et al.
8,894,551 B2 11/2014 Kerdjoudj
8,897,868 B2 11/2014 Mazar et al.
8,900,099 B1 12/2014 Boyette
8,902,714 B2 12/2014 Gossweiler, III et al.
8,903,671 B2 12/2014 Park et al.
8,908,894 B2 12/2014 Amento et al.
8,915,823 B2 12/2014 McKirdy et al.
8,918,465 B2 12/2014 Barak
8,918,543 B2 12/2014 Karstens

(56) References Cited

U.S. PATENT DOCUMENTS

| | | | |
|---|---|---|---|
| 8,920,291 | B2 | 12/2014 | Chen et al. |
| 8,920,332 | B2 | 12/2014 | Hong et al. |
| 8,920,343 | B2 | 12/2014 | Sabatino |
| 8,926,475 | B2 | 1/2015 | Lin et al. |
| 8,926,479 | B2 | 1/2015 | Chen et al. |
| 8,932,188 | B2 | 1/2015 | Svenberg |
| 8,939,831 | B2 | 1/2015 | Dugan |
| 8,943,002 | B2 | 1/2015 | Zelenko et al. |
| 8,944,958 | B1 | 2/2015 | Brumback et al. |
| 8,944,968 | B2 | 2/2015 | Baudhuin |
| 8,945,328 | B2 | 2/2015 | Longinotti-Buitoni et al. |
| 8,947,226 | B2 | 2/2015 | Dugan |
| 8,951,106 | B2 | 2/2015 | Crowley |
| 8,951,164 | B2 | 2/2015 | Morris et al. |
| 8,951,168 | B2 | 2/2015 | Baudhuin |
| 8,954,135 | B2 | 2/2015 | Yuen et al. |
| 8,954,290 | B2 | 2/2015 | Yuen et al. |
| 8,956,268 | B2 | 2/2015 | Huang et al. |
| 8,956,290 | B2 | 2/2015 | Gilley et al. |
| 8,956,303 | B2 | 2/2015 | Hong et al. |
| 8,956,715 | B2 | 2/2015 | Kim |
| 8,958,631 | B2 | 2/2015 | Kutliroff et al. |
| 8,961,371 | B2 | 2/2015 | Sultan et al. |
| 8,961,413 | B2 | 2/2015 | Teller et al. |
| 8,961,414 | B2 | 2/2015 | Teller et al. |
| 8,965,348 | B1 | 2/2015 | Cronin |
| 8,965,498 | B2 | 2/2015 | Katra et al. |
| 8,965,541 | B2 | 2/2015 | Martinez et al. |
| 8,965,732 | B2 | 2/2015 | Robinette et al. |
| 8,968,155 | B2 | 3/2015 | Bird |
| 8,968,161 | B2 | 3/2015 | Shapiro et al. |
| 8,968,163 | B1 | 3/2015 | Vidmar |
| 8,972,199 | B2 | 3/2015 | Liang |
| 8,976,007 | B2 | 3/2015 | Dugan |
| 8,977,194 | B2 | 3/2015 | Jain et al. |
| 8,979,709 | B2 | 3/2015 | Toback et al. |
| 8,979,765 | B2 | 3/2015 | Banet et al. |
| 8,986,165 | B2 | 3/2015 | Ashby |
| 8,992,383 | B2 | 3/2015 | Bilang |
| 8,992,387 | B2 | 3/2015 | Watterson et al. |
| 9,005,085 | B2 | 4/2015 | Astilean |
| 9,005,129 | B2 | 4/2015 | Venkatraman et al. |
| 9,010,222 | B2 | 4/2015 | Peirce |
| 9,011,291 | B2 | 4/2015 | Birrell |
| 9,011,292 | B2 | 4/2015 | Weast et al. |
| 9,011,293 | B2 | 4/2015 | Shavit et al. |
| 9,011,301 | B2 | 4/2015 | Balandis et al. |
| 9,015,952 | B2 | 4/2015 | Magosaki |
| 9,017,230 | B1 | 4/2015 | Pitts |
| 9,022,906 | B1 | 5/2015 | Nelson |
| 9,022,907 | B2 | 5/2015 | Magosaki |
| 9,026,927 | B2 | 5/2015 | Brumback et al. |
| 9,028,368 | B2 | 5/2015 | Ashby et al. |
| 9,028,381 | B2 | 5/2015 | Mestemaker |
| 9,028,441 | B2 | 5/2015 | Kuhn |
| 9,031,812 | B2 | 5/2015 | Roberts et al. |
| 9,037,578 | B2 | 5/2015 | Brust et al. |
| 9,038,218 | B1 | 5/2015 | Heil et al. |
| 9,038,549 | B1 | 5/2015 | Zebarjad |
| 9,039,578 | B2 | 5/2015 | Dalebout |
| 9,039,581 | B2 | 5/2015 | Chia et al. |
| 9,039,614 | B2 | 5/2015 | Yuen et al. |
| 9,042,596 | B2 | 5/2015 | Connor |
| 9,050,491 | B2 | 6/2015 | Gordon et al. |
| 9,050,497 | B2 | 6/2015 | Reyes |
| 9,050,498 | B2 | 6/2015 | Lu et al. |
| 9,052,798 | B1 | 6/2015 | Klassen et al. |
| 9,055,868 | B2 | 6/2015 | Islam |
| 9,064,342 | B2 | 6/2015 | Yuen et al. |
| 9,069,380 | B2 | 6/2015 | Rahman et al. |
| 9,072,930 | B2 | 7/2015 | Ashby et al. |
| 9,072,932 | B2 | 7/2015 | Piaget et al. |
| 9,079,068 | B2 | 7/2015 | Muehl |
| 9,083,826 | B2 | 7/2015 | Lu et al. |
| 9,084,912 | B2 | 7/2015 | Jaquish et al. |
| 9,089,732 | B2 | 7/2015 | Andon et al. |
| 9,089,733 | B2 | 7/2015 | Fisbein et al. |
| 9,095,740 | B2 | 8/2015 | Wu |
| 9,107,586 | B2 | 8/2015 | Tran |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,123,317 | B2 | 9/2015 | Watterson et al. |
| 9,123,380 | B2 | 9/2015 | Holtz et al. |
| 9,125,620 | B2 | 9/2015 | Walke |
| 9,126,072 | B2 | 9/2015 | Watterson |
| 9,128,981 | B1 | 9/2015 | Geer |
| 9,132,051 | B2 | 9/2015 | Heil |
| 9,135,347 | B2 | 9/2015 | Damman et al. |
| 9,137,309 | B2 | 9/2015 | Ananny et al. |
| 9,138,612 | B2 | 9/2015 | Breaux |
| 9,138,614 | B2 | 9/2015 | Lu et al. |
| 9,138,615 | B2 | 9/2015 | Olson et al. |
| 9,141,087 | B2 | 9/2015 | Brown et al. |
| 9,143,881 | B2 | 9/2015 | Fan et al. |
| 9,144,703 | B2 | 9/2015 | Dalebout et al. |
| 9,144,709 | B2 | 9/2015 | Reich |
| 9,146,147 | B1 | 9/2015 | Bakhsh |
| 9,162,102 | B1 | 10/2015 | Eder et al. |
| 9,162,104 | B1 | 10/2015 | Lee |
| 9,162,106 | B1 | 10/2015 | Scheiman |
| 9,162,142 | B2 | 10/2015 | Shum et al. |
| 9,168,001 | B2 | 10/2015 | Stivoric et al. |
| 9,168,414 | B2 | 10/2015 | Liu et al. |
| 9,173,593 | B2 | 11/2015 | Banet et al. |
| 9,173,594 | B2 | 11/2015 | Banet et al. |
| 9,174,084 | B2 | 11/2015 | Morris et al. |
| 9,174,085 | B2 | 11/2015 | Foley |
| 9,178,635 | B2 | 11/2015 | Ben-Shlomo |
| 9,183,498 | B2 | 11/2015 | Landers |
| 9,186,537 | B2 | 11/2015 | Arnold et al. |
| 9,186,549 | B2 | 11/2015 | Watterson et al. |
| 9,186,552 | B1 | 11/2015 | Deal |
| 9,189,021 | B2 | 11/2015 | Jerauld |
| 9,192,800 | B1 | 11/2015 | Meyer et al. |
| 9,192,816 | B2 | 11/2015 | Molyneux et al. |
| 9,199,115 | B2 | 12/2015 | Yim et al. |
| 9,199,123 | B2 | 12/2015 | Solow |
| 9,201,405 | B2 | 12/2015 | Clarkson et al. |
| 9,201,458 | B2 | 12/2015 | Hunt et al. |
| 9,205,301 | B2 | 12/2015 | Cohen |
| 9,208,764 | B2 | 12/2015 | Ghosh et al. |
| 9,211,431 | B2 | 12/2015 | Hornback et al. |
| 9,211,433 | B2 * | 12/2015 | Hall ..... A63B 69/10 |
| 9,211,440 | B2 | 12/2015 | Lagree |
| 9,213,803 | B2 | 12/2015 | Rolley |
| 9,220,940 | B2 | 12/2015 | Al Kuwari |
| 9,221,545 | B2 | 12/2015 | Popescu et al. |
| 9,223,936 | B2 | 12/2015 | Aragones et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,229,476 | B2 | 1/2016 | Yanev et al. |
| 9,230,064 | B2 | 1/2016 | Yanev et al. |
| 9,233,269 | B2 | 1/2016 | Lannon |
| 9,241,635 | B2 | 1/2016 | Yuen et al. |
| 9,245,428 | B2 | 1/2016 | Weddle et al. |
| 9,247,543 | B2 | 1/2016 | Berlin et al. |
| 9,248,329 | B2 | 2/2016 | Heideman |
| 9,253,168 | B2 | 2/2016 | Panther |
| 9,254,099 | B2 | 2/2016 | Connor |
| 9,254,409 | B2 | 2/2016 | Dalebout et al. |
| 9,256,910 | B2 | 2/2016 | Goldberg |
| 9,257,054 | B2 | 2/2016 | Coza et al. |
| 9,258,670 | B2 | 2/2016 | Goyal et al. |
| 9,259,633 | B2 | 2/2016 | Meyers |
| 9,262,064 | B2 | 2/2016 | Yanev et al. |
| 9,265,984 | B2 | 2/2016 | Huber |
| 9,269,119 | B2 | 2/2016 | Warner |
| 9,272,183 | B2 | 3/2016 | Quy |
| 9,272,186 | B2 | 3/2016 | Reich |
| 9,275,617 | B2 | 3/2016 | Regnier |
| 9,279,734 | B2 | 3/2016 | Walker |

(56) References Cited

U.S. PATENT DOCUMENTS 9,283,429 B2 3/2016 Aragones et al.
9,288,298 B2 3/2016 Choudhary et al.
9,289,063 B2 3/2016 Baugh et al.
9,289,644 B2 3/2016 Carson
9,292,935 B2 3/2016 Koduri et al.
9,295,302 B1 3/2016 Reed et al.
9,295,422 B2 3/2016 Tai
9,295,894 B2 3/2016 Papadopolous
9,305,141 B2 4/2016 Fabrizio
9,308,409 B2 4/2016 Beaver et al.
9,308,415 B2 4/2016 Crawford et al.
9,308,417 B2 4/2016 Grundy
9,311,802 B1 4/2016 Chin et al.
9,314,658 B2 4/2016 Kaye
9,314,659 B2 4/2016 Gvoich
9,317,662 B2 4/2016 Bangera et al.
9,318,030 B2 4/2016 Harris et al.
9,320,935 B1 4/2016 Paris
9,320,938 B1 4/2016 Belmore
9,320,940 B2 4/2016 Rainey
9,327,159 B1 5/2016 Medina
9,329,053 B2 5/2016 Lakovic et al.
9,332,363 B2 5/2016 Jain et al.
9,333,388 B2 5/2016 Lee et al.
9,339,209 B2 5/2016 Banet et al.
9,339,681 B1 5/2016 Nalley
9,339,682 B2 5/2016 Braier et al.
9,339,683 B2 5/2016 Dilli et al.
9,339,691 B2 5/2016 Brammer
9,339,692 B2 5/2016 Hashish
9,345,947 B2 5/2016 Harris et al.
9,349,280 B2 5/2016 Baldwin et al.
9,350,598 B2 5/2016 Barak et al.
9,352,181 B2 5/2016 O'Neil
9,352,185 B2 5/2016 Hendrickson et al.
9,352,186 B2 5/2016 Watterson
9,352,187 B2 5/2016 Piaget et al.
9,357,551 B2 5/2016 Gutman
9,357,921 B2 6/2016 Chang et al.
9,358,422 B2 6/2016 Brontman
9,358,426 B2 6/2016 Aragones et al.
9,364,158 B2 6/2016 Banet et al.
9,364,703 B1 6/2016 Kuka
9,364,706 B2 6/2016 Lo
9,364,708 B2 6/2016 Luger et al.
9,364,712 B2 6/2016 Wu
9,364,714 B2 6/2016 Koduri et al.
9,367,668 B2 6/2016 Wu
9,370,679 B2 6/2016 Lagree et al.
9,370,687 B2 6/2016 Hao
9,374,279 B2 6/2016 Yuen et al.
9,375,602 B2 6/2016 Krull
9,375,629 B2 6/2016 Schieffer et al.
9,377,314 B2 6/2016 Tseng et al.
9,378,336 B2 6/2016 Ohnemus et al.
9,381,420 B2 7/2016 Burroughs
9,381,445 B2 7/2016 Ventura et al.
9,385,810 B2 7/2016 Hazani
9,387,355 B1 7/2016 Joya
9,387,357 B2 7/2016 Mueller
9,387,387 B2 7/2016 Dalebout
9,389,057 B2 7/2016 Meschter et al.
9,389,718 B1 7/2016 Letourneur
9,389,754 B2 7/2016 Reese et al.
9,390,229 B1 7/2016 Kahn et al.
9,392,941 B2 7/2016 Powch et al.
9,393,453 B2 * 7/2016 Watterson ..... A63B 21/00196
9,395,754 B2 7/2016 Cronin
9,401,078 B2 7/2016 Barrett
9,403,047 B2 8/2016 Olson et al.
9,403,048 B2 8/2016 Balandis et al.
9,403,053 B2 8/2016 Kaiser et al.
9,405,892 B2 8/2016 Baldwin et al.
9,409,047 B2 8/2016 Kamenskikh
9,409,050 B2 8/2016 Mintz
9,409,052 B2 8/2016 Werner
9,411,936 B2 8/2016 Landrum et al.
9,411,940 B2 8/2016 Burroughs et al.
9,415,257 B2 * 8/2016 Habing ..... A63B 21/22
9,420,083 B2 8/2016 Roberts et al.
9,420,542 B2 8/2016 Henia
9,421,422 B2 8/2016 Yuen et al.
9,421,448 B2 8/2016 Tropper et al.
9,422,018 B2 8/2016 Pelot et al.
9,427,611 B1 8/2016 Balentine
9,430,043 B1 8/2016 Amento et al.
9,430,920 B2 8/2016 Munro et al.
9,439,574 B2 9/2016 McCombie et al.
9,440,134 B2 9/2016 Nicora
9,442,100 B2 9/2016 Connor
9,446,288 B1 9/2016 Pazan
9,451,897 B2 9/2016 Mazar et al.
9,452,315 B1 9/2016 Murray et al.
9,452,320 B2 9/2016 Yang
9,455,784 B2 9/2016 Cune et al.
9,457,220 B2 10/2016 Olson
9,457,224 B2 10/2016 Giannelli et al.
9,457,256 B2 10/2016 Aragones et al.
9,460,421 B2 10/2016 Lai et al.
9,462,844 B2 10/2016 Schrock et al.
9,463,345 B2 10/2016 Simonetti
9,463,349 B1 10/2016 Chang
9,463,572 B2 10/2016 Parente
9,468,382 B2 10/2016 Hanoun
9,468,792 B2 10/2016 Simonetti
9,468,793 B2 10/2016 Salmon
9,468,794 B2 10/2016 Barton
9,473,593 B2 10/2016 Wallace
9,474,666 B1 10/2016 Smith
9,474,925 B1 10/2016 Hsiung
9,474,935 B2 10/2016 Abbondanza et al.
9,477,303 B2 10/2016 Fleischmann et al.
9,480,874 B2 11/2016 Cutler
9,486,070 B2 11/2016 Labrosse et al.
9,486,382 B1 11/2016 Boss
9,486,658 B2 11/2016 Alexander
9,491,562 B2 11/2016 Cronin
9,495,015 B1 11/2016 Kahn et al.
9,495,860 B2 11/2016 Lett
9,498,066 B2 11/2016 Bock
9,498,666 B1 11/2016 Boatwright
9,498,668 B2 11/2016 Smith
9,498,671 B1 11/2016 Softky
9,498,704 B1 11/2016 Cohen et al.
9,500,464 B2 11/2016 Coza
9,504,414 B2 11/2016 Coza et al.
9,505,241 B2 11/2016 Cuzin
9,506,528 B2 11/2016 Tucker et al.
9,506,529 B2 11/2016 Cogne et al.
9,509,269 B1 11/2016 Rosenberg
9,511,259 B2 12/2016 Mountain
9,517,378 B2 12/2016 Ashby et al.
9,517,406 B2 12/2016 Shum et al.
9,526,937 B2 12/2016 Uygan
9,529,385 B2 12/2016 Connor
9,529,437 B2 12/2016 Kahn et al.
9,532,002 B2 12/2016 Glass et al.
9,532,734 B2 1/2017 Hoffman et al.
9,533,228 B2 1/2017 Dugan
9,535,505 B2 1/2017 Erkkila et al.
9,536,449 B2 1/2017 Connor
9,540,071 B2 1/2017 Jordan et al.
9,540,174 B2 1/2017 Josserond et al.
9,545,535 B2 1/2017 Lagree
9,545,540 B1 1/2017 Moschel
9,545,541 B2 1/2017 Aragones et al.
9,549,585 B2 1/2017 Amos et al.
9,550,091 B2 1/2017 Emerson
9,555,278 B2 1/2017 Kaye et al.
9,555,280 B2 1/2017 Kaye et al.
9,560,917 B2 2/2017 Roslund, Jr.
9,563,336 B2 2/2017 Barak et al.
9,563,700 B2 2/2017 Garmark et al.
9,573,017 B2 2/2017 Chang

(56) References Cited

U.S. PATENT DOCUMENTS 9,579,534 B2 2/2017 Sutkowski et al.
9,579,544 B2 2/2017 Millsap
9,582,071 B2 2/2017 Baldwin et al.
9,582,976 B2 2/2017 Chin et al.
9,585,563 B2 3/2017 Mensinger et al.
9,586,090 B2 3/2017 Watterson et al.
9,589,482 B2 3/2017 Baldwin et al.
9,593,992 B2 3/2017 Wu
9,594,433 B2 3/2017 Baldwin et al.
9,597,540 B2 3/2017 Arnold
9,599,981 B2 3/2017 Crabtree
9,600,079 B2 3/2017 Baldwin et al.
9,602,210 B2 3/2017 Berlin et al.
9,604,092 B2 3/2017 Krull
9,604,096 B2 3/2017 Arnold et al.
9,604,099 B2 3/2017 Taylor
9,610,475 B1 4/2017 DeKnock et al.
9,610,506 B2 4/2017 Dugan
9,615,215 B2 4/2017 Yuen et al.
9,615,785 B2 4/2017 Rocker et al.
9,616,274 B2 4/2017 Wehrell
9,616,276 B2 4/2017 Dalebout et al.
9,616,281 B2 4/2017 Hsiung
9,616,284 B1 4/2017 Aganyan et al.
9,616,292 B2 4/2017 Orfield
9,621,959 B2 4/2017 Mountain
9,622,537 B2 4/2017 Amos et al.
9,623,285 B1 4/2017 Ruiz
9,623,286 B1 4/2017 Chen
9,628,286 B1 4/2017 Nguyen et al.
9,630,048 B2 4/2017 Kaye et al.
9,632,746 B2 4/2017 Keipert et al.
9,636,539 B1 5/2017 Brumit
9,636,540 B2 5/2017 Mueller et al.
9,636,543 B2 5/2017 Dyer et al.
9,636,567 B2 5/2017 Brammer et al.
9,642,764 B2 5/2017 Kuehne et al.
9,643,042 B2 5/2017 Madden
9,646,137 B2 5/2017 Gilley et al.
9,646,481 B2 5/2017 Messenger et al.
9,647,758 B2 5/2017 Hazani
9,655,053 B2 5/2017 Park et al.
9,656,115 B2 5/2017 Young
9,656,144 B2 5/2017 Jafarifesharaki
9,656,591 B1 5/2017 Dumenigo
9,658,066 B2 5/2017 Yuen et al.
9,661,355 B2 5/2017 Ho
9,661,781 B2 5/2017 Anolik et al.
9,662,529 B2 * 5/2017 Miller ..... A63B 21/0616
9,669,261 B2 6/2017 Eder
9,672,196 B2 6/2017 Shachar et al.
9,672,754 B2 6/2017 Yuen et al.
9,673,904 B2 6/2017 Palanisamy et al.
9,675,836 B2 6/2017 Babon
9,678,626 B2 6/2017 Whang
9,681,313 B2 6/2017 Malach
9,682,267 B2 6/2017 Kaye et al.
9,682,306 B2 6/2017 Lin et al.
9,687,689 B2 6/2017 Lin
9,692,844 B2 6/2017 Messenger et al.
RE46,481 E 7/2017 Sako et al.
9,694,234 B2 7/2017 Dalebout et al.
9,694,247 B2 7/2017 Nurnberg
9,697,740 B2 7/2017 Zhang et al.
9,700,752 B1 7/2017 Powers
9,700,753 B1 7/2017 Boatwright
9,700,780 B2 7/2017 Riley et al.
9,700,802 B2 7/2017 Dugan
9,701,530 B2 7/2017 Kline
9,707,435 B1 7/2017 Ferlito et al.
9,707,441 B2 7/2017 Yang
9,707,447 B1 7/2017 Lopez Babodilla
9,710,711 B2 7/2017 Dibenedetto et al.
9,712,629 B2 7/2017 Molettiere et al.
9,713,739 B2 7/2017 Dalmia
9,715,774 B2 7/2017 Baldwin et al.
9,719,797 B2 8/2017 Fino et al.
9,720,443 B2 8/2017 Malhotra
9,720,912 B2 8/2017 Morimoto et al.
9,723,393 B2 8/2017 Nguyen et al.
9,724,553 B2 8/2017 Kaye et al.
9,724,563 B2 8/2017 Schmidt
9,724,589 B2 8/2017 Baudhuin
9,728,059 B2 8/2017 Arnold et al.
9,729,921 B2 8/2017 Kim et al.
9,729,989 B2 8/2017 Marten
9,730,025 B2 8/2017 Yuen et al.
9,730,228 B2 8/2017 Harel
9,730,619 B2 8/2017 Messenger et al.
9,731,158 B1 8/2017 Lo
9,734,184 B1 8/2017 Lagace et al.
9,737,261 B2 8/2017 Coza et al.
9,737,747 B1 8/2017 Walsh et al.
9,743,861 B2 8/2017 Giedwoyn et al.
9,750,454 B2 9/2017 Walke et al.
9,756,895 B2 9/2017 Rice et al.
9,757,605 B2 9/2017 Olson et al.
9,757,611 B1 9/2017 Colburn
9,763,581 B2 9/2017 Bonutti et al.
9,764,184 B2 9/2017 Kueker et al.
9,764,188 B1 9/2017 Aganyan et al.
9,767,212 B2 9/2017 Lavi et al.
9,769,522 B2 9/2017 Richardson
9,772,612 B2 9/2017 McCarthy, III et al.
9,775,123 B2 9/2017 Harel
9,776,032 B2 10/2017 Moran et al.
9,776,039 B1 10/2017 Xu
9,776,042 B2 10/2017 Prokhorov
9,778,280 B2 10/2017 Yuen et al.
9,782,125 B2 10/2017 Berner, Jr. et al.
9,782,625 B1 10/2017 Blum et al.
9,789,362 B1 10/2017 Su et al.
9,792,361 B1 10/2017 Geer
9,795,819 B2 10/2017 Wehrell
9,795,822 B2 10/2017 Smith et al.
9,795,827 B2 10/2017 Wiener et al.
9,795,828 B2 10/2017 Andrade
9,795,855 B2 10/2017 Jafarifesharaki
9,797,920 B2 10/2017 Kahn et al.
9,798,309 B2 10/2017 Tirpak
9,801,547 B2 10/2017 Yuen et al.
9,802,075 B2 10/2017 Gvoich
9,802,081 B2 10/2017 Ridgel et al.
9,808,202 B2 11/2017 Wu et al.
9,808,673 B2 11/2017 Robinson
9,811,639 B2 11/2017 Aragones et al.
9,814,920 B1 11/2017 Monterrey
9,814,922 B2 11/2017 Moran et al.
9,814,927 B2 11/2017 Forystek
9,814,928 B2 11/2017 Taylor
9,814,929 B2 11/2017 Moser
9,814,930 B2 11/2017 Manzke et al.
9,818,285 B2 11/2017 Clarke et al.
9,819,561 B2 11/2017 Freishtat et al.
9,819,754 B2 11/2017 Park et al.
9,821,191 B2 11/2017 Abbondanza
9,821,212 B2 11/2017 Kolman et al.
9,824,110 B2 11/2017 Giudici et al.
9,824,578 B2 11/2017 Burton et al.
9,827,458 B2 11/2017 Dalton
9,829,068 B2 11/2017 Marchetti
9,829,327 B2 11/2017 Nagy et al.
9,833,141 B2 12/2017 Kampman et al.
9,833,654 B1 12/2017 Gant
9,833,658 B2 12/2017 Wiener et al.
9,838,736 B2 12/2017 Smith et al.
9,841,077 B2 12/2017 Modrezejewski et al.
9,849,330 B2 12/2017 Lagree
9,849,333 B2 12/2017 Fung
9,849,361 B2 12/2017 Coza et al.
9,852,271 B2 12/2017 Aragones et al.
9,858,307 B2 1/2018 Sultan et al.
9,861,300 B2 1/2018 Gettelman et al.
9,864,844 B2 1/2018 Durham et al.

(56) References Cited

U.S. PATENT DOCUMENTS

| | | | |
|---|---|---|---|
| 9,866,596 | B2 | 1/2018 | Das et al. |
| 9,868,006 | B1 | 1/2018 | Epler |
| 9,878,200 | B2 * | 1/2018 | Edmondson ..... A63B 22/0076 |
| 9,878,201 | B1 | 1/2018 | Moschel |
| 9,880,805 | B1 | 1/2018 | Guralnick |
| 9,881,326 | B2 | 1/2018 | Gilley et al. |
| 9,882,736 | B2 | 1/2018 | Lett |
| 9,882,992 | B2 | 1/2018 | Baldwin et al. |
| 9,884,224 | B2 | 2/2018 | Spoeth et al. |
| 9,885,575 | B2 | 2/2018 | Collin |
| 9,886,309 | B2 | 2/2018 | Alles et al. |
| 9,886,871 | B1 | 2/2018 | Rauhala et al. |
| 9,889,334 | B2 | 2/2018 | Ashby et al. |
| 9,892,417 | B2 | 2/2018 | Shachar et al. |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,906,572 | B2 | 2/2018 | Wang et al. |
| 9,907,396 | B1 | 3/2018 | Labrosse et al. |
| 9,910,498 | B2 | 3/2018 | Kutliroff et al. |
| 9,914,003 | B2 | 3/2018 | Kuehne et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,919,198 | B2 | 3/2018 | Romeo et al. |
| 9,921,726 | B1 | 3/2018 | Sculley et al. |
| 9,937,375 | B2 | 4/2018 | Zhu |
| 9,940,161 | B1 | 4/2018 | Kahn et al. |
| 9,940,682 | B2 | 4/2018 | Hoffman et al. |
| 9,943,159 | B1 | 4/2018 | Novikova |
| 9,943,719 | B2 | 4/2018 | Smith et al. |
| 9,943,722 | B2 | 4/2018 | Dalebout |
| 9,946,857 | B2 | 4/2018 | Beals |
| 9,948,349 | B2 | 4/2018 | Malach |
| 9,948,477 | B2 | 4/2018 | Marten |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,959,902 | B2 | 5/2018 | McNamee |
| 9,960,980 | B2 | 5/2018 | Wilson |
| 9,962,081 | B2 | 5/2018 | Mensinger et al. |
| 9,962,305 | B2 | 5/2018 | Yamada et al. |
| 9,962,576 | B2 | 5/2018 | Anderson |
| 9,965,059 | B2 | 5/2018 | Myers et al. |
| 9,967,614 | B2 | 5/2018 | McCarthy, III |
| 9,968,821 | B2 | 5/2018 | Finlayson et al. |
| 9,968,823 | B2 | 5/2018 | Cutler |
| 9,974,997 | B2 | 5/2018 | Cei |
| 9,977,874 | B2 | 5/2018 | Aragones et al. |
| 9,983,011 | B2 | 5/2018 | Mountain |
| 9,986,315 | B2 | 5/2018 | Oleson et al. |
| 9,987,513 | B2 | 6/2018 | Yim et al. |
| 9,987,517 | B1 | 6/2018 | Kuo |
| 9,989,507 | B2 | 6/2018 | Benn |
| 9,993,680 | B2 | 6/2018 | Gordon |
| 9,993,683 | B2 | 6/2018 | Moschel |
| 9,996,066 | B2 | 6/2018 | Beals |
| 10,004,656 | B2 | 6/2018 | Whalen et al. |
| 10,004,934 | B2 | 6/2018 | Pennington |
| 10,004,940 | B2 | 6/2018 | Badarneh |
| 10,008,090 | B2 | 6/2018 | Yuen et al. |
| 10,010,745 | B1 | 7/2018 | Brumit |
| 10,013,986 | B1 | 7/2018 | Bhaya et al. |
| 10,015,216 | B2 | 7/2018 | Wang et al. |
| 10,016,646 | B2 | 7/2018 | Butler |
| 10,016,655 | B2 | 7/2018 | Lagree |
| 10,021,188 | B2 | 7/2018 | Oleson et al. |
| 10,022,583 | B2 | 7/2018 | Wang |
| 10,022,589 | B2 | 7/2018 | Case, Jr. et al. |
| 10,022,590 | B2 | 7/2018 | Foley et al. |
| 10,029,172 | B2 | 7/2018 | Galasso et al. |
| 10,035,010 | B1 | 7/2018 | Wagstaff |
| 10,037,053 | B2 | 7/2018 | Malhotra |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0024998 | A1 | 9/2001 | Novak |
| 2001/0027266 | A1 | 10/2001 | Hautala |
| 2001/0028350 | A1 | 10/2001 | Matsuoka et al. |
| 2001/0041647 | A1 | 11/2001 | Itoh |
| 2001/0049320 | A1 | 12/2001 | Cohen |
| 2001/0049470 | A1 | 12/2001 | Mault et al. |
| 2001/0051564 | A1 | 12/2001 | Iund |
| 2001/0051566 | A1 | 12/2001 | Krull |
| 2001/0053883 | A1 | 12/2001 | Yoshimura et al. |
| 2002/0004191 | A1 | 1/2002 | Tice et al. |
| 2002/0004439 | A1 | 1/2002 | Galbraith et al. |
| 2002/0013200 | A1 | 1/2002 | Sechrest |
| 2002/0013717 | A1 | 1/2002 | Ando |
| 2002/0016235 | A1 | 2/2002 | Ashby et al. |
| 2002/0019298 | A1 | 2/2002 | Eschenbach |
| 2002/0022551 | A1 | 2/2002 | Watterson et al. |
| 2002/0022555 | A1 | 2/2002 | Nesci |
| 2002/0022559 | A1 | 2/2002 | Krull |
| 2002/0024521 | A1 | 2/2002 | Goden |
| 2002/0025888 | A1 | 2/2002 | Germanton |
| 2002/0026130 | A1 | 2/2002 | West |
| 2002/0026292 | A1 | 2/2002 | Isami |
| 2002/0028733 | A1 | 3/2002 | Martens |
| 2002/0031756 | A1 | 3/2002 | Holtz |
| 2002/0035017 | A1 | 3/2002 | Pertegaz-Esteban |
| 2002/0039952 | A1 | 4/2002 | Clem |
| 2002/0042328 | A1 | 4/2002 | Yoo |
| 2002/0042912 | A1 | 4/2002 | Iijima |
| 2002/0043909 | A1 | 4/2002 | Nielsen |
| 2002/0045519 | A1 | 4/2002 | Watterson |
| 2002/0047867 | A1 | 4/2002 | Mault |
| 2002/0049123 | A1 | 4/2002 | Krull |
| 2002/0052268 | A1 | 5/2002 | Morcillo-Quintero |
| 2002/0054244 | A1 | 5/2002 | Holtz |
| 2002/0055419 | A1 | 5/2002 | Hinnebusch |
| 2002/0055420 | A1 | 5/2002 | Stearns et al. |
| 2002/0055422 | A1 | 5/2002 | Airmet |
| 2002/0055426 | A1 | 5/2002 | Krull |
| 2002/0055857 | A1 | 5/2002 | Mault |
| 2002/0060335 | A1 | 5/2002 | Edgar |
| 2002/0062236 | A1 | 5/2002 | Murashita |
| 2002/0066735 | A1 | 6/2002 | Hewlitt et al. |
| 2002/0068887 | A1 | 6/2002 | Kikumoto |
| 2002/0068991 | A1 | 6/2002 | Fitzsimmons |
| 2002/0070954 | A1 | 6/2002 | Lang |
| 2002/0072436 | A1 | 6/2002 | Liu |
| 2002/0077219 | A1 | 6/2002 | Cohen |
| 2002/0077221 | A1 | 6/2002 | Dalebout et al. |
| 2002/0083122 | A1 | 6/2002 | Lemchen |
| 2002/0086779 | A1 | 7/2002 | Wilkinson |
| 2002/0088337 | A1 | 7/2002 | Devecka |
| 2002/0091043 | A1 | 7/2002 | Rexach |
| 2002/0091796 | A1 | 7/2002 | Higginson |
| 2002/0094914 | A1 | 7/2002 | Maresh et al. |
| 2002/0098957 | A1 | 7/2002 | Webber |
| 2002/0101880 | A1 | 8/2002 | Kim |
| 2002/0106617 | A1 | 8/2002 | Hersh |
| 2002/0107058 | A1 | 8/2002 | Namba et al. |
| 2002/0109710 | A1 | 8/2002 | Holtz et al. |
| 2002/0111541 | A1 | 8/2002 | Bibl et al. |
| 2002/0115536 | A1 | 8/2002 | Hojo |
| 2002/0116266 | A1 | 8/2002 | Marshall |
| 2002/0119870 | A1 | 8/2002 | Chen |
| 2002/0128119 | A1 | 9/2002 | Arai |
| 2002/0128127 | A1 | 9/2002 | Chen |
| 2002/0132703 | A1 | 9/2002 | Martinez |
| 2002/0132706 | A1 | 9/2002 | Sleamaker |
| 2002/0137605 | A1 | 9/2002 | Olsen |
| 2002/0138023 | A1 | 9/2002 | Kume et al. |
| 2002/0142887 | A1 | 10/2002 | O'Malley |
| 2002/0142890 | A1 | 10/2002 | Ohrt |
| 2002/0147078 | A1 | 10/2002 | Wu |
| 2002/0151413 | A1 | 10/2002 | Dalebout |
| 2002/0155416 | A1 | 10/2002 | Barton |

(56) References Cited

U.S. PATENT DOCUMENTS

2002/0156351 A1 10/2002 Sagel
2002/0156387 A1 10/2002 Dardik
2002/0160883 A1 10/2002 Dugan
2002/0160891 A1 10/2002 Gallagher
2002/0164929 A1 11/2002 Pinson
2002/0169634 A1 11/2002 Nishi
2002/0171070 A1 11/2002 Shim
2002/0173407 A1 11/2002 Bowman
2002/0187879 A1 12/2002 Ball
2002/0193213 A1 12/2002 Batca
2002/0193214 A1 12/2002 Ish
2002/0193215 A1 12/2002 Cheng
2002/0194604 A1 12/2002 Sanchez et al.
2002/0198084 A1 12/2002 Stearns et al.
2002/0198776 A1 12/2002 Nara
2003/0004424 A1 1/2003 Birnbaum
2003/0008731 A1 1/2003 Anderson et al.
2003/0013072 A1 1/2003 Thomas
2003/0017918 A1 1/2003 Webb et al.
2003/0021273 A1 1/2003 Fouquet
2003/0022765 A1 1/2003 Wu
2003/0022770 A1 1/2003 Lee
2003/0032524 A1 2/2003 Lamar et al.
2003/0032528 A1 2/2003 Wu et al.
2003/0032531 A1 2/2003 Simonson
2003/0032535 A1 2/2003 Wang
2003/0033600 A1 2/2003 Cliff et al.
2003/0040348 A1 2/2003 Martens
2003/0041076 A1 2/2003 Lucovsky
2003/0043986 A1 3/2003 Creamer et al.
2003/0043989 A1 3/2003 Creamer et al.
2003/0044021 A1 3/2003 Wilkinson et al.
2003/0045406 A1 3/2003 Stone
2003/0060331 A1 3/2003 Polk
2003/0060344 A1 3/2003 David
2003/0060345 A1 3/2003 Piane
2003/0063133 A1 4/2003 Foote et al.
2003/0065561 A1 4/2003 Brown et al.
2003/0069108 A1 4/2003 Rubinstein
2003/0073545 A1 4/2003 Liu
2003/0078138 A1 4/2003 Toyama
2003/0087737 A1 5/2003 Studdard
2003/0088196 A1 5/2003 Steve
2003/0089596 A1 5/2003 Tao et al.
2003/0092532 A1 5/2003 Giannelli et al.
2003/0092533 A1 5/2003 Hippensteel
2003/0092540 A1 5/2003 Gillen
2003/0092542 A1 5/2003 Bartholomew et al.
2003/0096675 A1 5/2003 Wang
2003/0096683 A1 5/2003 Fenelon
2003/0097878 A1 5/2003 Farringdon et al.
2003/0100406 A1 5/2003 Millington
2003/0100413 A1 5/2003 Huang
2003/0100415 A1 5/2003 Augustine et al.
2003/0104907 A1 6/2003 Sankrithi
2003/0104908 A1 6/2003 Tung
2003/0105390 A1 6/2003 Alessandri
2003/0114276 A1 6/2003 Schiff
2003/0114281 A1 6/2003 Mackert
2003/0115157 A1 6/2003 Circenis
2003/0115955 A1 6/2003 Keiser
2003/0119635 A1 6/2003 Arbuckle
2003/0122384 A1 7/2003 Swanson et al.
2003/0125165 A1 7/2003 Trevino
2003/0126593 A1 7/2003 Mault
2003/0128186 A1 7/2003 Laker
2003/0134714 A1 7/2003 Oishi et al.
2003/0134718 A1 7/2003 Kim
2003/0138761 A1 7/2003 Pesnell
2003/0139254 A1 7/2003 Chang
2003/0142951 A1 7/2003 Tsurugai
2003/0148853 A1 8/2003 Alessandri
2003/0148857 A1 8/2003 Yu
2003/0148862 A1 8/2003 Chen
2003/0149344 A1 8/2003 Nizan
2003/0153434 A1 8/2003 Dalebout
2003/0153436 A1 8/2003 Ho
2003/0153439 A1 8/2003 Krull
2003/0158014 A1 8/2003 Valentin-Sivico
2003/0158016 A1 8/2003 Kolda
2003/0158019 A1 8/2003 Giannelli
2003/0158024 A1 8/2003 Saure
2003/0163287 A1 8/2003 Vock et al.
2003/0165802 A1 9/2003 Murphy
2003/0166434 A1 9/2003 Lopez-Santillana et al.
2003/0171189 A1 9/2003 Kaufman
2003/0171190 A1 9/2003 Rice
2003/0171192 A1 9/2003 Wu
2003/0176261 A1 9/2003 Simonson et al.
2003/0176815 A1 9/2003 Baba et al.
2003/0181289 A1 9/2003 Oscar Moavro
2003/0181291 A1 9/2003 Ogawa
2003/0181293 A1 9/2003 Baatz
2003/0183027 A1 10/2003 Koch
2003/0186792 A1 10/2003 Keeler
2003/0195089 A1 10/2003 Schroeder
2003/0199368 A1 10/2003 Krull
2003/0207237 A1 11/2003 Glezerman
2003/0208113 A1 11/2003 Mault et al.
2003/0211449 A1 11/2003 Seiller
2003/0211916 A1 11/2003 Capuano
2003/0212536 A1 11/2003 Wang
2003/0214530 A1 11/2003 Wang
2003/0216227 A1 11/2003 Smith
2003/0216228 A1 11/2003 Rast
2003/0216229 A1 11/2003 Bastyr
2003/0216230 A1 11/2003 Wang
2003/0220143 A1 11/2003 Shteyn et al.
2003/0222419 A1 12/2003 Geary
2003/0224337 A1 12/2003 Shum et al.
2003/0227473 A1 12/2003 Shih
2003/0232703 A1 12/2003 Webber
2003/0232707 A1 12/2003 Dalebout et al.
2003/0236153 A1 12/2003 Pan et al.
2004/0005958 A1 1/2004 Kamen et al.
2004/0005959 A1 1/2004 Takizawa
2004/0005961 A1 1/2004 Iund
2004/0005965 A1 1/2004 Panatta
2004/0008220 A1 1/2004 Snyder et al.
2004/0009855 A1 1/2004 Webber
2004/0009856 A1 1/2004 Hammer
2004/0010420 A1 1/2004 Rooks
2004/0012335 A1 1/2004 Shon et al.
2004/0014014 A1 1/2004 Hess
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0018920 A1 1/2004 Simonson
2004/0019654 A1 1/2004 Powers
2004/0021046 A1 2/2004 Hutchison
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0025993 A1 2/2004 Russell
2004/0027368 A1 2/2004 Snyder et al.
2004/0029645 A1 2/2004 Chen
2004/0030762 A1 2/2004 Silverthorne
2004/0033865 A1 2/2004 Wu
2004/0033866 A1 2/2004 Shapiro
2004/0033868 A1 2/2004 Van Straaten
2004/0043873 A1 3/2004 Wilkinson et al.
2004/0046692 A1 3/2004 Robson
2004/0051392 A1 3/2004 Badarneh
2004/0053748 A1 3/2004 Lo et al.
2004/0053752 A1 3/2004 Yang
2004/0053756 A1 3/2004 Tremayne
2004/0054350 A1 3/2004 Shaughnessy
2004/0063549 A1 4/2004 Kuo
2004/0067821 A1 4/2004 Kehrbaum

(56) References Cited

U.S. PATENT DOCUMENTS

2004/0067833 A1 4/2004 Talish
2004/0072652 A1 4/2004 Alessandri et al.
2004/0072659 A1 4/2004 Alessandri
2004/0072661 A1 4/2004 Krull
2004/0072662 A1 4/2004 Landfair
2004/0077462 A1 4/2004 Brown
2004/0077468 A1 4/2004 Myles
2004/0077975 A1 4/2004 Zimmerman
2004/0078208 A1 4/2004 Burwell
2004/0082444 A1 4/2004 Golesh
2004/0087420 A1 5/2004 Montesquieux
2004/0092367 A1 5/2004 Corbalis
2004/0095516 A1 5/2004 Rohlicek
2004/0097331 A1 5/2004 Zillig
2004/0097337 A1 5/2004 Chuang
2004/0097353 A1 5/2004 Mencis
2004/0100484 A1 5/2004 Barrett
2004/0102292 A1 5/2004 Pyles et al.
2004/0102931 A1 5/2004 Ellis
2004/0103146 A1 5/2004 Park
2004/0103432 A1 5/2004 Barrett
2004/0114768 A1 6/2004 Luo
2004/0116258 A1 6/2004 Hyder
2004/0116837 A1 6/2004 Yamaguchi
2004/0116899 A1 6/2004 Shaughnessy
2004/0117072 A1 6/2004 Takeda
2004/0117214 A1 6/2004 Shea
2004/0127285 A1 7/2004 Kavana
2004/0127334 A1 7/2004 Heppert
2004/0127335 A1 7/2004 Watterson
2004/0127336 A1 7/2004 Lapcevic
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0138032 A1 7/2004 Van Straaten
2004/0142799 A1 7/2004 Yeo
2004/0142800 A1 7/2004 Gerschefske
2004/0142801 A1 7/2004 Lin
2004/0144626 A1 7/2004 Saeki
2004/0152566 A1 8/2004 Yeh
2004/0155622 A1 8/2004 Mayhew et al.
2004/0157546 A1 8/2004 Fantaay
2004/0157709 A1 8/2004 Olson
2004/0160336 A1 8/2004 Hoch
2004/0162188 A1 8/2004 Watterson
2004/0162189 A1 8/2004 Hickman
2004/0162191 A1 8/2004 Ercanbrack
2004/0162194 A1 8/2004 Habing
2004/0162196 A1 8/2004 Degroot
2004/0162198 A1 8/2004 Towley
2004/0163574 A1 8/2004 Schoenbach
2004/0166996 A1 8/2004 Kolda
2004/0166999 A1 8/2004 Dodge
2004/0171460 A1 9/2004 Park
2004/0171464 A1 9/2004 Ashby et al.
2004/0171465 A1 9/2004 Hald
2004/0176215 A1 9/2004 Gramaccioni
2004/0176217 A1 9/2004 Watterson
2004/0177531 A1 9/2004 Dibenedetto et al.
2004/0180719 A1 9/2004 Feldman
2004/0181972 A1 9/2004 Csorba
2004/0185988 A1 9/2004 Hsiung
2004/0186390 A1 9/2004 Ross et al.
2004/0192514 A1 9/2004 Piaget et al.
2004/0198555 A1 10/2004 Anderson
2004/0198559 A1 10/2004 Grossi
2004/0198569 A1 10/2004 Sanford-Schwentke
2004/0198571 A1 10/2004 Howell et al.
2004/0204294 A2 10/2004 Wilkinson
2004/0208943 A1 10/2004 Miketin
2004/0210661 A1 10/2004 Thompson
2004/0214693 A1 10/2004 Piaget et al.
2004/0215958 A1 10/2004 Ellis
2004/0220017 A1 11/2004 Gordon
2004/0220025 A1 11/2004 Krull
2004/0224740 A1 11/2004 Ball et al.
2004/0224825 A1 11/2004 Giannelli et al.
2004/0224827 A1 11/2004 Ashley
2004/0225239 A1 11/2004 Yamamoto
2004/0225532 A1 11/2004 Gadiyak
2004/0229730 A1 11/2004 Ainsworth et al.
2004/0230138 A1 11/2004 Inoue et al.
2004/0242378 A1 12/2004 Pan
2004/0242379 A1 12/2004 Juva
2004/0242380 A1 12/2004 Kuivala
2004/0242388 A1 12/2004 Kusminsky
2004/0248699 A1 12/2004 Colley
2004/0248713 A1 12/2004 Campanaro
2004/0254020 A1 12/2004 Dragusin
2004/0256524 A1 12/2004 Beck et al.
2004/0259689 A1 12/2004 Wilkins et al.
2004/0260191 A1 12/2004 Stubbs
2004/0266587 A1 12/2004 Miller
2004/0266591 A1 12/2004 Alessandri
2004/0266961 A1 12/2004 Solan
2005/0003338 A1 1/2005 Norcott et al.
2005/0003933 A1 1/2005 Kau
2005/0003938 A1 1/2005 Henderson
2005/0008992 A1 1/2005 Westergaard et al.
2005/0009668 A1 1/2005 Savettiere
2005/0009672 A1 1/2005 Yeh
2005/0012622 A1 1/2005 Sutton
2005/0013433 A1 1/2005 Ghassabian
2005/0013658 A1 1/2005 Muders et al.
2005/0014571 A1 1/2005 Varner
2005/0014616 A1 1/2005 Tiahrt
2005/0015281 A1 1/2005 Clark et al.
2005/0020887 A1 1/2005 Goldberg
2005/0023292 A1 2/2005 Market et al.
2005/0026750 A1 2/2005 Oglesby et al.
2005/0026811 A1 2/2005 Mjalli
2005/0032610 A1 2/2005 Nelson
2005/0032611 A1 2/2005 Webber
2005/0037898 A1 2/2005 Chang
2005/0037904 A1 2/2005 Chang
2005/0038698 A1 2/2005 Lukose
2005/0038699 A1 2/2005 Lillibridge
2005/0043145 A1 2/2005 Anderson et al.
2005/0043146 A1 2/2005 Lo et al.
2005/0043155 A1 2/2005 Yannitte
2005/0044210 A1 2/2005 Ku
2005/0044984 A1 3/2005 Jones
2005/0048461 A1 3/2005 Lahteenmaki
2005/0049117 A1 3/2005 Rodgers
2005/0049121 A1 3/2005 Dalebout
2005/0049123 A1 3/2005 Dalebout et al.
2005/0054492 A1 3/2005 Neff
2005/0054940 A1 3/2005 Almen
2005/0060238 A1 3/2005 Gravina et al.
2005/0061587 A1 3/2005 Tsai
2005/0062841 A1 3/2005 Rivera-Cintron
2005/0064994 A1 3/2005 Matsumoto
2005/0065003 A1 3/2005 Klotzki
2005/0071462 A1 3/2005 Bodin et al.
2005/0071463 A1 3/2005 Bodin et al.
2005/0075213 A1 4/2005 Arick
2005/0075222 A1 4/2005 Adley
2005/0075903 A1 4/2005 Piccionelli
2005/0079905 A1 4/2005 Martens
2005/0079961 A1 4/2005 Dalebout
2005/0085348 A1 4/2005 Kiefer
2005/0085352 A1 4/2005 Baxter
2005/0090770 A1 4/2005 Chen
2005/0096187 A1 5/2005 Hsu
2005/0096189 A1 5/2005 Chen
2005/0096196 A1 5/2005 Webber
2005/0096197 A1 5/2005 Webber
2005/0096198 A1 5/2005 Webber
2005/0101458 A1 5/2005 Huang
2005/0101463 A1 5/2005 Chen
2005/0102172 A1 5/2005 Sirmans
2005/0107216 A1 5/2005 Lee et al.
2005/0107220 A1 5/2005 Wang

(56) References Cited

U.S. PATENT DOCUMENTS

2005/0107226 A1 5/2005 Monda
2005/0107723 A1 5/2005 Wehman et al.
2005/0107726 A1 5/2005 Oyen
2005/0112601 A1 5/2005 Hassibi
2005/0113158 A1 5/2005 Sterchi et al.
2005/0113223 A1 5/2005 Dovner et al.
2005/0113652 A1 5/2005 Stark et al.
2005/0113723 A1 5/2005 Ueyama
2005/0124463 A1 6/2005 Yeo et al.
2005/0124471 A1 6/2005 Wilkinson
2005/0129253 A1 6/2005 Chen
2005/0129903 A1 6/2005 Carr
2005/0130807 A1 6/2005 Cutler
2005/0130814 A1 6/2005 Nitta et al.
2005/0131319 A1 6/2005 Der Meer
2005/0132838 A1 6/2005 Lin
2005/0143226 A1 6/2005 Heidecke
2005/0143228 A1 6/2005 Lee
2005/0143230 A1 6/2005 Dalebout
2005/0148398 A1 7/2005 Lochtefeld et al.
2005/0148439 A1 7/2005 Wu
2005/0148440 A1 7/2005 Denton
2005/0148442 A1 7/2005 Watterson
2005/0148443 A1 7/2005 Watterson
2005/0148445 A1 7/2005 Carle
2005/0159273 A1 7/2005 Chen
2005/0159277 A1 7/2005 Mcvay
2005/0159278 A1 7/2005 Mcvay
2005/0159712 A1 7/2005 Andersen
2005/0160141 A1 7/2005 Galley
2005/0164832 A1 7/2005 Maschke
2005/0164837 A1 7/2005 Anderson
2005/0164838 A1 7/2005 Watterson
2005/0164839 A1 7/2005 Watterson
2005/0164853 A1 7/2005 Naidus
2005/0167907 A1 8/2005 Curkendall et al.
2005/0170935 A1 8/2005 Manser
2005/0170936 A1 8/2005 Quinn
2005/0170937 A1 8/2005 van Straaten
2005/0172311 A1 8/2005 Hjelt et al.
2005/0176560 A1 8/2005 Chen
2005/0178210 A1 8/2005 Lanham
2005/0181347 A1 8/2005 Barnes et al.
2005/0181911 A1 8/2005 Porth
2005/0181916 A1 8/2005 Frost et al.
2005/0187075 A1 8/2005 Bellamy
2005/0187082 A1 8/2005 Bowser
2005/0187704 A1 8/2005 Peters
2005/0192162 A1 9/2005 Pan
2005/0192163 A1 9/2005 Pan et al.
2005/0195094 A1 9/2005 White
2005/0196737 A1 9/2005 Mann
2005/0202862 A1 9/2005 Shuman et al.
2005/0202934 A1 9/2005 Olrik et al.
2005/0209051 A1 9/2005 Santomassimo et al.
2005/0209052 A1 9/2005 Ashby
2005/0209056 A1 9/2005 Daly
2005/0209060 A1 9/2005 Lull
2005/0209061 A1 9/2005 Crawford et al.
2005/0209062 A1 9/2005 Anderson et al.
2005/0209887 A1 9/2005 Pollner
2005/0210169 A1 9/2005 Chou
2005/0212202 A1 9/2005 Meyer
2005/0213442 A1 9/2005 Sako
2005/0215335 A1 9/2005 Marquardt
2005/0215397 A1 9/2005 Watterson
2005/0221962 A1 10/2005 Warner et al.
2005/0227811 A1 10/2005 Shum et al.
2005/0227820 A1 10/2005 Dyer et al.
2005/0227826 A1 10/2005 Oga
2005/0227831 A1 10/2005 Mills
2005/0227832 A1 10/2005 Wu
2005/0228245 A1 10/2005 Quy
2005/0228883 A1 10/2005 Brown
2005/0229367 A1 10/2005 Thompson
2005/0233859 A1 10/2005 Takai
2005/0233861 A1 10/2005 Hickman
2005/0233866 A1 10/2005 Miyamaru et al.
2005/0233871 A1 10/2005 Anders
2005/0233873 A1 10/2005 Chen
2005/0238182 A1 10/2005 Shih et al.
2005/0239600 A1 10/2005 Liang
2005/0239601 A1 10/2005 Thomas
2005/0239607 A1 10/2005 Chang
2005/0239612 A1 10/2005 Keiser
2005/0240444 A1 10/2005 Wooten
2005/0245365 A1 11/2005 Rolli
2005/0245370 A1 11/2005 Boland
2005/0245431 A1 11/2005 Demmer et al.
2005/0248713 A1 11/2005 Hirosue et al.
2005/0250619 A1 11/2005 Daikeler et al.
2005/0250622 A1 11/2005 Chang
2005/0261609 A1 11/2005 Collings et al.
2005/0266961 A1 12/2005 Shum et al.
2005/0269601 A1 12/2005 Tsubaki
2005/0272561 A1 12/2005 Cammerata
2005/0272562 A1 12/2005 Alessandri et al.
2005/0272575 A1 12/2005 Melegati
2005/0272577 A1 12/2005 Olson
2005/0274188 A1 12/2005 Cabanis et al.
2005/0277520 A1 12/2005 Van Waes
2005/0277525 A1 12/2005 Liu
2005/0281963 A1 12/2005 Cook
2005/0283051 A1 12/2005 Chen
2005/0283911 A1 12/2005 Roussy
2005/0288155 A1 12/2005 Yang
2005/0288954 A1 12/2005 McCarthy et al.
2006/0003869 A1 1/2006 Huang et al.
2006/0003872 A1 1/2006 Chiles et al.
2006/0003876 A1 1/2006 Duhamel
2006/0003877 A1 1/2006 Harmon
2006/0004265 A1 1/2006 Pulkkinen et al.
2006/0006005 A1 1/2006 Dumornay
2006/0009332 A1 1/2006 Jones
2006/0013351 A1 1/2006 Crider
2006/0019224 A1 1/2006 Behar et al.
2006/0019804 A1 1/2006 Young
2006/0019806 A1 1/2006 Mikulski
2006/0020174 A1 1/2006 Matsumura
2006/0020556 A1 1/2006 Hamnen
2006/0020990 A1 1/2006 McEneaney
2006/0021155 A1 2/2006 Lang et al.
2006/0025287 A1 2/2006 Chermack
2006/0030462 A1 2/2006 Ish
2006/0030465 A1 2/2006 Johnson
2006/0033392 A1 2/2006 Ritchey
2006/0034161 A1 2/2006 Muller
2006/0035757 A1 2/2006 Flick et al.
2006/0035758 A1 2/2006 Rogozinski
2006/0035764 A1 2/2006 Webber
2006/0035768 A1 2/2006 Kowallis
2006/0035772 A1 2/2006 Golesh et al.
2006/0035774 A1 2/2006 Marks
2006/0040244 A1 2/2006 Kain
2006/0040246 A1 2/2006 Ding et al.
2006/0040793 A1 2/2006 Martens
2006/0040797 A1 2/2006 Chang
2006/0040798 A1 2/2006 Weier et al.
2006/0040810 A1 2/2006 Chu
2006/0046807 A1 3/2006 Sanchez
2006/0046898 A1 3/2006 Harvey
2006/0046905 A1 3/2006 Doody, Jr.
2006/0047447 A1 3/2006 Brady et al.
2006/0052220 A1 3/2006 Jackson et al.
2006/0052222 A1 3/2006 Cardenas
2006/0053586 A1 3/2006 Chase
2006/0053587 A1 3/2006 Chase
2006/0058155 A1 3/2006 Kumar
2006/0058158 A1 3/2006 McAvoy
2006/0058162 A1 3/2006 Vieno et al.
2006/0063644 A1 3/2006 Yang
2006/0063980 A1 3/2006 Hwang et al.
2006/0068978 A1 3/2006 Moon
2006/0069102 A1 3/2006 Leban et al.

(56) References Cited

U.S. PATENT DOCUMENTS

2006/0075544 A1 4/2006 Kriesel
2006/0079800 A1 4/2006 Martikka et al.
2006/0084422 A1 4/2006 Huang et al.
2006/0084551 A1 4/2006 Volpe, Jr.
2006/0084556 A1 4/2006 Payne
2006/0084851 A1 4/2006 Lee et al.
2006/0089238 A1 4/2006 Huang et al.
2006/0094569 A1 5/2006 Day
2006/0094570 A1 5/2006 Schneider
2006/0097453 A1 5/2006 Feldman
2006/0100069 A1 5/2006 Dibble et al.
2006/0100070 A1 5/2006 Abdo
2006/0100546 A1 5/2006 Silk
2006/0104047 A1 5/2006 Guzman
2006/0105888 A1 5/2006 Piane, Jr.
2006/0105889 A1 5/2006 Webb
2006/0111944 A1 5/2006 Sirmans, Jr.
2006/0116253 A1 6/2006 Nizam
2006/0116254 A1 6/2006 Webber
2006/0116558 A1 6/2006 Jang
2006/0122034 A1 6/2006 Chen
2006/0122035 A1 6/2006 Felix
2006/0122038 A1 6/2006 Chou Lin
2006/0122044 A1 6/2006 Ho
2006/0122468 A1 6/2006 Tavor
2006/0122474 A1 6/2006 Teller et al.
2006/0123814 A1 6/2006 Choi et al.
2006/0128540 A1 6/2006 Engle
2006/0129432 A1 6/2006 Choi et al.
2006/0132070 A1 6/2006 Heydt et al.
2006/0135274 A1 6/2006 Henry
2006/0135322 A1 6/2006 Rocker
2006/0142665 A1 6/2006 Garay et al.
2006/0148622 A1 7/2006 Chen
2006/0151303 A1 7/2006 Motoda
2006/0155576 A1 7/2006 Deluz
2006/0160639 A1 7/2006 Klein
2006/0160665 A1 7/2006 Tai
2006/0160666 A1 7/2006 Wang
2006/0160667 A1 7/2006 Oglesby et al.
2006/0160677 A1 7/2006 Piane
2006/0160681 A1 7/2006 McBride et al.
2006/0161455 A1 7/2006 Anastasia
2006/0161621 A1 7/2006 Rosenberg
2006/0161656 A1 7/2006 Sorvisto
2006/0161850 A1 7/2006 Seaberg
2006/0166737 A1 7/2006 Bentley
2006/0166790 A1 7/2006 Wang
2006/0166791 A1 7/2006 Liao
2006/0166798 A1 7/2006 Nelson
2006/0166799 A1 7/2006 Boland et al.
2006/0172862 A1 8/2006 Badarneh et al.
2006/0173556 A1 8/2006 Rosenberg
2006/0173828 A1 8/2006 Rosenberg
2006/0179044 A1 8/2006 Rosenberg
2006/0179056 A1 8/2006 Rosenberg
2006/0183602 A1 8/2006 Astilean
2006/0183980 A1 8/2006 Yang
2006/0184427 A1 8/2006 Singh
2006/0186197 A1 8/2006 Rosenberg
2006/0189439 A1 8/2006 Baudhuin
2006/0189440 A1 8/2006 Gravagne
2006/0189452 A1 8/2006 Chou
2006/0189458 A1 8/2006 Walkerdine
2006/0189460 A1 8/2006 Katterjohn
2006/0189462 A1 8/2006 Pearson et al.
2006/0189854 A1 8/2006 Webb et al.
2006/0194679 A1 8/2006 Hatcher
2006/0195361 A1 8/2006 Rosenberg
2006/0198613 A1 9/2006 Lee
2006/0199155 A1 9/2006 Mosher
2006/0199706 A1 9/2006 Wehrell
2006/0203972 A1 9/2006 Hays
2006/0205349 A1 9/2006 Passier et al.
2006/0205564 A1 9/2006 Peterson
2006/0205568 A1 9/2006 Huang
2006/0205569 A1 9/2006 Watterson
2006/0205571 A1 9/2006 Krull
2006/0217231 A1 9/2006 Parks et al.
2006/0217236 A1 9/2006 Watterson
2006/0217240 A1 9/2006 White
2006/0217242 A1 9/2006 Karpachev
2006/0217245 A1 9/2006 Golesh et al.
2006/0218253 A1 9/2006 Hays
2006/0223635 A1 10/2006 Rosenberg
2006/0223637 A1 10/2006 Rosenberg
2006/0223674 A1 10/2006 Korkie
2006/0223680 A1 10/2006 Chang
2006/0223681 A1 10/2006 Loane
2006/0224051 A1 10/2006 Teller et al.
2006/0228683 A1 10/2006 Jianping
2006/0229058 A1 10/2006 Rosenberg
2006/0229163 A1 10/2006 Waters
2006/0229164 A1 10/2006 Einav
2006/0229170 A1 10/2006 Ozawa et al.
2006/0232147 A1 10/2006 Cheng
2006/0234832 A1 10/2006 Toyama et al.
2006/0234840 A1 10/2006 Watson
2006/0240947 A1 10/2006 Qu
2006/0240951 A1 10/2006 Wang
2006/0240956 A1 10/2006 Piane, Jr.
2006/0240959 A1 10/2006 Huang
2006/0244187 A1 11/2006 Downey
2006/0247095 A1 11/2006 Rummerfield
2006/0247098 A1 11/2006 Raniere
2006/0247107 A1 11/2006 Carter
2006/0247109 A1 11/2006 Powell
2006/0248965 A1 11/2006 Wyatt
2006/0250524 A1 11/2006 Roche
2006/0251638 A1 11/2006 Guenzler-Pukall
2006/0252600 A1 11/2006 Grogan
2006/0252602 A1 11/2006 Brown
2006/0252608 A1 11/2006 Kang et al.
2006/0252612 A1 11/2006 Melcer
2006/0253010 A1 11/2006 Brady et al.
2006/0253210 A1 11/2006 Rosenberg
2006/0256007 A1 11/2006 Rosenberg
2006/0256008 A1 11/2006 Rosenberg
2006/0258513 A1 11/2006 Routley
2006/0258515 A1 11/2006 Kang et al.
2006/0258519 A1 11/2006 Ardito et al.
2006/0259275 A1 11/2006 Maschke
2006/0259574 A1 11/2006 Rosenberg
2006/0262752 A1 11/2006 Moore
2006/0264299 A1 11/2006 Farinelli
2006/0264306 A1 11/2006 Tischler
2006/0264730 A1 11/2006 Stivoric
2006/0265469 A1 11/2006 Estrade
2006/0269251 A1 11/2006 Hsu
2006/0270522 A1 11/2006 Yonehana
2006/0271286 A1 11/2006 Rosenberg
2006/0276306 A1 12/2006 Pan et al.
2006/0279294 A1 12/2006 Cehelnik
2006/0281603 A1 12/2006 Hickman
2006/0281605 A1 12/2006 Lo
2006/0281608 A1 12/2006 Tumminello
2006/0283050 A1 12/2006 Carnes et al.
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2006/0293156 A1 12/2006 Trees
2006/0293608 A1 12/2006 Rothman et al.
2006/0293617 A1 12/2006 Einav et al.
2007/0000154 A1 1/2007 Dibenedetto
2007/0004561 A1 1/2007 Yoo
2007/0004562 A1 1/2007 Pan et al.
2007/0004565 A1 1/2007 Gebhardt
2007/0004569 A1 1/2007 Cao
2007/0004736 A1 1/2007 Kubo
2007/0005395 A1 1/2007 Singh
2007/0006489 A1 1/2007 Case et al.
2007/0010383 A1 1/2007 Pertegaz-Esteban

(56) References Cited

U.S. PATENT DOCUMENTS

2007/0011027 A1 1/2007 Melendez
2007/0011391 A1 1/2007 Kim et al.
2007/0011920 A1 1/2007 DiBenedetto et al.
2007/0013655 A1 1/2007 Rosenberg et al.
2007/0014422 A1 1/2007 Wesemann et al.
2007/0015635 A1 1/2007 Donner
2007/0015636 A1 1/2007 Molter
2007/0015644 A1 1/2007 Aucamp
2007/0015752 A1 1/2007 Hangauer, Jr.
2007/0016444 A1 1/2007 Holkkola
2007/0016930 A1 1/2007 Wesemann et al.
2007/0017025 A1 1/2007 Myer
2007/0018465 A1 1/2007 Vassilakos
2007/0021280 A1 1/2007 Tyree
2007/0026958 A1 2/2007 Barasch et al.
2007/0026999 A1 2/2007 Merolle et al.
2007/0027000 A1 2/2007 Shirai et al.
2007/0027002 A1 2/2007 Clark et al.
2007/0027003 A1 2/2007 Clark
2007/0028749 A1 2/2007 Basson
2007/0032345 A1 2/2007 Padmanabhan
2007/0032351 A1 2/2007 Reyes
2007/0032353 A1 2/2007 Wilkins et al.
2007/0032481 A1 2/2007 Dvorak
2007/0033012 A1 2/2007 Rosenberg
2007/0033068 A1 2/2007 Rao
2007/0033069 A1 2/2007 Rao
2007/0037667 A1 2/2007 Gordon
2007/0037676 A1 2/2007 Denisco
2007/0038038 A1 2/2007 Stivoric et al.
2007/0038137 A1 2/2007 Arand et al.
2007/0038153 A1 2/2007 Basson
2007/0042866 A1 2/2007 Skilken
2007/0042868 A1 2/2007 Fisher
2007/0042878 A1 2/2007 Lundquist
2007/0049384 A1 3/2007 King et al.
2007/0049461 A1 3/2007 Kim et al.
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0051369 A1 3/2007 Choi et al.
2007/0054778 A1 3/2007 Blanarovich
2007/0054790 A1 3/2007 Dodge et al.
2007/0057001 A1 3/2007 Wang
2007/0060408 A1 3/2007 Schultz et al.
2007/0060446 A1 3/2007 Asukai et al.
2007/0060449 A1 3/2007 Lo
2007/0060450 A1 3/2007 Lo
2007/0060451 A1 3/2007 Lucas
2007/0060898 A1 3/2007 Shaughnessy
2007/0061314 A1 3/2007 Rosenberg
2007/0063033 A1 3/2007 Silverbrook et al.
2007/0066448 A1 3/2007 Pan et al.
2007/0072156 A1 3/2007 Kaufman et al.
2007/0072748 A1 3/2007 Lee
2007/0072752 A1 3/2007 Koch
2007/0074617 A1 4/2007 Vergo
2007/0075127 A1 4/2007 Rosenberg
2007/0079691 A1 4/2007 Turner
2007/0083095 A1 4/2007 Rippo et al.
2007/0083323 A1 4/2007 Rosenberg
2007/0083975 A1 4/2007 Senegal
2007/0087908 A1 4/2007 Pan et al.
2007/0087918 A1 4/2007 Towley et al.
2007/0087920 A1 4/2007 Dachraoui et al.
2007/0093360 A1 4/2007 Neff
2007/0093369 A1 4/2007 Bocchicchio
2007/0099780 A1 5/2007 Bowser
2007/0100595 A1 5/2007 Earles
2007/0100666 A1 5/2007 Stivoric et al.
2007/0106484 A1 5/2007 Sweatman et al.
2007/0109491 A1 5/2007 Howell et al.
2007/0111753 A1 5/2007 Vock
2007/0111858 A1 5/2007 Dugan
2007/0111866 A1 5/2007 McVay et al.
2007/0117680 A1 5/2007 Neff
2007/0117683 A1 5/2007 Ercanbrack et al.
2007/0117693 A1 5/2007 Ilioi
2007/0122786 A1 5/2007 Relan et al.
2007/0123389 A1 5/2007 Martin
2007/0123390 A1 5/2007 Mathis
2007/0123395 A1 5/2007 Ellis
2007/0123396 A1 5/2007 Ellis
2007/0124762 A1 5/2007 Chickering et al.
2007/0129220 A1 6/2007 Bardha
2007/0129907 A1 6/2007 Demon
2007/0131409 A1 6/2007 Asahi
2007/0135264 A1 6/2007 Rosenberg
2007/0135272 A1 6/2007 Stuckey
2007/0135276 A1 6/2007 Alessandri
2007/0135279 A1 6/2007 Purdy et al.
2007/0135738 A1 6/2007 Bonutti
2007/0136093 A1 6/2007 Rankin et al.
2007/0137307 A1 6/2007 Gruben
2007/0137331 A1 6/2007 Kachouh
2007/0140403 A1 6/2007 Yuguchi et al.
2007/0141871 A1 6/2007 Scherer et al.
2007/0142175 A1 6/2007 Morgan
2007/0142177 A1 6/2007 Simms et al.
2007/0142179 A1 6/2007 Terao et al.
2007/0142183 A1 6/2007 Chang
2007/0142187 A1 6/2007 Kolomeir
2007/0146347 A1 6/2007 Rosenberg
2007/0149362 A1 6/2007 Lee et al.
2007/0149363 A1 6/2007 Wang
2007/0149364 A1 6/2007 Blau
2007/0150188 A1 6/2007 Rosenberg
2007/0151489 A1 7/2007 Byrne
2007/0153639 A1 7/2007 Lafever
2007/0155277 A1 7/2007 Amitai et al.
2007/0155495 A1 7/2007 Goo
2007/0155589 A1 7/2007 Feldman
2007/0155600 A1 7/2007 Cunningham et al.
2007/0156335 A1 7/2007 McBride et al.
2007/0161459 A1 7/2007 Watson
2007/0161466 A1 7/2007 Oglesby et al.
2007/0161468 A1 7/2007 Yanagisawa et al.
2007/0161470 A1 7/2007 Berryman
2007/0161472 A1 7/2007 Drechsler
2007/0161480 A1 7/2007 Trancart
2007/0167291 A1 7/2007 Kuo
2007/0167292 A1 7/2007 Kuo
2007/0167293 A1 7/2007 Nally
2007/0167299 A1 7/2007 Simonson et al.
2007/0167300 A1 7/2007 Krull
2007/0169381 A1 7/2007 Gordon
2007/0173355 A1 7/2007 Klein
2007/0173384 A1 7/2007 Sechrest et al.
2007/0173392 A1 7/2007 Stanford
2007/0176035 A1 8/2007 Campbell
2007/0179023 A1 8/2007 Dyer
2007/0179030 A1 8/2007 Slawinski
2007/0179359 A1 8/2007 Goodwin
2007/0180737 A1 8/2007 DiBenedetto et al.
2007/0184944 A1 8/2007 Huang
2007/0184953 A1 8/2007 Luberski et al.
2007/0189544 A1 8/2007 Rosenberg
2007/0190508 A1 8/2007 Dalton
2007/0191141 A1 8/2007 Weber
2007/0191190 A1 8/2007 Kuo
2007/0191197 A1 8/2007 Vittone
2007/0197193 A1 8/2007 Zhou
2007/0197274 A1 8/2007 Dugan
2007/0197345 A1 8/2007 Wallace et al.
2007/0197346 A1 8/2007 Seliber
2007/0197353 A1 8/2007 Hundley
2007/0197920 A1 8/2007 Adams
2007/0201727 A1 8/2007 Birrell et al.
2007/0202992 A1 8/2007 Grasshoff
2007/0203001 A1 8/2007 Krull
2007/0203004 A1 8/2007 Campanaro et al.
2007/0204430 A1 9/2007 Chase

(56) References Cited

U.S. PATENT DOCUMENTS

2007/0207733 A1 9/2007 Wong et al.
2007/0207902 A1 9/2007 Tiahrt
2007/0208392 A1 9/2007 Kuschner et al.
2007/0208530 A1 9/2007 Vock
2007/0213110 A1 9/2007 Rosenberg
2007/0213126 A1 9/2007 Deutsch et al.
2007/0213178 A1 9/2007 Lemmela
2007/0213183 A1 9/2007 Menektchiev
2007/0213185 A1 9/2007 Habing
2007/0214630 A1 9/2007 Kim
2007/0218432 A1 9/2007 Glass
2007/0219057 A1 9/2007 Fleishman
2007/0219058 A1 9/2007 Fleishman
2007/0219059 A1 9/2007 Schwartz
2007/0219062 A1 9/2007 Rodgers
2007/0219066 A1 9/2007 Wang
2007/0219068 A1 9/2007 Korfmacher
2007/0219074 A1 9/2007 Pride
2007/0219457 A1 9/2007 Lo
2007/0225118 A1 9/2007 Giorno
2007/0225119 A1 9/2007 Schenk
2007/0225120 A1 9/2007 Schenk
2007/0225126 A1 9/2007 Yoo
2007/0225127 A1 9/2007 Pan et al.
2007/0225136 A1 9/2007 Roman
2007/0225622 A1 9/2007 Huang et al.
2007/0232450 A1 10/2007 Hanoun
2007/0232452 A1 10/2007 Hanoun
2007/0232453 A1 10/2007 Hanoun
2007/0232455 A1 10/2007 Hanoun
2007/0232461 A1 10/2007 Jenkins et al.
2007/0232462 A1 10/2007 Webber
2007/0232463 A1 10/2007 Wu
2007/0233743 A1 10/2007 Rosenberg
2007/0239479 A1 10/2007 Arrasvuori
2007/0243974 A1 10/2007 Li
2007/0243975 A1 10/2007 Gearon
2007/0245258 A1 10/2007 Ginggen et al.
2007/0245612 A1 10/2007 Tresenfeld
2007/0247320 A1 10/2007 Morahan
2007/0249467 A1 10/2007 Hong et al.
2007/0249468 A1 10/2007 Chen
2007/0254778 A1 11/2007 Ashby
2007/0254785 A1 11/2007 Lin
2007/0259759 A1 11/2007 Sumners et al.
2007/0259763 A1 11/2007 McKeown et al.
2007/0260184 A1 11/2007 Justis et al.
2007/0260255 A1 11/2007 Haddock et al.
2007/0260482 A1 11/2007 Nurmela
2007/0265146 A1 11/2007 Kowalczewski
2007/0270284 A1 11/2007 Lin
2007/0270294 A1 11/2007 Sheets
2007/0270663 A1 11/2007 Ng et al.
2007/0270667 A1 11/2007 Coppi et al.
2007/0270721 A1 11/2007 Ananny et al.
2007/0270726 A1 11/2007 Chou
2007/0271065 A1 11/2007 Gupta et al.
2007/0271116 A1 11/2007 Wysocki et al.
2007/0271387 A1 11/2007 Lydon et al.
2007/0272011 A1 11/2007 Chapa, Jr.
2007/0275825 A1 11/2007 O'brien
2007/0275826 A1 11/2007 Niemimaki et al.
2007/0275830 A1 11/2007 Lee
2007/0276870 A1 11/2007 Rosenberg
2007/0281828 A1 12/2007 Rice
2007/0281831 A1 12/2007 Wang
2007/0281836 A1 12/2007 Gearon
2007/0283853 A1 12/2007 Sun
2007/0284495 A1 12/2007 Charles
2007/0287141 A1 12/2007 Milner
2007/0287597 A1 12/2007 Cameron
2007/0287600 A1 12/2007 Prenatt
2007/0287601 A1 12/2007 Burck et al.
2007/0287606 A1 12/2007 Mac Millan
2007/0287611 A1 12/2007 Januszek
2007/0287930 A1 12/2007 Sutton
2007/0288204 A1 12/2007 Gienke et al.
2007/0288251 A1 12/2007 Ebrom et al.
2007/0288331 A1 12/2007 Ebrom et al.
2007/0288476 A1 12/2007 Flanagan, III
2007/0288969 A1 12/2007 Prum
2007/0293377 A1 12/2007 Webber
2007/0293378 A1 12/2007 Webber
2007/0293781 A1 12/2007 Sims et al.
2007/0296313 A1 12/2007 Wang
2007/0298405 A1 12/2007 Ebrom et al.
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0001866 A1 1/2008 Martin
2008/0004162 A1 1/2008 Chen
2008/0005276 A1 1/2008 Frederick
2008/0009275 A1 1/2008 Werner
2008/0015061 A1 1/2008 Klein
2008/0015087 A1 1/2008 Negrin
2008/0015088 A1 1/2008 Del Monaco
2008/0015089 A1 1/2008 Hurwitz
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0020911 A1 1/2008 Castello Neto
2008/0020912 A1 1/2008 Dalebout et al.
2008/0026658 A1 1/2008 Kriesel
2008/0026838 A1 1/2008 Dunstan et al.
2008/0027337 A1 1/2008 Dugan
2008/0027673 A1 1/2008 Trumm
2008/0032864 A1 2/2008 Hakki
2008/0032865 A1 2/2008 Wu
2008/0032870 A1 2/2008 Wu
2008/0032871 A1 2/2008 Yeh
2008/0032873 A1 2/2008 Towley
2008/0037375 A1 2/2008 Ellner
2008/0039301 A1 2/2008 Halbridge
2008/0039302 A1 2/2008 Grant
2008/0045384 A1 2/2008 Matsubara
2008/0046246 A1 2/2008 Hakki
2008/0051256 A1 2/2008 Ashby et al.
2008/0051258 A1 2/2008 Schmehl et al.
2008/0051260 A1 2/2008 Simonson et al.
2008/0051261 A1 2/2008 Lewis
2008/0051919 A1 2/2008 Salai et al.
2008/0051993 A1 2/2008 Graham
2008/0057889 A1 3/2008 Jan
2008/0058169 A1 3/2008 Fox
2008/0058170 A1 3/2008 Giannascoli et al.
2008/0058172 A1 3/2008 Tyree
2008/0058176 A1 3/2008 Webber et al.
2008/0058177 A1 3/2008 Webber
2008/0059064 A1 3/2008 Werner
2008/0062818 A1 3/2008 Simonson et al.
2008/0064571 A1 3/2008 Lee
2008/0064576 A1 3/2008 Tyree
2008/0067302 A1 3/2008 Olivera
2008/0068559 A1 3/2008 Howell et al.
2008/0070755 A1 3/2008 Mckee
2008/0070756 A1 3/2008 Chu
2008/0070761 A1 3/2008 Lin
2008/0070765 A1 3/2008 Brown et al.
2008/0070766 A1 3/2008 Brown et al.
2008/0076637 A1 3/2008 Gilley et al.
2008/0076969 A1 3/2008 Kraft
2008/0076972 A1 3/2008 Dorogusker et al.
2008/0077489 A1 3/2008 Gilley et al.
2008/0077619 A1 3/2008 Gilley et al.
2008/0082311 A1 4/2008 Meijer et al.
2008/0085819 A1 4/2008 Yang et al.
2008/0085820 A1 4/2008 Majkrzak
2008/0085821 A1 4/2008 Webb
2008/0086318 A1 4/2008 Gilley et al.

(56) References Cited

U.S. PATENT DOCUMENTS

2008/0089551 A1 4/2008 Heather et al.
2008/0096726 A1 4/2008 Riley et al.
2008/0096735 A1 4/2008 Grider
2008/0096745 A1 4/2008 Perry
2008/0097633 A1 4/2008 Jochelson et al.
2008/0098797 A1 5/2008 Considine
2008/0103023 A1 5/2008 Chung
2008/0103024 A1 5/2008 Habing
2008/0103030 A1 5/2008 Watson et al.
2008/0103034 A1 5/2008 Mihara et al.
2008/0108481 A1 5/2008 Limma
2008/0108483 A1 5/2008 Fife
2008/0108917 A1 5/2008 Joutras et al.
2008/0109121 A1 5/2008 Takeda
2008/0109243 A1 5/2008 Ebrom et al.
2008/0109295 A1 5/2008 McConochie et al.
2008/0109310 A1 5/2008 Ebrom et al.
2008/0109841 A1 5/2008 Healther et al.
2008/0109851 A1 5/2008 Healther et al.
2008/0119332 A1 5/2008 Roman
2008/0119333 A1 5/2008 Bowser
2008/0119337 A1 5/2008 Wilkins
2008/0120436 A1 5/2008 Cowgill et al.
2008/0129825 A1 6/2008 DeAngelis et al.
2008/0132386 A1 6/2008 Helie
2008/0132389 A1 6/2008 Webber et al.
2008/0132391 A1 6/2008 Edeker
2008/0132798 A1 6/2008 Hong et al.
2008/0139370 A1 6/2008 Charnitski
2008/0141135 A1 6/2008 Mason et al.
2008/0146334 A1 6/2008 Kil
2008/0146336 A1 6/2008 Feldman
2008/0146416 A1 6/2008 Mueller et al.
2008/0146418 A1 6/2008 Summers
2008/0146890 A1 6/2008 LeBoeuf et al.
2008/0146892 A1 6/2008 LeBoeuf et al.
2008/0147502 A1 6/2008 Baker
2008/0153670 A1 6/2008 Mckirdy
2008/0153671 A1 6/2008 Ogg et al.
2008/0153676 A1 6/2008 Krietzman
2008/0153677 A1 6/2008 Webber et al.
2008/0153682 A1 6/2008 Chen et al.
2008/0155077 A1 6/2008 James
2008/0161168 A1 7/2008 Hsiao
2008/0161170 A1 7/2008 Lumpee
2008/0161653 A1 7/2008 Lin et al.
2008/0167535 A1 7/2008 Stivoric et al.
2008/0167536 A1 7/2008 Teller
2008/0167958 A1 7/2008 Balmadur
2008/0171636 A1 7/2008 Usui et al.
2008/0171640 A1 7/2008 Chang
2008/0171922 A1 7/2008 Teller
2008/0171945 A1 7/2008 Dotter
2008/0172328 A1 7/2008 Ajilian
2008/0176655 A1 7/2008 James
2008/0176713 A1 7/2008 Olivera Brizzio
2008/0176717 A1 7/2008 Wang
2008/0176718 A1 7/2008 Wang
2008/0176721 A1 7/2008 Boren
2008/0176722 A1 7/2008 Steffee
2008/0179214 A1 7/2008 Hall
2008/0182685 A1 7/2008 Marty et al.
2008/0182724 A1 7/2008 Guthrie
2008/0182731 A1 7/2008 Vittone
2008/0182732 A1 7/2008 Webber et al.
2008/0183049 A1 7/2008 Karkanias et al.
2008/0183052 A1 7/2008 Teller
2008/0187689 A1 8/2008 Dierkens et al.
2008/0188354 A1 8/2008 Pauws et al.
2008/0188362 A1 8/2008 Chen
2008/0189733 A1 8/2008 Apostolopoulos
2008/0190745 A1 8/2008 Taniguchi et al.
2008/0191864 A1 8/2008 Wolfson
2008/0195258 A1 8/2008 Schendel
2008/0200287 A1 8/2008 Marty et al.
2008/0200310 A1 8/2008 Tagliabue
2008/0200312 A1 8/2008 Tagliabue
2008/0200314 A1 8/2008 Dalebout et al.
2008/0200778 A1 8/2008 Taskinen
2008/0200853 A1 8/2008 Tielve
2008/0204225 A1 8/2008 Kitchen
2008/0207401 A1 8/2008 Harding et al.
2008/0207402 A1 8/2008 Fisher et al.
2008/0207407 A1 8/2008 Yeh
2008/0207415 A1 8/2008 Tsai
2008/0214358 A1 9/2008 Ogg et al.
2008/0214359 A1 9/2008 Niva et al.
2008/0214365 A1 9/2008 Webber et al.
2008/0214367 A1 9/2008 Webber et al.
2008/0214903 A1 9/2008 Orbach
2008/0214971 A1 9/2008 Talish
2008/0216717 A1 9/2008 Jones
2008/0218307 A1 9/2008 Schoettle
2008/0220941 A1 9/2008 Shaw
2008/0224988 A1 9/2008 Whang
2008/0227607 A1 9/2008 Nizam
2008/0228110 A1 9/2008 Berme
2008/0229875 A1 9/2008 Ray
2008/0234023 A1 9/2008 Mullahkhel et al.
2008/0234110 A1 9/2008 Webber et al.
2008/0234111 A1 9/2008 Packham
2008/0234113 A1 9/2008 Einav
2008/0242510 A1 10/2008 Topel
2008/0242511 A1 10/2008 Munoz et al.
2008/0242512 A1 10/2008 Kim
2008/0242513 A1 10/2008 Skilken et al.
2008/0242520 A1 10/2008 Hubbard
2008/0244870 A1 10/2008 Chase
2008/0245944 A1 10/2008 Chase
2008/0248926 A1 10/2008 Cole et al.
2008/0248929 A1 10/2008 Webber et al.
2008/0248935 A1 10/2008 Solow
2008/0249736 A1 10/2008 Prstojevich
2008/0250729 A1 10/2008 Kriesel
2008/0253378 A1 10/2008 Curry
2008/0254420 A1 10/2008 Nerenberg
2008/0254947 A1 10/2008 Mackay
2008/0255430 A1 10/2008 Alexandersson et al.
2008/0255794 A1 10/2008 Levine
2008/0261636 A1 10/2008 Lau et al.
2008/0261774 A1 10/2008 Fisher
2008/0261776 A1 10/2008 Skiba
2008/0261785 A1 10/2008 Albanese
2008/0262381 A1 10/2008 Kolen
2008/0262392 A1 10/2008 Ananny et al.
2008/0267444 A1 10/2008 Simons-Nikolova et al.
2008/0269016 A1 10/2008 Ungari et al.
2008/0269017 A1 10/2008 Shuster
2008/0273008 A1 11/2008 Chang
2008/0279896 A1 11/2008 Heinen et al.
2008/0280731 A1 11/2008 Dalebout et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0287270 A1 11/2008 Carter
2008/0293023 A1 11/2008 Diehl
2008/0295129 A1 11/2008 Laut
2008/0296883 A1 12/2008 Burkhardtsmaier
2008/0300109 A1 12/2008 Karkanias et al.
2008/0300110 A1 12/2008 Smith et al.
2008/0300114 A1 12/2008 Dalebout
2008/0300115 A1 12/2008 Erlandson
2008/0300116 A1 12/2008 Eder
2008/0300118 A1 12/2008 Wehrell
2008/0300914 A1 12/2008 Karkanias
2008/0305934 A1 12/2008 Medina
2008/0305936 A1 12/2008 Cao
2008/0306762 A1 12/2008 James
2008/0312039 A1 12/2008 Bucay-Bissu
2008/0312041 A1 12/2008 Schwabe et al.
2008/0312047 A1 12/2008 Feng
2008/0312052 A1 12/2008 Krietzman

(56) References Cited

U.S. PATENT DOCUMENTS

2008/0315371 A1 12/2008 Tang et al.
2008/0318737 A1 12/2008 Chu
2008/0318738 A1 12/2008 Chen
2008/0318743 A1 12/2008 Bizzell
2008/0318744 A1 12/2008 Barra
2008/0319787 A1 12/2008 Stivoric
2008/0319796 A1 12/2008 Stivoric
2008/0319855 A1 12/2008 Stivoric
2009/0001831 A1 1/2009 Cho et al.
2009/0005224 A1 1/2009 Davis
2009/0017991 A1 1/2009 Hung
2009/0018000 A1 1/2009 Brown
2009/0023553 A1 1/2009 Shim
2009/0023554 A1 1/2009 Shim
2009/0023556 A1 1/2009 Daly
2009/0023562 A1 1/2009 Lamarque
2009/0024233 A1 1/2009 Shirai et al.
2009/0027925 A1 1/2009 Kanouda et al.
2009/0028005 A1 1/2009 You et al.
2009/0029831 A1 1/2009 Weier
2009/0029834 A1 1/2009 Isom
2009/0036276 A1 2/2009 Loach
2009/0036277 A1 2/2009 Ish et al.
2009/0040231 A1 2/2009 Sano et al.
2009/0040301 A1 2/2009 Sandler et al.
2009/0041298 A1 2/2009 Sandler et al.
2009/0042174 A1 2/2009 Aries
2009/0042696 A1 2/2009 Wang
2009/0042698 A1 2/2009 Wang
2009/0043531 A1 2/2009 Kahn et al.
2009/0047645 A1 2/2009 Dibenedetto et al.
2009/0048044 A1 2/2009 Oleson et al.
2009/0048073 A1 2/2009 Roimicher
2009/0048074 A1 2/2009 Kamins
2009/0048079 A1 2/2009 Nalley
2009/0048493 A1 2/2009 James et al.
2009/0048939 A1 2/2009 Williams
2009/0049092 A1 2/2009 Capio et al.
2009/0053682 A1 2/2009 Stern
2009/0054207 A1 2/2009 Lin et al.
2009/0054214 A1 2/2009 Kadar
2009/0054751 A1 2/2009 Babashan et al.
2009/0061870 A1 3/2009 Finkelstein et al.
2009/0062072 A1 3/2009 Packham
2009/0062598 A1 3/2009 Haisma et al.
2009/0069156 A1 3/2009 Kurunmäki et al.
2009/0069159 A1 3/2009 Wang
2009/0069722 A1 3/2009 Flaction et al.
2009/0075781 A1 3/2009 Schwarzberg et al.
2009/0075784 A1 3/2009 Hoggan
2009/0075793 A1 3/2009 Trainor
2009/0076335 A1 3/2009 Schwarzberg et al.
2009/0076903 A1 3/2009 Schwarzberg et al.
2009/0080808 A1 3/2009 Hagen
2009/0082176 A1 3/2009 Watterson et al.
2009/0082880 A1 3/2009 Saunders
2009/0085873 A1 4/2009 Betts et al.
2009/0088248 A1 4/2009 Stevens
2009/0088299 A1 4/2009 Chen
2009/0088301 A1 4/2009 Alling
2009/0093319 A1 4/2009 Omidi
2009/0093341 A1 4/2009 James
2009/0093347 A1 4/2009 Wang
2009/0098980 A1 4/2009 Waters
2009/0098981 A1 4/2009 Del Giorno
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0105560 A1 4/2009 Solomon
2009/0109346 A1 4/2009 Viarani et al.
2009/0111656 A1 4/2009 Sullivan et al.
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0117890 A1 5/2009 Jacobsen et al.
2009/0118098 A1 5/2009 Yeh
2009/0118099 A1 5/2009 Fisher
2009/0118103 A1 5/2009 Ellis
2009/0118105 A1 5/2009 Schiff
2009/0119032 A1 5/2009 Meyer
2009/0120208 A1 5/2009 Meyer
2009/0120210 A1 5/2009 Phillips et al.
2009/0124460 A1 5/2009 Chen
2009/0124463 A1 5/2009 Lin
2009/0124464 A1 5/2009 Kastelic
2009/0124465 A1 5/2009 Wang
2009/0124466 A1 5/2009 Zhang
2009/0124470 A1 5/2009 Yu
2009/0128342 A1 5/2009 Cohen
2009/0128516 A1 5/2009 Rimon et al.
2009/0131230 A1 5/2009 Cole
2009/0131231 A1 5/2009 Smith
2009/0137367 A1 5/2009 Hendrickson et al.
2009/0137370 A1 5/2009 Kushnir
2009/0143201 A1 6/2009 Uygan
2009/0144080 A1 6/2009 Gray et al.
2009/0144084 A1 6/2009 Neumaier
2009/0144639 A1 6/2009 Nims et al.
2009/0149299 A1 6/2009 Tchao et al.
2009/0149302 A1 6/2009 Thuma
2009/0149721 A1 6/2009 Yang
2009/0150178 A1 6/2009 Sutton et al.
2009/0156363 A1 6/2009 Guidi et al.
2009/0156364 A1 6/2009 Simeoni
2009/0158871 A1 6/2009 Chuo
2009/0163262 A1 6/2009 Kang
2009/0163323 A1 6/2009 Bocchicchio
2009/0163326 A1 6/2009 Wang
2009/0163327 A1 6/2009 Huang et al.
2009/0163331 A1 6/2009 Lacher
2009/0163334 A1 6/2009 Gibson et al.
2009/0170663 A1 7/2009 Cox et al.
2009/0170667 A1 7/2009 Irving et al.
2009/0170668 A1 7/2009 Giannelli et al.
2009/0170669 A1 7/2009 Giannelli et al.
2009/0170672 A1 7/2009 Mcmullen
2009/0170675 A1 7/2009 Giannelli et al.
2009/0171229 A1 7/2009 Saldarelli
2009/0174558 A1 7/2009 White
2009/0176526 A1 7/2009 Altman
2009/0176581 A1 7/2009 Barnes et al.
2009/0176625 A1 7/2009 Giannelli et al.
2009/0176628 A1 7/2009 Radding et al.
2009/0177068 A1 7/2009 Stivoric et al.
2009/0180646 A1 7/2009 Vulfson et al.
2009/0181826 A1 7/2009 Turner
2009/0181829 A1 7/2009 Wu
2009/0181830 A1 7/2009 Wu
2009/0181831 A1 7/2009 Kuo
2009/0181833 A1 7/2009 Cassidy
2009/0186748 A1 7/2009 Golesh et al.
2009/0186749 A1 7/2009 Zhou
2009/0191988 A1 7/2009 Klein
2009/0192391 A1 7/2009 Lovitt et al.
2009/0192871 A1 7/2009 Deacon et al.
2009/0193344 A1 7/2009 Smyers
2009/0193796 A1 8/2009 Wei et al.
2009/0195350 A1 8/2009 Tsern et al.
2009/0196417 A1 8/2009 Beaver et al.
2009/0197739 A1 8/2009 Hashimoto et al.
2009/0197740 A1 8/2009 Julskjaer et al.
2009/0197745 A1 8/2009 Olson
2009/0203501 A1 8/2009 Rodgers, Jr.
2009/0204422 A1 8/2009 James
2009/0204668 A1 8/2009 Huang
2009/0205482 A1 8/2009 Shirai et al.
2009/0209393 A1 8/2009 Crater et al.
2009/0210078 A1 8/2009 Crowley
2009/0215594 A1 8/2009 Panaiotov
2009/0216629 A1 8/2009 James
2009/0217178 A1 8/2009 Niyogi et al.

(56) References Cited

U.S. PATENT DOCUMENTS

2009/0221404 A1 9/2009 Dorogusker et al.
2009/0221405 A1 9/2009 Wang
2009/0221407 A1 9/2009 Hauk
2009/0227424 A1 9/2009 Hirata et al.
2009/0227428 A1 9/2009 Tamari
2009/0227429 A1 9/2009 Baudhuin
2009/0227432 A1 9/2009 Pacheco
2009/0232420 A1 9/2009 Eisenberg et al.
2009/0233769 A1 9/2009 Pryor
2009/0233771 A1 9/2009 Quatrochi et al.
2009/0238400 A1 9/2009 Im
2009/0239714 A1 9/2009 Sellers
2009/0240858 A1 9/2009 Takebayashi
2009/0246746 A1 10/2009 Roerdink et al.
2009/0247366 A1 10/2009 Frumer
2009/0247376 A1 10/2009 Merrithew et al.
2009/0253109 A1 10/2009 Anvari
2009/0253554 A1 10/2009 Mcintosh
2009/0257323 A1 10/2009 Soltani
2009/0258710 A1 10/2009 Quatrochi et al.
2009/0258758 A1 10/2009 Hickman
2009/0258763 A1 10/2009 Richter
2009/0262088 A1 10/2009 Moll-Carrillo et al.
2009/0263772 A1 10/2009 Root
2009/0264258 A1 10/2009 Lo
2009/0264260 A1 10/2009 Piaget et al.
2009/0265649 A1 10/2009 Schlossberg et al.
2009/0267783 A1 10/2009 Vock et al.
2009/0269728 A1 10/2009 Verstegen et al.
2009/0270226 A1 10/2009 Watterson
2009/0270234 A1 10/2009 Alessandri et al.
2009/0270743 A1 10/2009 Dugan
2009/0278707 A1 11/2009 Biggins et al.
2009/0280964 A1 11/2009 Lin
2009/0282080 A1 11/2009 Schlossberg et al.
2009/0286653 A1 11/2009 Wiber
2009/0292178 A1 11/2009 Ellis et al.
2009/0293319 A1 12/2009 Avni
2009/0298649 A1 12/2009 Dyer et al.
2009/0305852 A1 12/2009 Svenberg
2009/0309891 A1 12/2009 Karkanias et al.
2009/0312151 A1 12/2009 Thieberger
2009/0312158 A1 12/2009 Trevino et al.
2009/0312658 A1 12/2009 Thieberger
2010/0003573 A1 1/2010 Jeanne et al.
2010/0003647 A1 1/2010 Brown et al.
2010/0004104 A1 1/2010 Gustafson
2010/0005624 A1 1/2010 Swearingen
2010/0009809 A1 1/2010 Carrington
2010/0009810 A1 1/2010 Trzecieski
2010/0015585 A1 1/2010 Baker
2010/0016127 A1 1/2010 Farnsworth et al.
2010/0016129 A1 1/2010 Chou
2010/0016742 A1 1/2010 James
2010/0017402 A1 1/2010 Fleming et al.
2010/0019593 A1 1/2010 Ritchey
2010/0022354 A1 1/2010 Fisher
2010/0024590 A1 2/2010 O'neill
2010/0031803 A1 2/2010 Lozada et al.
2010/0032533 A1 2/2010 Chen et al.
2010/0034665 A1 2/2010 Zhong et al.
2010/0035726 A1 2/2010 Fisher et al.
2010/0036736 A1 2/2010 McGee et al.
2010/0038149 A1 2/2010 Corel
2010/0041000 A1 2/2010 Glass
2010/0041516 A1 2/2010 Kodama
2010/0041526 A1 2/2010 Bowser et al.
2010/0048358 A1 2/2010 Tchao et al.
2010/0048368 A1 2/2010 Donofrio
2010/0050082 A1 2/2010 Katz et al.
2010/0056339 A1 3/2010 Chen
2010/0056340 A1 3/2010 Ellis
2010/0056345 A1 3/2010 Liu
2010/0056876 A1 3/2010 Ellis
2010/0062818 A1 3/2010 Haughay, Jr. et al.
2010/0062904 A1 3/2010 Crawford et al.
2010/0062914 A1 3/2010 Splane
2010/0063426 A1 3/2010 Planke
2010/0064255 A1 3/2010 Rottler et al.
2010/0068684 A1 3/2010 Sabel
2010/0069202 A1 3/2010 Olsen
2010/0075812 A1 3/2010 Piaget et al.
2010/0076278 A1 3/2010 van der Zande et al.
2010/0077564 A1 4/2010 Saier et al.
2010/0079291 A1 4/2010 Kroll et al.
2010/0081116 A1 4/2010 Barasch et al.
2010/0081548 A1 4/2010 Labedz
2010/0087298 A1 4/2010 Zaccherini et al.
2010/0087701 A1 4/2010 Berka et al.
2010/0088023 A1 4/2010 Werner
2010/0093492 A1 4/2010 Watterson et al.
2010/0093493 A1 4/2010 Eldridge
2010/0099437 A1 4/2010 Moerdijk
2010/0099541 A1 4/2010 Patel
2010/0099954 A1 4/2010 Dickinson et al.
2010/0105527 A1 4/2010 Johnson
2010/0105530 A1 4/2010 Inaizumi
2010/0112536 A1 5/2010 Claassen et al.
2010/0113222 A1 5/2010 Radow
2010/0113223 A1 5/2010 Chiles et al.
2010/0113948 A1 5/2010 Yang et al.
2010/0120585 A1 5/2010 Quy
2010/0125026 A1 5/2010 Zavadsky et al.
2010/0125029 A1 5/2010 Nielson et al.
2010/0125183 A1 5/2010 Vayalattu et al.
2010/0130337 A1 5/2010 Stewart
2010/0137049 A1 6/2010 Epstein
2010/0137105 A1 6/2010 McLaughlin
2010/0137106 A1 6/2010 Oshima et al.
2010/0137114 A1 6/2010 Keiser
2010/0144500 A1 6/2010 Canali
2010/0144501 A1 6/2010 Berhanu
2010/0146055 A1 6/2010 Hannuksela
2010/0152546 A1 6/2010 Behan et al.
2010/0156625 A1 6/2010 Ruha
2010/0156760 A1 6/2010 Cheswick
2010/0160013 A1 6/2010 Sanders
2010/0160014 A1 6/2010 Galasso et al.
2010/0160115 A1 6/2010 Morris et al.
2010/0164579 A1 7/2010 Acatrinei
2010/0167801 A1 7/2010 Karkanias et al.
2010/0167876 A1 7/2010 Cheng
2010/0167883 A1 7/2010 Grind
2010/0173276 A1 7/2010 Vasin
2010/0173755 A1 7/2010 P Erez De Lazarraga
2010/0173759 A1 7/2010 Lalaoua
2010/0175634 A1 7/2010 Chang et al.
2010/0178981 A1 7/2010 Holcomb
2010/0179032 A1 7/2010 Perry
2010/0179035 A1 7/2010 Carnahan
2010/0179883 A1 7/2010 Devolites
2010/0182436 A1 7/2010 Boman et al.
2010/0184565 A1 7/2010 Avellino
2010/0184568 A1 7/2010 Schippers
2010/0184570 A1 7/2010 Cheng
2010/0188405 A1 7/2010 Haughay, Jr. et al.
2010/0190610 A1 7/2010 Pryor
2010/0190615 A1 7/2010 Baker et al.
2010/0191462 A1 7/2010 Kobuya et al.
2010/0192715 A1 8/2010 Vauchel et al.
2010/0197462 A1 8/2010 Piane, Jr.
2010/0197465 A1 8/2010 Stevenson
2010/0204013 A1 8/2010 Chen
2010/0208038 A1 8/2010 Kutliroff et al.
2010/0208082 A1 8/2010 Buchner et al.
2010/0210418 A1 8/2010 Park
2010/0211439 A1 8/2010 Marci et al.
2010/0216536 A1 8/2010 Gagner
2010/0216599 A1 8/2010 Watterson
2010/0216600 A1 8/2010 Noffsinger
2010/0216603 A1 8/2010 Somers
2010/0216607 A1 8/2010 Mueller
2010/0216610 A1 8/2010 Gedeon-Janvier
2010/0217096 A1 8/2010 Nanikashvili

(56) References Cited

U.S. PATENT DOCUMENTS

2010/0217099 A1 8/2010 Leboeuf
2010/0217102 A1 8/2010 Leboeuf et al.
2010/0222165 A1 9/2010 Nurnberg et al.
2010/0222178 A1 9/2010 Shea
2010/0222179 A1 9/2010 Temple et al.
2010/0222182 A1 9/2010 Park
2010/0227542 A1 9/2010 Goldmann
2010/0227740 A1 9/2010 Liu
2010/0233664 A1 9/2010 Wroclawsky
2010/0234184 A1 9/2010 Le Page
2010/0234185 A1 9/2010 Watt et al.
2010/0234193 A1 9/2010 Friedman
2010/0234693 A1 9/2010 Srinivasan et al.
2010/0235667 A1 9/2010 Mucignat et al.
2010/0240458 A1 9/2010 Gaiba et al.
2010/0240493 A1 9/2010 Wang
2010/0240495 A1 9/2010 Law
2010/0240945 A1 9/2010 Bikko
2010/0241018 A1 9/2010 Vogel
2010/0243514 A1 9/2010 Samain et al.
2010/0247081 A1 9/2010 Victoria Pons
2010/0248899 A1 9/2010 Bedell et al.
2010/0248900 A1 9/2010 Ashby
2010/0248901 A1 9/2010 Martens
2010/0248917 A1 9/2010 Reyes
2010/0251454 A1 10/2010 Kiernan
2010/0255884 A1 10/2010 Konkka et al.
2010/0255955 A1 10/2010 Hickman
2010/0255959 A1 10/2010 Dalebout et al.
2010/0255965 A1 10/2010 Chen
2010/0259043 A1 10/2010 Balsamo
2010/0261580 A1 10/2010 Lannon
2010/0267524 A1 10/2010 Stewart et al.
2010/0271367 A1 10/2010 Vaden et al.
2010/0273610 A1 10/2010 Johnson
2010/0274100 A1 10/2010 Behar
2010/0279822 A1 11/2010 Ford
2010/0279823 A1 11/2010 Waters
2010/0281463 A1 11/2010 Estrade
2010/0283601 A1 11/2010 Tai et al.
2010/0285933 A1 11/2010 Nalley
2010/0285935 A1 11/2010 Barnett
2010/0289466 A1 11/2010 Telefus
2010/0289772 A1 11/2010 Miller
2010/0292050 A1 11/2010 DiBenedetto et al.
2010/0292056 A1 11/2010 Birch
2010/0292599 A1 11/2010 Oleson et al.
2010/0292600 A1 11/2010 Dibenedetto et al.
2010/0298098 A1 11/2010 Ercan
2010/0298104 A1 11/2010 Turner
2010/0298106 A1 11/2010 Bowser
2010/0298655 A1 11/2010 McCombie et al.
2010/0298656 A1 11/2010 McCombie et al.
2010/0298661 A1 11/2010 McCombie et al.
2010/0300272 A1 12/2010 Scherf
2010/0302142 A1 12/2010 French
2010/0302250 A1 12/2010 Hoebel
2010/0304931 A1 12/2010 Stumpf
2010/0304932 A1 12/2010 Kolman et al.
2010/0304934 A1 12/2010 Woodson
2010/0304938 A1 12/2010 Olson
2010/0304939 A1 12/2010 Svenberg
2010/0304940 A1 12/2010 Svenberg
2010/0311552 A1 12/2010 Sumners
2010/0312596 A1 12/2010 Saffari et al.
2010/0317488 A1 12/2010 Cartaya
2010/0317496 A1 12/2010 Abranchess
2010/0320956 A1 12/2010 Lumsden et al.
2010/0323852 A1 12/2010 Locsin
2010/0324387 A1 12/2010 Moon
2010/0327603 A1 12/2010 Suaan
2010/0331151 A1 12/2010 Signorile et al.
2010/0331153 A1 12/2010 Johnson
2011/0000024 A1 1/2011 Johnson et al.
2011/0003663 A1 1/2011 Chiu et al.
2011/0003664 A1 1/2011 Richard
2011/0009240 A1 1/2011 Chiu et al.
2011/0009249 A1 1/2011 Campanaro et al.
2011/0015039 A1 1/2011 Shea
2011/0015041 A1 1/2011 Shea
2011/0015468 A1 1/2011 Aarts et al.
2011/0021319 A1 1/2011 Nissila et al.
2011/0021323 A1 1/2011 Wu
2011/0021953 A1 1/2011 Sanematsu et al.
2011/0028277 A1 2/2011 Merli
2011/0028282 A1 2/2011 Sbragia
2011/0028286 A1 2/2011 Nortje
2011/0032105 A1 2/2011 Hoffman et al.
2011/0034300 A1 2/2011 Hall
2011/0039659 A1 2/2011 Kim et al.
2011/0045956 A1 2/2011 Colledge
2011/0046519 A1 2/2011 Raheman
2011/0048141 A1 3/2011 Svenberg
2011/0053131 A1 3/2011 Regnier
2011/0054242 A1 3/2011 Bender
2011/0054270 A1 3/2011 Derchak
2011/0054272 A1 3/2011 Derchak
2011/0054359 A1 3/2011 Sazonov et al.
2011/0054809 A1 3/2011 Templeman
2011/0056328 A1 3/2011 Ko
2011/0061515 A1 3/2011 Turner
2011/0061840 A1 3/2011 Goldmann
2011/0063114 A1 3/2011 Ikoyan
2011/0065371 A1 3/2011 Leff
2011/0065373 A1 3/2011 Goldmann
2011/0065504 A1 3/2011 Dugan et al.
2011/0066056 A1 3/2011 Huang
2011/0067361 A1 3/2011 Sloan
2011/0072955 A1 3/2011 Turner
2011/0073743 A1 3/2011 Shamie
2011/0075835 A1 3/2011 Hill
2011/0077055 A1 3/2011 Pakula et al.
2011/0077128 A1 3/2011 Hamada et al.
2011/0082006 A1 4/2011 Ishii
2011/0082007 A1 4/2011 Birrell
2011/0082010 A1 4/2011 Dyer
2011/0082011 A1 4/2011 Ellis
2011/0082013 A1 4/2011 Bastian
2011/0082015 A1 4/2011 Dreissigacker et al.
2011/0082017 A1 4/2011 Arlie
2011/0082397 A1 4/2011 Alberts
2011/0086707 A1 4/2011 Loveland
2011/0087076 A1 4/2011 Brynelsen et al.
2011/0087137 A1 4/2011 Hanoun
2011/0087445 A1 4/2011 Sobolewski
2011/0087446 A1 4/2011 Redmond
2011/0090092 A1 4/2011 Birrell et al.
2011/0091842 A1 4/2011 Dugan
2011/0092779 A1 4/2011 Chang et al.
2011/0093100 A1 4/2011 Ramsay
2011/0096764 A1 4/2011 Tunioli et al.
2011/0098157 A1 4/2011 Whalen et al.
2011/0098615 A1 4/2011 Whalen et al.
2011/0105278 A1 5/2011 Fabbri
2011/0105279 A1 5/2011 Herranen
2011/0105920 A1 5/2011 Haataja
2011/0106597 A1 5/2011 Ferdman et al.
2011/0109283 A1 5/2011 Kapels et al.
2011/0111925 A1 5/2011 Hobson
2011/0112771 A1 5/2011 French
2011/0117529 A1 5/2011 Barash
2011/0118084 A1 5/2011 Tsai et al.
2011/0118086 A1 5/2011 Radow
2011/0118089 A1 5/2011 Ellis
2011/0118090 A1 5/2011 Ellis
2011/0119027 A1 5/2011 Zhu et al.
2011/0124466 A1 5/2011 Nishimura
2011/0124469 A1 5/2011 Uhlir
2011/0124476 A1 5/2011 Holley
2011/0124978 A1 5/2011 Williams
2011/0125063 A1 5/2011 Shalon et al.
2011/0131005 A1 6/2011 Ueshima et al.
2011/0136627 A1 6/2011 Williams
2011/0140904 A1 6/2011 Kashi

(56) References Cited

U.S. PATENT DOCUMENTS

2011/0143769 A1 6/2011 Jones et al.
2011/0143890 A1 6/2011 Reyes
2011/0143898 A1 6/2011 Trees
2011/0152032 A1 6/2011 Barnett
2011/0152033 A1 6/2011 Yang
2011/0152037 A1 6/2011 Tsou
2011/0152038 A1 6/2011 Freitag
2011/0152039 A1 6/2011 Hendrickson et al.
2011/0152635 A1 6/2011 Morris et al.
2011/0152696 A1 6/2011 Ryan
2011/0163206 A1 7/2011 Bandera
2011/0163939 A1 7/2011 Tam et al.
2011/0164044 A1 7/2011 Huang
2011/0164175 A1 7/2011 Chung et al.
2011/0165995 A1 7/2011 Paulus
2011/0165996 A1 7/2011 Paulus
2011/0165997 A1 7/2011 Reich
2011/0165998 A1 7/2011 Lau et al.
2011/0167447 A1 7/2011 Wong
2011/0172058 A1 7/2011 Deaconu
2011/0172059 A1 7/2011 Watterson et al.
2011/0172060 A1 7/2011 Morales et al.
2011/0172068 A1 7/2011 Tyson, III
2011/0175744 A1 7/2011 Englert et al.
2011/0175989 A1 7/2011 Islam
2011/0176943 A1 7/2011 Tran et al.
2011/0177919 A1 7/2011 Tamari
2011/0177921 A1 7/2011 Olson
2011/0179068 A1 7/2011 O'brien
2011/0181420 A1 7/2011 Mack et al.
2011/0183307 A1 7/2011 Shum et al.
2011/0184225 A1 7/2011 Whitall et al.
2011/0184247 A1 7/2011 Contant et al.
2011/0185309 A1 7/2011 Challinor et al.
2011/0188269 A1 8/2011 Hosotani
2011/0188668 A1 8/2011 Donaldson
2011/0188980 A1 8/2011 Pumroy
2011/0190096 A1 8/2011 Clarke
2011/0191123 A1 8/2011 Buzynski
2011/0195819 A1 8/2011 Shaw
2011/0195825 A1 8/2011 Liester
2011/0197157 A1 8/2011 Hoffman et al.
2011/0199393 A1 8/2011 Nurse et al.
2011/0199799 A1 8/2011 Hui et al.
2011/0201476 A1 8/2011 Solomon
2011/0201481 A1 8/2011 Lo
2011/0202236 A1 8/2011 Galasso et al.
2011/0205164 A1 8/2011 Hansen et al.
2011/0207584 A1 8/2011 Webber et al.
2011/0214148 A1 9/2011 Gossweiler, III et al.
2011/0218086 A1 9/2011 Boren
2011/0221672 A1 9/2011 Osterhout et al.
2011/0222375 A1 9/2011 Tsubata et al.
2011/0224057 A1 9/2011 Wu
2011/0224058 A1 9/2011 Webber et al.
2011/0224498 A1 9/2011 Banet et al.
2011/0227268 A1 9/2011 Zheng
2011/0229862 A1 9/2011 Parikh
2011/0230732 A1 9/2011 Edman et al.
2011/0237396 A1 9/2011 Lu
2011/0237399 A1 9/2011 Toback
2011/0237405 A1 9/2011 Reyes
2011/0237407 A1 9/2011 Kaleal
2011/0238217 A1 9/2011 Kume
2011/0240403 A1 10/2011 Meillet
2011/0245633 A1 10/2011 Goldberg et al.
2011/0247530 A1 10/2011 Coffman
2011/0251021 A1 10/2011 Zavadsky et al.
2011/0251023 A1 10/2011 Fedriga
2011/0251033 A1 10/2011 Blancher
2011/0252597 A1 10/2011 Burris et al.
2011/0256988 A1 10/2011 Weier
2011/0257797 A1 10/2011 Burris et al.
2011/0263384 A1 10/2011 Drazan
2011/0263385 A1 10/2011 Shea
2011/0264305 A1 10/2011 Choe
2011/0267196 A1 11/2011 Hu et al.
2011/0269517 A1 11/2011 Englert et al.
2011/0269604 A1 11/2011 Tseng
2011/0270135 A1 11/2011 Dooley
2011/0275482 A1 11/2011 Brodess et al.
2011/0275489 A1 11/2011 Apau
2011/0275496 A1 11/2011 Chou
2011/0275499 A1 11/2011 Eschenbach
2011/0276312 A1 11/2011 Shalon et al.
2011/0281249 A1 11/2011 Gammell et al.
2011/0281691 A1 11/2011 Ellis
2011/0283188 A1 11/2011 Farrenkopf et al.
2011/0283231 A1 11/2011 Richstein et al.
2011/0287905 A1 11/2011 Reyes
2011/0295083 A1 12/2011 Doelling et al.
2011/0306480 A1 12/2011 Beaulieu et al.
2011/0308919 A1 12/2011 Hahn
2011/0311955 A1 12/2011 Forsten et al.
2011/0312473 A1 12/2011 Chu et al.
2011/0312475 A1 12/2011 Towley, III
2011/0319229 A1 12/2011 Corbalis et al.
2011/0319230 A1 12/2011 Brendle
2011/0320380 A1 12/2011 Zahn et al.
2012/0004074 A1 1/2012 Schelzig
2012/0004075 A1 1/2012 Kissel et al.
2012/0004076 A1 1/2012 Fenster
2012/0004080 A1 1/2012 Webb
2012/0010053 A1 1/2012 Bayerlein et al.
2012/0015778 A1 1/2012 Lee et al.
2012/0015779 A1 1/2012 Powch et al.
2012/0015784 A1 1/2012 Reed
2012/0015787 A2 1/2012 Crawley
2012/0020135 A1 1/2012 McCune
2012/0021873 A1 1/2012 Brunner
2012/0021875 A1 1/2012 Karl
2012/0021876 A1 1/2012 Hsiung
2012/0021877 A1 1/2012 Lundquist et al.
2012/0024237 A1 2/2012 Rice
2012/0028761 A1 2/2012 Dorogusker et al.
2012/0029666 A1 2/2012 Crowley et al.
2012/0032896 A1 2/2012 Vesely
2012/0035024 A1 2/2012 Price
2012/0035487 A1 2/2012 Werner et al.
2012/0036557 A1 2/2012 Li
2012/0046144 A1 2/2012 Lin et al.
2012/0050818 A1 3/2012 Watanabe
2012/0053024 A1 3/2012 Mendoza
2012/0055718 A1 3/2012 Chen
2012/0065031 A1 3/2012 Buzzanco
2012/0065034 A1 3/2012 Loach
2012/0071301 A1 3/2012 Kaylor et al.
2012/0078127 A1 3/2012 McDonald et al.
2012/0079429 A1 3/2012 Stathacopoulos et al.
2012/0079529 A1 3/2012 Harris et al.
2012/0081531 A1 4/2012 DeAngelis et al.
2012/0083395 A1 4/2012 Carson
2012/0083396 A1 4/2012 Aquino
2012/0083669 A1 4/2012 Abujbara
2012/0083705 A1 4/2012 Yuen et al.
2012/0084807 A1 4/2012 Thompson et al.
2012/0084811 A1 4/2012 Thompson
2012/0084812 A1 4/2012 Thompson et al.
2012/0088633 A1 4/2012 Grafton
2012/0088634 A1 4/2012 Heidecke
2012/0088638 A1 4/2012 Lull
2012/0088640 A1 4/2012 Wissink
2012/0090446 A1 4/2012 Moreno
2012/0092327 A1 4/2012 Adhikari
2012/0094809 A1 4/2012 Nishimura
2012/0096357 A1 4/2012 Folgner et al.
2012/0096405 A1 4/2012 Seo
2012/0105867 A1 5/2012 Komatsu
2012/0108914 A1 5/2012 Bravomalo
2012/0113029 A1 5/2012 Ye et al.
2012/0115682 A1 5/2012 Homsi
2012/0115689 A1 5/2012 Dalebout et al.
2012/0115691 A1 5/2012 Munroe
2012/0115695 A1 5/2012 Watterson et al.

(56) References Cited

U.S. PATENT DOCUMENTS

2012/0116550 A1 5/2012 Hoffman et al.
2012/0116684 A1 5/2012 Ingrassia et al.
2012/0116806 A1 5/2012 Stark et al.
2012/0122063 A1 5/2012 Chen et al.
2012/0125559 A1 5/2012 Fadell et al.
2012/0129139 A1 5/2012 Partovi
2012/0129653 A1 5/2012 Shalev
2012/0132877 A1 5/2012 Wang
2012/0133192 A1 5/2012 Simpson
2012/0142503 A1 6/2012 Sevadjian
2012/0143358 A1 6/2012 Adams et al.
2012/0149996 A1 6/2012 Stivoric et al.
2012/0153015 A1 6/2012 Gomez et al.
2012/0157265 A1 6/2012 Kao
2012/0158238 A1 6/2012 Daley
2012/0159563 A1 6/2012 Gomez et al.
2012/0165162 A1 6/2012 Lu
2012/0165703 A1 6/2012 Bottum
2012/0169603 A1 7/2012 Peterson et al.
2012/0174608 A1 7/2012 Kumamoto et al.
2012/0174833 A1 7/2012 Early
2012/0178590 A1 7/2012 Lu
2012/0178591 A1 7/2012 Remelius
2012/0178596 A1 7/2012 Vittone
2012/0179278 A1 7/2012 Riley et al.
2012/0183939 A1 7/2012 Aragones et al.
2012/0183940 A1 7/2012 Aragones et al.
2012/0187012 A1 7/2012 TeVault et al.
2012/0190502 A1 7/2012 Paulus et al.
2012/0190504 A1 7/2012 Lee et al.
2012/0202656 A1 8/2012 Dorsay
2012/0208153 A1 8/2012 Bolla et al.
2012/0212505 A1 8/2012 Burroughs et al.
2012/0214590 A1 8/2012 Newhouse et al.
2012/0216524 A1 8/2012 Browne
2012/0217758 A1 8/2012 Chen
2012/0218184 A1 8/2012 Wissmar
2012/0220434 A1 8/2012 Lien
2012/0225412 A1 9/2012 Wagner
2012/0225758 A1 9/2012 Shaw
2012/0228385 A1 9/2012 Deluca
2012/0230504 A1 9/2012 Kuroda
2012/0233002 A1 9/2012 Abujbara
2012/0237906 A9 9/2012 Glass
2012/0237911 A1 9/2012 Watterson
2012/0238411 A1 9/2012 McBride et al.
2012/0238418 A1 9/2012 Reyes
2012/0238800 A1 9/2012 Naujokat et al.
2012/0238851 A1 9/2012 Kamen et al.
2012/0242774 A1 9/2012 Numano et al.
2012/0248263 A1 10/2012 Grotenhuis
2012/0251983 A1 10/2012 Golden
2012/0252580 A1 10/2012 Dugan
2012/0252642 A1 10/2012 Chen
2012/0253234 A1 10/2012 Yang et al.
2012/0253485 A1 10/2012 Weast et al.
2012/0253487 A1 10/2012 Dugan
2012/0253489 A1 10/2012 Dugan
2012/0263892 A1 10/2012 Rodgers
2012/0264575 A1 10/2012 Towley, III
2012/0268592 A1 10/2012 Aragones et al.
2012/0270705 A1 10/2012 Lo
2012/0271121 A1 10/2012 Della Torre et al.
2012/0271143 A1 10/2012 Aragones et al.
2012/0277040 A1 11/2012 Vincent et al.
2012/0277068 A1 11/2012 Zhou et al.
2012/0277070 A1 11/2012 Sienna
2012/0277891 A1 11/2012 Aragones et al.
2012/0283071 A1 11/2012 Nalley
2012/0283074 A1 11/2012 Hutchins
2012/0285986 A1 11/2012 Irvin
2012/0289386 A1 11/2012 Yu
2012/0290109 A1 11/2012 Engelberg et al.
2012/0293141 A1 11/2012 Zhang et al.
2012/0295764 A1 11/2012 Brammer
2012/0295774 A1 11/2012 Dalebout et al.
2012/0296455 A1 11/2012 Ohnemus et al.
2012/0298017 A1 11/2012 Chen
2012/0300515 A1 11/2012 Carletti et al.
2012/0302408 A1 11/2012 Burger
2012/0306643 A1 12/2012 Dugan
2012/0313776 A1 12/2012 Utter, II
2012/0315986 A1 12/2012 Walling
2012/0315987 A1 12/2012 Walling
2012/0316406 A1 12/2012 Rahman et al.
2012/0316455 A1 12/2012 Rahman et al.
2012/0316456 A1 12/2012 Rahman et al.
2012/0316458 A1 12/2012 Rahman et al.
2012/0317024 A1 12/2012 Rahman et al.
2012/0319604 A1 12/2012 Walters
2012/0322625 A1 12/2012 Park
2012/0322628 A1 12/2012 Gautier
2012/0322629 A1 12/2012 Webb
2012/0323496 A1 12/2012 Burroughs
2012/0326873 A1 12/2012 Utter, II
2012/0329027 A1 12/2012 Lewolt
2012/0329611 A1 12/2012 Bouchard
2012/0329615 A1 12/2012 Jeong
2013/0002533 A1 1/2013 Burroughs et al.
2013/0004010 A1 1/2013 Royer
2013/0009993 A1 1/2013 Horseman
2013/0011818 A1 1/2013 Shum et al.
2013/0014155 A1 1/2013 Clarke et al.
2013/0015945 A1 1/2013 Chang
2013/0017888 A1 1/2013 King et al.
2013/0017929 A1 1/2013 Hendrickson et al.
2013/0018494 A1 1/2013 Amini
2013/0018668 A1 1/2013 Goldberg et al.
2013/0023933 A1 1/2013 Haas
2013/0029807 A1 1/2013 Amsel
2013/0034671 A1 2/2013 George
2013/0035209 A1 2/2013 Gilley et al.
2013/0035219 A1 2/2013 Williams
2013/0035220 A1 2/2013 Adams
2013/0035612 A1 2/2013 Mason et al.
2013/0040271 A1 2/2013 Rytky et al.
2013/0040783 A1 2/2013 Duda et al.
2013/0041590 A1 2/2013 Burich et al.
2013/0041617 A1 2/2013 Pease et al.
2013/0044521 A1 2/2013 Zhao et al.
2013/0050973 A1 2/2013 Rohrbach
2013/0053218 A1 2/2013 Barker
2013/0053220 A1 2/2013 Monaco
2013/0053222 A1 2/2013 Lo
2013/0053717 A1 2/2013 Vandine et al.
2013/0053990 A1 2/2013 Ackland
2013/0065680 A1 3/2013 Zavadsky
2013/0073093 A1 3/2013 Songkakul
2013/0083003 A1 4/2013 Perez et al.
2013/0085038 A1 4/2013 Fischer
2013/0090212 A1 4/2013 Wang
2013/0090216 A1 4/2013 Jackson
2013/0090565 A1 4/2013 Quy
2013/0092647 A1 4/2013 Chen
2013/0095959 A1 4/2013 Marty
2013/0095978 A1 4/2013 Sauter
2013/0097635 A1 4/2013 Yerli
2013/0102443 A1 4/2013 Lundquist et al.
2013/0105565 A1 5/2013 Kamprath
2013/0106684 A1 5/2013 Weast et al.
2013/0108995 A1 5/2013 DePasqua et al.
2013/0110264 A1 5/2013 Weast et al.
2013/0116091 A1 5/2013 Fritz
2013/0116092 A1 5/2013 Martinez
2013/0116093 A1 5/2013 Kehoe
2013/0116095 A1 5/2013 Hsieh
2013/0116514 A1 5/2013 Kroner et al.
2013/0116605 A1 5/2013 Dephouse
2013/0123073 A1 5/2013 Olson et al.
2013/0123083 A1 5/2013 Sip
2013/0127636 A1 5/2013 Aryanpur et al.
2013/0129217 A1 5/2013 Gupta
2013/0130868 A1 5/2013 Hou
2013/0130869 A1 5/2013 Hou

(56) References Cited

U.S. PATENT DOCUMENTS

2013/0135115 A1 5/2013 Johnson et al.
2013/0137552 A1 5/2013 Kemp et al.
2013/0139736 A1 6/2013 Flaherty
2013/0141235 A1 6/2013 Utter, II
2013/0143721 A1 6/2013 Dalebout
2013/0144464 A1 6/2013 Dorogusker et al.
2013/0147411 A1 6/2013 Pang et al.
2013/0148861 A1 6/2013 Ferlatte et al.
2013/0150214 A1 6/2013 Wu
2013/0154441 A1 6/2013 Redmond
2013/0158368 A1 6/2013 Pacione et al.
2013/0165195 A1 6/2013 Watterson
2013/0165297 A1 6/2013 Daly
2013/0172152 A1 7/2013 Watterson
2013/0173156 A1 7/2013 Wither et al.
2013/0174273 A1 7/2013 Grab et al.
2013/0177884 A1 7/2013 Root
2013/0178334 A1 7/2013 Brammer
2013/0178338 A1 7/2013 Ross
2013/0178346 A1 7/2013 Lin
2013/0182781 A1 7/2013 Matsutani
2013/0184843 A1 7/2013 Ellis et al.
2013/0185003 A1 7/2013 Carbeck et al.
2013/0190136 A1 7/2013 Watterson
2013/0190143 A1 7/2013 Greenhill et al.
2013/0190657 A1 7/2013 Flaction et al.
2013/0191034 A1 7/2013 Weast et al.
2013/0193655 A1 8/2013 Kaye et al.
2013/0196821 A1 8/2013 Watterson et al.
2013/0196822 A1 8/2013 Watterson et al.
2013/0196826 A1 8/2013 Colledge
2013/0196827 A1 8/2013 Chang
2013/0203557 A1 8/2013 Su
2013/0203561 A1 8/2013 Lee et al.
2013/0208576 A1 8/2013 Loree, IV et al.
2013/0209972 A1 8/2013 Carter et al.
2013/0210578 A1 8/2013 Birrell
2013/0210581 A1 8/2013 Watterson et al.
2013/0210582 A1 8/2013 Del Toro et al.
2013/0211858 A1 8/2013 Ohnemus et al.
2013/0216982 A1 8/2013 Bennett et al.
2013/0216990 A1 8/2013 Chu et al.
2013/0225373 A1 8/2013 Poat
2013/0225377 A1 8/2013 Lee et al.
2013/0228063 A1 9/2013 Turner
2013/0228422 A1 9/2013 Mathieu
2013/0231219 A1 9/2013 Huang
2013/0231224 A1 9/2013 Svenberg
2013/0231226 A1 9/2013 Bonutti
2013/0231575 A1 9/2013 Erkkila et al.
2013/0233097 A1 9/2013 Hayner
2013/0237383 A1 9/2013 Chen
2013/0241696 A1 9/2013 Fabrizio
2013/0245966 A1 9/2013 Burroughs et al.
2013/0260965 A1 10/2013 Chia et al.
2013/0263418 A1 10/2013 Johnson, Jr.
2013/0267385 A1 10/2013 Watterson et al.
2013/0267386 A1 10/2013 Her
2013/0267392 A1 10/2013 Miranda
2013/0273509 A1 10/2013 Mutti
2013/0274040 A1 10/2013 Coza et al.
2013/0274064 A1 10/2013 Liang
2013/0274067 A1 10/2013 Watterson et al.
2013/0274069 A1 10/2013 Watterson et al.
2013/0274071 A1 10/2013 Wang
2013/0274074 A1 10/2013 Ghandour
2013/0274075 A1 10/2013 Habing et al.
2013/0274587 A1 10/2013 Coza et al.
2013/0274635 A1 10/2013 Coza et al.
2013/0274904 A1 10/2013 Coza et al.
2013/0280682 A1 10/2013 Levine et al.
2013/0282157 A1 10/2013 Shin et al.
2013/0282447 A1 10/2013 Himanen et al.
2013/0288223 A1 10/2013 Watterson et al.
2013/0289932 A1 10/2013 Baechler
2013/0290364 A1 10/2013 Minvielle
2013/0296144 A1 11/2013 Gvoich
2013/0297642 A1 11/2013 Minvielle
2013/0298019 A1 11/2013 Henderson
2013/0303334 A1 11/2013 Adhami
2013/0303837 A1 11/2013 Berka et al.
2013/0310221 A1 11/2013 Zuber
2013/0310230 A1 11/2013 Norris
2013/0310658 A1 11/2013 Ricks
2013/0316830 A1 11/2013 Sedzin et al.
2013/0324368 A1 12/2013 Aragones et al.
2013/0325394 A1 12/2013 Yuen et al.
2013/0328416 A1 12/2013 Whitworth et al.
2013/0337974 A1 12/2013 Yanev et al.
2013/0337980 A1 12/2013 Himmelrick et al.
2013/0337981 A1 12/2013 Habing
2013/0338802 A1 12/2013 Winsper et al.
2013/0345978 A1 12/2013 Lush et al.
2013/0346043 A1 12/2013 Mewes et al.
2014/0005009 A1 1/2014 Giannelli
2014/0005811 A1 1/2014 Mikan et al.
2014/0011645 A1 1/2014 Johnson et al.
2014/0026788 A1 1/2014 Kallio et al.
2014/0031174 A1 1/2014 Huang
2014/0031181 A1 1/2014 Agostini
2014/0031703 A1 1/2014 Rayner et al.
2014/0038781 A1 2/2014 Foley
2014/0039329 A1 2/2014 Kampman et al.
2014/0039840 A1 2/2014 Yuen et al.
2014/0045656 A1 2/2014 Zhang
2014/0052280 A1 2/2014 Yuen et al.
2014/0056461 A1 2/2014 Afshar
2014/0058806 A1 2/2014 Guenette et al.
2014/0066264 A1 3/2014 Haddon
2014/0069838 A1 3/2014 Minvielle
2014/0073488 A1 3/2014 Wu
2014/0074265 A1 3/2014 Arginsky
2014/0077494 A1 3/2014 Sutkowski
2014/0080678 A1 3/2014 Wu
2014/0081436 A1 3/2014 Crowley
2014/0085077 A1 3/2014 Luna et al.
2014/0087923 A1 3/2014 Warren
2014/0089836 A1 3/2014 Damani et al.
2014/0094941 A1 4/2014 Ellis et al.
2014/0099614 A1 4/2014 Hu et al.
2014/0100464 A1 4/2014 Kaleal et al.
2014/0102340 A1 4/2014 Kooistra
2014/0106322 A1 4/2014 Durand
2014/0106943 A1 4/2014 Simonetti
2014/0106948 A1 4/2014 Agostini
2014/0106949 A1 4/2014 Mestemaker
2014/0113776 A1 4/2014 Jaguan
2014/0113779 A1 4/2014 Loach
2014/0121066 A1 5/2014 Huang et al.
2014/0121071 A1 5/2014 Strom et al.
2014/0121072 A1 5/2014 Ercanbrack
2014/0121471 A1 5/2014 Walker
2014/0125618 A1 5/2014 Panther et al.
2014/0129240 A1 5/2014 Zhang
2014/0134582 A1 5/2014 Konishi
2014/0135173 A1 5/2014 Watterson
2014/0135593 A1 5/2014 Jayalth et al.
2014/0135631 A1 5/2014 Brumback et al.
2014/0139450 A1 5/2014 Levesque et al.
2014/0141396 A1 5/2014 Spratt
2014/0142403 A1 5/2014 Brumback et al.
2014/0145935 A1 5/2014 Sztuk
2014/0147829 A1 5/2014 Jerauld
2014/0150042 A1 5/2014 Pacor et al.
2014/0156041 A1 6/2014 Martin
2014/0156084 A1 6/2014 Rahman et al.
2014/0156228 A1 6/2014 Molettiere et al.
2014/0156308 A1 6/2014 Ohnemus et al.
2014/0156645 A1 6/2014 Brust et al.
2014/0162230 A1 6/2014 Akopian
2014/0162854 A1 6/2014 Watterson
2014/0162856 A1 6/2014 Kramer
2014/0163429 A1 6/2014 Tropper et al.
2014/0164611 A1 6/2014 Molettiere et al.

(56) References Cited

U.S. PATENT DOCUMENTS

2014/0171266 A1 6/2014 Hawkins, III et al.
2014/0171272 A1 6/2014 Hawkins, III et al.
2014/0172873 A1 6/2014 Varoglu et al.
2014/0173660 A1 6/2014 Correa et al.
2014/0180480 A1 6/2014 Lee et al.
2014/0187383 A1 7/2014 Martin
2014/0194260 A1 7/2014 Campanaro et al.
2014/0195103 A1 7/2014 Nassef
2014/0197946 A1 7/2014 Park et al.
2014/0200122 A1 7/2014 Hallmark
2014/0200691 A1 7/2014 Lee et al.
2014/0203943 A1 7/2014 Kates
2014/0205980 A1 7/2014 Braier et al.
2014/0206506 A1 7/2014 Huang
2014/0212857 A1 7/2014 Sullivan et al.
2014/0213416 A1 7/2014 Wang
2014/0214446 A1 7/2014 Pera, Jr.
2014/0220514 A1 8/2014 Waldron et al.
2014/0221160 A1 8/2014 Hardy et al.
2014/0221168 A1 8/2014 Chen
2014/0221175 A1 8/2014 Liu
2014/0221784 A1 8/2014 Pacione et al.
2014/0221854 A1 8/2014 Wai
2014/0221881 A1 8/2014 Schlauder et al.
2014/0222173 A1 8/2014 Giedwoyn et al.
2014/0228118 A1 8/2014 Hardy et al.
2014/0228175 A1 8/2014 Lemos et al.
2014/0228181 A1 8/2014 Powell
2014/0228649 A1 8/2014 Rayner et al.
2014/0235409 A1 8/2014 Salmon
2014/0235411 A1 8/2014 Dailey
2014/0235937 A1 8/2014 Plath
2014/0249440 A1 9/2014 Banet
2014/0257535 A1 9/2014 Morris et al.
2014/0257537 A1 9/2014 Stroupe et al.
2014/0265072 A1 9/2014 Chiu
2014/0265690 A1 9/2014 Henderson
2014/0266939 A1 9/2014 Baringer et al.
2014/0270375 A1 9/2014 Canavan et al.
2014/0272894 A1 9/2014 Grimes et al.
2014/0273858 A1 9/2014 Panther et al.
2014/0274564 A1 9/2014 Greenbaum
2014/0274574 A1 9/2014 Shorten et al.
2014/0274579 A1 9/2014 Olson
2014/0274596 A1 9/2014 Krull
2014/0274600 A1 9/2014 Dalebout et al.
2014/0275852 A1 9/2014 Hong et al.
2014/0275854 A1 9/2014 Venkatraman et al.
2014/0277637 A1 9/2014 Ventura et al.
2014/0278139 A1 9/2014 Hong et al.
2014/0278218 A1 9/2014 Chang
2014/0278220 A1 9/2014 Yuen
2014/0287886 A1 9/2014 Patti
2014/0288390 A1 9/2014 Hong et al.
2014/0288438 A1 9/2014 Venkatraman et al.
2014/0288680 A1 9/2014 Hoffman et al.
2014/0308629 A1 10/2014 Dugan
2014/0309085 A1 10/2014 Watterson et al.
2014/0309087 A1 10/2014 Uygan
2014/0309092 A1 10/2014 De Michele
2014/0316192 A1 10/2014 de Zambotti et al.
2014/0335490 A1 11/2014 Baarman et al.
2014/0336796 A1 11/2014 Agnew
2014/0338120 A1 11/2014 Baugh et al.
2014/0349257 A1 11/2014 Connor
2014/0351150 A1 11/2014 Ainsworth et al.
2014/0357457 A1 12/2014 Boekema
2014/0358012 A1 12/2014 Richards et al.
2014/0358473 A1 12/2014 Goel et al.
2014/0360413 A1 12/2014 Schenk
2014/0363797 A1 12/2014 Hu et al.
2014/0363800 A1 12/2014 Harris et al.
2014/0371887 A1 12/2014 Hoffman et al.
2014/0380167 A1 12/2014 Bloch et al.
2015/0001048 A1 1/2015 Koppes et al.
2015/0003621 A1 1/2015 Trammell
2015/0004579 A1 1/2015 Shelton
2015/0004580 A1 1/2015 Shum et al.
2015/0011362 A1 1/2015 Oh et al.
2015/0016623 A1 1/2015 Trammell
2015/0018989 A1 1/2015 Chen
2015/0019135 A1 1/2015 Kacyvenski et al.
2015/0025660 A1 1/2015 Prassler et al.
2015/0031964 A1 1/2015 Bly et al.
2015/0038300 A1 2/2015 Forhan et al.
2015/0044648 A1 2/2015 White et al.
2015/0048807 A1 2/2015 Fan et al.
2015/0051051 A1 2/2015 Liu et al.
2015/0059257 A1 3/2015 Beaver et al.
2015/0065301 A1 3/2015 Oteman
2015/0069738 A1 3/2015 Knight
2015/0072842 A1 3/2015 Segal
2015/0079562 A1 3/2015 Yeh et al.
2015/0081209 A1 3/2015 Yeh et al.
2015/0081210 A1 3/2015 Yeh et al.
2015/0082408 A1 3/2015 Yeh et al.
2015/0087478 A1 3/2015 Zhang et al.
2015/0092972 A1 4/2015 Lai et al.
2015/0097700 A1 4/2015 Holthouse
2015/0099952 A1 4/2015 Lain et al.
2015/0105220 A1 4/2015 Hong
2015/0105881 A1 4/2015 Guerrero et al.
2015/0106868 A1 4/2015 Lo
2015/0111708 A1 4/2015 Smith
2015/0118657 A1 4/2015 Shrake et al.
2015/0119197 A1 4/2015 Liu
2015/0126348 A1 5/2015 Kaye et al.
2015/0126873 A1 5/2015 Connor
2015/0135284 A1 5/2015 Bogard
2015/0141202 A1 5/2015 Ellis et al.
2015/0148204 A1 5/2015 Sleppy
2015/0151160 A1 6/2015 Balakrishnan et al.
2015/0154452 A1 6/2015 Bentley et al.
2015/0157918 A1 6/2015 Tracy
2015/0165259 A1 6/2015 Huppee et al.
2015/0165269 A1 6/2015 Herrala et al.
2015/0165270 A1 6/2015 Allos
2015/0168365 A1 6/2015 Connor
2015/0181314 A1 6/2015 Swanson
2015/0182773 A1 7/2015 Olson
2015/0182782 A1 7/2015 Cutler
2015/0186609 A1 7/2015 Utter, II
2015/0190679 A1 7/2015 Carbone
2015/0192929 A1 7/2015 Rihn et al.
2015/0199494 A1 7/2015 Koduri et al.
2015/0201722 A1 7/2015 Brouard
2015/0202487 A1 7/2015 Wu
2015/0209610 A1 7/2015 Dalebout et al.
2015/0209617 A1 7/2015 Hsiao
2015/0224363 A1 8/2015 Clark et al.
2015/0238801 A1 8/2015 Meredith
2015/0238806 A1 8/2015 Mintz
2015/0238815 A1 8/2015 Lee
2015/0246751 A1 9/2015 Spivack et al.
2015/0248844 A1 9/2015 Ellis et al.
2015/0250304 A1 9/2015 Dalebout
2015/0250420 A1 9/2015 Longinotti-Buitoni et al.
2015/0251048 A1 9/2015 Dalebout
2015/0251055 A1 9/2015 Ashby
2015/0253210 A1 9/2015 Ashby et al.
2015/0255002 A1 9/2015 Harris et al.
2015/0258382 A1 9/2015 Nolan et al.
2015/0258384 A1 9/2015 Suzuki
2015/0262459 A1 9/2015 Munro et al.
2015/0265903 A1 9/2015 Kolen et al.
2015/0269354 A1 9/2015 Klassen
2015/0272262 A1 10/2015 Escamilla
2015/0272473 A1 10/2015 Zafiroglu
2015/0273267 A1 10/2015 Manzke
2015/0273272 A1 10/2015 Wang
2015/0283420 A1 10/2015 Chang
2015/0283421 A1 10/2015 Gaylord
2015/0288926 A1 10/2015 Glass et al.
2015/0290490 A1 10/2015 Badarneh

(56) References Cited

U.S. PATENT DOCUMENTS

2015/0295397 A1 10/2015 Lin et al.
2015/0296020 A1 10/2015 Granqvist et al.
2015/0297932 A1 10/2015 Wehrell
2015/0297936 A1 10/2015 Madden
2015/0305961 A1 10/2015 Broerman et al.
2015/0306456 A1 10/2015 Pasini et al.
2015/0310062 A1 10/2015 Wang et al.
2015/0314184 A1 11/2015 Moya Saez
2015/0318015 A1 11/2015 Bose et al.
2015/0320588 A1 11/2015 Connor
2015/0324751 A1 11/2015 Orenstein et al.
2015/0327804 A1 11/2015 Lefever et al.
2015/0331449 A1 11/2015 Ng
2015/0335288 A1 11/2015 Toth et al.
2015/0335941 A1 11/2015 Lo
2015/0339946 A1 11/2015 Pacione et al.
2015/0342815 A1 12/2015 Watson
2015/0346994 A1 12/2015 Chanyontpatanakul
2015/0351690 A1 12/2015 Toth et al.
2015/0352396 A1 12/2015 Dalebout
2015/0352401 A1 12/2015 Johnson
2015/0352402 A1 12/2015 Arnold et al.
2015/0352404 A1 12/2015 Schwenger
2015/0360073 A1 12/2015 Moran et al.
2015/0360133 A1 12/2015 MacCallum et al.
2015/0364026 A1 12/2015 Rubin et al.
2015/0364058 A1 12/2015 Lagree
2015/0366746 A1 12/2015 Ashby
2015/0367158 A1 12/2015 Pretz et al.
2015/0367176 A1 12/2015 Bejestan et al.
2015/0369326 A1 12/2015 Modrezejewski et al.
2015/0370320 A1 12/2015 Connor
2015/0375028 A1 12/2015 Oteman et al.
2015/0379239 A1 12/2015 Basta et al.
2015/0379891 A1 12/2015 Wallace
2015/0381736 A1 12/2015 Seltzer
2016/0001123 A1 1/2016 Parrish, Jr.
2016/0008650 A1 1/2016 Jue et al.
2016/0012749 A1 1/2016 Connor
2016/0016035 A1 1/2016 Hao
2016/0018119 A1 1/2016 Desmet et al.
2016/0023043 A1 1/2016 Grundy
2016/0027325 A1 1/2016 Malhotra
2016/0038785 A1 2/2016 Netter
2016/0047446 A1 2/2016 Hung
2016/0051184 A1 2/2016 Wisbey et al.
2016/0051857 A1 2/2016 Rasner
2016/0058245 A1 3/2016 Smith et al.
2016/0059077 A1 3/2016 Paul et al.
2016/0059078 A1 3/2016 Liao
2016/0059079 A1 3/2016 Watterson
2016/0061300 A1 3/2016 Aoto et al.
2016/0063615 A1 3/2016 Watterson
2016/0066818 A1 3/2016 Cowley et al.
2016/0067537 A1 3/2016 Bayerlein et al.
2016/0071014 A1 3/2016 Brand et al.
2016/0074691 A1 3/2016 Pearce et al.
2016/0074701 A1 3/2016 Wiener
2016/0074705 A1 3/2016 Wiener
2016/0077547 A1 3/2016 Aimone et al.
2016/0089559 A1 3/2016 Smith et al.
2016/0089560 A1 3/2016 Smith et al.
2016/0089569 A1 3/2016 Soukup et al.
2016/0089575 A1 3/2016 Smith et al.
2016/0096064 A1 4/2016 Gatti
2016/0101311 A1 4/2016 Workman
2016/0107019 A1 4/2016 Shah
2016/0107029 A1 4/2016 Kim et al.
2016/0112684 A1 4/2016 Connor et al.
2016/0114205 A1 4/2016 Giunchi
2016/0114211 A1 4/2016 Schmidt
2016/0121156 A1 5/2016 Bach
2016/0121161 A1 5/2016 Mountain
2016/0136483 A1 5/2016 Reich
2016/0148535 A1 5/2016 Ashby
2016/0148536 A1 5/2016 Ashby
2016/0151603 A1 6/2016 Shouldice et al.
2016/0157740 A1 6/2016 Kampman et al.
2016/0166872 A1 6/2016 Cervone et al.
2016/0166881 A1 6/2016 Ridgel et al.
2016/0171110 A1 6/2016 Gao et al.
2016/0175643 A1 6/2016 Kueker et al.
2016/0184625 A1 6/2016 Chang
2016/0184635 A1 6/2016 Kwon
2016/0199683 A1 7/2016 Shamlin
2016/0206248 A1 7/2016 Sartor et al.
2016/0206922 A1 7/2016 Dalebout et al.
2016/0211841 A1 7/2016 Harrison
2016/0219968 A1 8/2016 Martin
2016/0232811 A9 8/2016 Connor
2016/0249365 A1 8/2016 Harel
2016/0250514 A1 9/2016 Gvoich
2016/0250519 A1 9/2016 Watterson
2016/0253918 A1 9/2016 Watterson
2016/0256082 A1 9/2016 Ely
2016/0256728 A1 9/2016 Tang
2016/0256745 A1 9/2016 Brammer
2016/0263426 A1 9/2016 Mueller et al.
2016/0278487 A1 9/2016 Postolek
2016/0279462 A1 9/2016 Sutherland
2016/0279470 A1 9/2016 Hampton
2016/0287930 A1 10/2016 Moser
2016/0296053 A1 10/2016 Bakhsh
2016/0303414 A1 10/2016 Werner
2016/0303421 A1 10/2016 Tyger et al.
2016/0317861 A1 11/2016 Dalebout
2016/0317866 A1 11/2016 Fung
2016/0319850 A1 11/2016 Kamen et al.
2016/0321075 A1 11/2016 Catherwood et al.
2016/0321932 A1 11/2016 Mitchell
2016/0346586 A1 12/2016 Pullins et al.
2016/0346598 A1 12/2016 Manzke et al.
2016/0346616 A1 12/2016 Kirby et al.
2016/0346617 A1 12/2016 Sprugo
2016/0351070 A1 12/2016 Aillon-Sohl
2016/0367851 A1 12/2016 Astilean et al.
2016/0367857 A1 12/2016 Aragones et al.
2016/0371998 A1 12/2016 Fazeel
2016/0375307 A1 12/2016 Durham
2016/0375308 A1 12/2016 Anderson
2017/0007886 A1 1/2017 Alessandri
2017/0011210 A1 1/2017 Cheong
2017/0014661 A1 1/2017 Lin
2017/0020440 A1 1/2017 Flitsch et al.
2017/0021218 A1 1/2017 Peritz
2017/0036106 A1 2/2017 Stechschulte et al.
2017/0050069 A1 2/2017 Ky
2017/0050074 A1 2/2017 Olson
2017/0050102 A1 2/2017 Kelly
2017/0056711 A1 3/2017 Dalebout et al.
2017/0056712 A1 3/2017 Johnson
2017/0056715 A1 3/2017 Dalebout et al.
2017/0056716 A1 3/2017 Cutler
2017/0056726 A1 3/2017 Dalebout et al.
2017/0063567 A1 3/2017 Tanaka et al.
2017/0065187 A1 3/2017 Hsieh et al.
2017/0065851 A1 3/2017 Deluca et al.
2017/0065852 A1 3/2017 Cygan et al.
2017/0065947 A1 3/2017 Haney et al.
2017/0068782 A1 3/2017 Pillai et al.
2017/0082983 A1 3/2017 Katzer et al.
2017/0093451 A1 3/2017 Chen et al.
2017/0097717 A1 4/2017 Anisetti et al.
2017/0100636 A1 4/2017 Umetsu et al.
2017/0104425 A1 4/2017 Meloche
2017/0106227 A1 4/2017 Lalaoua
2017/0106240 A1 4/2017 Chuang
2017/0113093 A1 4/2017 Bellavista et al.
2017/0120102 A1 5/2017 Chen
2017/0128783 A1 5/2017 Hasegawa et al.
2017/0128784 A1 5/2017 Molins et al.
2017/0136280 A1 5/2017 Lee
2017/0136288 A1 5/2017 Huang
2017/0136289 A1 5/2017 Frank

(56) References Cited

U.S. PATENT DOCUMENTS

| | | | |
|---|---|---|---|
| 2017/0136291 | A1 | 5/2017 | Huang |
| 2017/0136293 | A1 | 5/2017 | Caccia |
| 2017/0136301 | A1 | 5/2017 | Cameron |
| 2017/0136339 | A1 | 5/2017 | Oleson et al. |
| 2017/0144051 | A1 | 5/2017 | Oleson et al. |
| 2017/0164876 | A1 | 6/2017 | Hyde et al. |
| 2017/0165523 | A1 | 6/2017 | Chou |
| 2017/0165552 | A1 | 6/2017 | Martin |
| 2017/0173394 | A1 | 6/2017 | Rider |
| 2017/0180535 | A1 | 6/2017 | Esenwein et al. |
| 2017/0189745 | A1 | 7/2017 | Hamilton et al. |
| 2017/0193578 | A1 | 7/2017 | Watterson |
| 2017/0197103 | A1 | 7/2017 | Rau et al. |
| 2017/0197106 | A1 | 7/2017 | Dalebout et al. |
| 2017/0216660 | A1 | 8/2017 | Lernihan |
| 2017/0225034 | A1 | 8/2017 | Kass et al. |
| 2017/0235922 | A1 | 8/2017 | Weast et al. |
| 2017/0239509 | A1 | 8/2017 | Wang |
| 2017/0252599 | A1 | 9/2017 | Wang |
| 2017/0252623 | A1 | 9/2017 | Sharifi |
| 2017/0252641 | A1 | 9/2017 | Morimura |
| 2017/0266481 | A1 | 9/2017 | Dalebout |
| 2017/0266483 | A1 | 9/2017 | Dalebout et al. |
| 2017/0266503 | A1 | 9/2017 | Watterson et al. |
| 2017/0266532 | A1 | 9/2017 | Watterson |
| 2017/0266533 | A1 | 9/2017 | Dalebout |
| 2017/0266534 | A1 | 9/2017 | Watterson |
| 2017/0266535 | A1 | 9/2017 | Watterson |
| 2017/0270820 | A1 | 9/2017 | Ashby |
| 2017/0274237 | A1 | 9/2017 | Chang |
| 2017/0274242 | A1 | 9/2017 | Corbalis |
| 2017/0311817 | A9 | 11/2017 | Hsieh et al. |
| 2017/0312580 | A1 | 11/2017 | Chang |
| 2017/0319906 | A1 | 11/2017 | Chang et al. |
| 2017/0326411 | A1 | 11/2017 | Watterson |
| 2017/0333755 | A1 | 11/2017 | Rider |
| 2017/0340917 | A1 | 11/2017 | Chang |
| 2017/0354846 | A1 | 12/2017 | Von Rueckmann |
| 2017/0361145 | A1 | 12/2017 | Olson et al. |
| 2017/0364661 | A1 | 12/2017 | Hamilton et al. |
| 2017/0365048 | A1 | 12/2017 | Hamilton et al. |
| 2017/0367480 | A1 | 12/2017 | Dickerson et al. |
| 2017/0368442 | A1 | 12/2017 | Baudhuin |
| 2018/0001135 | A1 | 1/2018 | Powell |
| 2018/0008865 | A9 | 1/2018 | Lannon et al. |
| 2018/0036572 | A1 | 2/2018 | Hsu |
| 2018/0036585 | A1 | 2/2018 | Powell |
| 2018/0056111 | A1 | 3/2018 | Chiang et al. |
| 2018/0084817 | A1 | 3/2018 | Capell et al. |
| 2018/0085622 | A1 | 3/2018 | Ivan |
| 2018/0085630 | A1 | 3/2018 | Capell et al. |
| 2018/0085654 | A1 | 3/2018 | Black et al. |
| 2018/0089396 | A1 | 3/2018 | Capell et al. |
| 2018/0092603 | A1 | 4/2018 | Duan et al. |
| 2018/0099116 | A1 | 4/2018 | Ashby |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0099184 | A1 | 4/2018 | Eder |
| 2018/0099205 | A1 | 4/2018 | Watterson |
| 2018/0104533 | A1 | 4/2018 | Powell et al. |
| 2018/0109838 | A1 | 4/2018 | Garcia et al. |
| 2018/0111018 | A1 | 4/2018 | Lee |
| 2018/0111034 | A1 | 4/2018 | Watterson |
| 2018/0116599 | A1 | 5/2018 | Bastide et al. |
| 2018/0117383 | A1 | 5/2018 | Workman |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0140886 | A1 | 5/2018 | Hetrick et al. |
| 2018/0147440 | A1 | 5/2018 | Lin |
| 2018/0154205 | A1 | 6/2018 | Watterson |
| 2018/0154206 | A1 | 6/2018 | Kim |

FOREIGN PATENT DOCUMENTS

| | | | |
|---|---|---|---|
| CN | 1658929 | | 8/2005 |
| CN | 1708333 | | 12/2005 |
| CN | 201516258 | | 6/2010 |
| CN | 201410258 | Y | 2/2014 |
| CN | 10488413 | | 9/2015 |
| CN | 105848733 | | 8/2016 |
| EP | 2969058 | | 1/2016 |
| EP | 3086865 | A1 | 11/2016 |
| SU | 1533710 | | 1/1990 |
| WO | 1997006859 | | 2/1997 |
| WO | 2007015096 | A3 | 2/2007 |
| WO | 2014153158 | | 9/2014 |
| WO | 2015/100429 | | 7/2015 |

OTHER PUBLICATIONS

Exxentric, Movie Archives, obtained from The Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *ICON Health & Fitness, Inc.*, Civil Case No. IPR2017-01363, Petition for Inter Partes Review of U.S. Pat. No. 9,403,047, filed May 5, 2017.

*Nautilus, Inc.* v. *ICON Health & Fitness, Inc.*, Civil Case No. IPR2017-01363, Olson, U.S. Pat. No. 9,403,047, (Petition Ex. 1001).

*Nautilus, Inc.* v. *ICON Health & Fitness, Inc.*, Civil Case No. IPR2017-01363, Sleamaker, U.S. Pat. No. 5,354,251 (Petition Ex. 1002).

*Nautilus, Inc.* v. *ICON Health & Fitness, Inc.*, Civil Case No. IPR2017-01363, Hanoun, U.S. Publication No. 2007-0232452 (Petition Ex. 1003).

*Nautilus, Inc.* v. *ICON Health & Fitness, Inc.*, Civil Case No. IPR2017-01363, Six-Pak, Printed Publication TuffStuff Fitness Six-Pak Trainer Owner's Manual (Petition Ex 1004).

*Nautilus, Inc.* v. *ICON Health & Fitness, Inc.*, Civil Case No. IPR2017-01363, Ehrenfried, U.S. Pat. No. 5,738,611 (Petition Ex. 1005).

*Nautilus, Inc.* v. *ICON Health & Fitness, Inc.*, Civil Case No. IPR2017-01363, Kleinman, International Publication No. WO2008/152627 (Petition Ex. 1006).

*Nautilus, Inc.* v. *ICON Health & Fitness, Inc.*, Civil Case No. IPR2017-01363, Declaration of Lee Rawls, (Petition Ex. 1007).

*Nautilus, Inc.* v. *ICON Health & Fitness, Inc.*, Civil Case No. IPR2017-01363, U.S. Pat. No. 9,403,047 File history, (Petition Ex. 1008).

*Nautilus, Inc.* v. *ICON Health & Fitness, Inc.*, Civil Case No. IPR2017-01363, U.S. Appl. No. 61/920,834, (Petition Ex. 1009).

*Nautilus, Inc.* v. *ICON Health & Fitness, Inc.*, Civil Case No. IPR2017-01363, Declaration of Christopher Butler (Petition Ex. 1010).

*Nautilus, Inc.* v. *ICON Health & Fitness, Inc.*, Civil Case No. IPR2017-01363, Petitioner's Power of Attorney, filed May 5, 2017.

*Nautilus, Inc.* v. *ICON Health & Fitness, Inc.*, Civil Case No. IPR2017-01363, Mandatory Notice to Patent Owner, filed May 19, 2017.

*Nautilus, Inc.* v. *ICON Health & Fitness, Inc.*, Civil Case No. IPR2017-01363, Power of Attorney, filed May 19, 2017.

*Nautilus, Inc.* v. *ICON Health & Fitness, Inc.*, Civil Case No. IPR2017-01363, Notice of Accord Filing Date, filed Jun. 9, 2017.

U.S. Appl. No. 61/786,007, filed Mar. 14, 2013, titled "Strength Training Apparatus with Flywheel and Related Methods", 28 pages.

International Search Report & Written Opinion for PCT Application No. PCT/US2014/029353, dated Aug. 4, 2014, 9 pages.

Supplemental European Search Report for European Application No. 14768130, dated Oct. 11, 2016, 9 pages.

U.S. Appl. No. 15/472,954, filed Mar. 29, 2017, titled "Strength Training Apparatus with Flywheel and Related Methods", 22 pages.

(56) References Cited

OTHER PUBLICATIONS

*Nautilus, Inc.* v. *ICON Health & Fitness, Inc.*, Civil Case No. IPR2017-01407, Petition for Inter Partes Review of U.S. Pat. No. 9,616,276 (Claims 1-4, 7-10), filed May 5, 2017.
*Nautilus, Inc.* v. *ICON Health & Fitness, Inc.*, Civil Case No. IPR2017-01407, Dalebout et al., U.S. Pat. No. 9,616,276, (Petition Ex. 1001).
*Nautilus, Inc.* v. *ICON Health & Fitness, Inc.*, Civil Case No. IPR2017-01407, Wu, U.S. Publication No. 20030171192, (Petition Ex. 1002).
*Nautilus, Inc.* v. *ICON Health & Fitness, Inc.*, Civil Case No. IPR2017-01407, Webb, U.S. Publication No. 20030017918, (Petition Ex. 1003).
*Nautilus, Inc.* v. *ICON Health & Fitness, Inc.*, Civil Case No. IPR2017-01407, Watson, U.S. Publication No. 20060234840, (Petition Ex. 1004).
*Nautilus, Inc.* v. *ICON Health & Fitness, Inc.*, Civil Case No. IPR2017-01407, Jones, U.S. Pat. No. 4,798,378, (Petition Ex. 1005).
*Nautilus, Inc.* v. *ICON Health & Fitness, Inc.*, Civil Case No. IPR2017-01407, Zhou et al., U.S. Pat. No. 8,517,899, (Petition Ex. 1006).
*Nautilus, Inc.* v. *ICON Health & Fitness, Inc.*, Civil Case No. IPR2017-01407, Loach, U.S. Publication No. WO2007015096, (Petition Ex. 1007).
*Nautilus, Inc.* v. *ICON Health & Fitness, Inc.*, Civil Case No. IPR2017-01407, Rawls Declaration, Part 1 & 2, (Petition Ex. 1008).
*Nautilus, Inc.* v. *ICON Health & Fitness, Inc.*, Civil Case No. IPR2017-01407, U.S. Pat. No. 9,616,276 File History, (Petition Ex. 1009).
*Nautilus, Inc.* v. *ICON Health & Fitness, Inc.*, Civil Case No. IPR2017-01407, U.S. Appl. No. 61/786,007 File History, (Petition Ex. 1010).
*Nautilus, Inc.* v. *ICON Health & Fitness, Inc.*, Civil Case No. IPR2017-01407, Sawicky, U.S. Pat. No. 5,042,798, (Petition Ex. 1011).
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01408, Petition for Inter Partes Review of U.S. Pat. No. 9,616,276 (Claims 1-20) filed May 5, 2017.
*Nautilus, Inc.* v. *ICON Health & Fitness, Inc.*, Civil Case No. IPR2017-01408, Dalebout et al., U.S. Pat. No. 9,616,276, (Petition Ex. 1001).
*Nautilus, Inc.* v. *ICON Health & Fitness, Inc.*, Civil Case No. IPR2017-01408, Wu, U.S. Publication No. 20030171192, (Petition Ex. 1002).
*Nautilus, Inc.* v. *ICON Health & Fitness, Inc.*, Civil Case No. IPR2017-01408, Webb, U.S. Publication No. 20030017918, (Petition Ex. 1003).
*Nautilus, Inc.* v. *ICON Health & Fitness, Inc.*, Civil Case No. IPR2017-01408, Watson, U.S. Publication No. 20060234840, (Petition Ex. 1004).
*Nautilus, Inc.* v. *ICON Health & Fitness, Inc.*, Civil Case No. IPR2017-01408, Jones, U.S. Pat. No. 4,798,378, (Petition Ex. 1005).
*Nautilus, Inc.* v. *ICON Health & Fitness, Inc.*, Civil Case No. IPR2017-01408, Zhou et al., U.S. Pat. No. 8,517,899, (Petition Ex. 1006).
*Nautilus, Inc.* v. *ICON Health & Fitness, Inc.*, Civil Case No. IPR2017-01408, Loach, U.S. Publication No. WO2007015096, (Petition Ex. 1007).
*Nautilus, Inc.* v. *ICON Health & Fitness, Inc.*, Civil Case No. IPR2017-01408, Rawls Declaration, Part 1 & 2, (Petition Ex. 1008).
*Nautilus, Inc.* v. *ICON Health & Fitness, Inc.*, Civil Case No. IPR2017-01408, U.S. Pat. No. 9,616,276 File History, (Petition Ex. 1009).
*Nautilus, Inc.* v. *ICON Health & Fitness, Inc.*, Civil Case No. IPR2017-01408, U.S. Appl. No. 61/786,007 File History, (Petition Ex. 1010).
*Nautilus, Inc.* v. *ICON Health & Fitness, Inc.*, Civil Case No. IPR2017-01408, Sawicky, U.S. Pat. No. 5,042,798, (Petition Ex. 1011).
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *ICON Health & Fitness, Inc.*, Civil Case No. IPR2017-01363, Declaration of Tyson Hottinger in Support of Motion for Admission PRO HAC VICE, filed Feb. 1, 2018 (Ex 2001).
*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of Inter Partes Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).
*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, Order Conduct of Proceedings 37 C.F.R. Sec 42.5, filed Apr. 27, 2018 (Paper 18).

(56) References Cited

OTHER PUBLICATIONS

*Nautilus, Inc.* v. *ICON Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01408, Declaration of Tyson Hottinger in Support of Motion for Admission PRO HAC VICE, (Patent Owner Ex. 2001).
*Nautilus, Inc.* v. *ICON Health & Fitness, Inc.*, Civil Case No. IPR2017-01408, Claim Listing of Proposed Substitute Claims for Patent Owner Motion to Amend, (Patent Owner Ex. 2002).
*Nautilus, Inc.* v. *ICON Health & Fitness, Inc.*, Civil Case No. IPR2017-01408, Specification of U.S. Pat. No. 9,616,276, (Patent Owner Ex. 2003).
*Nautilus, Inc.* v. *ICON Health & Fitness, Inc.*, Civil Case No. IPR2017-01408, Drawings of U.S. Pat. No. 9,616,276, (Patent Owner Ex. 2004).
*Nautilus, Inc.* v. *ICON Health & Fitness, Inc.*, Civil Case No. IPR2017-01408, Specification of U.S. Pat. No. 9,254,409 (Patent Owner Ex. 2005).
*Nautilus, Inc.* v. *ICON Health & Fitness, Inc.*, Civil Case No. IPR2017-01408, Drawings of U.S. Pat. No. 9,254,409 (Patent Owner Ex. 2006).
*Nautilus, Inc.* v. *ICON Health & Fitness, Inc.*, Civil Case No. IPR2017-01408, Patent Specification of U.S. Appl. No. 61/786,007, (Patent Owner Ex. 2007).
*Nautilus, Inc.* v. *ICON Health & Fitness, Inc.*, Civil Case No. IPR2017-01408, Patent Drawings of U.S. Appl. No. 61/786,007, (Patent Owner Ex. 2008).
*Nautilus, Inc.* v. *ICON Health & Fitness, Inc.*, Civil Case No. IPR2017-01408, Specification of U.S. Appl. No. 13/754,361 (Patent Owner Ex. 2009).
*Nautilus, Inc.* v. *ICON Health & Fitness, Inc.*, Civil Case No. IPR2017-01408, Drawings of U.S. Appl. No. 13/754,361 (Patent Owner Ex. 2010).
*Nautilus, Inc.* v. *ICON Health & Fitness, Inc.*, Civil Case No. IPR2017-01408, Webster Dictionary p. 2211 (Merriam-Webster, Inc. 1961, 2002) (Ex. 3001).
*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of Inter Partes Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, Order Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for PRO HAC VICE Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for PRO HAC VICE Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, Order Conduct of Proceedings, filed Apr. 27, 2018 (Paper 19).
*Nautilus, Inc.* v. *ICON Health & Fitness, Inc.*, Civil Case No. IPR2017-01408, Order Conduct of Proceedings, filed May 7, 2018 (Paper 20).
*Nautilus, Inc.* v. *ICON Health & Fitness, Inc.*, Civil Case No. IPR2017-01408, Specification of U.S. Appl. No. 15/019,088, (Patent Owner Ex. 2003).
*Nautilus, Inc.* v. *ICON Health & Fitness, Inc.*, Civil Case No. IPR2017-01408, Drawings of U.S. Appl. No. 15/019,088, (Patent Owner Ex. 2004).
*Nautilus, Inc.* v. *ICON Health & Fitness, Inc.*, Civil Case No. IPR2017-01408, Specification of U.S. Appl. No. 14/213,793, (Patent Owner Ex. 2005).
*Nautilus, Inc.* v. *ICON Health & Fitness, Inc.*, Civil Case No. IPR2017-01408, Drawings of U.S. Appl. No. 14/213,793, (Patent Owner Ex. 2006).
*Nautilus, Inc.* v. *ICON Health & Fitness, Inc.*, Civil Case No. IPR2017-01408, Specification of U.S. Appl. No. 61/786,007, (Patent Owner Ex. 2007).
*Nautilus, Inc.* v. *ICON Health & Fitness, Inc.*, Civil Case No. IPR2017-01408, Drawings of U.S. Appl. No. 61/786,007, (Patent Owner Ex. 2008).

* cited by examiner

MAGNETIC RESISTANCE MECHANISM IN A CABLE MACHINE

RELATED APPLICATIONS

This application is a continuation of U.S. patent application Ser. No. 15/696,841 filed Sep. 6, 2017, now U.S. Pat. No. 9,968,816, which is a continuation of U.S. patent application Ser. No. 15/226,703 filed Aug. 2, 2016, now U.S. Pat. No. 9,757,605, which is a continuation of U.S. patent application Ser. No. 14/582,493 filed Dec. 24, 2014, now U.S. Pat. No. 9,403,047, which claims priority to provisional Patent Application No. 61/920,834 filed Dec. 26, 2013. Each of these applications is herein incorporated by reference in its entirety.

BACKGROUND

While there are numerous exercise activities that one may participate in, exercise may be broadly classified into categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming, or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups, or a series of short sprints.

To build skeletal muscle, a muscle group is contracted against resistance. The contraction of some muscle groups produces a pushing motion, while the contraction of other muscle groups produces a pulling motion. A cable machine is a popular piece of exercise equipment for building those muscle groups that produce pulling motions. A cable machine often includes a cable with a handle connected to a first end and a resistance mechanism connected to a second end. Generally, the resistance mechanism is connected to a selectable set of weights. A midsection of the cable is supported with at least one pulley. To move the cable, a user pulls on the handle with a force sufficient to overcome the force of the resistance mechanism. As the cable moves, the pulley or pulleys direct the movement of the cable and carry a portion of the resistance mechanism's load.

One type of cable exercise machine is disclosed in WIPO Patent Publication No. WO/2007/015096 issued to Andrew Loach. In this reference, an exercise apparatus allows the user to perform a variety of aerobic and strength training exercises. A user input means allows the user to apply torque to an input shaft of a resistance unit. A control means adjusts the resistance provided by a resistance means coupled to the input shaft according to the output of a number of sensors. In a preferred embodiment, the resistance unit is able to simulate at the input shaft the dynamic response of a damped flywheel or the dynamic response of an object driven through a viscous medium, or to maintain the resistance at a constant level that is set by the user. The resistance unit includes a battery or an electric generator device and can be operated without connection to an external power source.

Other types of cable exercise machines are described in U.S. Patent Publication Nos. 2012/0065034 issued to Andrew Loach and 2006/0148622 issued to Ping Chen. All of these references are herein incorporated by reference for all that they disclose.

SUMMARY

In one aspect of the invention, a cable exercise machine includes a first pull cable and a second pull cable incorporated into a frame.

In one aspect of the invention, the cable exercise machine may further include that each of the first pull cable and the second pull cable are linked to at least one resistance mechanism.

In one aspect of the invention, the at least one resistance mechanism comprises a flywheel and a magnetic unit arranged to resist movement of the flywheel.

In one aspect of the invention, the cable exercise machine may further include a sensor arranged to collect information about a position of the flywheel.

In one aspect of the invention, the cable exercise machine may further include a counter in communication with the sensor and arranged to track a number of rotations of the flywheel.

In one aspect of the invention, the counter is arranged to provide the number as input to an energy tracker.

In one aspect of the invention, the energy tracker is arranged to receive as input a level of magnetic resistance exerted on the flywheel with the magnetic unit.

In one aspect of the invention, the frame is a tower.

In one aspect of the invention, the cable exercise machine may further include that a third pull cable and a fourth pull cable are also incorporated into the tower.

In one aspect of the invention, the cable exercise machine may further include that a first handle end of the first pull cable is routed to an upper right location of the tower.

In one aspect of the invention, the cable exercise machine may further include that a second handle end of the second pull cable is routed to an upper left location of the tower.

In one aspect of the invention, the cable exercise machine may further include that a third handle end of the third pull cable is routed to a lower right location of the tower.

In one aspect of the invention, the cable exercise machine may further include that a fourth handle end of the fourth pull cable is routed to a lower left location of the tower.

In one aspect of the invention, the flywheel is positioned between the upper right location, the upper left location, the lower right location, and the lower left location.

In one aspect of the invention, the cable exercise machine may further include at least two of the first pull cable, the second pull cable, the third pull cable and the fourth pull cable are connected to the same resistance mechanism.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in just a single direction while at least one of the multiple spools are arranged to rotate in the single direction and an opposite direction.

In one aspect of the invention, the spools are linked to at least one counterweight.

In one aspect of the invention, an cable exercise machine may include a first pull cable, a second pull cable, a third pull cable, and a fourth pull cable incorporated into a tower.

In one aspect of the invention, the cable exercise machine may further include that a first handle end of the first pull cable is routed to an upper right location of the tower, a second handle end of the second pull cable is routed to an upper left location of the tower, a third handle end of the third pull cable is routed to a lower right location of the tower, and a fourth handle end of the fourth pull cable is routed to a lower left location of the tower.

In one aspect of the invention, each of the first pull cable, the second pull cable, the third pull cable, and the fourth pull cable are connected to a resistance mechanism.

In one aspect of the invention, the resistance mechanism comprises a flywheel and a magnetic unit arranged to resist movement of the flywheel.

In one aspect of the invention, the flywheel is positioned between the upper right location, the upper left location, the lower right location, and the lower left location.

In one aspect of the invention, the cable exercise machine may further include a sensor arranged to collect information about a position of the flywheel.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in only a single direction while at least one of the multiple spools is arranged to rotate in the single direction and an opposite direction.

In one aspect of the invention, the spools are linked to at least one counterweight.

In one aspect of the invention, the cable exercise machine may further include a counter in communication with the sensor and arranged to track a number of rotations of the flywheel.

In one aspect of the invention, the counter is arranged to provide the number as input to an energy tracker.

In one aspect of the invention, a cable exercise machine may include a first pull cable, a second pull cable, a third pull cable, and a fourth pull cable incorporated into a tower.

In one aspect of the invention, the cable exercise machine may further include that a first handle end of the first pull cable is routed to an upper right location of the tower, a second handle end of the second pull cable is routed to an upper left location of the tower, a third handle end of the third pull cable is routed to a lower right location of the tower, and a fourth handle end of the fourth pull cable is routed to a lower left location of the tower.

In one aspect of the invention, each of the first pull cable, the second pull cable, the third pull cable, and the fourth pull cable are connected to a resistance mechanism.

In one aspect of the invention, the resistance mechanism comprises a flywheel and a magnetic unit arranged to resist movement of the flywheel.

In one aspect of the invention, the flywheel is positioned between the upper right location, the upper left location, the lower right location, and the lower left location.

In one aspect of the invention, the flywheel is attached to a central shaft about which the flywheel is arranged to rotate and the central shaft supports multiple cable spools.

In one aspect of the invention, the multiple cable spools are attached to at least one of the first pull cable, the second pull cable, the third pull cable, and the fourth pull cable.

In one aspect of the invention, the flywheel is arranged to rotate in only a single direction while at least one of the multiple spools is arranged to rotate in the single direction and an opposite direction.

In one aspect of the invention, the spools are linked to at least one counterweight.

In one aspect of the invention, the cable exercise machine may further include a sensor is arranged to collect information about a position of the flywheel.

In one aspect of the invention, the cable exercise machine may further include a counter is in communication with the sensor and arranged to track a number of rotations of the flywheel.

In one aspect of the invention, the counter is arranged to provide the number as input to an energy tracker.

In one aspect of the invention, the energy tracker is arranged to receive as input a level of magnetic resistance exerted on the flywheel with the magnetic unit.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
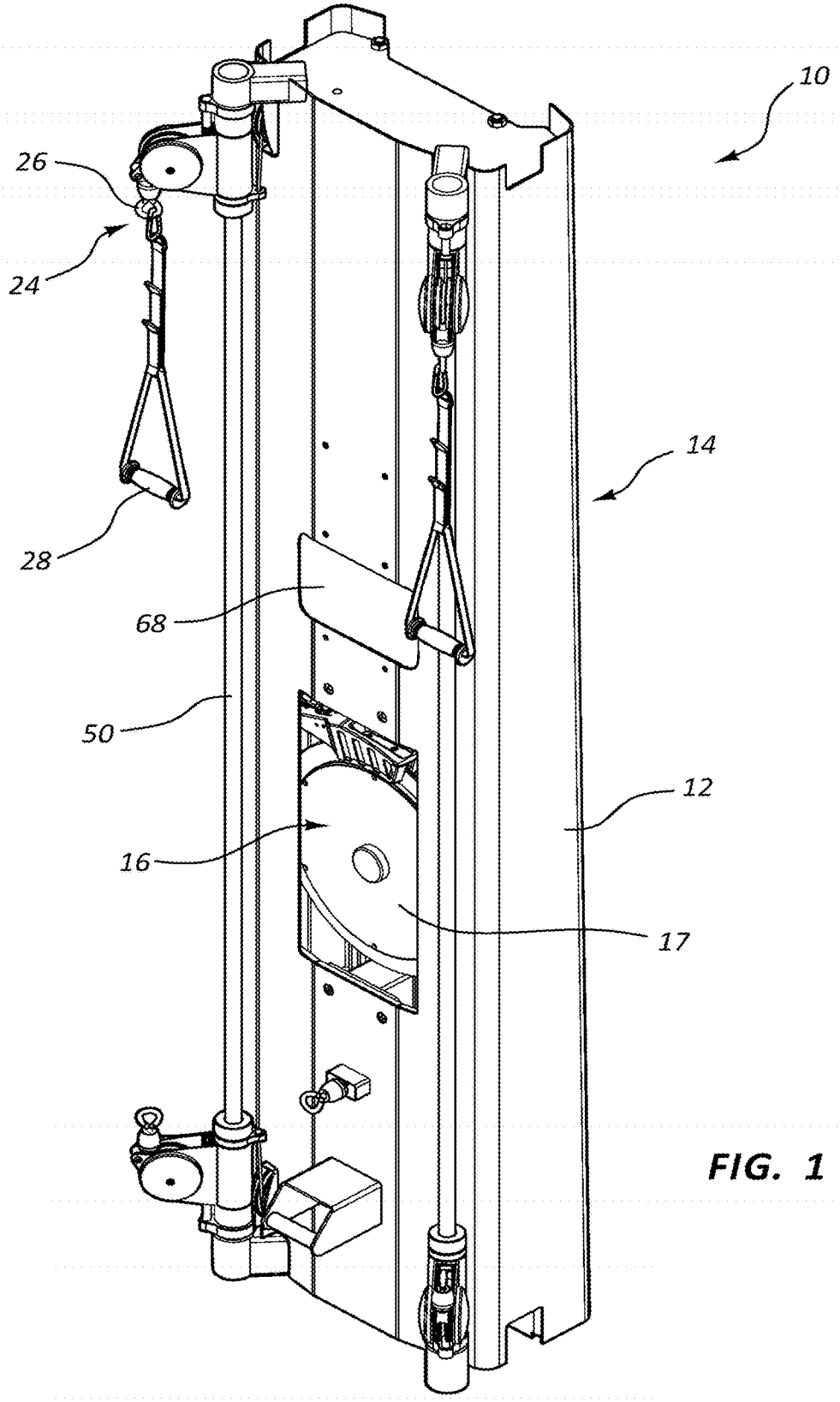
FIG. 1 illustrates a front perspective view of an example of a cable exercise machine in accordance with the present disclosure.
Figure 2:
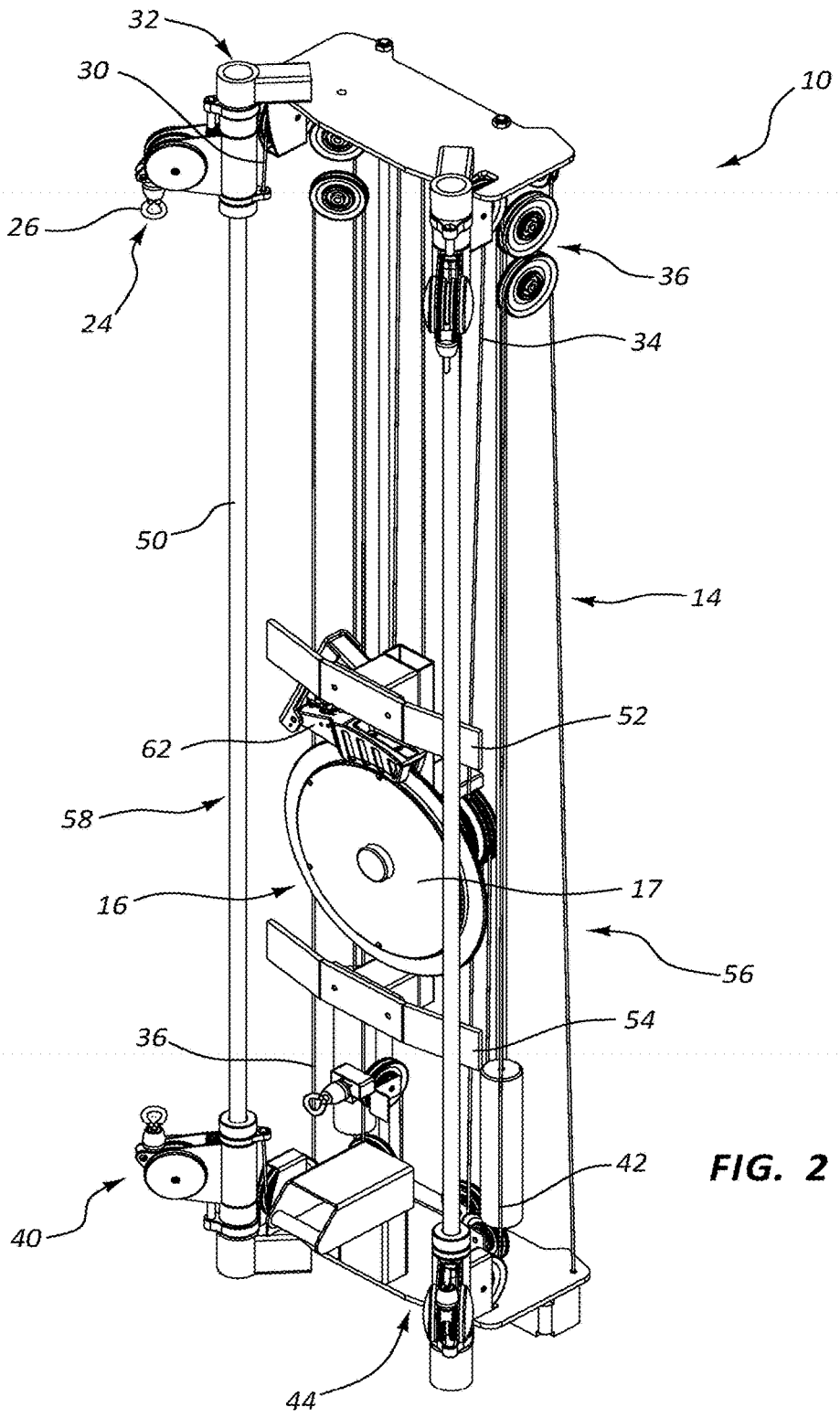
FIG. 2 illustrates a front perspective view of the cable exercise machine of FIG. 1 with an outside cover removed.
Figure 3:
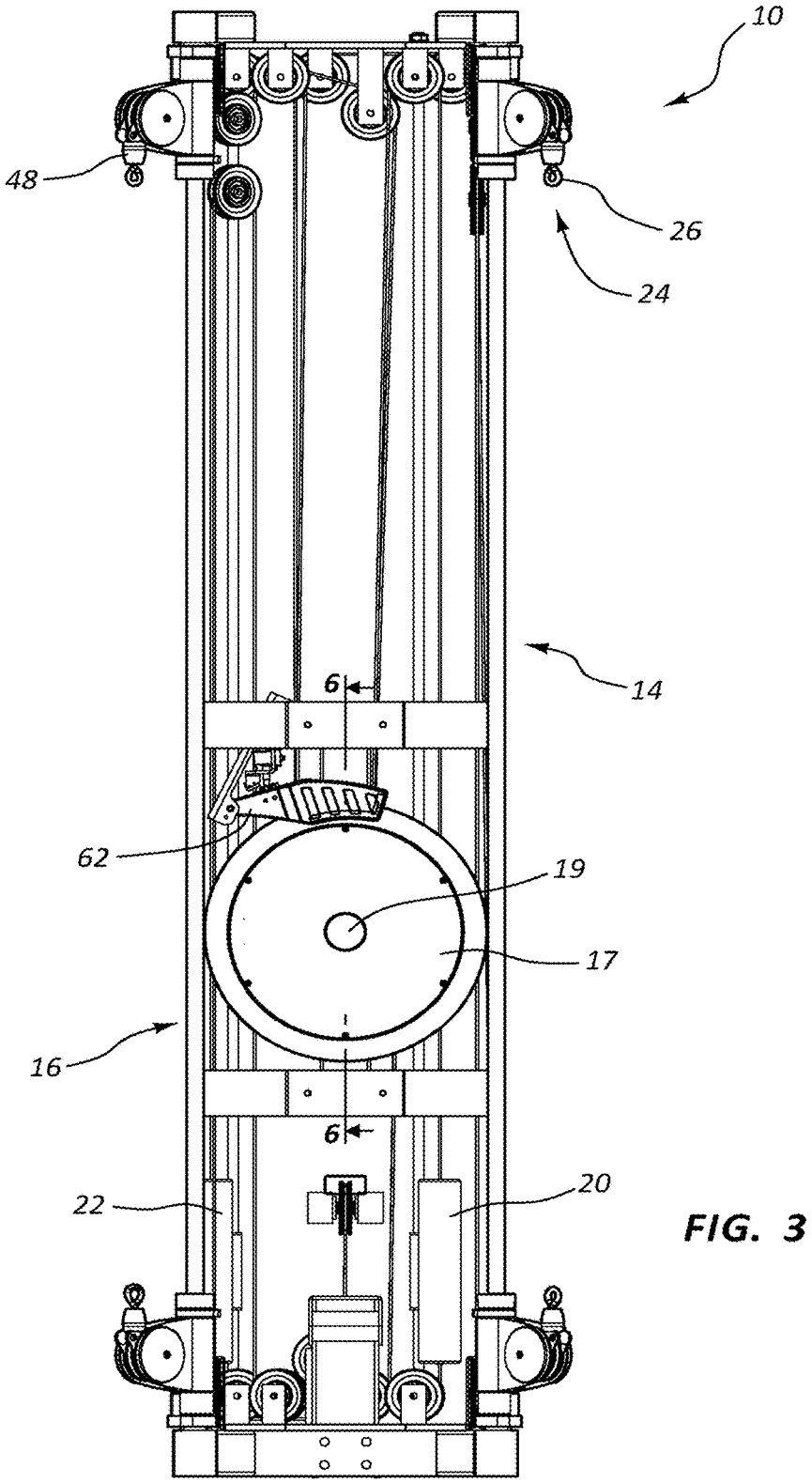
FIG. 3 illustrates a front view of the cable exercise machine of FIG. 1 with an outside cover removed.
Figure 4:
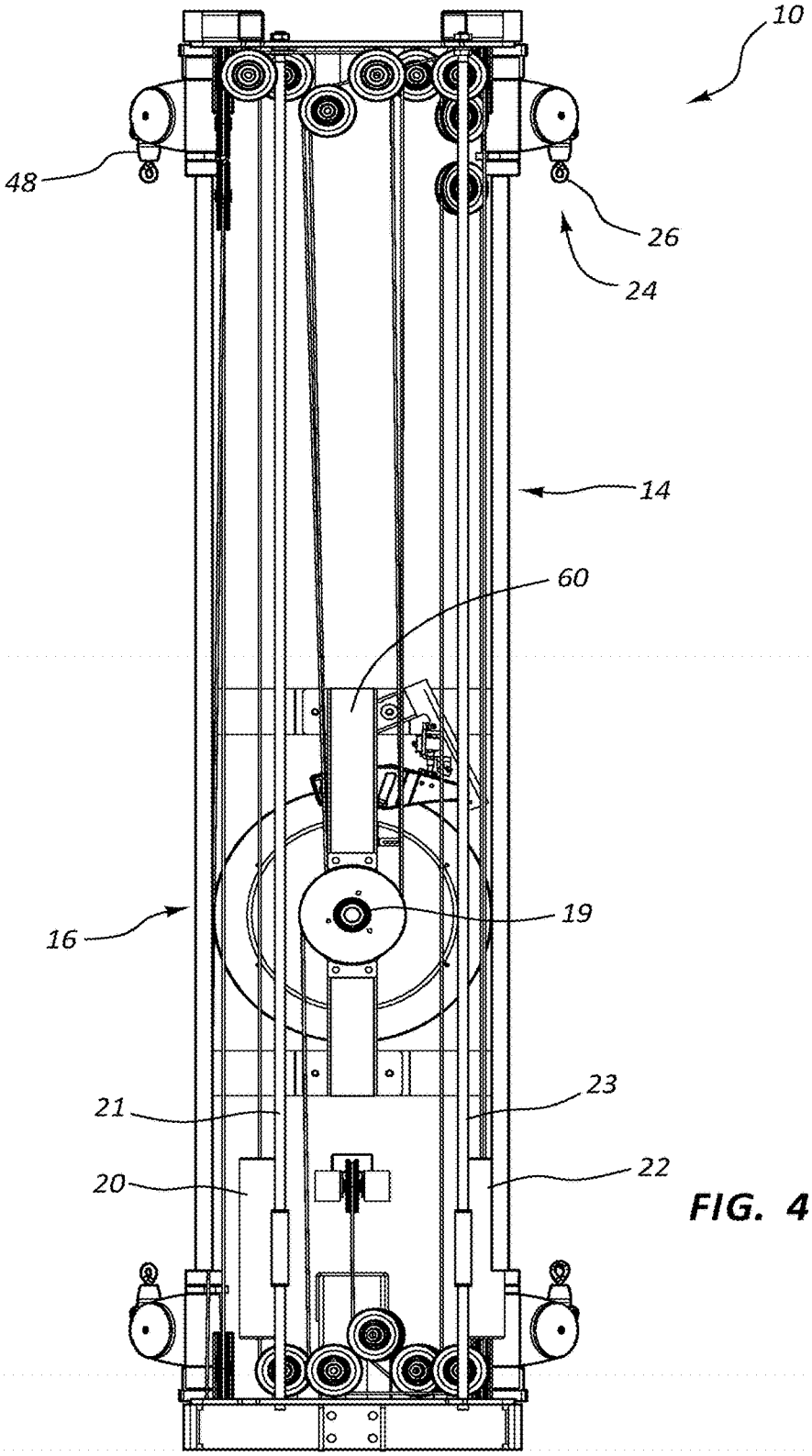
FIG. 4 illustrates a back view of the cable exercise machine of FIG. 1 with an outside cover removed.
Figure 5:
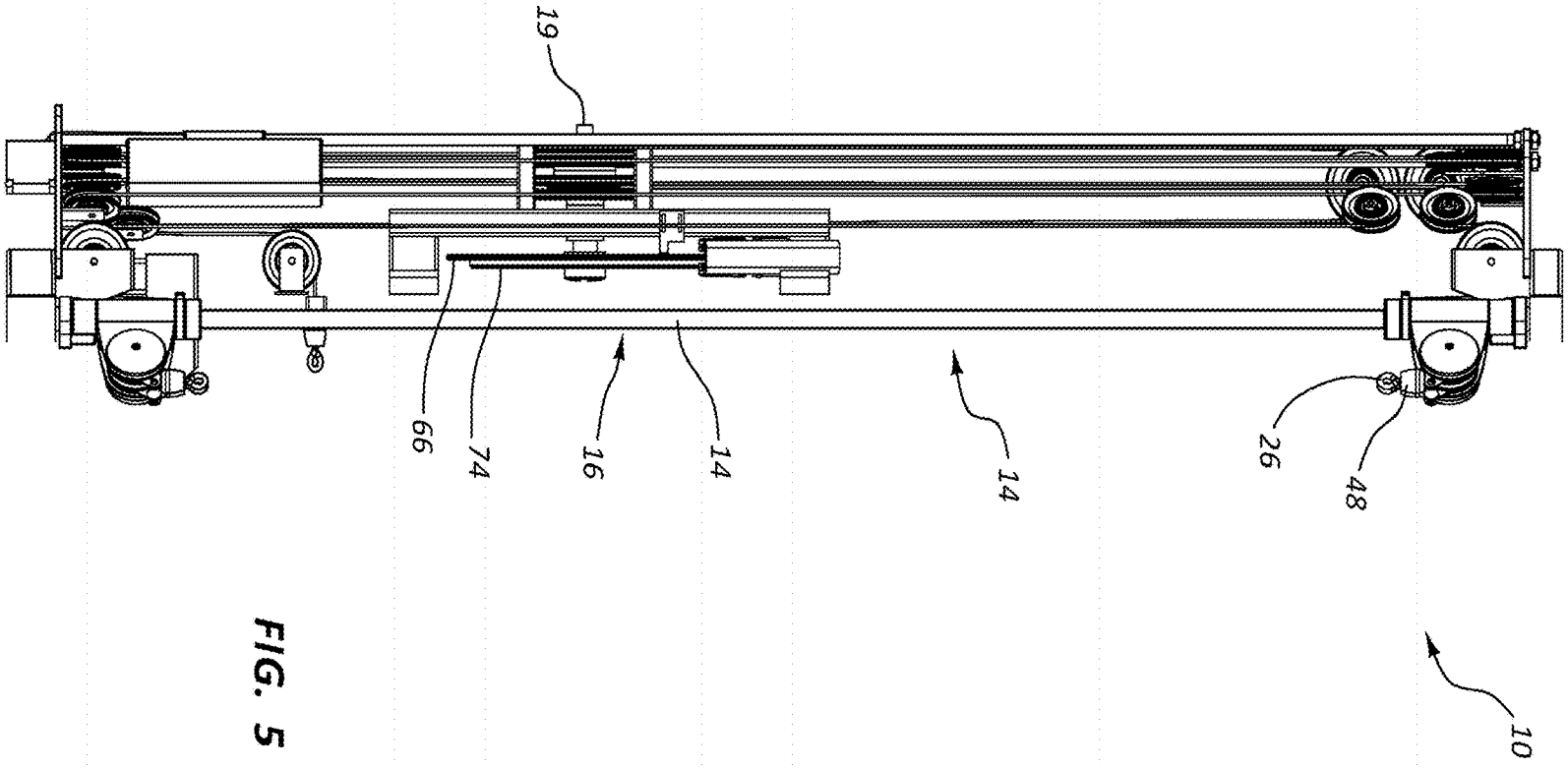
FIG. 5 illustrates a side view of the cable exercise machine of FIG. 1 with an outside cover removed.

Those who exercise often desire to know the amount of calories that they burn during their workouts. This information allows them to track their progress and achieve health related goals. Calories are burned during anaerobic exercises, such as those types of exercises that are performed on a cable exercise machine. The amount of calories that are burned using a cable exercise machine depends on the number of repetitions that the cable is pulled, the distance that the cable is moved during each pull, and the amount of resistance associated with each pull.

Generally, cable exercise machines provide resistance to the movement of the cable with a set of weighted plates. Often, these weighted plates are arranged in a stack with an ability to selectively connect a subset of the weighted plates to an attachment of the cable. This can be done by inserting a removable pin within a plate slot of at least one of the weighted plates such that the pin is also inserted into an attachment slot of the cable. With this arrangement, when the user pulls the cable, the weighted plate will move with the cable. Also, any plates stacked over the moving plate will move with the cable as well. However, this type of cable exercise machine does not include a mechanism that assists the user in tracking the amount of calories burned during the workout.

The principles described in the present disclosure include a cable exercise machine that incorporates a sensor that tracks the position of a flywheel. The flywheel is incorporated into a magnetic resistance mechanism that applies a load of resistance to the movement of the pull cable. As the flywheel rotates, the sensor tracks the rotation of the flywheel. In some embodiments, the sensor causes a counter to be incremented up one for each rotation of the flywheel. In other embodiments, the sensor can track partial revolutions of the flywheel.

The level of resistance applied by the magnetic resistance mechanism can be controlled electronically. For example, an electrical input into an electromagnetic unit can produce an output of resistance that can resist the movement of the cable. In other examples, an adjustable distance between a magnetic unit and the flywheel can also change the amount of resistance that is applied to the movement of the cable. The inputs or outputs of these and other types of adjustable resistance mechanisms can be tracked and stored.

The tracked level of resistance can be sent to an energy tracker. Also, the sensor that tracks the position of the flywheel can also send position information to the energy tracker as an input. The energy tracker can determine the amount of calories (or other energy units) burned during each pull and/or collectively during the course of the entire workout based on the inputs about the flywheel position and the resistance level.

The principles described herein also include a unique example of a flywheel arrangement where a single flywheel is arranged to resist the movement of four different resistance cables. In some examples, the flywheel is attached to a central shaft with multiple spools coaxially mounted around the central shaft. The spools can contain attachments to at least one of the cables. As one of the pull cables is moved in a first direction, the spools are rotated in a first direction. The torque generated by rotating the spools is transferred to the flywheel, and the flywheel will rotate in the first direction with the spools. However, when the pull cable is returned, the force that caused the spools to rotate in the first direction ceases. At least one counterweight is connected to the flywheel through a counterweight cable. In the absence of the force imposed on the pull cable, the counterweights cause the spools to rotate back in the opposite direction to their original orientation before the pull cable force was imposed. However, the arrangement between the flywheel, shaft, and spools does not transfer the torque generated in the second direction to the flywheel. As a result, the orientation of the flywheel does not change as the counterweights pull the spools back. As the spools return to their original orientation in the opposite direction, the pull cables are rewound around the spools, which returns the handles connected to the pull cable back to their original locations as well.

Thus, in this example, the flywheel rotates in a single direction regardless of the direction that the pull cable is moving. Further, in this example, the flywheel is just rotating when a pull force is exerted by the user. Thus, the position of the flywheel represents just work done as part of the workout. In other words, the return movement of the cable does not affect the calorie count. Further, the calorie counting calculations of the cable exercise machine are simplified because the sensor is insulated from at least the return forces that may skew the calorie counting calculations. Consequently, the tracked calories represent just those calories that are consumed during the course of the workout.

With reference to this specification, terms such as "upper," "lower," and similar terms that are used with reference to components of the cable exercise machine are intended to describe relative relationships between the components being described. Such terms generally depict the relationship between such components when the cable exercise machine is standing in the intended upright position for proper use. For example, the term "lower" may refer to those components of the cable exercise machine that are located relatively closer to the base of the cable exercise machine than another component when the cable exercise machine is in the upright position. Likewise, the term "upper" may refer to those components of the cable exercise machine that are located relatively farther away from the base of the cable exercise machine when in the upright position. Such components that are described with "upper," "lower," or similar terms do not lose their relative relationships just because the cable exercise machine is temporarily on one of its sides for shipping, storage, or during manufacturing.

Particularly, with reference to the figures, FIGS. 1-5 depict a cable exercise machine 10. FIG. 1 depicts the cable exercise machine 10 with an outer covering 12 about a tower 14 that supports the cables while FIGS. 2-5 depict different views of the cable exercise machine 10 without the outer covering 12. In the example of FIGS. 1-5, a resistance mechanism, such as a flywheel assembly 16, is positioned in the middle of the tower 14. The flywheel assembly 16 includes a flywheel 17, a spool subassembly 18, and a central shaft 19. The flywheel assembly 16 is connected to multiple cables through a spool subassembly 18. The cables are routed through multiple locations within the tower 14 with an arrangement of pulleys that direct the movement of the cables, a first counterweight 20, a second counterweight 22, and the flywheel assembly 16. The first and second counterweights 20, 22 are attached to a first counterweight guide 21 and a second counterweight guide 23 respectively. These guides 21, 23 guide the movement of the counterweights 20, 22 as they move with the rotation of the spool subassembly 18.

At least some of the cables have a handle end 24 that is equipped with a handle connector 26 that is configured to secure a handle 28 for use in pulling the cables. The pulleys route the handle ends 24 of a first cable 30 to an upper right location 32 of the tower 14, a second cable 34 to an upper left location 36 of the tower 14, a third cable 38 to a lower right location 40 of the tower 14, and a fourth cable 42 to a lower left location 44 of the tower 14. Each of these cables 30, 34, 38, 42 may be pulled to rotate the flywheel 17.

The handle connectors 26 may be any appropriate type of connector for connecting a handle 28 to a cable. In some examples, at least one of the handle connectors 26 includes a loop to which a handle 28 can be connected. Such a loop may be made of a metal, rope, strap, another type of material, or combinations thereof. In some examples, the loop is spring loaded. In yet other examples, a loop is formed out of the cable material which serves as the handle 28. The handle 28 may be a replaceable handle so that the user can change the type of grip or move the handle 28 to a different handle connector 26.

The user can pull any combination of the cables 30, 34, 38, 42 as desired. For example, the user may use the first and second cables 30, 34 as a pair for exercises that involve muscle groups that produce downward motions. In other examples, the user may use the third and fourth cables 38, 42 as a pair for exercises that involve muscle groups that produce upwards motions. Further, the user may use the first and third cables 30, 38 as a pair. Likewise, the user may use the second and fourth cables 34, 42 as a pair. In general, the user may combine any two of the cables to use as a pair to execute a workout as desired. Also, the user may use just a single cable as desired to execute a workout.

In some embodiments, a stopper 48 is attached to the handle ends 24 of the cables 30, 34, 38, 42. The stopper 48 can include a large enough cross sectional thickness to stop the handle end 24 from being pulled into a pulley, an opening in the outer covering, or another feature of the cable exercise machine 10 that directs the movement of the cables.

Additionally, the precise location to where the cables 30, 34, 38, 42 are routed may be adjusted. For example, a guide bar 50 may be positioned on the cable exercise machine 10 that allows a pulley supporting the handle end 24 to move along the guide bar's length. Such adjustments may be made to customize the workout for the individual user's height and/or desired target muscle group.

Within the tower 14, the pull cables 30, 34, 38, 42 may be routed in any appropriate manner such that a pull force on one of the pull cables 30, 34, 38, 42 causes the rotation of the flywheel 17. For example, each of the pull cables 30, 34, 38, 42 may have an end attached directly to the spool subassembly 18. In other examples, each of the pull cables 30, 34, 38, 42 may have an end attached directly to an intermediate component that attaches to the spool subassembly 18. The movement of the pull cables 30, 34, 38, 42 in a first pulling direction may cause the spool subassembly 18 to rotate in a first direction about the central shaft 19. Further, counterweights 20, 22 may be in communication with the spool subassembly 18 and arranged to rotate the spool subassembly 18 in a second returning direction. Further, the pull cables 30, 34, 38, 42 may be routed with a single pulley or with multiple pulleys. In some examples, multiple pulleys are used to distribute the load to more than one location on the tower to provide support for the forces generated by a user pulling the pull cables 30, 34, 38, 42 against a high resistance. Further, at least one of the pulleys incorporated within the tower may be a tensioner pulley that is intended to reduce the slack in the cables so that the resistance felt by the user is consistent throughout the pull.

A first cross bar 52 and a second cross bar 54 may collectively span from a first side 56 to a second side 58 of the tower 14. The cross bars 52, 54 collectively support an assembly member 60 that is oriented in a transverse orientation to the cross bars 52, 54. The central shaft 19 is inserted into an opening of the assembly member 60 and supports the flywheel assembly 16.

The flywheel assembly 16 includes an arm 62 that is pivotally coupled to a fixture 64 connected to the first cross bar 52. The arm 62 contains at least one magnetic unit 63 arranged to provide a desired magnetic flux. As the arm 62 is rotated to or away from the proximity of the flywheel 17, the magnetic flux through which the flywheel 17 rotates changes, thereby altering the amount of rotational resistance experienced by the flywheel 17.

The flywheel 17 may be constructed of multiple parts. For example, the flywheel 17 may include a magnetically conductive rim 66. In other embodiments, the flywheel 17 includes another type of magnetically conductive component that interacts with the magnetic flux imparted by the arm 62. As the magnetic flux increases, more energy is required to rotate the flywheel 17. Thus, a user must impart a greater amount of energy as he or she pulls on the pull cable to rotate the flywheel 17. As a result of the increased resistance, the user will consume more calories. Likewise, as the magnetic flux decreases, less energy is required to rotate the flywheel 17. Thus, a user can impart a lower amount of energy as he or she pulls on the pull cable to rotate the flywheel 17.

While this example has been described with specific reference to an arm 62 producing a magnetic flux that pivots to and away from the flywheel 17 to achieve a desired amount of resistance to rotation of the flywheel 17, any appropriate mechanism for applying a resistance to the rotation of the flywheel 17 may be used in accordance with the principles described herein. For example, the arm 62 may remain at a fixed distance from the flywheel 17. In such an example, the magnetic flux may be altered by providing a greater electrical input to achieve a greater magnetic output. Further, in lieu of pivoting the arm 62 to and away from the flywheel 17, a magnetic unit 63 may be moved towards or away from the flywheel 17 with a linear actuator or another type of actuator.

The cable exercise machine 10 may further include a control panel 68 which may be incorporated into the outer covering 12 or some other convenient location. The control panel 68 may include various input devices (e.g., buttons, switches, dials, etc.) and output devices (e.g., LED lights, displays, alarms, etc.). The control panel 68 may further include connections for communication with other devices. Such input devices may be used to instruct the flywheel assembly to change a level of magnetic resistance, track calories, set a timer, play music, play an audiovisual program, provide other forms of entertainment, execute a pre-programmed workout, perform another type of task, or combinations thereof. A display can indicate the feedback to the user about his or her performance, the resistance level at which the resistance mechanism is set, the number of calories consumed during the workout, other types of information, or combinations thereof.

Figure 6:
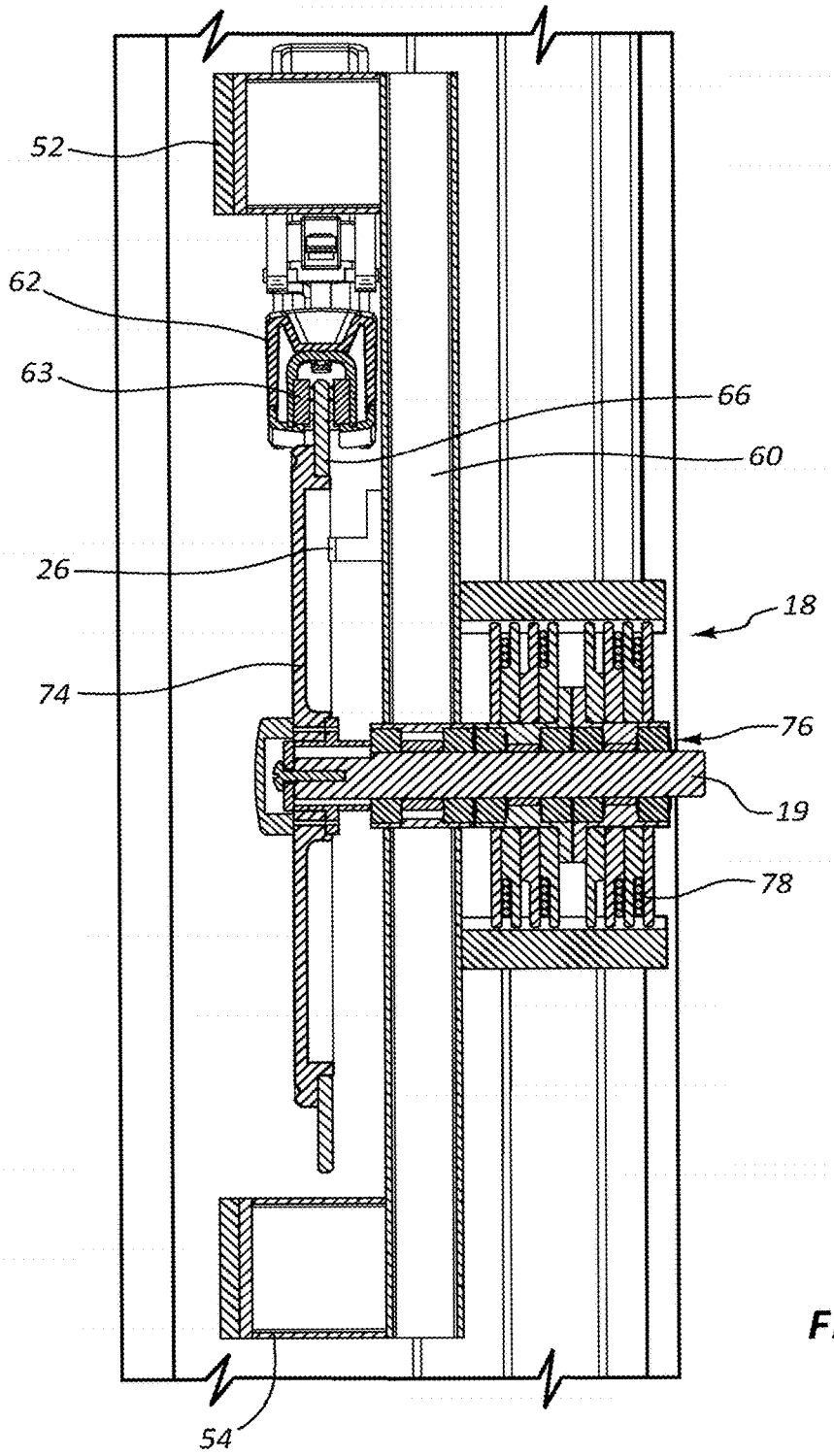
FIG. 6 illustrates a cross sectional view of a resistance mechanism of the cable exercise machine of FIG. 1.

FIG. 6 illustrates a cross sectional view of a resistance mechanism of the cable exercise machine of FIG. 1. In this example, the central shaft 19 is rigidly connected to a body 74 of the flywheel 17. A bearing subassembly 76 is disposed around the central shaft 19 and is positioned to transfer a rotational load imparted in a first direction to the flywheel 17. Concentric to the central shaft 19 and the bearing subassembly 76 is the spool subassembly 18 which is connected to at least one of the pull cables 30, 34, 38, 42.

In a retracted position, a portion of a pull cable connected to the spool subassembly 18 is wound in slots 78 formed in the spool subassembly 18. As the pull cable is pulled by the user during a workout, the pull cable exerts a force tangential in the first direction to the spool subassembly 18 and rotates the spool subassembly 18 in the first direction as the pull cable unwinds. In some examples, a counterweight cable that is also connected to the spool subassembly 18 winds up in the slots 78 of the spool subassembly 18. This motion shortens the available amount of the counterweight cable and causes at least one of the counterweights 20, 22 to be raised to a higher elevation. When the force on the pull cable ceases, the gravity on the counterweight pulls the counterweight back to its original position, which imposes another tangential force in a second direction on the spool subassembly 18 causing it to unwind the counterweight cable in the second direction. The unwinding motion of the counterweight cable causes the pull cable to rewind back into the slots 78 of the spool subassembly 18. This motion pulls the pull cable back into the tower 14 until the stoppers 48 attached to the handle ends 24 of the pull cables prevent the pull cables from moving.

As the spool subassembly 18 rotates in the first direction, the bearing subassembly 76 is positioned to transfer the rotational load from the spool subassembly 18 to the central shaft 19 which transfers the rotational load to the flywheel body 74. As a result, the flywheel 17 rotates with the spool subassembly 18 in the first direction as the user pulls on the pull cables. However, as the spool subassembly 18 rotates in the second direction imposed by the counterweights 20, 22 returning to their original positions, the bearing subassembly 76 is not positioned to transfer the rotational load from the spool subassembly 18 to the central shaft 19. Thus, no rotational load is transferred to the flywheel body 74. As a result, the flywheel 17 remains in its rotational orientation as the spool subassembly 18 rotates in the second direction. Consequently, the flywheel 17 moves in just the first direction.

While this example has been described with specific reference to the flywheel 17 rotating in just a single direction, in other examples the flywheel is arranged to rotate in multiple directions. Further, while this example has been described with reference to a specific arrangement of cables, pulleys, and counterweights, these components of the cable exercise machine 10 may be arranged in other configurations.

A sensor 80 can be arranged to track the rotational position of the flywheel 17. As the flywheel 17 rotates from the movement of the pull cables, the sensor 80 can track the revolutions that the flywheel rotates. In some examples, the sensor 80 may track half revolutions, quarter revolutions, other fractional revolutions, or combinations thereof.

The sensor 80 may be any appropriate type of sensor that can determine the rotational position of the flywheel 17. Further, the sensor 80 may be configured to determine the flywheel's position based on features incorporated into the flywheel body 74, the magnetically conductive rim 66, or the central shaft 19 of the flywheel 17. For example, the sensor 80 may be a mechanical rotary sensor, an optical rotary sensor, a magnetic rotary sensor, a capacitive rotary sensor, a geared multi-turn sensor, an incremental rotary sensor, another type of sensor, or combinations thereof. In some examples, a visual code may be depicted on the flywheel body 74, and the sensor 80 may read the position of the visual code to determine the number of revolutions or partial revolutions. In other examples, the flywheel body 74 includes at least one feature that is counted as the features rotate with the flywheel body 74. In some examples, a feature is a magnetic feature, a recess, a protrusion, an optical feature, another type of feature, or combinations thereof.

The sensor 80 can feed the number of revolutions and/or partial revolutions to a processor as an input. The processor can also receive as an input the level of resistance that was applied to the flywheel 17 when the revolutions occurred. As a result, the processor can cause the amount of energy or number of calories consumed to be determined. In some examples, other information, other than just the calorie count, is determined using the revolution count. For example, the processor may also determine the expected remaining life of the cable exercise machine 10 based on use. Such a number may be based, at least in part, on the number of flywheel revolutions. Further, the processor may also use the revolution count to track when maintenance should occur on the machine, and send a message to the user or another person indicating that maintenance should be performed on the machine based on usage.

In some examples, the sensor 80 is accompanied with an accelerometer. The combination of the inputs from the accelerometer and the sensor can at least aid the processor in determining the force exerted by the user during each pull. The processor may also track the force per pull, the average force over the course of the workout, the trends of force over the course of the workout, and so forth. For example, the processor may cause a graph of force per pull to be displayed to the user. In such a graph, the amount of force exerted by the user at the beginning of the workout versus the end of the workout may be depicted. Such information may be useful to the user and/or a trainer in customizing a workout for the user.

The number of calories per pull may be presented to the user in a display of the cable exercise machine 10. In some examples, the calories for an entire workout are tracked and presented to the user. In some examples, the calorie count is presented to the user through the display, through an audible mechanism, through a tactile mechanism, through another type of sensory mechanism, or combinations thereof.

Figure 7:
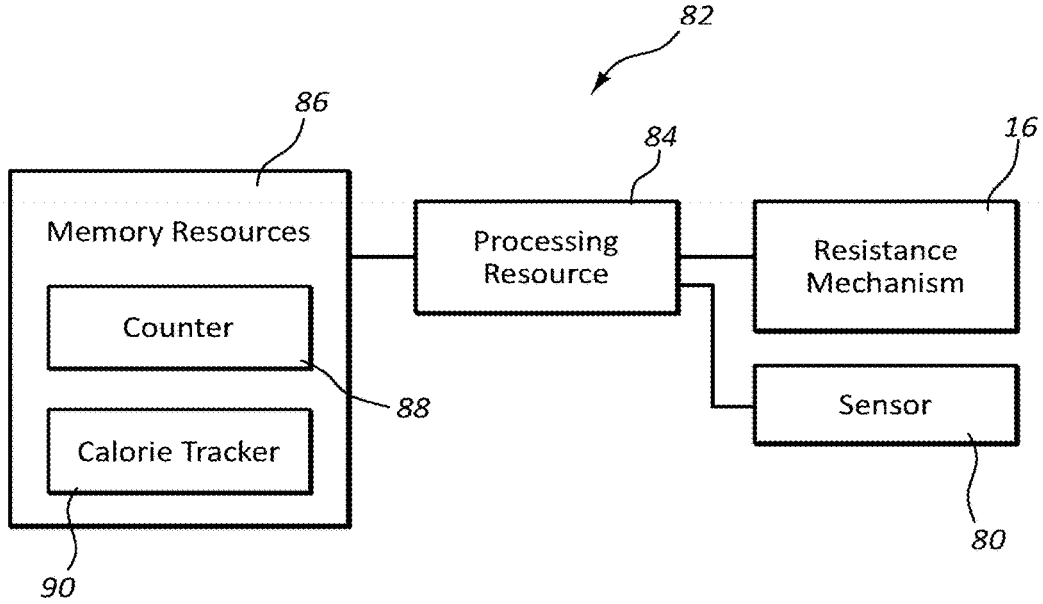
FIG. 7 illustrates a perspective view of an example of a tracking system of a cable exercise machine in accordance with the present disclosure.

FIG. 7 illustrates a perspective view of a tracking system 82 of a cable exercise machine 10 in accordance with the present disclosure. The tracking system 82 may include a combination of hardware and programmed instructions for executing the functions of the tracking system 82. In this example, the tracking system 82 includes processing resources 84 that are in communication with memory resources 86. Processing resources 84 include at least one processor and other resources used to process programmed instructions. The memory resources 86 represent generally any memory capable of storing data such as programmed instructions or data structures used by the tracking system 82. The programmed instructions shown stored in the memory resources 86 include a counter 88 and a calorie tracker 90.

The memory resources 86 include a computer readable storage medium that contains computer readable program code to cause tasks to be executed by the processing resources 84. The computer readable storage medium may be tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic storage media, other types of memory, or combinations thereof.

The counter 88 represents programmed instructions that, when executed, cause the processing resources 84 to count the number of revolutions and/or partial revolutions made by the flywheel 17. The calorie tracker 90 represents programmed instructions that, when executed, cause the processing resources 84 to track the number of calories burned by the user during this workout. The calorie tracker 90 takes inputs from at least the sensor 80 and the resistance mechanism to calculate the number of calories burned.

Further, the memory resources 86 may be part of an installation package. In response to installing the installation package, the programmed instructions of the memory resources 86 may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources 84 and the memory resources 86 are located within the same physical component, such as the cable exercise machine 10 or a remote component in connection with the cable exercise machine 10. The memory resources 86 may be part of the cable exercise machine's main memory, caches, registers, non-volatile memory, or elsewhere in the physical component's memory hierarchy. Alternatively, the memory resources 86 may be in communication with the processing resources 84 over a network. Further, the data structures, such as the libraries, calorie charts, histories, and so forth may be accessed from a remote location over a network connection while the programmed instructions are located locally. Thus, information from the tracking system 82 may be accessible on a user device, on a server, on a collection of servers, or combinations thereof.

Figure 8:
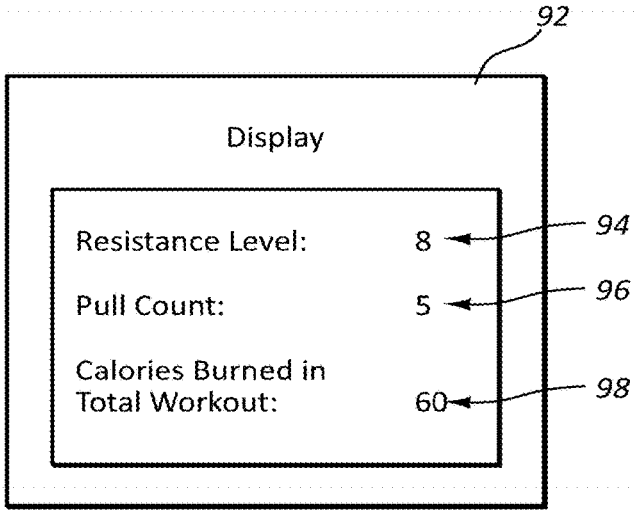
FIG. 8 illustrates a block diagram of an example of a display of a cable exercise machine in accordance with the present disclosure.

FIG. 8 illustrates a block diagram of a display 92 of a cable exercise machine 10 in accordance with the present disclosure. In this example, the display 92 includes a resistance level indicator 94, a pull count indicator 96, and a calorie indicator 98. The resistance level indicator 94 may be used to display the current resistance setting of the cable exercise machine 10.

The pull count indicator 96 may track the number of pulls that have been executed by the user. Such a number may track the time periods where the flywheel 17 is rotating, the number of periods when the flywheel 17 is not rotating, the time periods where the spool subassembly 18 is rotating in the first direction, the time periods where the spool subassembly 18 is rotating in the second direction, the movement of the counterweights 20, 22, another movement, or combinations thereof. In some examples, the cable exercise machine 10 has an ability to determine whether a pull is a partial pull or a full length pull. In such examples, the pull count indicator 96 may depict the total pulls and partial pulls.

The calorie indicator 98 may depict the current calculation of consumed calories in the workout. In some examples, the calorie count reflects just the input from the sensor 80. In other examples, the calorie count reflects the input from the flywheel assembly 16 and the sensor 80. In other examples, inputs from an accelerometer are input into the flywheel assembly 16, a pedometer worn by the user, another exercise machine (i.e. a treadmill or elliptical with calorie tracking capabilities), another device, or combinations thereof are also reflected in the calorie indicator 98.

While the above examples have been described with reference to a specific cable exercise machine with pulleys and cables for directing the rotation of the flywheel 17 and pull cables 30, 34, 38, 42, any appropriate type of cable pull machine may be used. For example, the cable exercise machine may use bearing surfaces or sprockets to guide the cables. In other examples, the cables may be partially made of chains, ropes, wires, metal cables, other types of cables, or combinations thereof. Further, the cables may be routed in different directions than depicted above.

INDUSTRIAL APPLICABILITY

In general, the invention disclosed herein may provide a user with the advantage of an intuitive energy tracking device incorporated into a cable exercise machine. The user can adjust his or her workout based on the number of calories consumed. Further, the user may use the calorie count to adjust his or her diet throughout the day. The cable exercise machine described above may also have the ability to track other information besides the calorie count, such as a force exerted per pull as well as track a maintenance schedule based on the flywheel's revolution count.

The level of resistance applied by the magnetic resistance mechanism of the present exemplary system can be finely controlled via electronic inputs. The inputs or outputs of these and other types of adjustable resistance mechanisms can be tracked and stored. The tracked level of resistance can then be sent to a calorie tracker. The calorie tracker can determine the amount of calories burned during each individual pull and/or a group of pulls collectively during the course of the entire workout based on the inputs about the flywheel position and the resistance level. This may provide a user with an accurate representation of the work performed on the cable exercise machine.

The present system may also provide a precise calculation of work performed during the workout, while providing the user the flexibility of using multiple resistance cables. The unique flywheel arrangement allows for the use of a single flywheel to resist the movement of multiple different resistance cables. According to the present configuration, the flywheel rotates in a single direction regardless of the direction that the pull cable is moving. Further, in this example, the flywheel is just rotating when a pull force is exerted by the user, thus the position of the flywheel represents just the work done as part of the workout. Further, the calorie counting calculations of the cable exercise machine are simplified because the sensor is insulated from at least the pull cable's return forces that may skew the calorie counting calculations. Consequently, the tracked calories can represent just those calories that are consumed during the course of the workout.

Additionally, the present exemplary system also determines the angular position of the flywheel during operation. Measuring the angular position of the flywheel provides advantages over merely measuring forces applied directly to the flywheel, such as torque or magnetic resistance. For example, angular position changes may be implemented in the calculation process. Further, the angular displacement of the flywheel may reflect the total interaction between all of the components of the flywheel assembly, which can provide a more accurate understanding of when the cable exercise machine ought to be flagged for routine service.

Such a cable exercise machine may include a tower that has the ability to position the ends of the pull cables at a location above the user's head. Further, the user has an ability to adjust the position of the cable ends along a height of the cable exercise machine so that the user can refine the muscle groups of interest. In the examples of the exercise machine disclosed above, the user has four pull cables to which the user can attach a handle. Thus, the user can work muscle groups that involve pulling a low positioned cable with a first hand while pulling a relatively higher positioned cable with a second hand. The pull cable ends can be adjusted to multiple positions when the magnetic flywheel is positioned in the middle of the cable exercise machine. This central location allows for the pull cables to be attached to the spool subassembly from a variety of angles.

The invention claimed is:

1. A cable exercise system comprising:

a tower;

a first pull cable, a second pull cable, a third pull cable, and a fourth pull cable incorporated into the tower;

a resistance mechanism linked to the first pull cable, the second pull cable, the third pull cable, and the fourth pull cable, the resistance mechanism including:

a central shaft;

a flywheel connected to the central shaft and configured to rotate by a user pulling on any of the first pull cable, the second pull cable, the third pull cable, and the fourth pull cable;

rotation magnets configured to rotate with the flywheel; and resistance magnets arranged to apply one or more levels of magnetic resistance to rotation of the flywheel during a workout and thereby apply the one or more levels of magnetic resistance to the user pulling on any of the first pull cable, the second pull cable, the third pull cable, and the fourth pull cable during the workout;

a magnetic sensor configured to track the rotation magnets as they rotate;

a processor and a memory storing a counter and an energy tracker that are programmed instructions configured to be executed by the processor, the counter configured to count the number of partial rotations of the flywheel during the workout based on input from the magnetic sensor, the energy tracker configured to calculate a number of calories burned by the user during the workout by the user pulling on any of the first pull cable, the second pull cable, the third pull cable, and the fourth pull cable based at least in part on the counted number of partial rotations of the flywheel during the workout and based at least in part on the one or more levels of magnetic resistance applied to rotation of the flywheel by the resistance magnets during the workout; and a control panel including a display configured to present the calculated number of calories burned by the user during the workout.

2. The cable exercise machine of claim 1, wherein:

the rotation magnets are arranged such that input to the counter from the magnetic sensor enables the counter to track quarter rotations of the flywheel; and the energy tracker is configured to calculate the number of calories burned by the user during the workout by the user pulling on any of the first pull cable, the second pull cable, the third pull cable, and the fourth pull cable based at least in part on the counted number of quarter rotations of the flywheel during the workout.

3. The cable exercise machine of claim 2, wherein the rotation magnets include exactly four rotation magnets.

4. The cable exercise machine of claim 1, wherein:

the first pull cable is routed through a first pulley positioned at an upper right location of the tower, the second pull cable is routed through a second pulley positioned at an upper left location of the tower, the third pull cable is routed through a third pulley positioned at a lower right location of the tower, and the fourth pull cable is routed through a fourth pulley positioned at a lower left location of the tower.

5. The cable exercise machine of claim 4, wherein:

the central shaft is positioned in the tower between the positions of the first pulley, the second pulley, the third pulley, and the fourth pulley.

6. The cable exercise machine of claim 5, wherein:

the axis of the central shaft is arranged to intersect a plane that intersects the centers of the first pulley, the second pulley, the third pulley, and the fourth pulley.

7. The cable exercise machine of claim 6, wherein:

the axis of the central shaft is arranged to be perpendicular to a plane that intersects the tower.

8. The cable exercise machine of claim 1, wherein the control panel is incorporated into an outer covering of the tower.

9. The cable exercise machine of claim 1, wherein:

the control panel further includes a dial; and the memory further stores programmed instructions configured to be executed by the processor and configured to:

adjust the level of magnetic resistance applied by the resistance magnets during the workout based at least in part on user input from the dial; and present the adjusted level of magnetic resistance on the display.

10. The cable exercise system of claim 1, wherein:

the calculated number of calories burned is accessible remotely over a network connection by a user device.

11. The cable exercise system of claim 1, wherein the memory is configured to have programmed instructions stored therein that are downloaded from a portable flash memory.

12. The cable exercise system of claim 1, wherein the memory is configured to have an installation package stored therein that is downloaded from a portable flash memory.

13. The cable exercise machine of claim 1, wherein:

the control panel further includes buttons; and the memory further stores programmed instructions configured to be executed by the processor and configured to:

execute a pre-programmed workout based at least in part on user input from the buttons as the workout; and present feedback regarding the user's performance during the pre-programmed workout on the display.

14. The cable exercise machine of claim 1, further comprising multiple tensioner pulleys configured to reduce slack in the first pull cable, the second pull cable, the third pull cable, and the fourth pull cable.

15. The cable exercise machine of claim 1, wherein the resistance mechanism further comprises:

a cross bar spanning from a first side to a second side of the tower and an assembly supported by the cross bar and defining an opening through which the central shaft is inserted and supported.

16. The cable exercise machine of claim 1, wherein:

the flywheel includes a magnetically conductive rim;

the resistance mechanism further comprises an arm having two sides;

the two sides define an open slot;

the first side houses a first set of the resistance magnets on the first side of the open slot;

the second side houses a second set of the resistance magnets on the second side of the open slot;

the first set of the resistance magnets and the second set of the resistance magnets are configured to provide a magnetic flux to the magnetically conductive rim of the flywheel when the magnetically conductive rim of the flywheel is positioned in the open slot;

the arm is configured to pivot, relative to the flywheel, to alter the level of magnetic resistance exerted on the flywheel by the first set of the resistance magnets and the second set of the resistance magnets; and the arm is configured to pivot between:

an upper limit;

a lower limit in which at least a portion of the magnetically conductive rim of the flywheel is surrounded by the first set of the resistance magnets and the second set of the resistance magnets within the open slot; and multiple incremental positions between the upper limit and the lower limit.

17. The cable exercise machine of claim 1, wherein as the control panel includes connections configured for communication with a user device over a network.

18. A cable exercise system comprising:

a tower;

a first pull cable routed through a first pulley positioned at an upper right location of the tower;

a second pull cable routed through a second pulley positioned at an upper left location of the tower;

a third pull cable routed through a third pulley positioned at a lower right location of the tower;

a fourth pull cable routed through a fourth pulley positioned at a lower left location of the tower;

means for reducing slack in the first pull cable, the second pull cable, the third pull cable, and the fourth pull cable;

a resistance mechanism linked to the first pull cable, the second pull cable, the third pull cable, and the fourth pull cable, the resistance mechanism including:

a central shaft positioned in the tower between the positions of the first pulley, the second pulley, the third pulley, and the fourth pulley, the axis of the central shaft arranged to intersect a plane that intersects the centers of the first pulley, the second pulley, the third pulley, and the fourth pulley, the axis of the central shaft arranged to be perpendicular to a plane that intersects the tower;

a cross bar spanning from a first side to a second side of the tower and an assembly supported by the cross bar and defining an opening through which the central shaft is inserted and supported;

a flywheel connected to the central shaft and configured to rotate by a user pulling on any of the first pull cable, the second pull cable, the third pull cable, and the fourth pull cable;

four rotation magnets configured to rotate with the flywheel; and resistance magnets arranged to apply one or more levels of magnetic resistance to rotation of the flywheel during a workout and thereby apply the one or more levels of magnetic resistance to the user pulling on any of the first pull cable, the second pull cable, the third pull cable, and the fourth pull cable during the workout;

means for tracking the four rotation magnets as they rotate;

a processor and a memory storing a counter and an energy tracker that are programmed instructions configured to be executed by the processor, the counter configured to count the number of quarter rotations of the flywheel during the workout based on input from the means for tracking, the energy tracker configured to calculate a number of calories burned by the user during the workout by the user pulling on any of the first pull cable, the second pull cable, the third pull cable, and the fourth pull cable based at least in part on the counted number of quarter rotations of the flywheel during the workout and based at least in part on the one or more levels of magnetic resistance applied to rotation of the flywheel by the resistance magnets during the workout; and a control panel incorporated into an outer covering of the tower, the control panel including a display configured to present the calculated number of calories burned by the user during the workout.

19. The cable exercise machine of claim 18, wherein:

the calculated number of calories burned is accessible remotely over a network connection by a user device;

the memory is configured to have programmed instructions stored therein that are downloaded from a portable flash memory;

the control panel includes connections configured for communication with a user device over a network;

the control panel further includes a dial;

the control panel further includes buttons; and the memory further stores programmed instructions configured to be executed by the processor and configured to:

adjust the level of magnetic resistance applied by the resistance magnets during the workout based at least in part on user input from the dial;

present the adjusted level of magnetic resistance on the display;

execute a pre-programmed workout based at least in part on user input from the buttons as the workout; and present feedback regarding the user's performance during the pre-programmed workout on the display.

20. The cable exercise machine of claim 18, wherein:

the flywheel includes a magnetically conductive rim;

the resistance mechanism further comprises an arm having two sides;

the two sides define an open slot;

the first side houses a first set of the resistance magnets on the first side of the open slot;

the second side houses a second set of the resistance magnets on the second side of the open slot;

the first set of the resistance magnets and the second set of the resistance magnets are configured to provide a magnetic flux to the magnetically conductive rim of the flywheel when the magnetically conductive rim of the flywheel is positioned in the open slot;

the arm is configured to pivot, relative to the flywheel, to alter the level of magnetic resistance exerted on the flywheel by the first set of the resistance magnets and the second set of the resistance magnets; and the arm is configured to pivot between:

an upper limit;

a lower limit in which at least a portion of the magnetically conductive rim of the flywheel is surrounded by the first set of the resistance magnets and the second set of the resistance magnets within the open slot; and multiple incremental positions between the upper limit and the lower limit.

* * * * *